US006591070B1

(12) United States Patent
Shoji et al.

(10) Patent No.: US 6,591,070 B1
(45) Date of Patent: Jul. 8, 2003

(54) IMAGE FORMING APPARATUS AND CARTRIDGE DETACHABLY MOUNTABLE TO SAME

(75) Inventors: Takeo Shoji, Sunto-gun (JP); Atsuya Takahashi, Gotenba (JP); Hideki Matsumoto, Mishima (JP); Tomomi Kakeshita, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/697,500

(22) Filed: Oct. 27, 2000

(30) Foreign Application Priority Data

| | | |
|---|---|---|
| Oct. 29, 1999 | (JP) | 11-310414 |
| Nov. 10, 1999 | (JP) | 11-320347 |
| Nov. 10, 1999 | (JP) | 11-320349 |
| Nov. 10, 1999 | (JP) | 11-320350 |
| Jan. 14, 2000 | (JP) | 2000-007216 |

(51) Int. Cl.[7] ..... G03G 15/08; G03G 15/00
(52) U.S. Cl. ..... 399/27; 399/12; 399/119
(58) Field of Search ..... 399/30, 61, 62, 399/27, 119, 12

(56) References Cited

U.S. PATENT DOCUMENTS

| | | | | |
|---|---|---|---|---|
| 5,095,335 A | | 3/1992 | Watanabe et al. | |
| 5,331,372 A | | 7/1994 | Tsuda et al. | |
| 5,455,665 A | | 10/1995 | Baba et al. | |
| 5,470,635 A | | 11/1995 | Shirai et al. | 428/131 |
| 5,565,961 A | | 10/1996 | Shoji et al. | |
| 5,608,509 A | | 3/1997 | Shirai et al. | 399/351 |
| 5,621,507 A | * | 4/1997 | Nishimura et al. | |
| 5,708,912 A | * | 1/1998 | Lee | 399/27 X |
| 5,724,627 A | * | 3/1998 | Okuno et al. | 399/27 |
| 5,828,928 A | | 10/1998 | Sasago et al. | 399/111 |
| 5,835,818 A | | 11/1998 | Hoshika et al. | 399/26 |
| 5,884,124 A | | 3/1999 | Karakama et al. | 399/123 |
| 5,923,917 A | * | 7/1999 | Sakurai et al. | |
| 5,946,522 A | * | 8/1999 | Inami | 399/27 |
| 6,173,133 B1 | * | 1/2001 | Donaldson et al. | 399/27 X |

FOREIGN PATENT DOCUMENTS

| | | | |
|---|---|---|---|
| JP | 1-35579 | * | 2/1989 |
| JP | 5-134512 | * | 5/1993 |
| JP | 9-80891 | | 3/1997 |
| JP | 9-120247 | * | 5/1997 |
| JP | 9-204095 | | 8/1997 |
| JP | 10-133543 | | 5/1998 |
| JP | 11-167267 | * | 6/1999 |

* cited by examiner

*Primary Examiner*—Susan S. Y. Lee
(74) *Attorney, Agent, or Firm*—Fitzpatrick, Cella, Harper & Scinto

(57) ABSTRACT

The present invention provides an image forming apparatus which has a developer container for containing developer, the container being detachably mountable to a main assembly of the image forming apparatus, developer amount detecting device for detecting an amount of the developer contained in the developer container, and determining device for determining the amount of the developer in accordance with a maximum value of a detected amount of the developer amount detecting device.

90 Claims, 58 Drawing Sheets

IMAGE FORMING APPARATUS AND CARTRIDGE DETACHABLY MOUNTABLE TO SAME

BACKGROUND OF THE INVENTION

1. Field of the Invention

The present invention relates to an image forming apparatus and a cartridge detachably mountable to such an image forming apparatus and more particularly, it relates to an image forming apparatus capable of detecting a remaining amount of developer and a cartridge detachably mountable to such an image forming apparatus.

Here, an electrophotographic image forming apparatus as an example of the image forming apparatus may be, for example, an electrophotographic copying machine, an electrophotographic printer (for example, LED printer, laser beam printer or the like), an electrophotographic facsimile or the like.

Further, a process cartridge detachably mountable to a main body (assembly) of the image forming apparatus may incorporate therein at least one of an electrophotographic photosensitive member, charging means for charging the electrophotographic photosensitive member, developing means for supplying developer to the electrophotographic photosensitive member and cleaning means for cleaning the electrophotographic photosensitive member. In particular, the process cartridge may incorporate therein at least one of charging means, developing means and cleaning means, and an electrophotographic photosensitive member as a cartridge unit which can be detachably mounted to a main body of the image forming apparatus or may incorporate therein at least an electrophotographic photosensitive member and developing means as a cartridge unit which can be detachably mounted to a main body of the image forming apparatus.

2. Related Background Art

In conventional electrophotographic image forming apparatuses of the electrophotographic type, such as an electrophotographic copying machine, a laser beam printer or the like, a latent image is formed on an electrophotographic photosensitive member by illuminating the photosensitive member with a beam corresponding to image information, and developer (including toner) is supplied to the latent image by using developing means to visualize the latent image as a toner image, which is, in turn, transferred from the photosensitive member onto a recording medium, thereby forming an image on the recording medium. A developer containing container is connected to the developing means so that the developer is consumed by image formation.

In such an image forming apparatus, in order to facilitate exchange and maintenance of consumption parts, such as the electrophotographic photosensitive member and the developer, the electrophotographic photosensitive member and the developing means, charging means and cleaning means as process means acting on the electrophotographic photosensitive member and further a developer containing container and a waste developer container are integrally incorporated as a process cartridge that can be detachably mounted to a main body of the image forming apparatus. According to the process-cartridge system, since maintenance of the apparatus can be performed by the user himself without any expert, operability can be improved considerably. Thus, the process cartridge system has widely been used in the electrophotographic image forming apparatus.

Further, for example, in a color image forming apparatus having a plurality of color developing means, when the consumption degrees of the respective developing means are different, respective color developing cartridges may be formed by integrally incorporating the respective color developing means and corresponding developer containing containers, and such cartridges can detachably be mounted to the image forming apparatus to permit exchange independently.

In such image forming apparatuses of the cartridge type, the user permits the image formation again by exchanging the cartridge when the developer is used up. To this end, in some cases, such an image forming apparatus is provided with means for detecting the fact that the developer is used up and for informing the user of such fact, i.e., a developer amount detecting device.

Regarding the developer amount detecting device, in order to always know the amount of developer to be supplied for image formation remaining within the cartridge, developer remaining amount detecting means capable of detecting the developer remaining amount level are provided on the cartridge or the main body of the image forming apparatus.

Particularly, there is a technique in which the user's convenience is further enhanced not only by informing the user of the fact that the developer is used up but also by successively detecting and informing the user of the amount of the developer. In an image forming apparatus incorporating such a technique, the percentage (with respect to the unused condition) of the developer remaining amount may be calculated and a calculated result be successively communicated to the user, or the "absence of developer" indicating the fact that the developer is decreased to the extent that image formation cannot be effected with a predetermined quality may be determined, thereby warning the user of the fact that the remaining developer is insufficient, before a poor image is generated.

As an example of such developer remaining amount detecting means, there is a plate antenna system. According to this plate antenna system, for example, metal plates constituting electrodes are installed at locations opposed to a developer bearing member of the developing means or at other plural locations, and the fact that capacitances between the metal plates and the developer bearing member and between the metal plates are varied with the amount of developer such as insulation toner is utilized.

That is to say, if gaps between the metal plates and the developer bearing member and between the metal plates are filled with the developer, the capacitances therebetween become greater, and, as the developer is decreased, the air occupying ratio in the gaps is increased, with the result that the capacitances are decreased. Accordingly, by previously seeking a relationship between the capacitances (between the metal plates and the developer bearing member and between the metal plates) and the developer amount, the developer amount level can be detected by measuring the capacitances.

The measurement of the capacitance is effected by measuring electric current flowing to the metal plate from the developer bearing member when AC bias is applied to the developer bearing member. Alternatively, when a plurality of metal plates are provided, by measuring electric current flowing from one of the metal plates to the other metal plate when AC bias is applied to one of the metal plates as electrodes, the capacitance between the metal plates can be measured similarly. In the developer amount detecting device of the plate antenna type, in many cases, during the image formation in which the developing bias is applied to the developer bearing member, the developer amount is detected.

However, as mentioned above, even when the developer remaining amount detecting means capable of detecting the developer remaining amount level is provided, in some cases, the value of the developer remaining amount detected by the developer remaining amount detecting means does not coincide with the amount of the developer actually remaining in the developing device. In this case, the developer remaining amount cannot be detected correctly.

For example, in case of the above-mentioned developer amount detecting device of the plate antenna type, the capacitances between the developer bearing member and the metal plates as electrodes or the capacitances between the metal plates depend upon respective positional relationships. That is to say, even when there is no developer in the developing device, if a distance between both (developer bearing member and metal plate or metal plate and metal plate) is small, the absolute value of the capacitance becomes greater, whereas, if the distance between both is great, the absolute value of the capacitance becomes smaller. Thus, for example, due to tolerance of the metal plates of the developer remaining amount detecting means, there may be dispersion in the developer amount detecting value from cartridge to cartridge. Further, due to differences in the manufacturing lots of developer contained in the developing device, the using environment and tolerance of parts of the cartridge and the electronic parts of the main body of the image forming apparatus, dispersion in developer amount detecting value may occur.

Accordingly, when the developer remaining amount level is detected by using the previously set relationship between the detection value of the capacitance and the developer amount, the detected result may be different from the amount of the developer actually remaining in the developing device.

Namely, when the developing device is filled with the developer (developer full condition), i.e., in the initial use of the process cartridge, in case of a process cartridge in which the capacitance detection value obtained by the developer remaining amount detecting means is greater than the set value (ideal value), since the developer amount detecting device always detects a value greater than the actual developer remaining amount during the usage of the process cartridge, the amount of the developer becomes smaller than the predetermined value before the user is informed of the "absence of developer", thereby generating a so-called blank stripe image.

To the contrary, in case of a process cartridge in which the capacitance detection value in the developer full condition is smaller than the set value, since the developer amount detecting device always detects a value smaller than the actual developer remaining amount during the usage of the process cartridge, in spite of the fact that there is much developer in the developing device, the user may be warned of the "absence of developer". And, if the user exchanges the process cartridge for a new one in accordance with such alarming, a large amount of toner will be unused, thereby wasting resources too much. The present invention aims to eliminate such a problem.

SUMMARY OF THE INVENTION

The present invention aims to eliminate the above-mentioned problems, and an object of the present invention is to provide an image forming apparatus and a process cartridge detach ably mountable to such an image forming apparatus, in which a remaining amount of developer can be detected correctly.

Another object of the present invention is to provide an image forming apparatus and a process cartridge detachably mountable to such an image forming apparatus, in which a remaining amount of developer can be detected correctly even if there is an individual difference in an image forming apparatus or an individual unit mounted to such an image forming apparatus (particularly, remaining amount detecting means therein.

A further object of the present invention is to provide an image forming apparatus comprising a developer container for containing developer, the container being detachably mountable to a main assembly of the image forming apparatus, developer amount detecting means for detecting an amount of the developer contained in the developer container, and determining means for determining the amount of the developer in accordance with a maximum value of a detection amount of the developer amount detecting means.

A still further object of the present invention is to provide an image forming apparatus comprising a developer container for containing developer, developer amount detecting means for detecting an amount of the developer contained in the developer container, a memory, and recording means for recording a detection amount of the developer amount detecting means in the memory, the recording means renewing the detection amount stored in the memory whenever the detection amount of the detecting means becomes greater than the detection value stored in the memory.

A further object of the present invention is to provide a unit comprising a memory, and a developer container for containing a developer, and wherein the memory stores a maximum value of a detection amount of developer amount detecting means for detecting an amount of the developer contained in the developer container.

A still further object of the present invention is to provide an image forming apparatus comprising a developer container for containing a developer, the container being detachably mountable to a main assembly of the image forming apparatus, developer amount detecting means for detecting an amount of the developer contained in the developer container, and determining means for determining the amount of the developer in accordance with an average value of plural detection amounts of the detecting means.

A further object of the present invention is to provide a unit comprising a memory, and a developer container for containing a developer, and wherein the memory stores plural detection amounts of the developer amount detecting means for detecting the amount of the developer contained in the developer container.

A still further object of the present invention is to provide an image forming apparatus comprising a developer container for containing a developer, the container being detachably mountable to a main assembly of the image forming apparatus, developer amount detecting means for detecting an amount of the developer contained in the developer container, and determining means for determining the amount of the developer in accordance with a detection amount of the developer amount detecting means when the developer is not filled in the container.

A further object of the present invention is to provide a unit comprising a memory, and a developer container for containing developer, and wherein the memory stores a detection amount of the developer amount detecting means when the developer is not filled in the container.

A still further object of the present invention is to provide an image forming apparatus comprising a developer container detachably mountable to a main assembly of the image forming apparatus, the container having a first room and a second room, developer amount detecting means which is arranged in the first room for detecting the amount of developer, a seal member for sealing the developer in the second room, and determining means for determining the amount of the developer in accordance with a detection amount of the detecting means before the seal member is removed.

A further object of the present invention is to provide a unit comprising a memory, and a developer container for containing a developer, the container having a first room and a second room, developer amount detecting means which is arranged in the first room for detecting the amount of the developer, and a seal member for sealing the developer in the second room, wherein the memory stores a detection amount of the detecting means before the seal member is removed.

These and other objects of the present invention will become more apparent upon consideration of the following description of the preferred embodiments of the present invention taken in conjunction with the accompanying drawings.

DETAILED DESCRIPTION OF THE PREFERRED EMBODIMENTS

Figure 1:
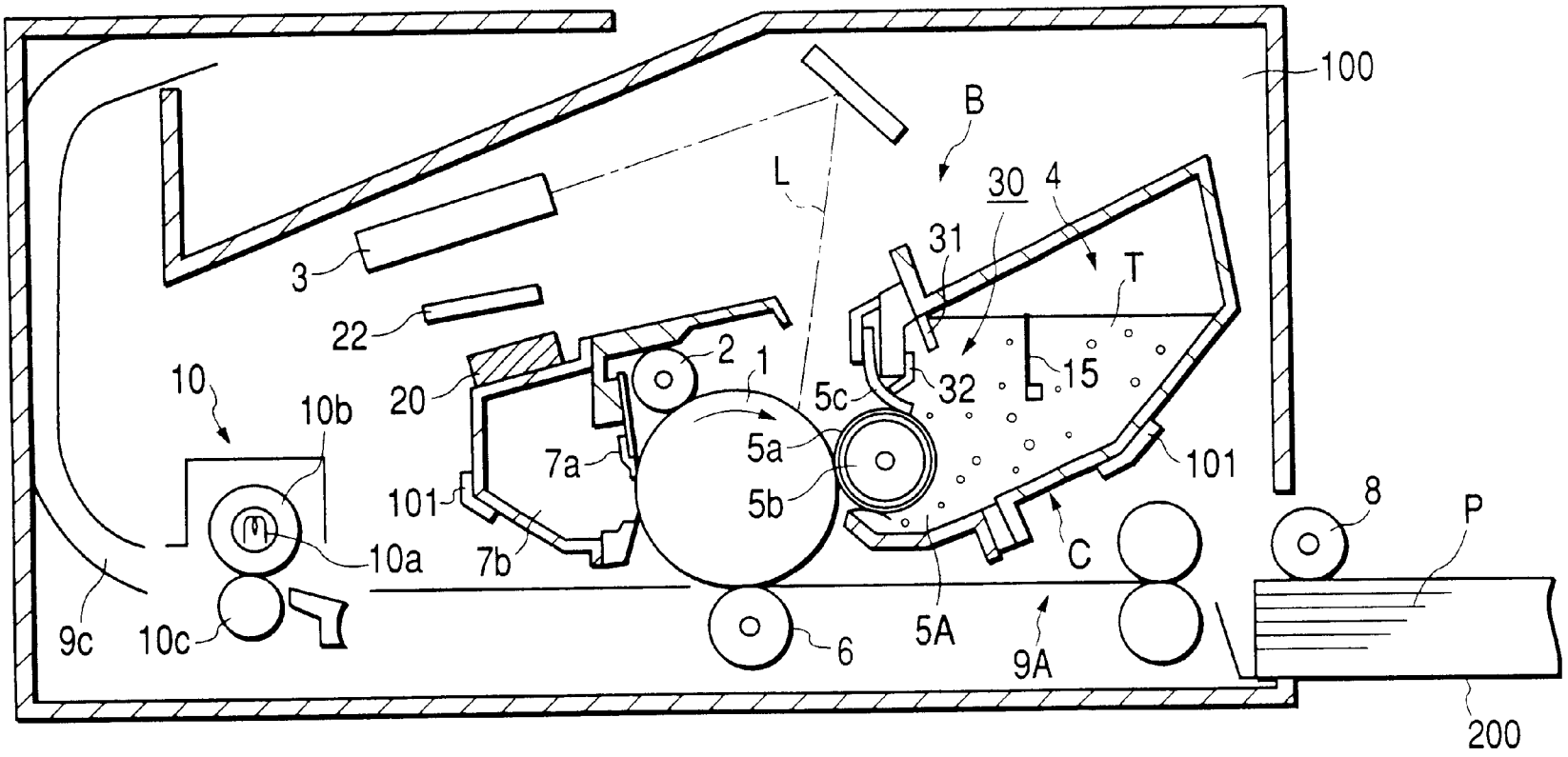
FIG. 1 is a sectional view showing an embodiment of a process cartridge and an image forming apparatus according to the present invention.

Now, an image forming apparatus according to the present invention and a cartridge detachably mountable to such an image forming apparatus will be fully explained with reference to the accompanying drawings.

First Embodiment

First of all, an embodiment of an electrophotographic image forming apparatus to which a process cartridge (unit) constructed in accordance with the present invention can detachably be mounted will be explained with reference to FIGS. 1 and 2. In this embodiment, the electrophotographic image forming apparatus is embodied as a laser beam printer A of electrophotographic type and serves to receive image information from a host computer and to form an image on a recording medium such as a recording paper, an OHP sheet, cloth and the like by an electrophotographic image forming process.

The laser beam printer A has a drum-shaped electrophotographic photosensitive member, i.e., a photosensitive drum 1. The photosensitive drum 1 is charged by a charging roller 2 as charging means. Then, by illuminating the drum with a laser beam corresponding to the image information from a laser scanner 3, a latent image corresponding to the image information is formed on the photosensitive drum 1. The latent image is developed by developing means 5 of a developing device C to visualize the latent image as a toner image.

Namely, the developing device C has, as a developer containing portion, a developing room 5A including a developing roller 5*a* as a developer bearing member, and a developer containing container 4 formed adjacent to the developing room 5A, and developer T in the developer containing container 4 is supplied to the developing roller 5*a* within the developing room 5A. Agitating means 15 rotated in a direction shown by the arrow in FIG. 1 are provided within the developer containing container 4 so that, by rotating the agitating means 15, the developer T is supplied to the developing roller 5*a* while being loosened. In the illustrated embodiment, insulative magnetic one-component toner is used as the developer T. Further, the developing roller 5*a* has a stationary magnet 5*b* therein, so that the developer is carried by rotating the developing roller 5*a*. Meanwhile, triboelectric charge is applied to the developer and a developer layer having a predetermined thickness is formed by a developing blade 5*c* as a developer layer thickness regulating member, which developer layer is supplied to a developing area on the photosensitive drum 1. The developer supplied to the developing area is transferred onto the latent image on the photosensitive drum 1 thereby forming the toner image. The developing roller 5*a* is connected to developing bias applying means 34 (FIG. 2) so that developing bias voltage obtained by superimposing DC voltage to AC voltage is normally applied to the developing roller.

On the other hand, in synchronism with the formation of the toner image, a recording medium P set in a sheet feeding cassette 200 is conveyed to a transfer position by a pick-up roller 8 and conveying means 9A. A transfer roller 6 as transfer means is disposed at the transfer position so that, by applying voltage to the transfer roller, the toner image on the photosensitive drum 1 is transferred onto the recording medium P.

The recording medium P to which the toner image was transferred is conveyed to fixing means 10 by conveying means 9B. The fixing means 10 include a fixing roller 10*b* having a heater 10*a* therein, and a drive roller 10*c*. While the recording medium P is being passed through the fixing means, the toner image is fixed to the recording medium P by heat and pressure.

Thereafter, the recording medium P is discharged onto a discharge tray 14 by conveying means 9*c*. The discharge tray 14 is provided on an upper surface of a main body 100 of the laser beam printer A.

After the toner image was transferred to the recording medium P by the transfer roller 6, the developer remaining on the photosensitive drum 1 is removed by cleaning means 7, for preparing for a next image forming process. In the cleaning means 7, the residual developer on the photosensitive drum is scraped off by an elastic cleaning blade 7*a* urged against the photosensitive drum 1, and the scraped developer is collected into a waste developer container 7*b*.

Figure 2:
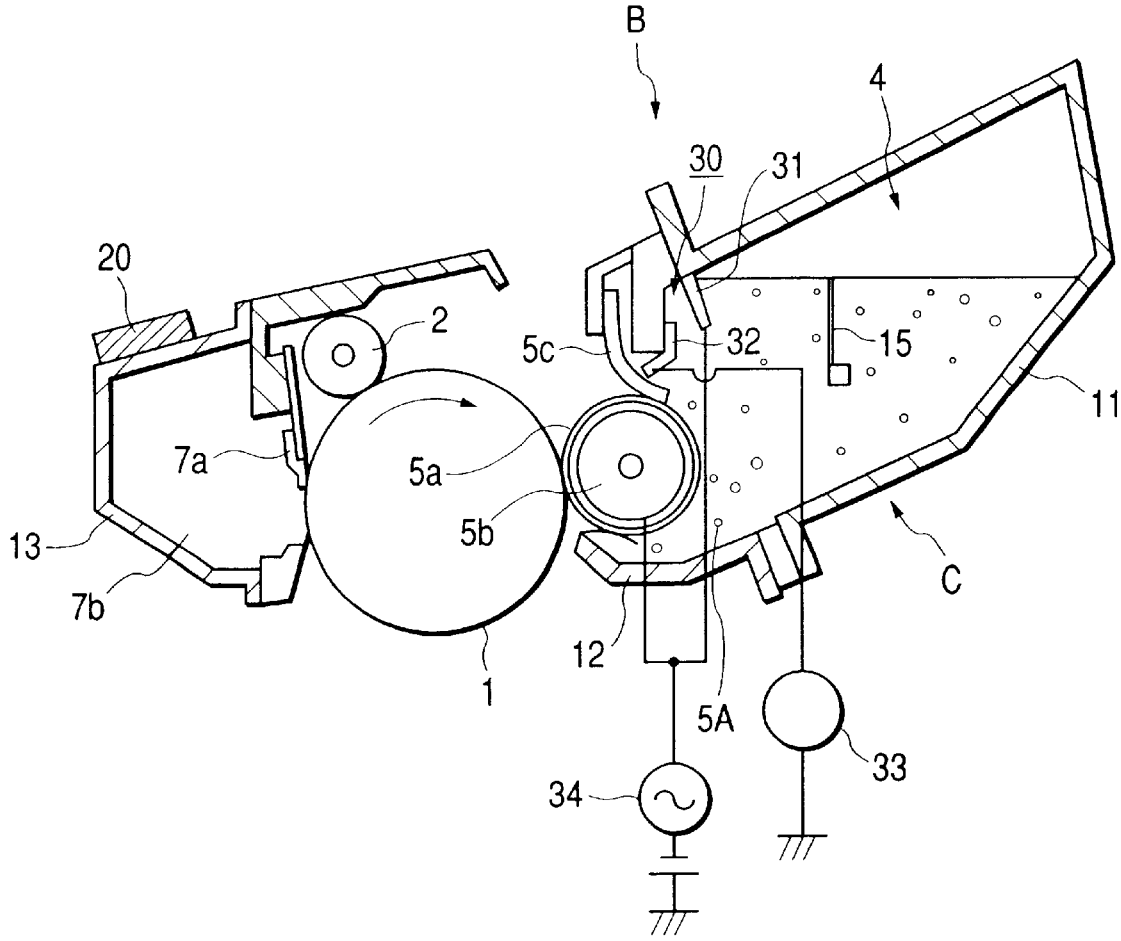
FIG. 2 is an enlarged sectional view of the process cartridge of FIG. 1.

On the other hand, in the illustrated embodiment, as shown in FIG. 2, in the process cartridge B, a developing unit (developing device) C is formed by integrally welding a developer frame 11 having the developer containing container 4 containing the developer and the agitating means 15 to a developing frame 12 holding the developing means 5 such as the developing roller 5*a* and the developing blade 5*c*, and the cartridge is formed by integrally joining the developing unit (developing device) C to a cleaning frame 13 to which the photosensitive drum 1, the cleaning means 7 such as the cleaning blade 7*a* and the waste developer container 7*b* and the charging roller 2 are attached.

The process cartridge B is detachably mounted to cartridge mounting means 101 (FIG. 1) of the main body 100 of the image forming apparatus by the user.

According to the present invention, the laser beam printer A has a developer amount detecting device having developer remaining amount detecting means capable of detecting the remaining amount of the developer successively as the developer T in the developing device C is consumed.

According to the illustrated embodiment, a plate antenna is used as the developer remaining amount detecting means 30. In the illustrated embodiment, as shown in FIG. 2, the plate antenna has an output metal plate 32 provided along the longitudinal entire area of the developing device C, and an input metal plate 31 having substantially the same longitudinal length as that of the output metal plate 32 and opposed to the output metal plate 32.

Although the material of the input metal plate 31 and the output metal plate 32 as the plate antenna is not limited so long as it can fundamentally permit the flow of electric current, in the illustrated embodiment, SUS having an excellent anti-rust property is used as the material of the metal plates 31, 32.

In the illustrated embodiment, when the process cartridge B is mounted on the main body 100 of the image forming apparatus, the developing roller 5*a* and the input metal plate 31 are electrically connected to developing bias applying means 34 as voltage applying means provided on the main body 100 of the image forming apparatus.

When AC bias of about 2 kHz as a normal developing bias and DC bias of about −400 V are applied to the developing roller 5*a* and the input metal plate 31, AC electric current flows between the developing roller 5*a* and the output metal plate 32 opposed to the developing roller 5*a* and between the input metal plate 31 and the output metal plate 32, and the resultant electric current value between them is measured by an electric current measuring device 33. In this way, on the basis of the electric current value measured by the electric current measuring device 33, the resultant capacitance based on capacitances between the developing roller 5*a* and the output metal plate 32 and between the input metal plate 31 and the output metal plate 32 is measured.

In this way, by providing the input metal plate 31 and the output metal plate 32 constituting the plate antenna within the developing device C and by observing the capacitances between the input metal plate 31 and the output metal plate 32 and between the developing roller 5*a* and the output metal plate 32 as the developer T in the developing device C is being decreased, the amount of the developer within the developer containing container 4 can be known at any time.

In the following explanation, a signal outputted ultimately through the output metal plate 32 in accordance with the capacitance between the developing roller 5*a* and the output metal plate 32 and the capacitance between the input metal plate 31 and the output metal plate 32 is merely called the "signal from the developer remaining amount detecting means" or the "detected value of the developer remaining amount detecting means".

Figure 3:
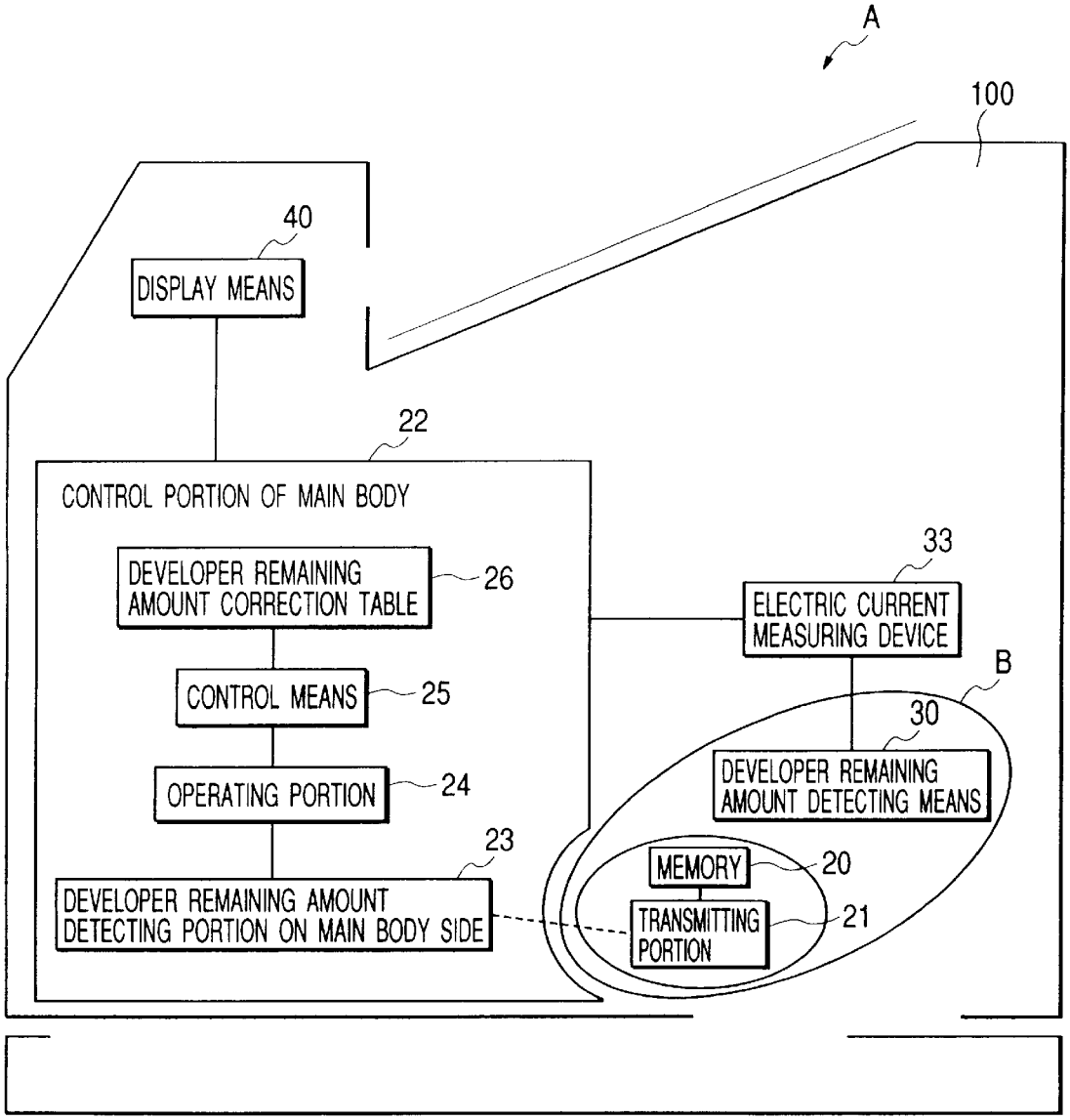
FIG. 3 is a schematic view showing the relationship between a memory of the process cartridge according to the first embodiment and a control portion of a main body of the image forming apparatus.

According to the illustrated embodiment, as shown in FIG. 3, the electric current from the developer remaining amount detecting means 30 is measured by the electric current measuring device 33 of the main body 100 of the image forming apparatus and is sent to a main body control portion 22 provided in the main body 100 of the image forming apparatus. In the main body control portion 22, the output signal from the developer remaining amount detecting means 30 is converted into a voltage signal by a developer amount detecting portion 23 on the main body side, and, as will be fully described later, a developer remaining amount level is determined by using a calculation portion 24, control means 25, and a developer remaining amount correction table 26. Further, in the main body control portion 22, a remaining percentage (%) of the developer is sought on the basis of the detected developer remaining amount, and information regarding the remaining percentage or a warning about the "absence of developer" informing the user of the fact that the developer is decreased to the extent that the image with predetermined quality cannot be formed is displayed on a display means 40 of the main body 100 of the apparatus.

Next, a developer-remaining-amount detecting principle of the developer amount detecting device according to the illustrated embodiment will be further fully described.

In the illustrated embodiment, as mentioned above, the capacitance detected value from the developer remaining amount detecting means 30 is inputted, via the electric current measuring device 33, to the main body side developer amount detecting portion 23 in the main body control portion 22, where the value is converted into the voltage value (the voltage value detected by the main body control portion 22 of the main body 100 of the image forming apparatus on the basis of the output of the developer remaining amount detecting means 30 is referred to merely as the "detected voltage value" hereinafter).

Figure 4:
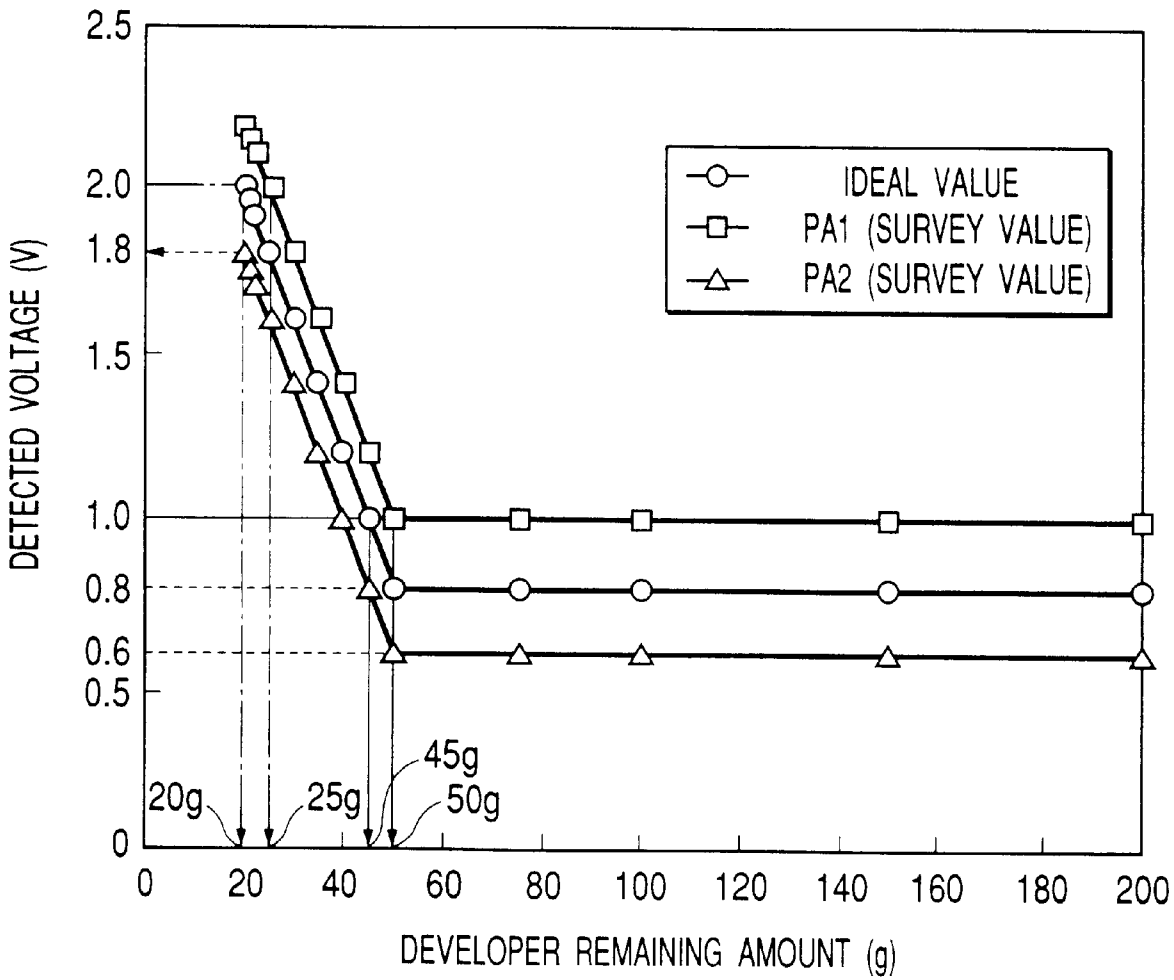
FIG. 4 is a graph showing a relationship between the detected voltage value of a developer amount detecting device constructed in accordance with the present invention and a developer remaining amount.

In the developer amount detecting device according to the illustrated embodiment, in accordance with the developer amount in the developing device C, for example, the voltage value as shown in FIG. 4 is outputted. In FIG. 4, the ordinate indicates the detected voltage value corresponding to a value which is the sum of the capacitance values detected between the developing roller 5*a* and the output metal plate 32 as the developer remaining amount detecting means 30 and the capacitance value detected between the input metal plate 31 and the output metal plate 32, and the abscissa indicates the remaining amount of the developer in the developing device C. Further, FIG. 4 shows an ideal curve (-o-) of the detected voltage value detected by the developer amount detecting device, and two survey values PA1 (-□-) and PA2 (-Δ-) as an example that the detected voltage values are deviated from the ideal value due to individual or inherent difference of the cartridge as will be described later. Here, in the illustrated embodiment, from a relation of the conversion circuit, as shown in the following relationship:

(capacitance, detected voltage)=(13 pF, 1.0 V), (18 pF, 0.8 V)

a decrease/increase relationship between the resultant capacitance (obtained by combining the capacitance between the developing roller 5*a* and the output metal plate 32 and the capacitance between the input metal plate 31 and the output metal plate 32) and the detected voltage has a reverse relationship, so that, when the capacitance detected by the developer remaining amount detecting means 30 is great, the detected voltage becomes small, and when the capacitance is small, the detected voltage becomes great.

Namely, as shown in FIG. 4, in a condition that the developer is fully loaded between the developing roller 5*a* and the output metal plate 32 and between the input metal plate 31 and the output metal plate 32, the detected capacitance values show maximum values, and, in this case, the detected voltage values show minimum values (the minimum value of the detected voltage value obtained by the developer remaining amount detecting device is referred to as the "PAF value (plate antenna full value)" hereinafter).

Incidentally, in the illustrated embodiment, since the developing roller 5*a*, the output metal plate 32 located relatively near the developing roller 5*a*, and the input metal plate 31 located relatively near the output metal plate 32 are used as the developer remaining amount detecting means 30, in an arrangement relationship of the developer remaining amount detection, as shown in FIG. 4, when the developer within the developing device C is consumed so that half the developer or less remains, reduction of the detected voltage is started, and, thereafter, the developer remaining amount can be detected successively until the developer is used up. However, the present invention is not limited to this example, but, as the developer remaining amount detecting means 30, an input side electrode and an output side electrode constituted by a plate antenna as is in the illustrated embodiment may be located at any positions within the developing device and, by measuring the capacitance between the electrodes, the remaining amount of the developer may be detected successively within a range from when much of the developer remains to when the developer is used up.

As mentioned above, in the developer remaining amount detecting means of the plate antenna type, the capacitance between the developer bearing member and the metal plate as the electrode or the capacitance between the metal plates as the electrodes depends upon the respective positional relationship, with the result that there may be dispersion in the developer detected value obtained by the developer remaining amount detecting means due to individual difference of the cartridge. Further, dispersion in the developer amount detection result occurs due to the manufacturing lot of the developer to be contained, the usage environment, the tolerance of parts of the cartridge and the tolerance of electronic parts of the main body of the image forming apparatus.

Further explaining, as the individual difference of the cartridge, for example, the detected voltage value in the condition that there is no developer between the developing roller 5*a* and the output metal plate 32 and between the input metal plate 31 and the output plate 32 may be differentiated due to a deviation in the positional relationship of the antenna plate. As a result, even in the condition that the developer is fully loaded between the developing roller 5*a* and the output metal plate 32 and between the input metal plate 31 and the output plate 32, dispersion in the detected voltage value may occur. Further, even if there is no deviation the positional relationship of the antenna plate, as mentioned above, the dispersion in detected voltage value in the condition that the developer is fully loaded occurs from cartridge due to the manufacturing lot of the developer and the tolerance of the electronic parts of the main body of the image forming apparatus.

That is to say, between the ideal value (-o-) and the actually measured survey values PA1 (-□-) and PA2 (-Δ-), for example as shown in FIG. 4, under the condition that the developer is fully filled, the minimum values (PAF value) of the detected voltage corresponding to the maximum values of the capacitances detected by the developer remaining amount detecting means 30 are differentiated; for example, although the PAF value is 0.8 V in ideal value, the PAF value becomes 1.0 V in the survey value PA1 and 0.6 V in the survey value PA2.

As can be understood from FIG. 4, even when the dispersion in detected voltage occurs in this way, in any cases, the curve configuration showing the relationship between the detected voltage and the developer remaining amount is not changed so long as the amount of the developer contained in the developing device C is identical, and, due to various factors as mentioned above, the detected voltage values are relatively deviated from the ideal curve (-o-), as the survey values PA1 (-□-) and PA2 (-Δ-) shown in FIG. 4.

The following Table 1 shows data regarding the developer remaining amounts and detected voltage values in the ideal value (-o-), the survey value PA1 (-□-) and the survey value PA2 (-Δ-) shown in FIG. 4.

TABLE 1

| developer remaining amount (g) | ideal value (V) | PA1 (V) (survey value) | PA2 (V) (survey value) |
|---|---|---|---|
| 0 | — | — | — |
| 10 | — | — | — |
| 20 | 2.0 | 2.2 | 1.8 |
| 21 | 2.0 | 2.2 | 1.8 |
| 22 | 1.9 | 2.1 | 1.7 |
| 25 | 1.8 | 2.0 | 1.6 |
| 30 | 1.6 | 1.8 | 1.4 |
| 35 | 1.4 | 1.6 | 1.2 |
| 40 | 1.2 | 1.4 | 1.0 |
| 45 | 1.0 | 1.2 | 0.8 |
| 50 | 0.8 | 1.0 | 0.6 |
| 75 | 0.8 | 1.0 | 0.6 |
| 100 | 0.8 | 1.0 | 0.6 |

TABLE 1-continued

| developer remaining amount (g) | ideal value (V) | PA1 (V) | PA2 (V) |
|---|---|---|---|
| | | (survey value) | |
| 150 | 0.8 | 1.0 | 0.6 |
| 200 | 0.8 | 1.0 | 0.6 |

In this way, since there is a deviation in the detected voltage due to various factors, such as the individual difference in the process cartridge or the image forming apparatus, when the developer-remaining-amount level is detected by using one pre-set relationship between the capacitance (detected voltage value) and the developer amount, the developer amount actually remaining in the developing device may be deviated from the detected result.

Namely, if the developer remaining amount is determined only on the basis of the pre-set ideal curve of the relationship between the developer remaining amount and the ideal detected voltage, for example, the following inconveniences will occur: (a) In a case where the developer amount detecting device has an output property such as the survey value PA1 (-□-), i.e., a property in which the PAF value is greater than the ideal value (0.8 V), when the detected voltage is 1.0 V, although a developer amount greater than 50 grams is actually remaining in the developing device C, if the developer amount is judged from the ideal curve (-o-), the developer amount is judged as 45 grams, and, thus, a developer amount smaller than the actual amount will be estimated.

Thereafter, for example, in a case where it is previously set so that the user is warned of the "absence developer" at a time when the developer amount in the developing device C becomes 25 grams, thereby risking the occurrence of a blank stripe and the warning display is effected at a time when the detected voltage value reaches 2.0 V, obtained by adding 1.2 V to the PAF value (0.8 V) in the ideal curve (-o-), if a developer amount detecting device having the property shown by the curve (-□-) of the survey value PA1 is used, at the time when the warning, the "absence of developer" is displayed, the developer amount of 25 grams still remains in the developing device C. Namely, in spite of the fact that the blank stripe is not actually generated and the developer amount of 25 grams can further be used, the warning "absence of developer" is displayed on the display portion 40 of the main body 100 of the image forming apparatus. Thus, if the user exchanges the cartridge for a new one in accordance with the display, the developer is discarded in vain. (b) To the contrary, in a case where the developer amount detecting device has an output property such as the survey value PA2 (-Δ-), i.e., a property in which the PAF value (0.6 V) is smaller than the ideal value (0.8 V), a developer amount smaller than the actual amount is estimated. As a result, when the point of the alarm "absence of developer" is set in the same manner as the above, in spite of the fact that the blank stripe image is actually generated when the detected voltage value reaches 1.8 V (=0.6 V (PAF value)+1.2 V), the alarm is not displayed until the detected voltage value reaches 2.0 V. As a result, a fault image such as a blank stripe image is outputted before the warning "absence of developer" is given, and, as the case may be, the user cannot prepare the exchange of the cartridge immediately, and the image forming apparatus cannot be used until a new cartridge is prepared.

Thus, according to the present invention, as shown in FIGS. 1 to 3, memory means 20 is provided on the process cartridge B, and, by storing information regarding the developer amount obtained when the developer remaining amount detecting means 30 detect the maximum amount of the developer in the developing device C into the memory means 20, even if the output of the developer remaining amount detecting means 30 is deviated from the ideal value due to the individual difference of the process cartridge B or the main body 100 of the image forming apparatus, such deviation can be corrected, thereby achieving the correct detection of the developer remaining amount.

That is to say, more specifically, according to the present invention, the following control is effected:

(1) The process cartridge B is provided with the memory means 20 so that the detected voltage value, i.e., the minimum value (PAF value) of the detected voltage obtained when the capacitance detected by the developer remaining amount detecting means 30 is a maximum is stored in the memory 20.

(2) The toner remaining amount is calculated by utilizing the correction table in accordance with the changed amount of the detected voltage value from the PAF value, by using the PAF value stored in the memory means 20.

(3) The result is displayed on the display means 40 at any time.

In this way, the individual difference of the cartridge can be compensated for, thereby effecting more accurate toner remaining amount detection successively.

First of all, the memory means 20 provided on the process cartridge B will be explained. As shown in FIGS. 1 and 3, according to the illustrated embodiment, the process cartridge B has a read/write memory 20 as the memory means 20 provided on an upper surface of the waste developer container 7*b*, and a cartridge side transmitting portion 21 for controlling read/write with respect to the memory 20. When the process cartridge B is mounted to the main body 100 of the image forming apparatus, the cartridge side transmitting portion 21 is opposed to the main body control portion 22 of the main body 100 of the image forming apparatus. Further, the main body control portion 22 includes a function as transmitting means of the main body 100 of the apparatus.

In the illustrated embodiment, although the memory 20 is provided on the upper surface of the waste developer container 7*b*, this is designed in consideration of the fact that, in the laser beam printer A according to the illustrated embodiment, since the process cartridge B is inserted into the main body 100 of the image forming apparatus with the waste developer container 7*b* side as a leading end, the positioning of the communication means constituted by the cartridge side transmitting portion 21 located adjacent to the memory 20 and the main body control portion 22 of the main body 100 of the image forming apparatus can easily be effected.

As the memory means 20 used in the present invention, normal semiconductor electronic memories, such as a non-volatile memory or combination of a volatile memory and a back-up battery, can be used without special limitation. Particularly, in the case of a memory of the non-contact type in which data communication between the memory 20 and a read/write 1C is effected by an electromagnetic wave, since the cartridge side transmitting portion 21 may not be contacted with the main body control portion 22, the danger of causing poor contact depending upon the mounting condition of the process cartridge B is eliminated, with the result that highly reliable control can be achieved. In the illustrated embodiment, a memory of non-contact type is used as the memory means 20.

The main-body control portion 22 and the transmitting portion 21 constitute control means for effecting read/write of information with respect to the memory 20. The capacity of the memory 20 is sufficient to store the PAF value. Further, in addition to the PAF value, when other information is desired to be stored, a memory having an appropriate capacity can be selected. For example, in order to provide a memory having a capacity sufficient to store a plurality of pieces of information, such as the cartridge usage amount and the cartridge property value, it can be designed so that information regarding the amount of usage of the cartridge and the developer remaining amount can be written and stored in the memory 20 at any time.

Next, the control arrangement of the memory 20 according to the illustrated embodiment will be explained.

As shown in FIG. 3, the process cartridge B is provided with the memory 20 and the transmitting portion 21, and the main body control portion 22 of the main-body 100 of the image forming apparatus is provided with the calculation portion 24, control means 25, a developer remaining amount correction table 26 and a main-body-side, developer remaining amount detecting portion 23.

As mentioned above, the electric current from the developer remaining amount detecting means 30 is measured by the electric current measuring device 33 of the main body 100 of the image forming apparatus and is sent to the main body control portion 22 of the main body 100 of the image forming apparatus.

In the main body control portion 22, the signal from the developer remaining amount detecting means 30 is converted into a voltage signal by the main-body-side, developer remaining amount detecting portion 23, and the calculation portion 24 effects a predetermined calculation process on the basis of the signals from the memory 20 of the process cartridge B and the main-body-side, developer remaining amount detecting portion 23, and, further, the control means 25 correct the developer-remaining-amount detected value properly by effecting verification of data obtained by the calculation portion 24 by using the developer remaining amount correction table 26, thereby determining the developer remaining amount level.

Further, in the main body control portion 22, the developer remaining amount (%) is sought on the basis of the detected developer remaining amount, and the sought information or the alarm "absence of developer" is displayed on the display means 40 of the main body of the apparatus.

Although various information can be stored in the memory, in the illustrated embodiment, at least the minimum value (PAF value) of the detected voltage value is stored.

Further, the information stored in the memory 20 can always be communicated with respect to the calculation portion 24 of the main body control portion 22, so that the calculation is effected on the basis of the information and the data is verified by the control portion.

Next, a method for correcting the developer remaining amount detected value by using the memory 20 of the process cartridge B will be explained.

In the illustrated embodiment, as mentioned above, the detected voltage value (PAF value) is written in the memory 20. The PAF value stored in the memory 20 is always compared with the detected voltage value, and, if the detected voltage value is smaller than the previous value, the PAF value stored in the memory 20 is re-written successively. In this way, the minimum value of the detected voltage corresponding to the maximum value of the capacitance detected by the developer remaining amount detecting means 30 is always stored in the memory 20 positively as the PAF value.

Further, according to the present invention, in the main body control portion 22, as a table for correcting the detected voltage value, the relationship between the change amount (V) from the PAF value of the detected voltage value X and the developer remaining amount (g) in the developing device C is previously stored in the developer remaining amount correction table 26. The developer remaining amount correction table 26 used in the illustrated embodiment is shown in the following Table 2.

TABLE 2

| developer remaining amount (g) | remaining amount display | X-(PAF value) |
|---|---|---|
| 0 | 0: (no developer) | — |
| 10 | 0: (no developer) | — |
| 20 | 0: (no developer) | from 1.4 |
| 21 | 1 | 1.36 to 1.40 |
| 22 | 2 | 1.32 to 1.36 |
| 25 | 5 | 1.2 to 1.32 |
| 30 | 10 | 1.0 to 1.2 |
| 35 | 15 | 0.8 to 1.0 |
| 40 | 20 | 0.6 to 0.8 |
| 45 | 25 | 0.4 to 0.6 |
| 50 | 30 | 0.2 to 0.4 |
| from 100 | 100 | 0 to 0.2 |

As shown in the Table 2, in the illustrated embodiment, it is assumed that there is a risk of obtaining a blank stripe image if the remaining amount in the developing device C becomes smaller than 25 grams, and, it is set so that the alarm "absence of developer" is displayed on the display means 40 of the main body 100 of the apparatus when the changed amount from the maximum value of the detected voltage, i.e., the PAF value becomes 1.4 V or more. Further, the changed amount from the PAF value is divided into plural values with an appropriate interval from 0 V to 1.4 V and such values correspond to the remaining amount of the developer. Further, in the illustrated embodiment, in the developer remaining amount correction table 26, the remaining amount (g) of the developer corresponds to the developer remaining amount (%) for indicating the percentage (%) of usable developer (with respect to the unused condition) remaining.

In the illustrated embodiment, the developer loading amount in the unused condition of the process cartridge B is 200 grams, and, since there is a risk of the occurrence of a blank stripe when the remaining amount of the developer in the developing device C becomes 20 grams or less, the amount of developer which can actually be used is 180 grams. According, on the basis of the percentage (%) of developer remaining with respect to the usable developer amount of 180 grams, the developer remaining amount (%) is displayed. Further, in the illustrated embodiment, due to the arrangement relationship of the developer remaining amount detecting means 30, the detected voltage value obtained by the developer amount detecting device is changed when the remaining amount of the developer becomes about 50 grams (usable developer; 30 grams). Thus, when the remaining amount of the developer is greater than 50 grams, i.e., before the increase in the detected voltage value (reduction in the capacitance) is started, regarding the display of the developer remaining amount (%) information for indicating the sufficient developer remaining amount, for example, "30% or more" or "100%" can be displayed.

In this way, in the calculation portion 24 of the main body control portion 22, the changed amount of the detected voltage value from the PAF value is calculated on the basis of the detected voltage of the developer amount detecting device inputted via the main-body-side, developer remaining amount detecting portion 23 and the PAF value stored in the memory 20 of the process cartridge B, and, in the control means 25, by comparing the changed amount calculated in the calculation portion 24 with the table (shown in the Table 2) stored in the developer remaining amount correction table 26, for example, the changed amount of the detected voltage value from the PAF value is 0.7 V, it is judged that the developer remaining amount is 40 grams and the percentage of the developer with respect to the unused condition is 15%, and such information is displayed on the display means 40.

Figure 5:
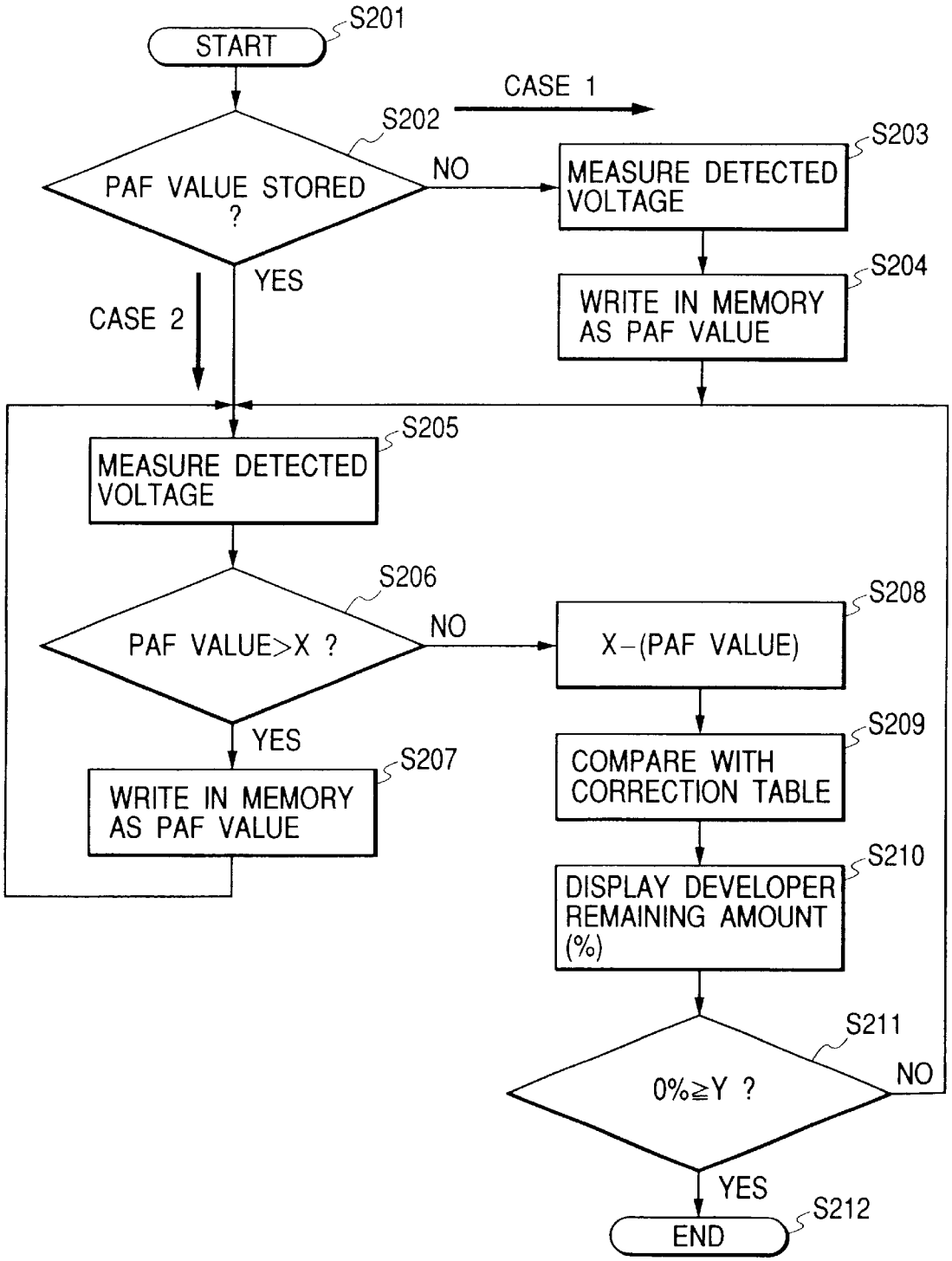
FIG. 5 is a flow chart for explaining a developer amount detecting operation using memory means of the cartridge according to the first embodiment.

Next, the PAF value writing operation and successive developer remaining amount detecting operation in the illustrated embodiment will be explained with reference to a flow chart shown in FIG. 5. Incidentally, the used developer remaining amount correction table is as shown in the Table 2.

Step S201: A power supply of the main body 100 of the image forming apparatus is turned ON.

Step S202: The main body side developer remaining amount detecting portion 23 judges whether the PAF value is stored in the memory 20.

Case 1: If it is judged as "NO" in the step S202

Step S203: The detected voltage value is measured by the main body side developer remaining amount detecting portion 23.

Step S204: The measured value X of the detected voltage is stored in the memory 20 as the PAF value, and the program goes to a step S205.

Case 2: If it is judged as "YES" in the step S202

Step S205: The detected voltage value is measured by the main body side developer remaining amount detecting portion 23.

Step S206: The control means 25 compares the PAF value stored in the memory 20 with the measured value X of the detected voltage and judges whether the measured value X is smaller than the PAF value stored in the memory 20. If YES, the program goes to a step S207, where the PAF value in the memory 20 is renewed and then the program is returned to the step S205. On the other hand, if it is judged as NO in the step S206, the program goes to a step S208.

Step S208: The calculation portion 24 calculates the changed amount of the measured value X of the detected voltage from the PAF value on the basis of the relationship between the PAF value stored in the memory 20 and the measured value X of the detected voltage.

Step S209: The control portion 25 compares the value calculated by the calculation portion 24 in the step S208 with the developer remaining amount correction table 26.

Step S210: The control portion 23 sends the signal indicating the fact that the developer remaining amount is Y% to the display portion 40 of the main body 100 of the image forming apparatus, and such information is displayed on the display portion 40.

Step S211: The control portion 23 judges whether the developer remaining amount (%) reaches 0%. If NO, the program goes to the step S205, where the above sequence is repeated; whereas, if YES, the program is ended.

Figure 6:
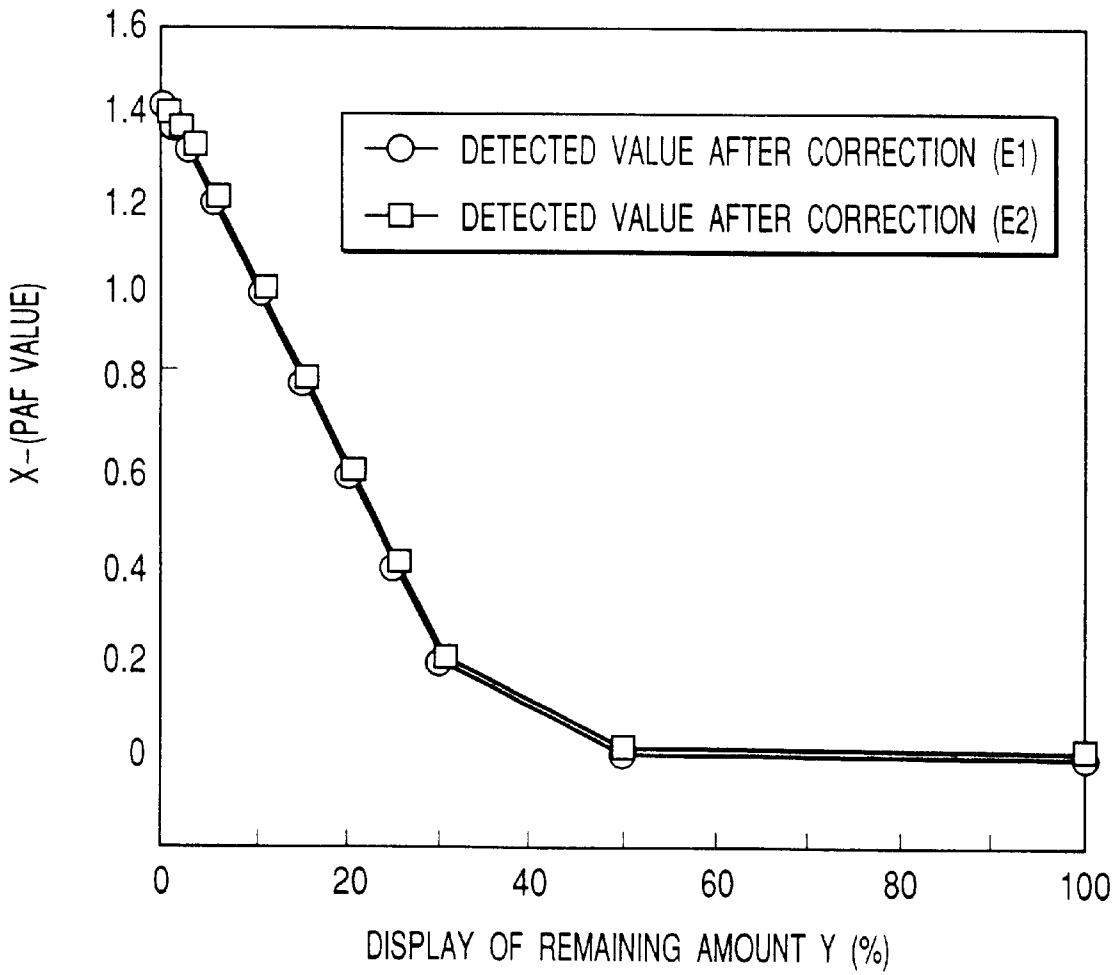
FIG. 6 is a graph for explaining the indication of a developer remaining amount after the detected voltage value of the developer amount detecting device is corrected in the first embodiment.

As a result, the indication of the developer remaining amount depending upon the consumption of the developer was evaluated with respect to two process cartridges B (E1, E2) having the same design and including respective developer amount detecting devices having different PAF values due to tolerance by effecting the control in accordance with the above-mentioned flow chart, as shown in FIG. 6, and it was found that successive developer remaining amount detection with eliminating the individual difference of the process cartridge B can be achieved. In FIG. 6, the ordinate indicates the changed amount of the detected voltage obtained by the developer amount detecting device from the PAF value, and the abscissa indicates remaining amount display Y (%) of the developer in the developing device C.

As mentioned above, according to the present invention, even if the capacitance detected by the developer remaining amount detecting means in the no developer condition is different from cartridge to cartridge due to the positional relationship of the developer remaining amount detecting means, since the relationship between the developer remaining amount and the capacitance (detected voltage value) can be corrected on the basis of the capacitance value (detected voltage value) detected under the condition that the developer is fully loaded (developer full condition), the remaining amount of the developer can be detected correctly.

Further, by storing the information (detected voltage value in the illustrated embodiment) corresponding to the capacitance detected in the developer full condition in the memory of the cartridge, even in a case where the cartridge is dismounted from the main body of the image forming apparatus and a new cartridge is mounted, when the dismounted cartridge is again used later, the relationship between the developer remaining amount and the capacitance (detected voltage value) of the respective cartridge can be corrected by reading the information stored in the memory by means of the main body of the image forming apparatus, thereby always detecting the remaining amount of the developer correctly.

Incidentally, naturally, since the relationship between the developer remaining amount and the detected voltage value is changed greatly in dependence upon the construction of the cartridge, and particularly, the construction and arrangement of the developer remaining amount detecting means, the developer remaining amount correction table is not limited to that shown in the Table 1, but the table can be selected appropriately in accordance with the properties of the image forming apparatus and the cartridge to which the present invention is applied. Further, in the illustrated embodiment, the interval of division of the changed amount from the PAF value in the developer remaining amount correction table is set to correspond to 5 grams (5%) of the developer amount when the remaining amount is great, and the interval is reduced when the developer remaining amount is decreased. However, the present invention is not limited to the interval in the table shown in the Table 1, but, the interval is set individually in accordance with the embodiments, and, naturally, the narrower the interval the finer the display of the developer remaining amount. Further, in the above explanation, while an example that the changed amount of the detected voltage value from the PAF value is sought from the difference therebetween was explained, the present invention is not limited to such an example.

Further, in the illustrated embodiment, while an example that the developer remaining amount correction table 26 is stored in the main body control portion 22 was explained, alternatively, the developer remaining amount correction table may be stored in the memory 20 of the process cartridge B. In this case, since the table depending upon the inherent property of the cartridge can be held in the cartridge itself and be used, the successive remaining amount detection can be effected more correctly in correspondence to various cartridges.

In the illustrated embodiment, while an example that the developer remaining amount is calculated by using the table was explained, a calculation for correcting the measured value of the detected voltage may be effected by using a function of predetermined weighting utilizing the PAF value.

Further, in the illustrated embodiment, while an example that the decrease/increase relationship between the capacitance detected by the developer remaining amount detecting means and the detected voltage ultimately detected by the developer remaining amount detecting device is set to become reverse was explained, the relationship between the capacitance and the voltage is varied with the detection circuit provided in the image forming apparatus, and, thus, the relationship between the capacitance and the voltage may be the same decrease function or the same increase function.

The developer remaining amount expressing method is not limited to expressing the developer remaining amount in grams (g) or a percentage (%), but, other expressing methods may be used, so that for example, "how many sheets can be further outputted" may be expressed. Further, regarding the display of the display means, the present invention is not limited to the illustrated embodiment in which the developer remaining amount is displayed in a percentage indication. For example, a display by a gas gauge, a line graph or a numerical indication may be used. Further, of course, the user may be informed of the developer remaining amount based on an alarm message or a voice message or an indication may be recorded on the recording medium and outputted. Thus, any display system can be used so long as the remaining amount of the developer can be communicated to the user. Further, the display of the developer remaining amount is not necessarily effected by the display means 40 of the main body 100 of the image forming apparatus, but may be effected by display means such as a picture plane of a host computer connected in communication with the main body 100 of the image forming apparatus.

Further, in the illustrated embodiment, while an example that the plate antenna system is used as the developer remaining amount detecting means was explained, the present invention is not limited to the application to a process cartridge having a developer remaining amount detecting means of the plate-antenna type. That is to say, even under the condition that the developer is fully loaded in the developing device, so long as a dispersion in the detected value of the developer remaining amount detecting means may occur due to difference in manufacturing lots of the developer remaining amount detecting means and the developer, a change in usage environment, the tolerance of parts of the cartridge or electronic parts of the main body of the image forming apparatus, regardless of the detecting system, by using the principle of the present invention, the developer remaining amount can be detected correctly.

Second Embodiment

Figure 7:
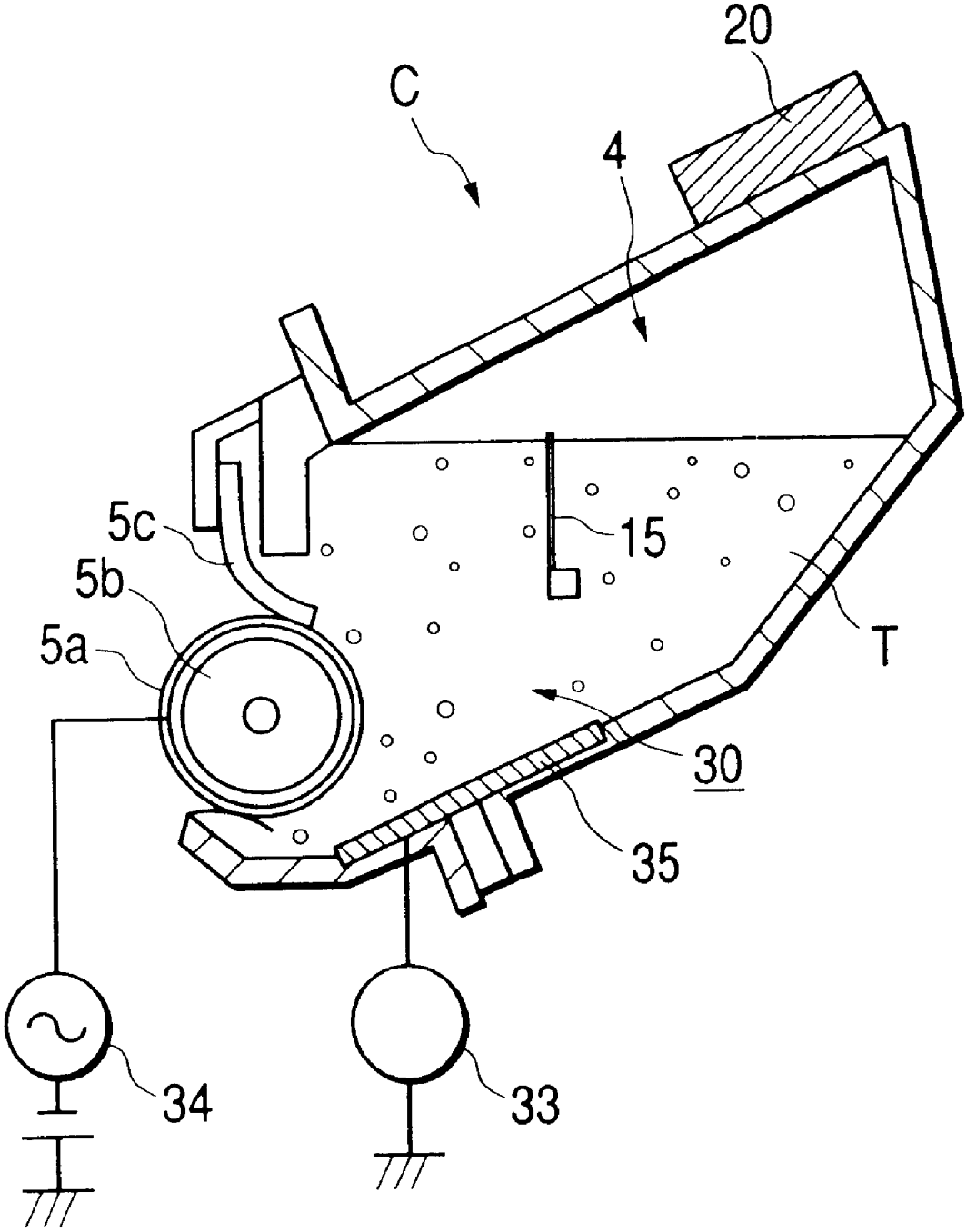
FIG. 7 is a sectional view of a developing device constructed as a cartridge according to a second embodiment of the present invention.

FIG. 7 shows a developing device C as a cartridge according to a second embodiment of the present invention.

The developing device C according to the second embodiment includes a developer bearing member such as a developing roller 5*a*, and a developing room 5A containing developer to be supplied to the developer bearing member, and is constituted as a cartridge by integrally welding plastic developing frames 11, 12. In the developing device C according to this embodiment, the developing device constituting parts in the process cartridge B of the first embodiment are integrated as a unit; that is to say, it is considered that parts other than the photosensitive drum 1, charging means 2 and cleaning means 7 of the process cartridge B are integrated as a unit. Accordingly, all of the developing device constituting parts and the construction of the developer amount detecting device explained in connection with the first embodiment can similarly be applied to the developing device C according to the second embodiment. Therefore, the explanation for the first embodiment will be cited for the explanation of such parts and construction and their functions.

However, this embodiment differs from the first embodiment in that a memory 20 is provided on a developer containing container 4 and a single output metal plate 35 acting as a plate antenna as developer amount detecting means is provided on a bottom surface of the developer containing container 4 located below a developing roller 5*a* in FIG. 7. In the illustrated embodiment, a change in capacitance between the developing roller 5*a* and the output metal plate 35 as the plate antenna generated when developing bias is applied to the developing roller 5*a* is detected, and the cost of the device is thereby reduced. Of course, by combining the plate antenna (input metal plate 31 and output metal plate 32) explained in connection with the first embodiment with the plate antenna 35 of this embodiment, the capacitance changed in accordance with the amount of the developer can be detected at various locations, thereby achieving more accurate measurement.

Also in the arrangement according to the second embodiment, the same technical effect as the first embodiment can be obtained.

Third Embodiment

First of all, an embodiment of an electrophotographic image forming apparatus to which a process cartridge constructed in accordance with the present invention can detachably be mounted will be explained with reference to FIGS. 8 and 9. In this embodiment, the electrophotographic image forming apparatus is embodied as a laser beam printer A of electrophotographic type and serves to receive image information from a host computer and to form an image on a recording medium such as a recording paper, an OHP sheet, cloth and the like by an electrophotographic image forming process.

The laser beam printer A has a drum-shaped electrophotographic photosensitive member, i.e., a photosensitive drum 1. The photosensitive drum 1 is charged by a charging roller 2 as charging means. Then, by illuminating the drum with a laser beam L corresponding to the image information from a laser scanner 3, a latent image corresponding to the image information is formed on the photosensitive drum 1. The latent image is developed by developing means 5 of a developing device C to visualize the latent image as a toner image.

Namely, the developing device C has, as a developer containing portion, a developing room 5A including a developing roller 5*a* as a developer bearing member, and a developer containing container 4 formed adjacent to the developing room 5A, and developer T in the developer containing container 4 is supplied to the developing roller 5*a* within the developing room 5A. Agitating means 15 rotated in a direction shown by the arrow in FIG. 8 are provided within the developer containing container 4 so that, by rotating the agitating means 15, the developer T is supplied to the developing roller 5*a* while being loosened.

Incidentally, in the illustrated embodiment, a developer seal member 4A is disposed between the developing room 5A and the developer containing container 4. The seal member 4A serves to prevent the developer from leaking even if severe shock is generated during the transportation of the cartridge and is adapted to be removed or unsealed by the user immediately before the process cartridge is mounted to a main body of the image forming apparatus.

In the illustrated embodiment, insulative magnetic one-component toner is used as the developer T. Further, the developing roller 5*a* has a stationary magnet 5*b* therein, so that the developer is carried by rotating the developing roller 5*a*. Meanwhile, triboelectric charge is applied to the developer and a developer layer having a predetermined thickness is formed by a developing blade 5*c* as a developer layer thickness regulating member, which developer layer is supplied to a developing area on the photosensitive drum 1. The developer supplied to the developing area is transferred onto the latent image on the photosensitive drum 1 thereby forming the toner image. The developing roller 5*a* is connected to developing bias applying means 34 (FIG. 11) so that a developing bias voltage, obtained by superimposing DC voltage on AC voltage, is normally applied to the developing roller.

On the other hand, in synchronism with formation of the toner image, a recording medium P set in a sheet feeding cassette 200 is conveyed to a transfer position by a pick-up roller 8 and conveying means 9A. A transfer roller 6 as transfer means is disposed at the transfer position so that, by applying voltage to the transfer roller, the toner image on the photosensitive drum 1 is transferred onto the recording medium P.

The recording medium P to which the toner image was transferred is conveyed to fixing means 10 by conveying means 9B. The fixing means 10 include a fixing roller 10*b* having a heater 10*a* therein, and a drive roller 10*c*. While the recording medium P is being passed through the fixing means, the toner image is fixed to the recording medium P by heat and pressure.

Thereafter, the recording medium P is discharged onto a discharge tray 14 by conveying means 9*c*. The discharge tray 14 is provided on an upper surface of a main body 100 of the laser beam printer A.

After the toner image was transferred to the recording medium P by the transfer roller 6, the developer remaining on the photosensitive drum 1 is removed by cleaning means 7, for preparing for a next image forming process. In the cleaning means 7, the residual developer on the photosensitive drum is scraped off by an elastic cleaning blade 7*a* urged against the photosensitive drum 1, and the scraped developer is collected into a waste developer container 7*b*.

Figure 9:
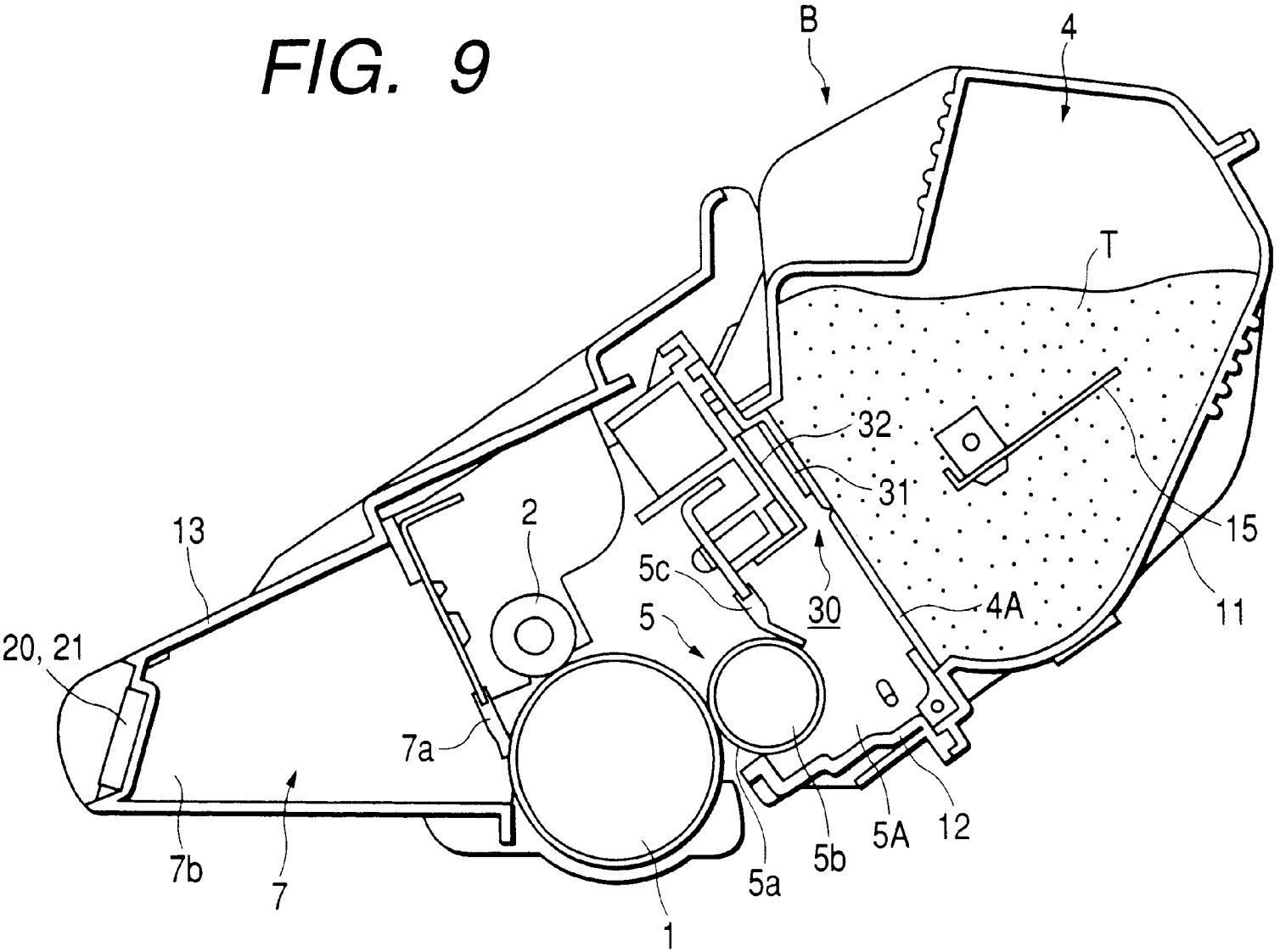
FIG. 9 is an enlarged sectional view of the process cartridge of FIG. 8.

On the other hand, in the illustrated embodiment, as shown in FIG. 9, in the process cartridge B, a developing unit (developing device) C is formed by integrally welding a developer frame 11 having the developer containing container 4 containing the developer and the agitating means 15 to a developing frame 12 holding the developing means 5 such as the developing roller 5*a* and the developing blade 5*c*, and the cartridge is formed by integrally joining the developing unit C to a cleaning frame 13 to which the photosensitive drum 1, the cleaning means 7 such as the cleaning blade 7*a* and waste developer container 7*b* and the charging roller 2 are attached.

The process cartridge B is detachably mounted to cartridge mounting means 101 (FIG. 8) of the main body 100 of the image forming apparatus by the user.

According to the present invention, the laser beam printer A has a developer amount detecting device having developer remaining amount detecting means capable of detecting a remaining amount of the developer successively as the developer T in the developing device C is consumed.

According to the illustrated embodiment, a plate antenna is used as the developer remaining amount detecting means 30. In the illustrated embodiment, as shown in FIG. 9, the plate antenna has an output metal plate 32 provided along the entire longitudinal area of the developing device C, and an input metal plate 31 having substantially the same longitudinal length as that of the output metal plate 32 and opposed to the output metal plate 32.

Although material of the input metal plate 31 and the output metal plate 32 as the plate antenna is not limited so long as it can fundamentally permit the flow of electric current, in the illustrated embodiment, SUS having excellent anti-rust is used as the material of the metal plates 31, 32.

In the illustrated embodiment, when the process cartridge B is mounted on the main body 100 of the image forming apparatus, the developing roller 5*a* and the input metal plate 31 are electrically connected to developing bias applying means 34 as voltage applying means provided on the main body 100 of the image forming apparatus.

When AC bias of about 2 kHz as a normal developing bias and DC bias of about −400 V are applied to the developing roller 5*a* and the input metal plate 31, AC electric current flows between the developing roller 5*a* and the output metal plate 32 opposed to the developing roller 5*a* and between the input metal plate 31 and the output metal plate 32, and the resultant electric current value between them is measured by an electric current measuring device 33. In this way, on the basis of the electric current value measured by the electric current measuring device 33, the resultant capacitance based on the capacitance between the developing roller 5*a* and the output metal plate 32 and between the input metal plate 31 and the output metal plate 32 is measured.

In this way, by providing the input metal plate 31 and output metal plate 32 constituting the plate antenna within the developing device C and by observing the capacitances between the input metal plate 31 and the output metal plate 32 and between the developing roller 5*a* and the output metal plate 32 as the developer T in the developing device C is being decreased, the amount of the developer within the developer containing container 4 can be known at any time.

Figure 10:
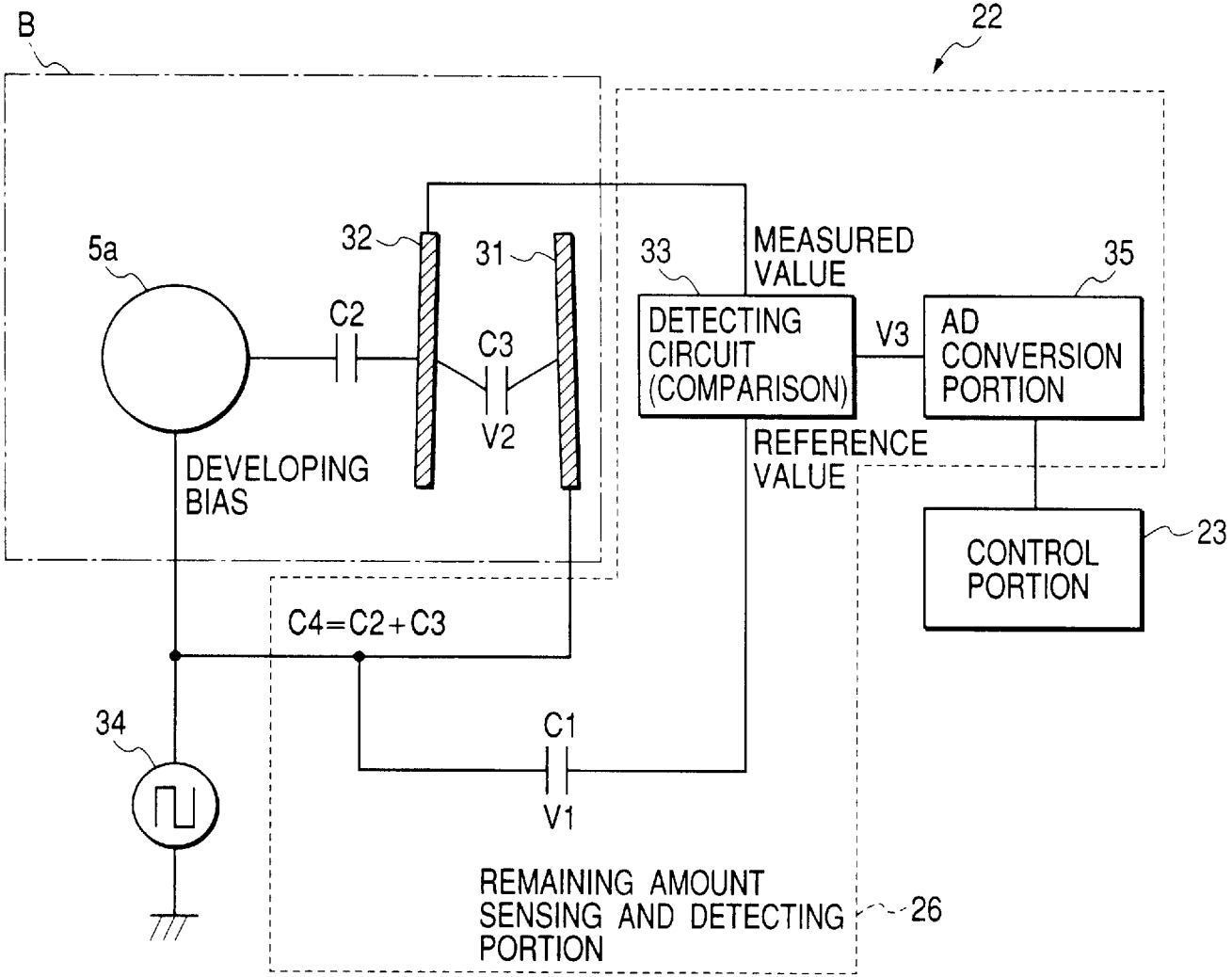
FIG. 10 is a view showing an example of a circuit arrangement for detecting the developer amount in the process cartridge in the third to eighth embodiments.

FIG. 10 shows a circuit arrangement for detecting the developer amount in the process cartridge. When a predetermined AC bias is outputted from a developing bias circuit 34 as developing bias applying means, the applied bias is applied to a reference capacitor C1, the developing roller 5*a* and the electrode 31, respectively. As a result, voltage V1 is generated on both ends of the reference capacitor C1, and electric current corresponding to capacitance C4 (C2+C3) is generated between the electrodes 31 and 32. The electric current is converted into voltage V2 by calculation.

A detection circuit of the electric current measuring device 33 constituting a remaining amount detecting portion 26 of a main body control portion 22 serves to form voltage V3 on the basis of the difference in voltage between the voltage V1 generated on both ends of the reference capacitor C1 and the electrode-to-electrode voltage and to output it to an AD converter portion 35. The AD converter portion 35 serves to output a result obtained by digital-converting analogue voltage V3 to a control portion 23. The control portion 23 serves to determine the developer remaining amount level by using a calculation portion 24 and a developer correction table 25 shown in FIG. 11 (fully described later) on the basis of the digital-converted voltage value.

In the following explanation, a signal outputted ultimately through the output metal plate 32 in accordance with the capacitance between the developing roller 5*a* and the output metal plate 32 and the capacitance between the input metal plate 31 and the output metal plate 32 is merely called a "signal from the developer remaining amount detecting means" or a "detected value of the developer remaining amount detecting means".

Further, the control portion 23 serves to seek the percentage (%) of the remaining developer and to display such data or provide a warning by using display means 40 of the main body of the apparatus or a computer connected to the image forming apparatus via a network.

In the developer remaining amount detecting portion 26 according to the illustrated embodiment, the voltage value sent to the control portion 23 of the main body of the image forming apparatus is referred to merely as "detected voltage value V3".

Figure 12:
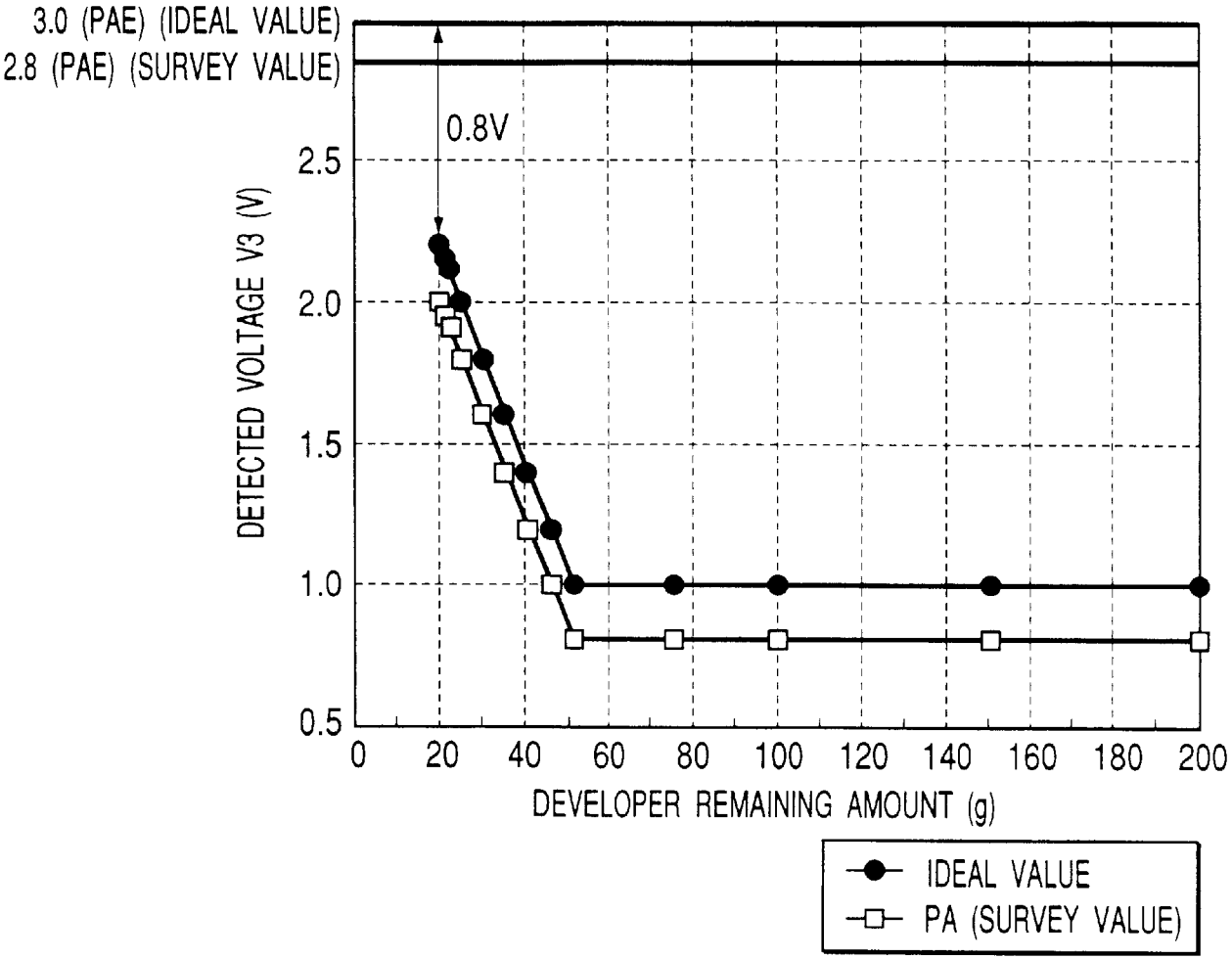
FIG. 12 is a graph showing the relationship between a detected voltage value of a developer amount detecting device and a developer remaining amount.

FIG. 12 shows the relationship between the developer remaining amount and the detected voltage. In FIG. 12, the ordinate indicates the "detected voltage value V3" corresponding to a value which is the sum of the capacitance measured between the developing roller 5*a* acting as a part of the developer remaining amount detecting means and the plate metal plate 32 as the plate antenna or electrode and the capacitance measured between the plate metal plate 31 and the plate metal plate 32, and the abscissa indicates the remaining amount of the developer in the developing device.

Further, FIG. 12 shows an ideal curve (-o-) of the detected voltage value obtained by the developer amount detecting device, and a survey value PA (-□-) as an example of the detected voltage value deviated from the ideal value due to an individual difference of the cartridge which will be described later.

Here, in the illustrated embodiment, from the relationship of the conversion circuit, as shown in the following relationship:

(capacitance, detected voltage)=(13 pF, 1.0 V), (18 pF, 0.8 V)

a decrease/increase relationship between the resultant or total capacitance (obtained by combining the capacitance measured between the developing roller 5*a* and the output metal plate 32 and the capacitance measured between the input metal plate 31 and the output metal plate 32) and the detected voltage has a reverse relationship, so that, when the capacitance detected by the developer remaining amount detecting means 30 is great, the detected voltage becomes small, and when the capacitance is small, the detected voltage becomes great.

Namely, as shown in FIG. 12, under a condition that there is no developer in the developer container, the detected voltage value shows the maximum value; whereas, in a condition that the developer is fully filled, the detected voltage value shows a minimum value.

Incidentally, in the illustrated embodiment, since the developing roller 5*a*, the plate metal plates 32 located relatively near the developing roller 5*a*, and the plate metal plate 31 are used as the developer remaining amount detecting means 30, in an arrangement relationship of the developer remaining amount detection, as shown in FIG. 12, when the developer within the developing device is consumed by half or lower, a reduction of the detected voltage is started, and, thereafter, the developer remaining amount can be detected successively until the developer is used up.

However, the present invention is not limited to this example, but, as the plate antenna constituting the developer remaining amount detecting means, for example, by providing an input side electrode and an output side electrode constituted by the metal plates as is in the illustrated embodiment at any position within the developing device, the remaining amount of the developer may be detected successively within a range from when much of the developer remains to when the developer is used up, so long as there is at least a portion where the output value is not changed in accordance with the developer remaining amount.

Next, factors for generating error in the detection of the developer remaining amount will be explained.

As mentioned above, in the developer remaining amount detecting means of the type according to the present invention, detecting error will occur due to the positional relationship between the developer bearing member 5*a* and the metal plates 31, 32 as the electrodes, and dispersion in parts of the cartridge for measuring the capacitance and adjustment dispersion.

If the detection error is generated, as shown in FIG. 12, the detected voltage values with respect to the developer remaining amount are deviated from each other between the ideal value and a PA survey value, with the result that the correct detection cannot be effected.

To avoid this, in the illustrated embodiment, the following control is effected:

(1) The process cartridge B is provided with the memory means (memory) 20, and the "detected voltage value V3" in the area where the output value is not changed in accordance with the developer remaining amount in actual use is measured by at least one, and a PAF value is sought by calculating these values. The PAF value is the plate antenna full value, and the developer correction table 25 is altered on the basis of this value.

(2) The developer correction table 25 is altered on the basis of the PAF value, and the present developer remaining amount is calculated on the basis of the altered correction table 25 and the present "detected voltage value V3".

(3) A calculated result is displayed on the display means successively.

In this way, the detection of the developer remaining amount can be effected even by using the correction table including the individual differences of the cartridge and the main body of the image forming apparatus, and, in this case, the individual differences are compensated for, thereby effecting more correct developer remaining amount detection successively.

Next, the memory means, i.e., memory 20 provided on the process cartridge B, will be explained.

Figure 8:
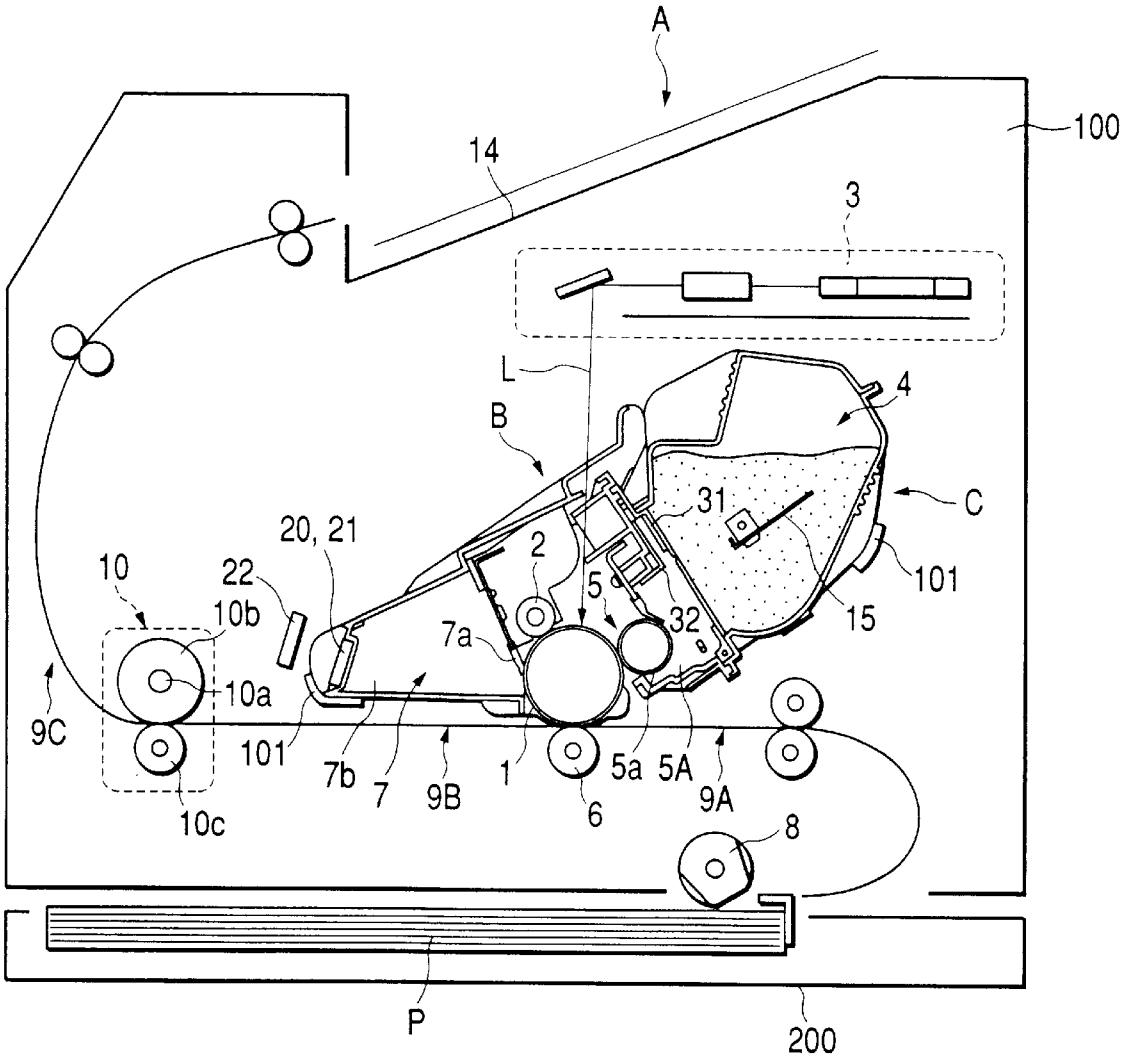
FIG. 8 is a sectional view showing a process cartridge and an image forming apparatus according to third to seventh embodiments of the present invention.

As shown in FIGS. 8 and 10, according to the illustrated embodiment, the process cartridge B has a memory 20 and a cartridge side transmitting portion 21 for controlling read/write with respect to the memory 20, which are provided on a distal end of the developer reservoir 7*b*. When the process cartridge B is mounted to the main body 100 of the image forming apparatus, the cartridge side transmitting portion 21 is opposed to the main body control portion 22 of the main body 100 of the image forming apparatus. Further, in the illustrated embodiment, the main body control portion 22 also includes the function of transmitting means of the main body of the apparatus.

In the illustrated embodiment, the memory 20 is provided on the developer reservoir 7*b*. This is designed in consideration of the fact that, in the illustrated embodiment, when the cartridge B is mounted to the main body 100 of the image forming apparatus, since the cartridge B is inserted into the main body 100 of the image forming apparatus with the developer reservoir 7*b* side as a leading end, the positioning of the communication means constituted by the cartridge side transmitting portion 21 located adjacent to the memory 20 and the main body control portion 22 of the main body 100 of the image forming apparatus can easily be effected.

As the memory means 20 used in the present invention, normal semiconductor electronic memories such as a non-volatile memory or combination of a volatile memory and a back-up battery can be used without special limitation. Particularly, in case of a memory of the non-contact type in which data communication between the memory 20 and a read/write IC is effected by an electromagnetic wave, since the cartridge side transmitting portion 21 may not contact the main body control portion 22, the danger of causing poor contact depending upon the mounting condition of the process cartridge B is eliminated, with the result that highly reliable control can be achieved. In the illustrated embodiment, a memory of the non-contact type is used as the memory means 20.

The main body control portion 22 and the transmitting portion 21 constitute control means for effecting read/write of information with respect to the memory 20. The capacity of the memory 20 is sufficient to store plural information such as the cartridge usage amount and the cartridge property value, as will be described later.

Next, a control arrangement of the memory 20 according to the illustrated embodiment will be explained with reference to FIG. 11.

Figure 11:
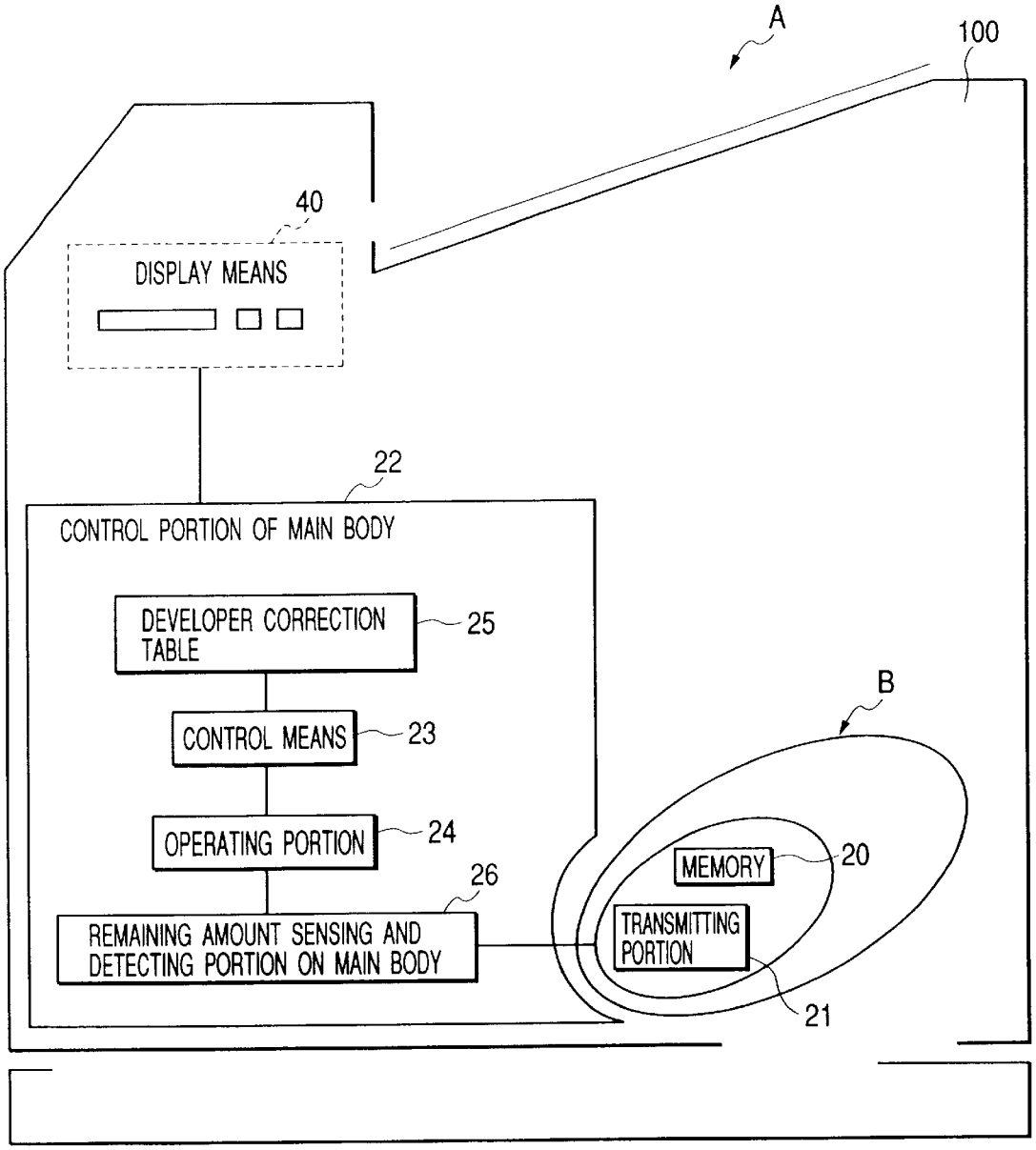
FIG. 11 is a schematic view showing the relationship between a memory of the process cartridge according to the third embodiment and a control portion of a main body of the image forming apparatus.

As shown in FIG. 11, the process cartridge B is provided with the memory 20 and the transmitting portion 21. Further, the main body 100 has the main body control portion 22, and, as mentioned above, the main body control portion 22 is provided with the control portion 23, the calculation portion 24, the developer correction table 25, and the developer remaining amount detecting portion 26.

As mentioned above, the voltage from the developer remaining amount detecting means 30 is send to the control portion 23 of the main body 100 of the image forming apparatus. In the control portion 23, the output signal from the developer remaining amount detecting means 30 is converted into a voltage signal by the remaining amount detecting portion 26, and the control portion corrects the developer remaining amount detected value properly by effecting verification of data obtained by the calculation portion 24 by using memory 20 of the process cartridge B and the developer correction table 25, thereby determining the developer remaining amount level.

Further, in the main body control portion 22, the developer remaining amount (%) is sought on the basis of the detected developer remaining amount, and the sought information or the warning "absence of developer" is displayed on the display means 40 of the main body 100 of the apparatus.

Although various pieces of information can be stored in the memory 20, in the illustrated embodiment, at least the PAF value and the present developer remaining amount (%) information is stored. Further, the information stored in the memory can always be communicated with respect to the calculation portion 24 of the main body control portion 22, so that the calculation is effected on the basis of the information and the data is verified by the control portion 23.

Further, in the illustrated embodiment, the main body control portion 22 is provided with the correction table for calculating the developer remaining amount on the basis of a relation formula between the PAF value and "detected voltage value V3", as shown in the following Table 3 and 4, and the developer remaining amount is calculated by using the correction table 25.

TABLE 3

| display (%) | conversion formula |
|---|---|
| toner out | V3 > PAF + (20-PAF) × 1.0 |
| 2 | V3 > PAF + (20-PAF) × 0.95 |
| 3 | V3 > PAF + (20-PAF) × 0.9 |
| 4 | V3 > PAF + (20-PAF) × 0.85 |
| 6 | V3 > PAF + (20-PAF) × 0.8 |
| 8 | V3 > PAF + (20-PAF) × 0.7 |
| 10 | V3 > PAF + (20-PAF) × 0.6 |
| 15 | V3 > PAF + (20-PAF) × 0.5 |
| 20 | V3 > PAF + (20-PAF) × 0.4 |
| 25 | V3 > PAF + (20-PAF) × 0.3 |

TABLE 4

| display (%) | conversion formula |
|---|---|
| toner out | V3 > PAF + 1.0 |
| 2 | V3 > PAF + 0.95 |
| 3 | V3 > PAF + 0.9 |
| 4 | V3 > PAF + 0.85 |
| 6 | V3 > PAF + 0.8 |
| 8 | V3 > PAF + 0.7 |
| 10 | V3 > PAF + 0.6 |
| 15 | V3 > PAF + 0.5 |
| 20 | V3 > PAF + 0.4 |
| 25 | V3 > PAF + 0.3 |

The Table 3 is a system in which the detected voltage from PAF to blank stripe is divided with a predetermined ratio and is converted, and the relationship between the "ratio" and the "remaining percent (%)" and "conversion formula" is stored. Namely, in the Table 3, although the remaining (%) is determined on the basis of the PAF value depending upon the individual difference of the main body and the ratio between blank stripe voltages, regarding the blank stripe voltage, there are the following cases:

(1) the case where a constant value is used regardless of the individual difference; and (2) the case where the blank stripe voltage is determined in consideration of the individual difference before use.

In the illustrated embodiment, the blank stripe voltage is set to the given value regardless of the individual difference.

The Table 4 shows a system in which the relationship between the difference from the PAF value and the remaining percent (%) is previously determined and the conversion is effected, and the relationship between the "difference" and the "remaining percent (%)" and "conversion formula" stored.

In the illustrated embodiment, the conversion is effected by using the system of the Table 3.

In this way, the illustrated embodiment is characterized in that the successive remaining amount detection is not effected by using the absolute value of the detected voltage value, but the developer remaining amount is detected on the basis of the "detected voltage value V3" including the individual differences of the process cartridge B and the main body 100 using the process cartridge B.

The PAF value is a value including the positional dispersion of the developing roller 5*a* and the plate metal plates 31, 32 presently used and the dispersion in the detecting circuit in the image forming apparatus, and, since the conversion table is formed on the basis of this value, the detection of developer remaining amount with quite less dispersion can be effected.

Now, a method for determining the PAF value in the illustrated embodiment will be explained. The PAF value is a value calculated by the calculation of the "detected voltage value V3" in the area where the "detected voltage value V3" is almost not changed in accordance with the developer remaining amount and is particularly an important value by which the conversion table is altered.

Figure 13:
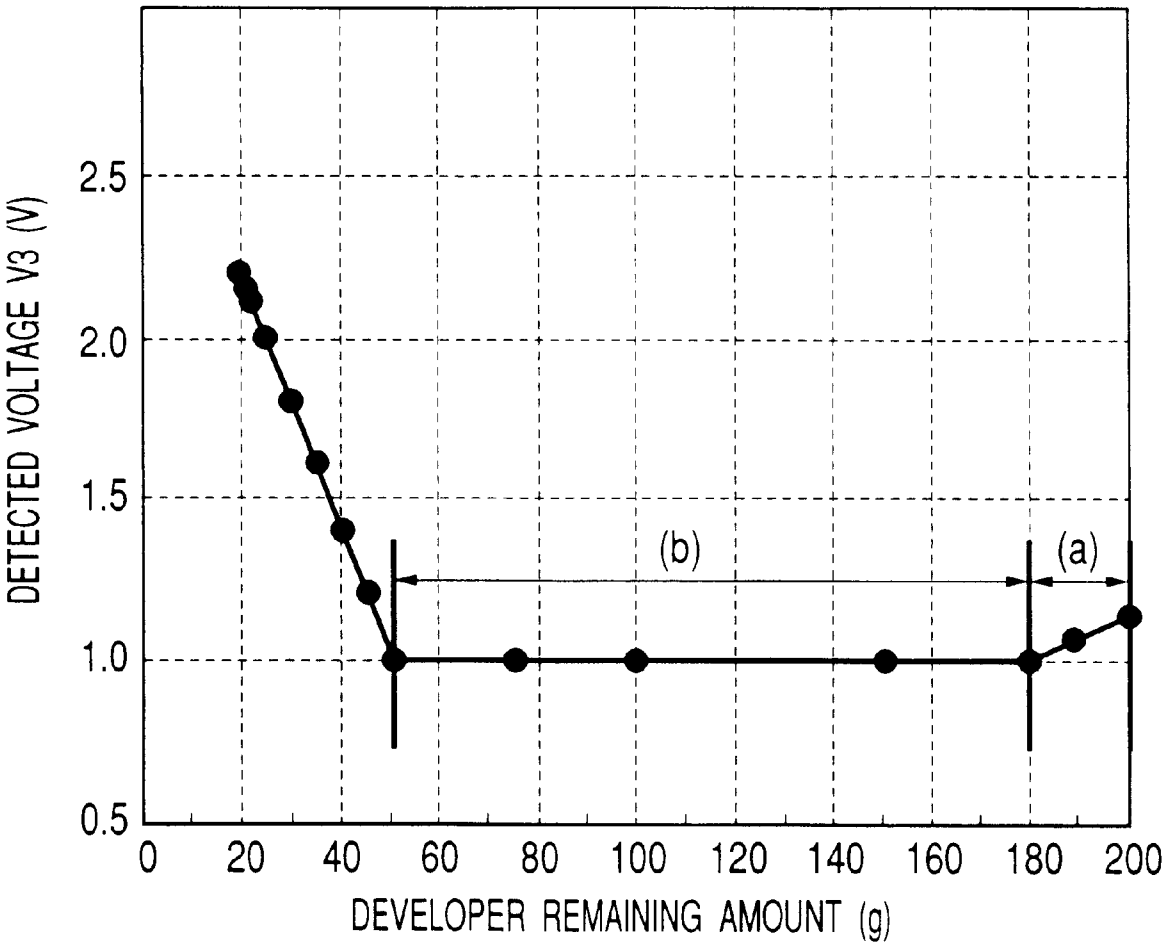
FIG. 13 is a graph showing the relationship between a detected voltage value of a developer amount detecting device constructed in accordance with the present invention and the developer remaining amount.

FIG. 13 shows the transition of the "detected voltage value V3" around the initial usage of the cartridge. The abscissa and the ordinate are the same as those in FIG. 12. As can be seen from FIG. 13, the "detected voltage value V3" has a short falling time (a) from the initial usage and thereafter reaches an equilibrium condition (b). The reason is that a certain time period elapses until the developer enters into a detection sensitive portion of capacitors comprised of the plate metal plates 31, 32 and developing roller 5*a* constituting the developer remaining amount detecting means 30 according to the illustrated embodiment. For this reason, it is not preferable that the "detected voltage value V3" in the initial usage condition where the developer remaining amount is the greatest is used as the PAF value as it is.

Figure 14:
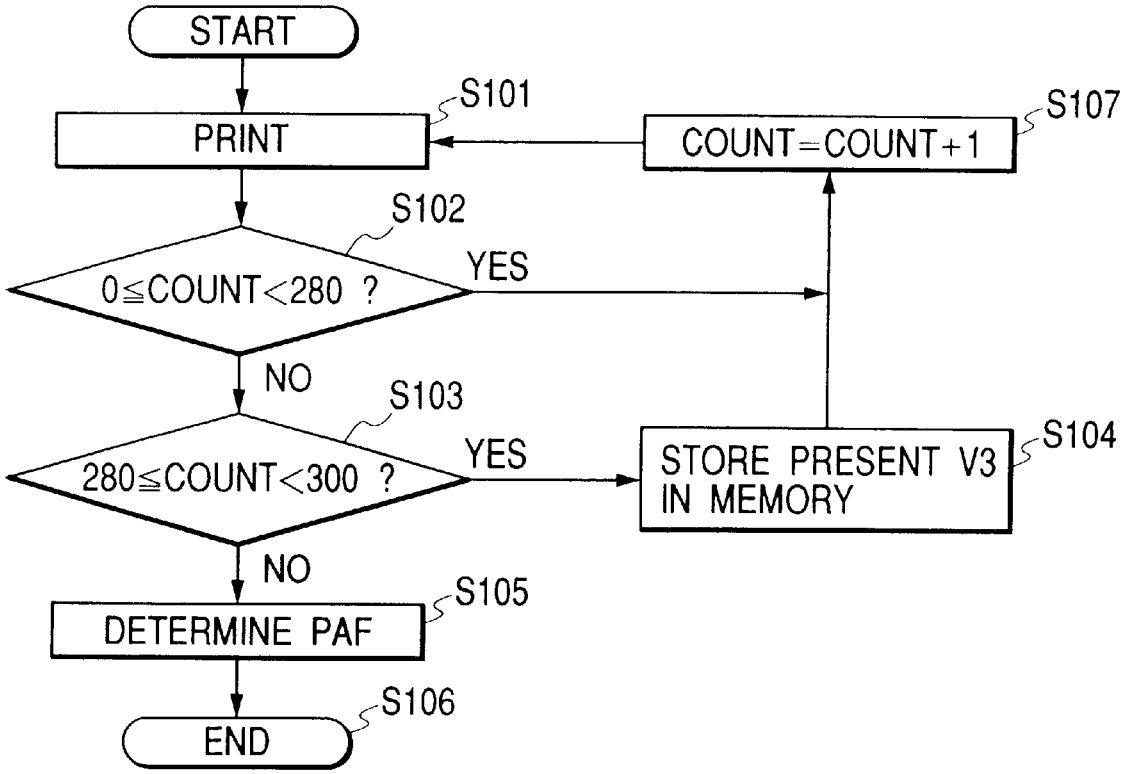
FIG. 14 is a flow chart for explaining a developer amount detecting operation using a developer correction table and memory means of the cartridge according to the third embodiment.

Accordingly, in the illustrated embodiment, the PAF value is stored by using a sequence shown in FIG. 14. Now, the sequence having steps S101 to S106 for seeking the PAF value will be explained.

S101: The image forming apparatus is turned ON (START), and the print is started.

S102: It is judged whether the number of print sheets is not less than 0 and not more than 280.

If YES, the sequence goes to a step S107, where 1 is added to the COUNT for preparing for the next printing operation.

If NO, the sequence goes to a step S103, it is judged whether the COUNT is not less than 280 and not more than 300.

In the step S103, if YES, the sequence goes to a step S104, where the present V3 is stored in the memory 20, and then the sequence goes to the step S107. If NO, the sequence goes to a step S105, where an average of 20 data stored in the memory 20 is sought, and the sought value is determined as the PAF value.

S106: The sequence is ended.

The PAF value is sought by using the above-mentioned sequence. That is to say, the "detected voltage value V3" in the predetermined sheet number period is stored in the memory 20, and the PAF value in consideration of the individual differences of the cartridge B and the main body 100 of the image forming apparatus is obtained by using the average value between these values.

In the illustrated embodiment, the developer amount in the unused condition of the process cartridge B is 200 grams. Since there is a danger of the occurrence of the blank stripe at a time when the remaining amount of the developer in the developing device C reaches below 20 grams, the amount of the developer that can be used actually is 180 grams. Accordingly, on the basis of what percentage (%) of developer remains with respect to the usable developer amount of 180 grams, the developer remaining amount (%) is displayed.

Further, in the illustrated embodiment, due to the arrangement relationship of the developer remaining amount detecting means 30, the detected voltage value obtained by the developer amount detecting device is changed when the remaining amount of the developer becomes about 50 grams (usable developer; 30 grams). Thus, when the remaining amount of the developer is greater than 50 grams, i.e., before the increase in the detected voltage value (reduction in the capacitance) is started, regarding the display of the developer remaining amount (%), for example, "30% or more" or "100%" can be displayed.

Figure 15A:
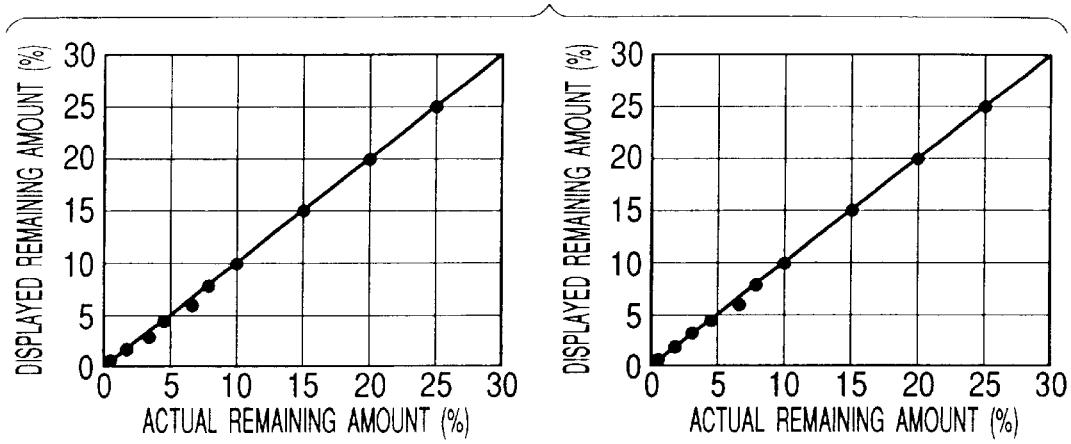
FIGS. 15A, 15B and 15C are graphs for explaining an effect of the developer amount detecting operation according to the present invention.
Figure 15B:
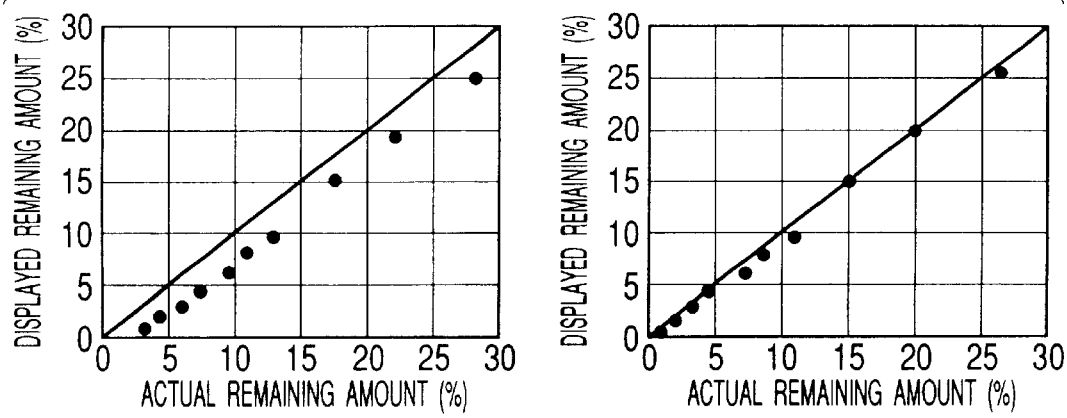
Figure 15C:
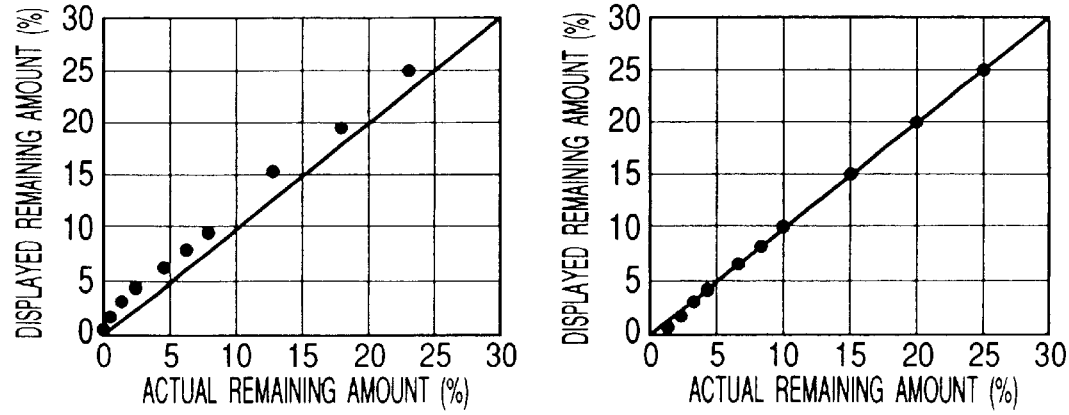

When the developer remaining amount as the developer is consumed was evaluated by using this method, it was found that successive remaining amount detection, while considering the individual differences of the cartridge and the main body of the image forming apparatus, can be effected, as shown in FIGS. 15A to 15C.

FIG. 15A shows a case where the "detected voltage value V3" indicates the ideal value totally, FIG. 15B shows a case where the "detected voltage value V3" is always greater (capacitance is measured to be too small), and FIG. 15C shows a case where the "detected voltage value V3" is always smaller (capacitance is measured to be too great). Further, the left graphs in these figures show a case where the detection is effected by using the absolute value, i.e., a case where the conversion table 25 is not used, and the right graphs in these figures show a case where the detection is effected by using the PAF value according to the illustrated embodiment, i.e., a case where the conversion table 25 is used.

In all of the graphs shown in FIGS. 15A to 15C, the abscissa indicates the "actual developer remaining amount" and the ordinate indicates the "remaining amount (%) displayed by detection", and the nearer the points to the straight line, the greater the detection accuracy.

Incidentally, of course, since the relationship between the developer remaining amount and the detected voltage value is greatly changed in accordance with the construction of the cartridge B, the construction and arrangement of the developer remaining amount detecting means 30 and the kind of developer, the developer conversion table 25 is not limited to that shown in the Table 3, but, the table can be determined appropriately in accordance with the properties of the image forming apparatus and the process cartridge to which the present invention is applied.

Further, in the illustrated embodiment, the resolving power is not constant but is increased as the remaining amount is decreased to, for example, 100%, 30%, 20%, 15%, 10%, 8%, 5%. Naturally, the narrower the distance between the given values, the finer the display of the developer remaining amount.

Further, in the illustrated embodiment, while an example that the developer conversion table 25 is stored in the main body control portion 22 was explained, the table may be stored in the memory 20 of the cartridge B. In this case, since the table depending upon the inherent property of the cartridge can be held in the cartridge itself and be used, the successive remaining amount detection can be effected more correctly in correspondence to various cartridges.

Further, in the illustrated embodiment, while an example that the decrease/increase relationship between the capacitance detected by the developer remaining amount detecting means 30 and the detected voltage ultimately detected by the developer remaining amount detecting device 30 is set to become reverse was explained, such a relationship is varied with the detection circuit provided in the image forming apparatus, and, thus, the relationship between the capacitance and the voltage may be the same decrease function or the same increase function.

Further, the developer remaining amount expressing method is not limited to gram (g) or percentage (%), but, other expressing methods may be used, for example, "how many sheets can be further outputted" may be expressed. Further, regarding the display of the display means, the display by a gas gauge or a line graph, a numerical indication or ratio with respect to the full condition, i.e., the remaining percentage (%) may be used, or other systems may be used so long as the user can know the developer remaining amount.

Furthermore, the display of the developer remaining amount is not necessarily effected by the display means 40 of the main body 100 of the image forming apparatus, but may be effected by display means such as a picture plane of a host computer connected in communication with the main body 100 of the image forming apparatus.

In the illustrated embodiment, while an example that the plate antenna system is used as the developer remaining amount detecting means 30 was explained, the present invention is not limited to the developer remaining amount detecting means of this type, but any system can be used so long as the developer remaining amount level can be detected. Further, while an example that the successive remaining amount detecting means 30 is provided in the developing device was explained, a plurality of detecting means may be provided to enhance accuracy, and thus, for example, remaining amount detecting mechanisms may be provided in the developer containing container 4 so that successive remaining amount detection is effected from the developer full condition to the blank stripe generation.

Further, in the illustrated embodiment, while an example that the average value of the "detected voltage V3" values in the predetermined sheet number period is used as the PAF value was explained, alternatively, even when the following value is used as the PAF value, there is no problem:

(1) the calculated value such as the maximum value among all of the "detected voltage V3" values or an average value of all of the "detected voltage V3" values within the predetermined sheet number period; or (2) the calculated value such as the maximum value, the minimum value or the average value of at least one value measured when the portions relating to the movement of the developer such as the agitating means 15 reach the predetermined number of revolutions.

Fourth Embodiment

Next, a fourth embodiment of the present invention will be explained. In the fourth embodiment, since the constructions of an image forming apparatus and a process cartridge are the same as those of the third embodiment, an explanation thereof will be omitted, and a method for seeking the PAF value which is a characteristic portion of the fourth embodiment will be explained. The fourth embodiment is characterized by a control method for seeking the PAF value more correctly.

In the third embodiment, although the PAF value is sought by storing the predetermined number of "detected voltage V3" values on the basis of the predetermined number of sheets and by calculating such values, this method cannot seek the correct PAF value if the following unstable factor is added to an area ((b) in FIG. 13) where the "detected voltage value V3" is assumed to be stabilized:

(1): When the cartridge B is mounted or dismounted with respect to the main body 100 of the image forming apparatus immediately before a portion where the "detected voltage value V3" is to be detected, i.e., a portion ((b) in FIG. 13) where the change with respect to the developer remaining amount is assumed to be stabilized, the condition of the developer becomes unstable; or (2): When the environment (vibration, temperature, humidity or the like) under which the image forming apparatus is used is greatly changed suddenly, the condition of the developer becomes unstable temporarily.

To avoid this, in the fourth embodiment, successive plural "detected voltage V3" values are averaged to obtain the "detected voltage value V3", and the "detected voltage value V3" is regarded as the detected voltage value at that time and is compared with the PAF value in the memory 20. This operation is effected not only in a predetermined period but also frequently during usage, thereby eliminating the above-mentioned unstable factors.

Figure 16:
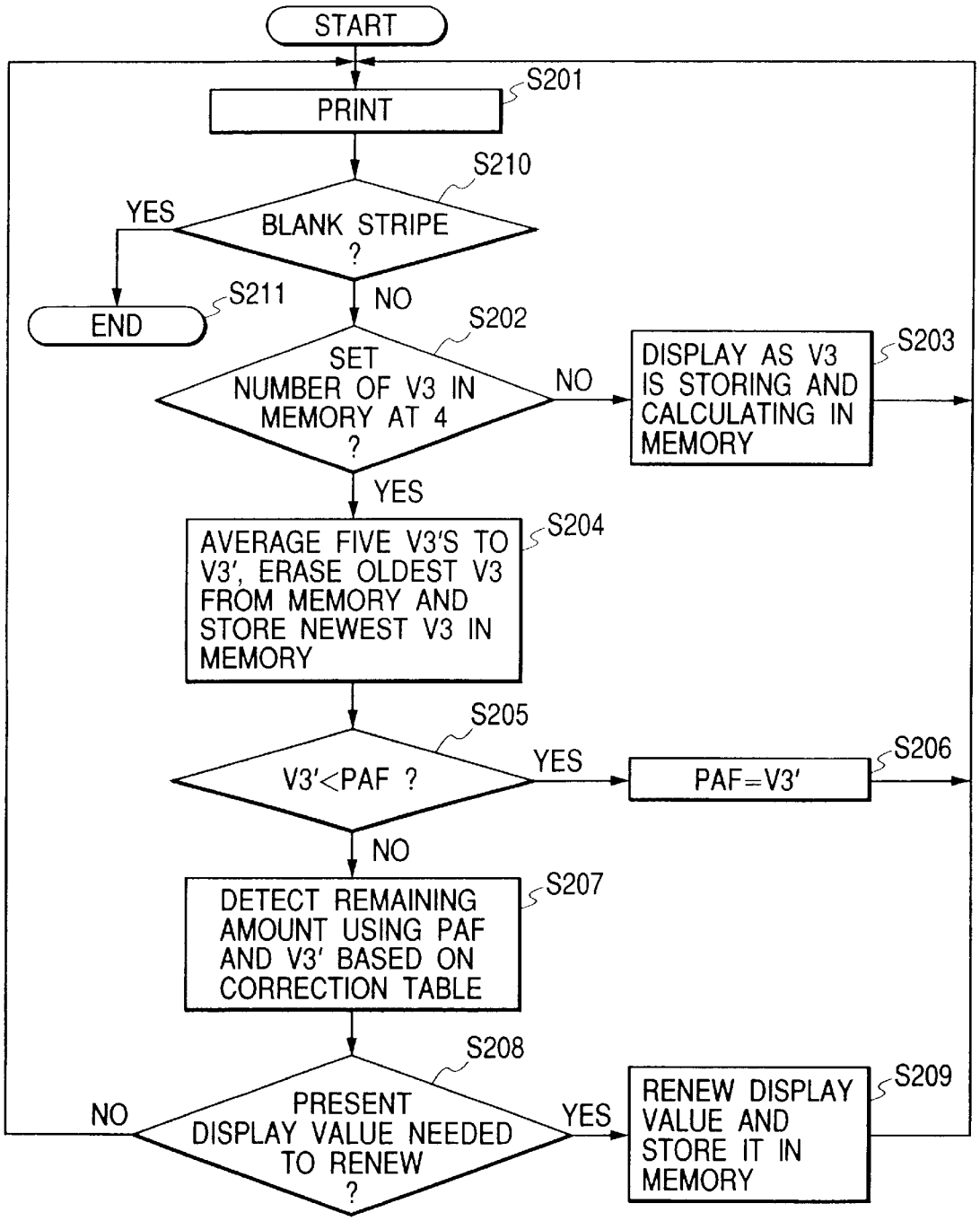
FIG. 16 is a flow chart for explaining a developer amount detecting operation using a developer correction table and memory means of the cartridge according to the fourth embodiment.

Now, a sequence including steps S201 to S211 for seeking the PAF value in the illustrated embodiment will be explained with reference to FIG. 16.

S201: The image forming apparatus is turned ON (START), and the print operation is started.

S210: It is judged whether there is a blank stripe (blank stripe).

If YES, the sequence goes to a step S211, where the sequence is ended.

If NO, the sequence goes to a step S202, where it is judged whether the number of previous "detected voltage V3" values is four or not.

In the step S202, if NO, the sequence goes to a step S203, where the "detected voltage V3" values are stored in the memory 20, and "under calculation" is displayed. If YES, the sequence goes to a step S204, where an average value of the previous four values and the present one value is sought to obtain the "detected voltage value V3". The oldest "detected voltage value V3" is deleted from the memory, and at the same time, the latest "detected voltage value V3" is stored in the memory.

S205: If the PAF value in the memory is greater than the "detected voltage value V3", the sequence goes to a step S206, where the PAF value in the memory is re-written to the present "detected voltage value V3", for preparing for next the print operation.

S205: If the PAF value in the memory is equal to or smaller than the "detected voltage value V3", the sequence goes to a step S207, where the detection of the remaining amount is effected by using the PAF value presently stored and the "detected voltage value V3".

S208: It is judged whether the present display value is needed to renew. If needed, the sequence goes to a step S209, where the display value is renewed, for preparing for the next print operation.

S208: It is judged whether the present display value is needed to renew. If not needed, next print operation is prepared as it is.

By the above method, even if the "detected voltage value V3" enters the unstable condition temporarily, the influence thereof can be suppressed to a minimum, thereby effecting the detection more correctly.

Although the greater the number of values to be averaged, the more correctly the PAF can be sought even if a sudden value is generated, the capacity of the memory is increased accordingly, and a timing for displaying the correct remaining amount is delayed accordingly. For example, even when the "detected voltage value V3" corresponding to the remaining amount of 10% is obtained, since this value and the previous "detected voltage V3" values are now being averaged, "10%" is not displayed for a while. Thus, for example, when a pattern having a high print ratio is outputted, a value greater than the actual remaining amount is always displayed.

In consideration of the above, in the illustrated embodiment, an average value of five "detected voltage V3" values being detected for each sheet (i.e., the present "detected voltage V3" value and four previous "detected voltage V3" values) is used as "detected voltage value V3'".

Thus, if the "detected voltage value V3" becomes abnormal suddenly, the influence thereof can be suppressed to a minimum and the capacity of the memory can be minimized, and the display of the remaining amount can be prevented from being delayed extremely.

In the illustrated embodiment, while an example that the value obtained by averaging five "detected voltage V3" values is used was explained, the present invention is not limited to such an example, but, in accordance with the vacant capacity in the memory and/or the required detection accuracy, the optimum number of values to be averaged can be varied.

Further, as another method, a maximum value and a minimum value are removed from the previous five "detected voltage V3" values and the remaining three values may be averaged. In this case, the same effect can be achieved.

Further, by storing the PAF value in the memory 20 of the process cartridge B, even in a case where the cartridge B is dismounted from the main body 100 of the image forming apparatus, when the same cartridge B is again used later, by reading the information stored in the memory by the main body 100 of the image forming apparatus, the relationship between the developer remaining amount and the capacitance (detected voltage) can be corrected in accordance with the individual cartridge, thereby always detecting the developer remaining amount correctly.

Fifth Embodiment

Next, a fifth embodiment of the present invention will be explained. In the fifth embodiment, since the constructions of an image forming apparatus and a process cartridge are the same as those of the third embodiment, an explanation thereof will be omitted, and a method for seeking the PAF value which is a characteristic portion of the fifth embodiment will be explained. The fifth embodiment is characterized by a control method for seeking the PAF value more accurately.

In the fourth embodiment, while an example that the memory 20 is provided on the cartridge B and the previous plural "detected voltage V3" values are averaged by using the memory 20 and the averaged value is compared with the PAF value stored in the memory was explained, as described in the fourth embodiment, as the case may be, there is a problem that the "timing for displaying the correct remaining amount is delayed".

Accordingly, in the fifth embodiment, the average value is not merely used, but the successive detection of the remaining amount is effected also in consideration of the transition of the previous "detected voltage V3" values (increase tendency or decrease tendency).

Figure 17:
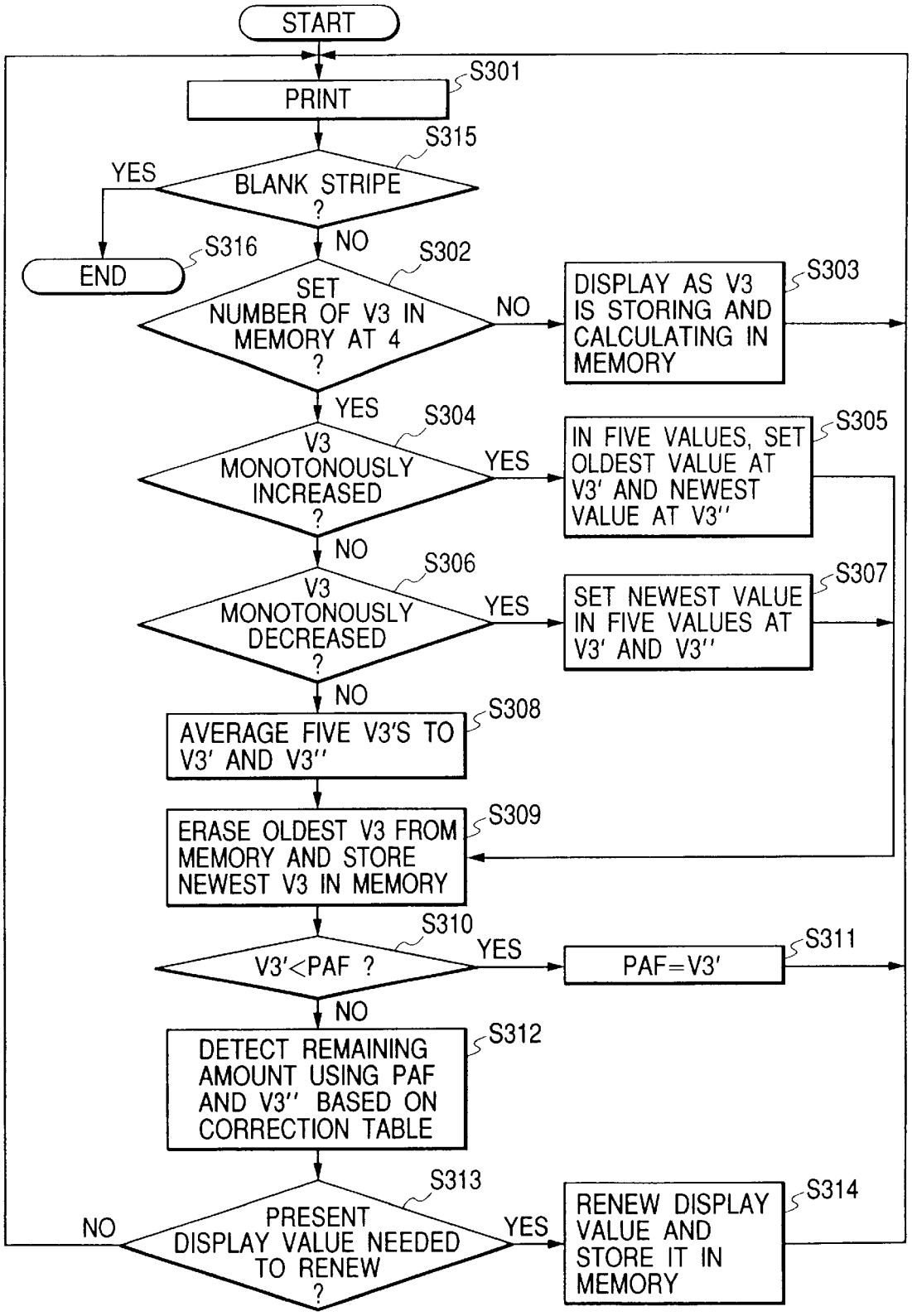
FIG. 17 is a flow chart for explaining a developer amount detecting operation using a developer correction table and memory means of the cartridge according to the fifth embodiment.

Now, a sequence having steps S301 to S315 for seeking the PAF value in the illustrated embodiment will be explained with reference to FIG. 17.

S301: The image forming apparatus is turned ON (START), and the print operation is started.

S315: It is judged whether there is blank stripe.

If YES, the sequence goes to a step S316, where the sequence is ended.

If NO, the sequence goes to a step S302, where it is judged whether the number of previous the "detected voltage V3" values is four or not. In the step S302, if NO, the sequence goes to a step S303, where "detected voltage V3" values are stored in the memory 20 and "under calculation" is displayed, thereby preparing for the next print operation. If YES, the sequence goes to a step S304, where it is judged whether the previous four values and the present one value (five in total) are monotonously increased.

In the step S304, if YES, the sequence goes to a step S305, where the oldest value among the five V3 values is set to V3' and the latest value is set to V3", and then, the sequence goes to a step S309. If NO, the sequence goes to a step S306, where it is judged whether the previous four values and the present one value (five in total) are monotonously decreased.

In the step S306, if YES, the sequence goes to a step S307, where the latest value among the five V3 values is set to V3' and the oldest value is set to V3", and then, the sequence goes to the step S309.

In the step S306, if NO, the sequence goes to a step S308, where the previous four values and the present one value (five in total) are averaged to V3' and V3", and then, the sequence goes to the step S309.

S309: The oldest "detected voltage value V3" is deleted from the memory, and at the same time, the latest "detected voltage value V3" is stored in the memory.

S310: If the PAF value in the memory is greater than the "detected voltage value V3'", the sequence goes to a step S311, where the PAF value in the memory is re-written to the present "detected voltage value V3'", for preparing for the next print operation.

S310: If the PAF value in the memory is equal to or smaller than "detected voltage value V3'", the sequence goes to a step S312, where the detection of the remaining amount is effected by using the PAF value presently stored and the "detected voltage value V3'".

S313: It is judged whether the present display value is needed for renewal. If needed, the sequence goes to a step S314, where the display value is renewed, for preparing for the next print operation.

S313: It is judged whether the present display value is needed for renewal. If not needed, the next print operation is prepared as it is.

In the illustrated embodiment, if the plural "detected voltage V3" values are monotonously increased, there is the possibility that the developer remaining amount reaches a detection and display permitting condition, and, accordingly, in order to prevent the display from being delayed from the actual state, the detection of the remaining amount is effected by using the latest value, i.e., the "detected voltage value V3 (5)".

Further, since there is the possibility that the "detected voltage value V3" is near the PAF value, in the illustrated embodiment, the first or oldest "detected voltage value V3 (1)" among the plural "detected voltage V3" values is compared with the PAF value.

Further, in the illustrated embodiment, while an example that the first "detected voltage value V3 (1)" is compared with the PAF value was explained, the average value or the latest "detected voltage value V3 (5)" may be compared with the PAF value.

According to this method of the illustrated embodiment, if the "detected voltage value V3" becomes a sudden value, the influence thereof can be suppressed, and the correct "detected voltage value V3" can be sought more quickly.

Sixth Embodiment

Next, a sixth embodiment of the present invention will be explained. In the sixth embodiment, since the constructions of an image forming apparatus and a process cartridge are the same as those of the third embodiment, an explanation thereof will be omitted, and a method for seeking the PAF value which is a characteristic portion of the sixth embodiment will be explained.

In the fourth and fifth embodiments, while an example that the memory 20 is provided on the cartridge B and the previous plural "detected voltage V3" values are stored and averaged by using the memory so that even if the sudden value is generated the influence thereof can be suppressed was explained, in the above arrangements, there is a disadvantage that the capacity of the memory is increased.

To avoid this, in the illustrated embodiment, if the change is greater than a predetermined value (0.1 V in the illustrated embodiment), such change is regarded as a normal value, and, at that time, the sequence is ended without comparing it with the PAF value in the memory and/or without effecting the detection of the remaining amount.

The abnormal value may continue during the printing of the predetermined number of sheets or during the operation of the cartridge for a predetermined period. Accordingly, when it is judged that the abnormal value is generated, the calculation for detection of the developer remaining amount is not effected during the printing of the predetermined number of sheets (for example, about 10 sheets) or during the operation of the cartridge for the predetermined period, and the printing operation is continued. In this case, the developer remaining amount can be detected more accurately.

Further, in the illustrated embodiment, since if the predetermined amount (0.1 V) is too great, it can merely cope with a relatively great sudden value alone and since if the predetermined value is too small it cannot be discriminated whether there is a true change (generated, for example, when the pattern having high print ratio is printed) or a sudden value, it is required that the predetermined value be corrected to an optimum value in accordance with the construction.

Figure 18:
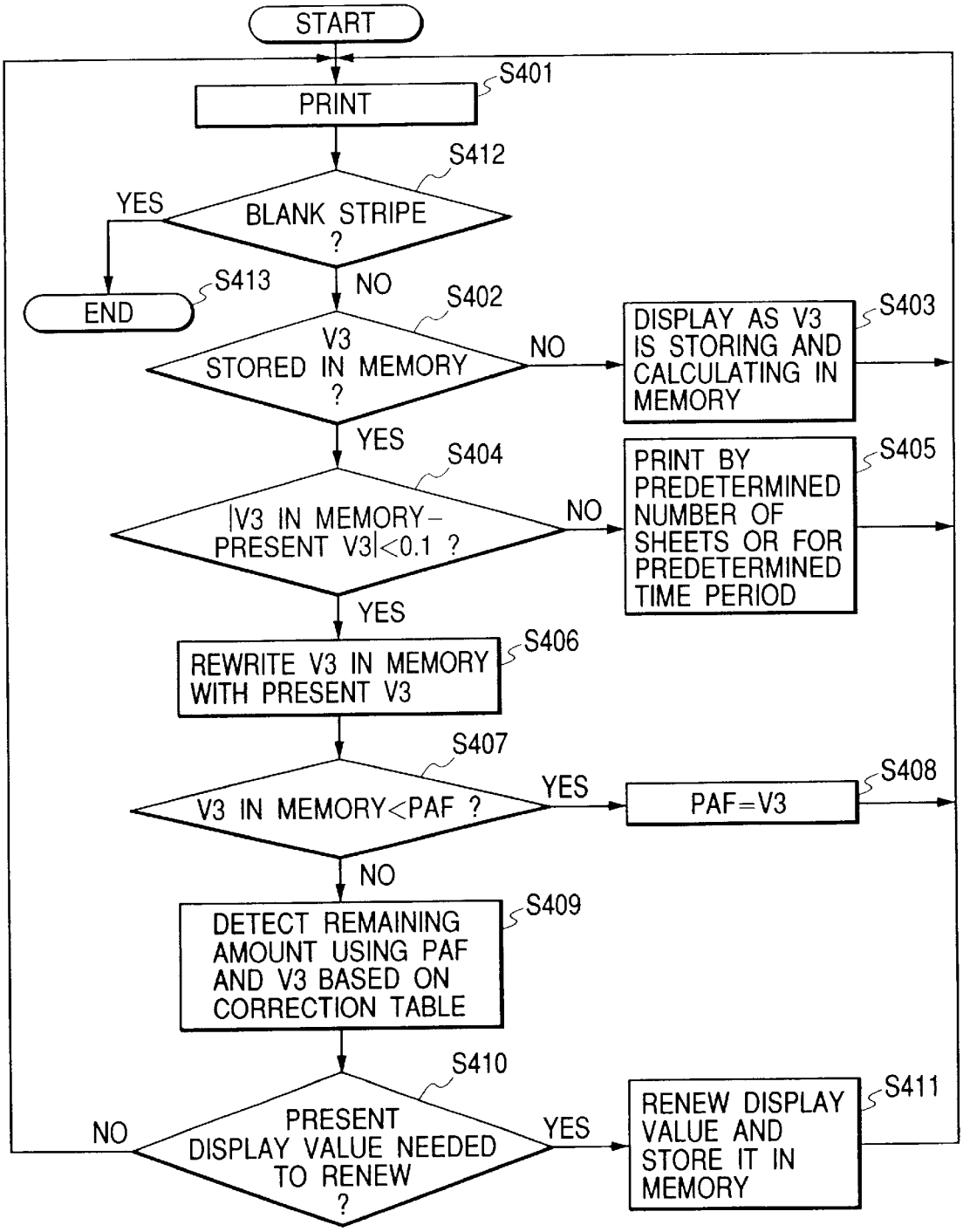
FIG. 18 is a flow chart for explaining a developer amount detecting operation using a developer correction table and memory means of the cartridge according to the sixth embodiment.

Now, a sequence having steps S401 to S413 according to the illustrated embodiment will be explained with reference to FIG. 18.

S401: The image forming apparatus is turned ON (START), and the print operation is started.

S412: It is judged whether there is blank stripe.

If YES, the sequence goes to a step S413, where the sequence is ended.

If NO, the sequence goes to a step S402, where it is judged whether the detected voltage value V3 is stored in the memory 20. If NO, the sequence goes to a step S403, where the "detected voltage value V3" is stored in the memory 20 and "under calculation" is displayed, thereby preparing for the next print operation. If YES, the sequence goes to a step S404, where it is judged whether a difference between the V3 value in the memory and the present V3 value is smaller than 0.1 (not including 0.1).

In the step S404, if NO, the sequence goes to a step S405, where the calculation for detection of the developer remaining amount is not effected during the predetermined print sheet number time period or the predetermined operating time period of the cartridge, and then, the sequence goes to the step S401, where the print operation is effected.

In the step S404, if YES, the sequence goes to a step S406, where the V3 value in the memory is re-written to the present V3 value.

S407: It is judged whether the present PAF value is smaller than the "detected voltage value V3" in the memory.

If YES, the sequence goes to a step S408, where the PAF value in the memory is re-written to the present "detected voltage value V3", for preparing for the next print operation.

If NO, the sequence goes to a step S409, where detection of the remaining amount is effected by using the PAF value presently stored and the "detected voltage value V3".

S410: It is judged whether the present display value is needed for renewal. If needed, the sequence goes to a step S411, where the display value is renewed, for preparing for the next print operation.

S410: It is judged whether the present display value is needed for renewal. If not needed, the next print operation is prepared as it is.

In the method according to the illustrated embodiment, since the memory 20 has only the capacity capable of storing the preceding "detected voltage value V3" for comparison, the capacity of the memory can be reduced in comparison with the fourth and fifth embodiments.

Seventh Embodiment

Next, a seventh embodiment of the present invention will be explained. In the seventh embodiment, since the constructions of an image forming apparatus and a process cartridge are the same as those of the third embodiment, an explanation thereof will be omitted, and a method for seeking the PAF value, which is a characteristic portion of the seventh embodiment, will be explained.

In the third to sixth embodiments, while an example that the memory 20 is provided on the cartridge B and the previous plural "detected voltage V3" values are stored in the memory and a value for converting the conversion table is determined by calculating these values was explained, the seventh embodiment is characterized in that, if it is judged that the "detected voltage value V3" is almost not changed for a predetermined period, that value is used as a value for converting the conversion table.

Figure 19:
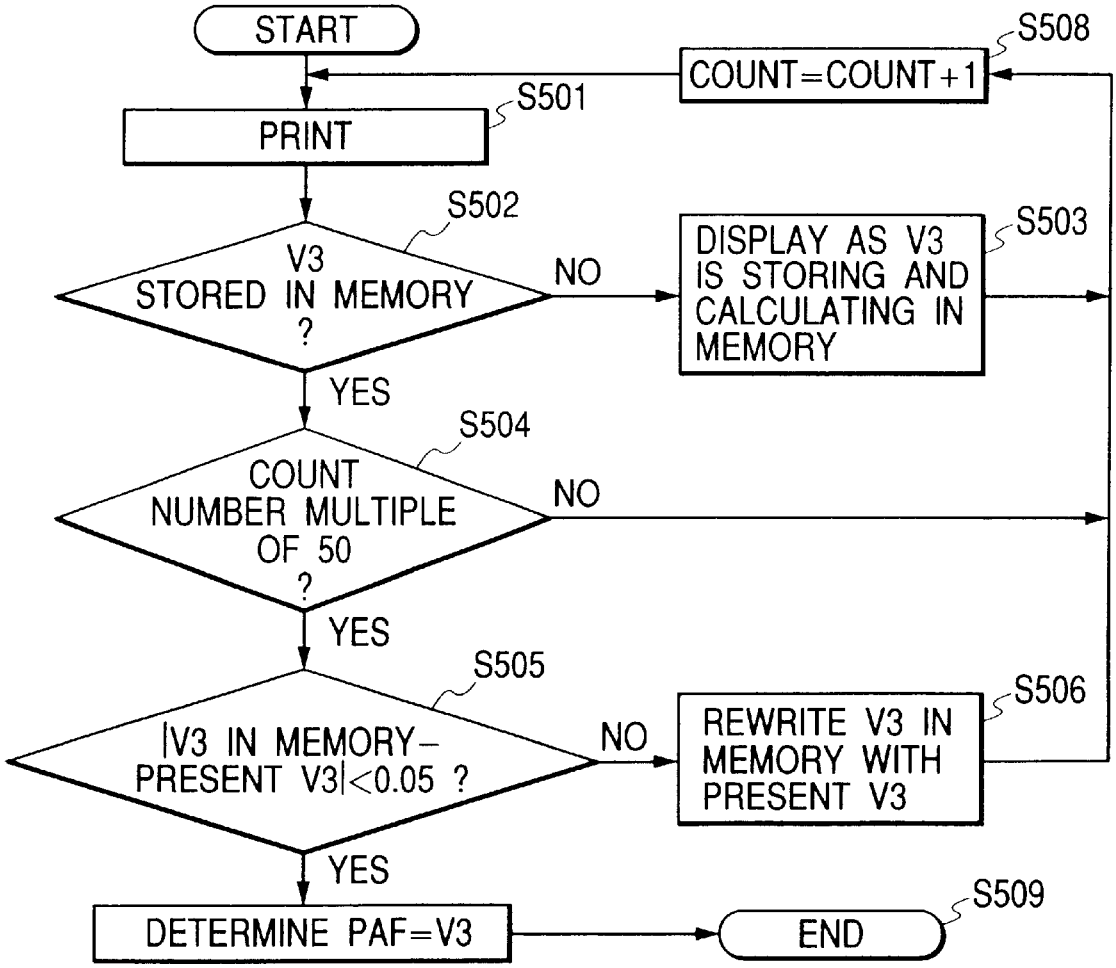
FIG. 19 is a flow chart for explaining a developer amount detecting operation using a developer correction table and memory means of the cartridge according to the seventh embodiment.

Now, a sequence having steps S501 to S509 according to the illustrated embodiment will be explained with reference to FIG. 19.

S501: The image forming apparatus is turned ON (START), and the print operation is started.

S502: It is judged whether "detected voltage value V3" is stored in the memory 20.

If NO, the sequence goes to a step S503, where the "detected voltage value V3" is stored in the memory 20 and "under calculation" is displayed, and then, the sequence goes to a step S508, where 1 is added to COUNT, thereby preparing for the next print operation.

If YES, the sequence goes to a step S504, where it is judged whether the count number is a multiple of 50. In the step S504, if NO, the sequence goes to the step S508, where 1 is added to COUNT, thereby preparing for the next print operation. In the step S504, if YES, the sequence goes to the step S505, where it is judged whether the difference between the V3 value in the memory and the present V3 value is not more than 0.05 (not including 0.05).

In the step S505, if NO, the sequence goes to the step S506, where the V3 value in the memory is re-written to the present V3 value. Then, the sequence goes to the step S508, where 1 is added to COUNT, thereby preparing for the next print operation.

In the step S505, if YES, the sequence goes to the step S507, where the PAF value is determined, and then, the sequence goes to the step S509, where the sequence is ended END.

In the method according to the illustrated embodiment, since the memory has only the capacity capable of storing the preceding "detected voltage value V3" for comparison, the capacity of the memory can be reduced in comparison with the fourth and fifth embodiments.

Further, in the illustrated embodiment, while an example that the V3 values are compared every 50 sheets and once the difference is 0.05 V, that value is used as the PAF value was explained, the construction or arrangement at that time determines the measuring sheet number interval or the difference value, or how many times the difference should be contained within the predetermined range continuously, or which values obtained by calculation of the plural values should be selected as the PAF value.

Further, in the illustrated embodiment, while an example that the V3 values are compared for every predetermined sheet numbers was explained, for example, the V3 values may be compared every predetermined operating time periods of the process cartridge or every predetermined light emitting time periods of the laser.

Eighth Embodiment

Figure 20:
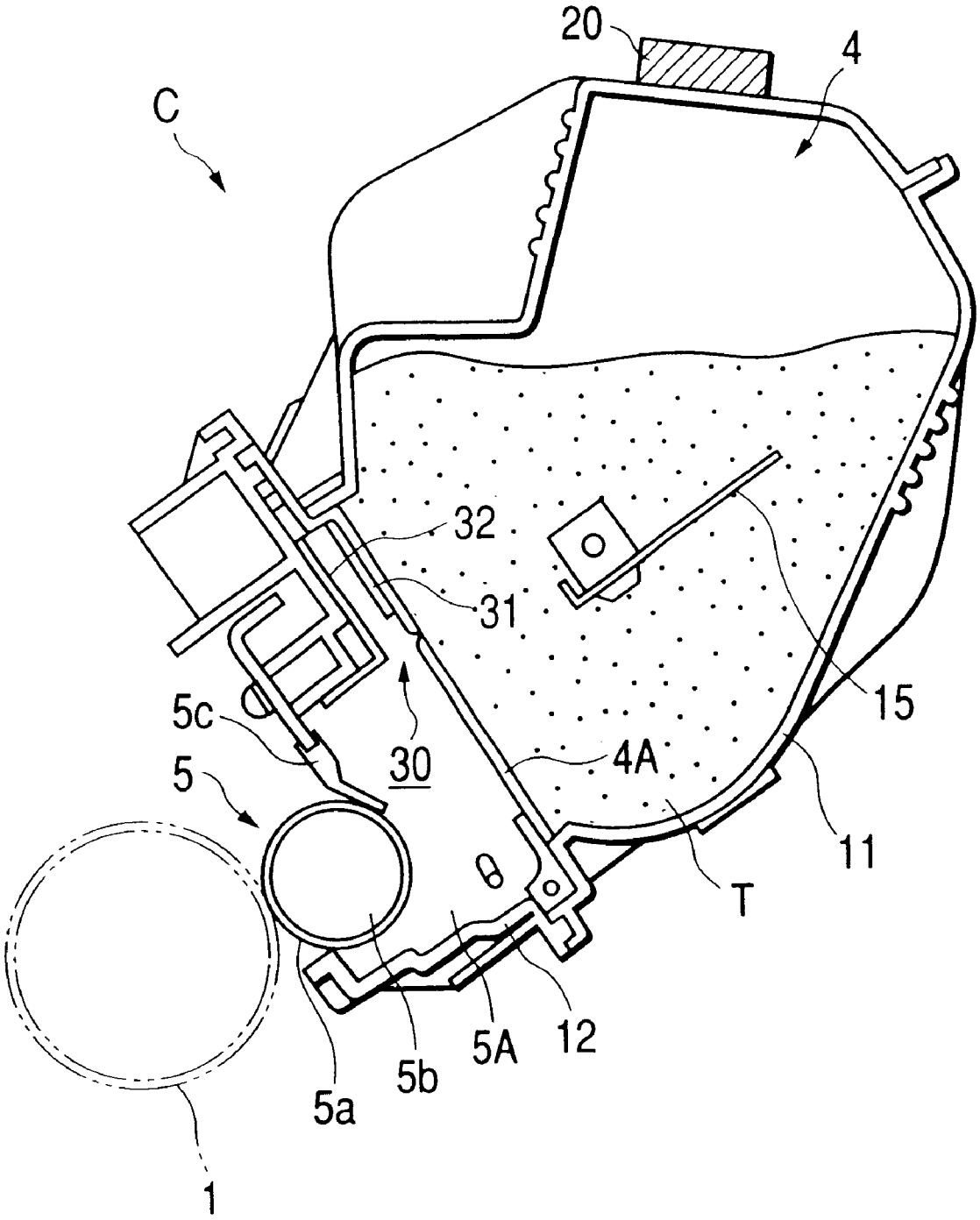
FIG. 20 is a sectional view of a developing device as a cartridge according to the eighth embodiment.

FIG. 20 shows a developing device C as a cartridge according to an eighth embodiment of the present invention.

The developing device C according to the eighth embodiment includes a developer bearing member such as a developing roller 5*a*, and a developing room 5A containing developer to be supplied to the developer bearing member, and is constituted as a cartridge by integrally welding plastic developing frames 11, 12. Namely, in the developing device C according to this embodiment, the developing device constituting parts in the process cartridge B described in connection with the first embodiment are integrated as a unit; that is to say, it is considered that parts other than the photosensitive drum 1, the charging means 2 and the cleaning means 7 of the process cartridge B are integrated as a unit.

Accordingly, all of the developing device constituting parts and the construction of the developer amount detecting device explained in connection with the third to seventh embodiments can similarly be applied to the developing device C according to the eighth embodiment. Therefore, an explanation of such parts and construction and their functions will be omitted.

Also with this arrangement, a similar technical effect to those of the third to seventh embodiments can be achieved.

Ninth Embodiment

Next, a detecting principle of the developer remaining amount in a developer amount detecting device according to a ninth embodiment of the present invention will be explained. Incidentally, since the mechanical constructions of a printer body and a cartridge are substantially the same as those in the first embodiment, FIGS. 1 and 2 are used for explaining such constructions.

In the ninth embodiment, as mentioned above, the capacitance value detected by the developer remaining amount detecting means 30 is inputted to the main body side developer remaining amount detecting portion 23 of the main body control portion 22 (FIG. 21) and is converted into the voltage value (hereinafter, the voltage value detected by the main body control portion 22 of the main body 100 of the image forming apparatus on the basis of the output of the developer remaining amount detecting means 30 is referred to merely as the "detected voltage value").

Figure 22:
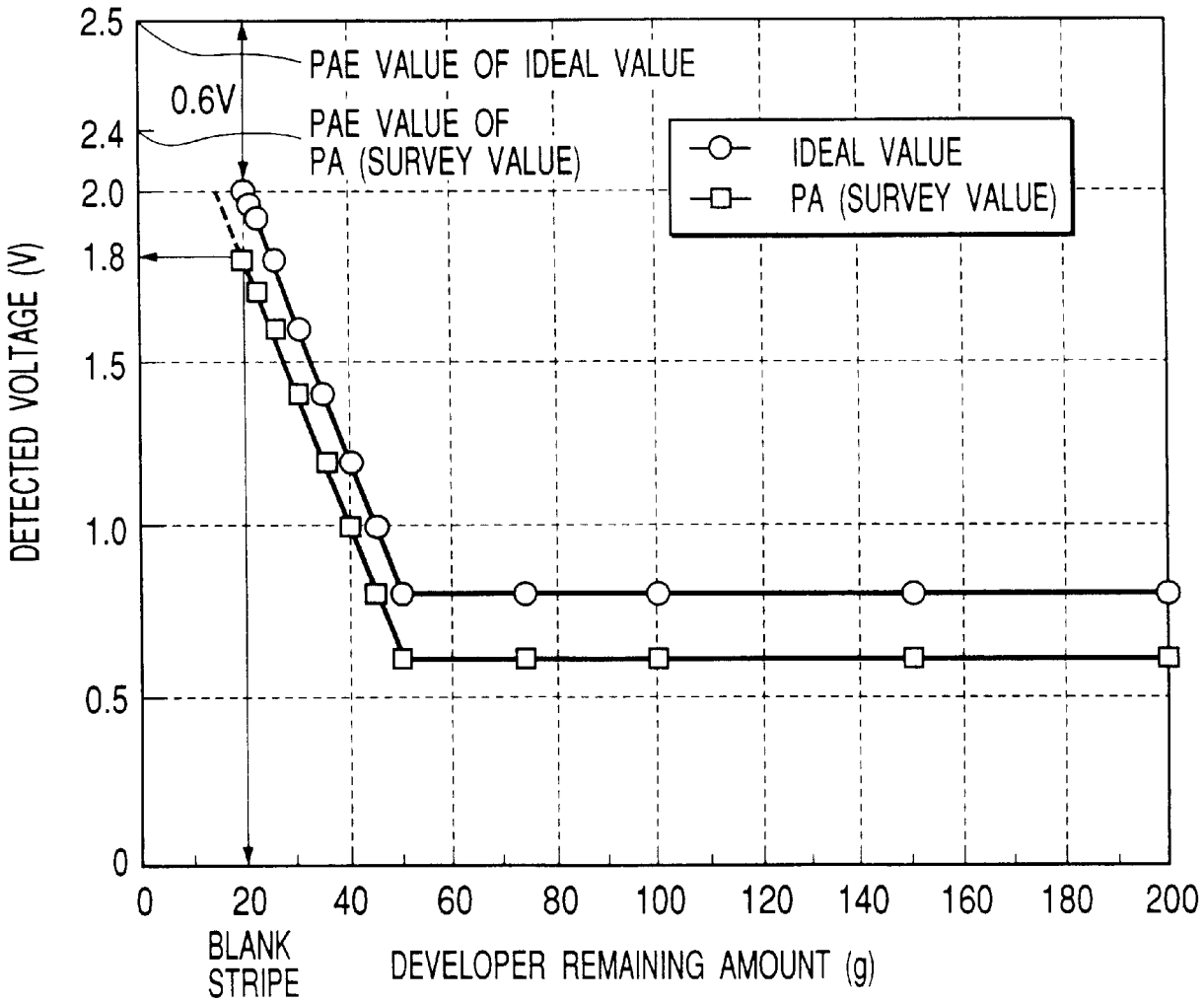
FIG. 22 is a graph showing the relationship between the detected voltage value of the developer amount detecting device constructed in accordance with the present invention and the developer remaining amount.

In the developer amount detecting device according to the illustrated embodiment, in accordance with the developer amount in the developing device C, for example, the voltage value as shown in FIG. 22 is outputted. In FIG. 22, the ordinate indicates a detected voltage value corresponding to a value which is the sum of the capacitance value measured between the developing roller 5*a* and the output metal plate 32 as the developer remaining amount detecting means 30 and the capacitance value measured between the input metal plate 31 and the output metal plate 32, and the abscissa indicates a remaining amount of the developer in the developing device C. Further, FIG. 22 shows an ideal curve (-o-) of the detected voltage value detected by the developer amount detecting device, and a survey value PA (-□-) as an example that the detected voltage value deviates from the ideal value due to an individual or inherent difference of the cartridge as will be described later. Here, in the illustrated embodiment, from a relationship of the conversion circuit, as shown in the following relationship:

(capacitance, detected voltage)=(13 pF, 1.0 V), (18 pF, 0.8 V)

a decrease/increase relationship between the resultant capacitance (obtained by combining the capacitance between the developing roller 5*a* and the output metal plate 32 and the capacitance between the input metal plate 31 and the output metal plate 32) and the detected voltage has a reverse relationship, so that, when the capacitance detected by the developer remaining amount detecting means 30 is great, the detected voltage becomes small, and when the capacitance is small, the detected voltage becomes great.

Namely, under a condition that there is no developer between the developing roller 5*a* and the output metal plate 32 and between the input metal plate 31 and the output metal plate 32, the detected capacitance values show minimum values, and, in this case, the detected voltage values show maximum values (the detected voltage value corresponding to the output of the developer remaining amount detecting means under the condition that the developer is not loaded in the developing device C is referred to as "PAE value (plate antenna empty value)" hereinafter).

Incidentally, in the illustrated embodiment, since the developing roller 5*a*, the output metal plate 32 located relatively near the developing roller 5*a*, and the input metal plate 31 located relatively near the output metal plate 32 are used as the developer remaining amount detecting means 30, in an arrangement relationship of the developer remaining amount detecting means 30, as shown in FIG. 22, when the developer within the developing device C is consumed to be half or lower, an increase of the detected voltage value is started, and, thereafter, the reduction of the developer remaining amount can be detected successively until the developer is used up. With this arrangement, detection accuracy of the developer remaining amount at a specific location within the developing device C is enhanced, with the result that the developer remaining amount can be detected with high accuracy. However, the present invention is not limited to this example, but, as the developer remaining amount detecting means 30, an input side electrode and an output side electrode constituted by a plate antenna as is in the illustrated embodiment may be located at any positions within the developing device and, by measuring the capacitance between the electrodes, the remaining amount of the developer may be detected successively within a range from when much of the developer remains to when the developer is used up.

As mentioned above, in the developer remaining amount detecting means 30 of the plate-antenna type, the capacitance between the developer roller 5*a* and the output metal plate 32 as the electrode or the capacitance between the metal plates 31, 32 as the electrodes depends upon the respective positional relationship, with the result that there may be dispersion in the detected voltage value due to individual differences in different process cartridges B, such as dispersion in the assembling tolerance of the plate antenna. Further, dispersion in the detected voltage value occurs due to the tolerance of parts of the cartridge and the tolerance of electronic parts of the main body of the image forming apparatus.

Further explaining, as the individual difference of the cartridge, for example, as shown in FIG. 22, the maximum value (PAE value) of the detected voltage value is different between the ideal value (-o-) and the survey value (-□-) under the condition that there is no developer between the developing roller 5*a* and the output metal plate 32, and between the input metal plate 31 and the output plate 32 is differentiated due to deviation in the positional relationship of the antenna plate.

That is to say, between the ideal value (-o-) and the survey value PA (-□-), for example, although the PAE value is 2.6 V in the ideal value, the PAE value becomes 2.4 V in the survey value PA.

As can be understood from FIG. 22, even when the dispersion in the detected voltage occurs in this way, in any case, the curve configuration showing the relationship between the detected voltage and the developer remaining amount is not changed so long as the amount of the developer contained in the developing device C is identical, and, due to various factors as mentioned above, the detected voltage value is relatively deviated from the ideal curve (-o-), as the survey value PA (-□-) shown in FIG. 22.

The following Table 5 shows data regarding the developer remaining amounts and detected voltage in the ideal value (-o-) and the survey value PA (-□-) shown in FIG. 22.

TABLE 5

| deloveloper remaining amount (g) | Ideal value (V) | PA (V) (survey value) |
|---|---|---|
| 0 | — | — |
| 10 | — | — |
| 20 | 2.0 | 1.8 |
| 21 | 2.0 | 1.8 |
| 22 | 1.9 | 1.7 |
| 25 | 1.8 | 1.6 |
| 30 | 1.6 | 1.4 |
| 35 | 1.4 | 1.2 |
| 40 | 1.2 | 1.0 |
| 45 | 1.0 | 0.8 |
| 50 | 0.8 | 0.6 |
| 75 | 0.8 | 0.6 |
| 100 | 0.8 | 0.6 |
| 150 | 0.8 | 0.6 |
| 200 | 0.8 | 0.6 |

In this way, since there is a deviation in the detected voltage value due to individual difference in process cartridges based on various factors, when the developer remaining amount level is detected by using a pre-set relationship between the detected value of the capacitance (detected voltage value) and the developer amount, the developer amount actually remaining in the device C may deviate from the detected result.

Namely, if the developer remaining amount is determined only on the basis of the ideal curve representive of the relationship between the developer remaining amount and the detected voltage as shown in FIG. 22 and the Table 5, for example, when developer remaining amount detecting means in which the PAE value has an output property (2.4 V) smaller than the ideal value (2.6 V) as shown by the survey value (-□-) are used, if the developer amount is sought on the basis of the ideal curve (-o-), the developer amount will be estimated to be greater than the actual one.

As, a result, for example, in a case where it is assumed that there is a danger of the occurrence of a so-called blank stripe (i.e., a condition that a poor image is generated due to the fact that the entire area cannot be visualized) at a time when the remaining amount of the developer becomes 20 grams, in order to ensure that the alarm is emitted before the blank stripe is generated, at time when the detected voltage value becomes 2.0 V smaller than the PAE value (2.6 V) by 0.6 V in the ideal curve, the warning "absence of developer" can be displayed. In this case, in spite of the fact that the blank-stripe image is actually generated when the detected voltage value is 1.8 V (a value smaller than 2.4 V (PAE value) by 0.6 V) in the survey value PA, if the developer remaining amount is determined only by the ideal curve, the fact that the detected voltage value is 1.8 V indicates the fact that 25 grams of developer remains with the result that the warning is not displayed until the detected voltage value becomes 2.0 V. Thus, in this case, the blank stripe image may be outputted before the warning is given to the user.

On the other hand, in a case where developer remaining amount detecting means, in which the PAE value has an output property greater than the ideal curve (-o-), are used, contrary to the above, if the developer remaining amount is determined on the basis of the relationship between the developer remaining amount and the detected voltage value shown by the ideal curve, the developer amount will be estimated to be smaller than the actual one. Thus, if the alarming timing of the warning "absence of developer" (there is the danger of the occurrence of the blank stripe image) is set on the basis of the ideal curve as mentioned above, at a time when the warning is displayed, much developer remains in the developing device C, thereby discarding the developer in vain.

Figure 21:
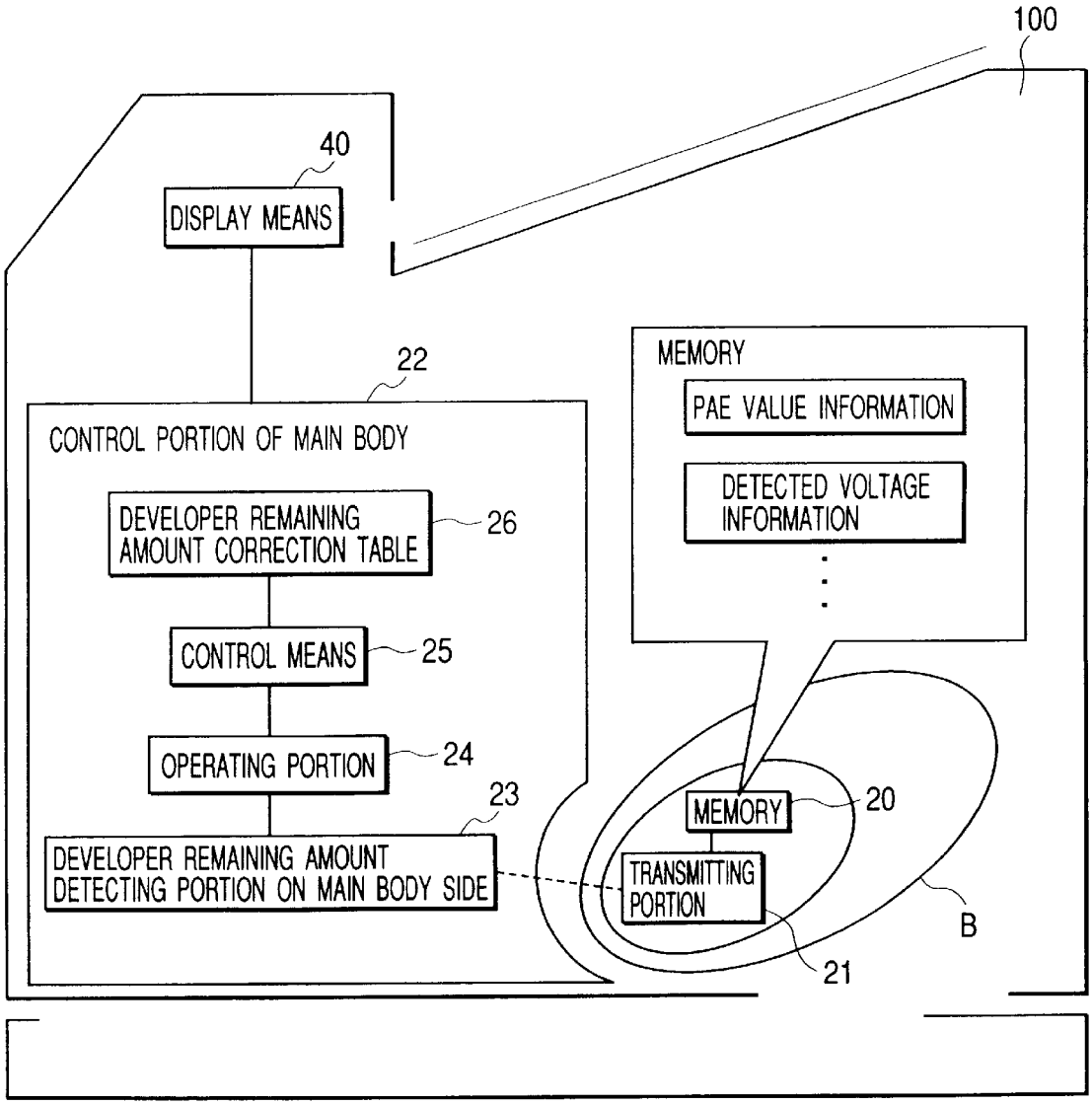
FIG. 21 is a schematic view showing the relationship between a cartridge according to a ninth embodiment of the present invention and a main body of an image forming apparatus, for explaining a control arrangement of a memory of the cartridge.

To avoid this, according to the present invention, as shown in FIGS. 1, 2 and 21, memory means 20 are provided on the process cartridge B, and memory means 20 is provided on the process cartridge B, and, by storing information corresponding to the output of the developer remaining amount detecting means 30 under the condition that the developer is not loaded in the developing device C in the memory means 20, even if the output of the developer remaining amount detecting means 30 under the condition that the developer is not loaded in the developing device C is different due to individual differences of different process cartridges B, such a difference can be corrected, thereby achieving the correct detection of the developer remaining amount.

That is to say, more specifically, according to the illustrated embodiment, the following control is effected:

(1) The process cartridge B is provided with the memory means 20, and the detected voltage value, i.e., the PAE value of the developer remaining amount detecting means 30, measured by a tool and the like in the condition that the developer is not loaded in the developing device C at the manufacture of the process cartridge B is written in the memory means 20 provided on the process cartridge B.

(2) The developer remaining amount is calculated by utilizing the developer remaining amount correction table in accordance with the changed amount of the detected voltage value from the PAE value, by using the PAE value stored in the memory means 20.

(3) The result is displayed on the display means 40 at any time.

In this way, the individual differences of the cartridges can be compensated for, thereby effecting more correct developer remaining amount detection successively.

First of all, the memory means 20 provided on the process cartridge B will be explained. As shown in FIGS. 1 and 2, according to the illustrated embodiment, the process cartridge B has a read/write memory 20 as the memory means 20 provided on an upper surface of the waste-developer container 7*b*, and a cartridge side transmitting portion 21 for controlling the reading/writing of information with respect to the memory 20. When the process cartridge B is mounted to the main body 100 of the image forming apparatus, the cartridge side transmitting portion 21 is opposed to the main body control portion 22 of the main body 100 of the image forming apparatus. Further, the main body control portion 22 includes a function as transmitting means of the main body 100 of the apparatus.

In the illustrated embodiment, although the memory 20 is provided on the upper surface of the waste developer container 7*b*, this is designed in consideration of the fact that, in the laser beam printer A according to the illustrated embodiment, since the process cartridge B is inserted into the main body 100 of the image forming apparatus with the waste developer container 7*b* side as a leading end, the positioning of the communication means constituted by the cartridge side transmitting portion 21, located adjacent to the memory 20 and the main body control portion 22 of the main body 100 of the image forming apparatus, can easily be effected.

As the memory means 20 used in the present invention, normal semiconductor electronic memories such as a non-volatile memory or a combination of a volatile memory and a back-up battery can be used without special limitation. Particularly, in case of a memory of the non-contact type in which data communication between the memory 20 and a read/write IC is effected by an electromagnetic wave, since the cartridge side transmitting portion 21 may not contact the main body control portion 22, the danger of causing poor contact depending upon the mounting condition of the process cartridge B is eliminated, with the result that highly reliable control can be achieved. In the illustrated embodiment, the memory of the non-contact type is used as the memory means 20.

The main body control portion 22 and the transmitting portion 21 constitute control means for effecting reading/writing of information with respect to the memory 20. The capacity of the memory 20 is sufficient to store the PAE value. Further, in addition to the PAE value, when other information is desired to be stored, a memory having an appropriate capacity can be selected. For example, a memory can be designed to have a capacity sufficient to store a plurality of pieces of information such as the cartridge usage amount and the cartridge property value. Further, information regarding the amount of usage of the cartridge and the detected voltage value obtained by the developer remaining amount detecting means 30 can be written and stored in the memory 20 at any time.

Next, a control arrangement of the memory 20 according to the illustrated embodiment will be explained.

As shown in FIG. 21, the process cartridge B is provided with the memory 20 and the transmitting portion 21, and the main body control portion 22 of the main body 100 of the image forming apparatus is provided with the main body side developer remaining amount detecting portion 23, the calculation portion 24, the control means 25 and the developer remaining amount correction table 26.

As mentioned above, the electric current from the developer remaining amount detecting means 30 is measured by the electric current measuring device 33 of the main body 100 of the image forming apparatus and is sent to the main body control portion 22 of the main body 100 of the image forming apparatus.

In the main body control portion 22, the output signal from the developer remaining amount detecting means 30 is converted into a voltage signal by the main body side developer remaining amount detecting portion 23, and the calculation portion 24 effects a predetermined calculation process (described later) on the basis of the signals from the memory 20 of the process cartridge B and the main body side developer remaining amount detecting portion 23, and, further, the control means 25 corrects the developer remaining amount detected value properly by effecting verification of data obtained by the calculation portion 24 by using the developer remaining amount correction table 26, thereby determining the developer remaining amount level.

Further, in the main body control portion 22, the developer remaining amount (%) is sought on the basis of the detected developer remaining amount, and the sought information or the alarm "absence of developer" is displayed on the display means 40 of the main body of the apparatus.

Although various pieces of information can be stored in the memory, in the illustrated embodiment, at least the detected voltage value (PAE value) from the developer remaining amount detecting means 30, under the condition that the developer is not loaded in the developing device C, is stored.

Further, the information stored in the memory 20 can always be communicated with respect to the calculation portion 24 of the main body control portion 22, so that the calculation is effected on the basis of the pieces of information and the data is verified by the control portion 25.

Next, a method for correcting the developer remaining amount detected value by using the memory 20 of the process cartridge B will be explained.

In the illustrated embodiment, as mentioned above, the PAE value is written in the memory 20 by using a tool capable of measuring the detected voltage value of the developer remaining amount detecting means 30 and writing it in the memory 20, at the manufacture of the process cartridge B.

Further, according to the illustrated embodiment, in the main body control portion 22, as a table for correcting the detected voltage value, the relationship between a change amount of the detected voltage value X from the PAE value and the developer remaining amount (g) in the developing device C is previously stored in the developer remaining amount correction table 26. In the illustrated embodiment, as the change amount of the detected voltage value X from the PAE value, the difference (V) between the PAE value and the detected voltage value corresponds to the developer remaining amount. The developer remaining amount correction table 26 used in the illustrated embodiment is shown in the following Table 6.

TABLE 6

| deloveloper remaining amount (g) | remaining amount display Y (%) | PAE - X |
|---|---|---|
| 0 | 0 | — |
| 10 | 0 | — |
| 20 | 0 | to 0.6 |
| 21 | 1 | 0.6 to 0.64 |
| 22 | 2 | 0.64 to 0.68 |
| 25 | 5 | 0.68 to 0.8 |
| 30 | 10 | 0.8 to 1.0 |
| 35 | 15 | 1.0 to 1.2 |
| 40 | 20 | 1.2 to 1.4 |
| 45 | 25 | 1.4 to 1.6 |
| 50 | 30 | 1.6 to 1.8 |
| from 100 | 100 | from 1.8 |

As shown in the Table 6, in the illustrated embodiment, it is assumed that there is a danger of the occurrence of a blank stripe image if the remaining amount in the developing device C becomes smaller than 20 grams, and, the apparatus is set so that the alarm "absence of developer" is dislayed on the display means 40 of the main body 100 of the apparatus when the changed amount from the PAE value becomes 0.6 V or more. Further, in the illustrated embodiment, the difference from the PAE value is divided with appropriate interval between 0.6 and 1.8 V and corresponds to the remaining amount of the developer. Further, in the illustrated embodiment, in the developer remaining amount table 26, the remaining amount (g) of the developer corresponds to the developer remaining amount (%) indicated by a percentage.

As a percentage indication of the developer remaining amount, the remaining percentage (%) of the developer with respect to the unused condition or the remaining percentage (%) of the usable developer with respect to the usable developer amount may be displayed. For example, when the developer amount in the unused condition is 200 grams and if the developer remaining amount becomes 20 grams or less, a blank stripe may occur, and the amount of developer that can actually be used is 180 grams. The developer remaining amount (%) can be displayed on the basis of the remaining percentage of the developer with respect to this usable developer. The embodiment shown in the Table 6 shows an example that the remaining percentage of the usable developer with respect to the usable developer of 100 grams is displayed. Further, as is in the illustrated embodiment, due to the arrangement relationship of the developer remaining amount detecting means 30, when the increase of the detected voltage value (reduction of the capacitance) is started after the developer is consumed to some extent, regarding the display of the developer remaining amount (%) before the change in the detected voltage value is started, information for indicating a sufficient developer remaining amount, for example, "30% or more" or "100%" can be displayed.

In this way, in the calculation portion 24 of the main body control portion 22, the changed amount of the detected voltage value from the PAE value is calculated on the basis of the detected voltage value inputted via the main body side developer remaining amount detecting portion 23 and the PAE value stored in the memory 20 of the process cartridge B, and, in the control means 25, by comparing the changed amount calculated in the calculation portion 24 with the table (shown in the Table 6) stored in the developer remaining amount correction table 26, the remaining amount of the developer is determined and such information is displayed on the display means 40.

Figure 23:
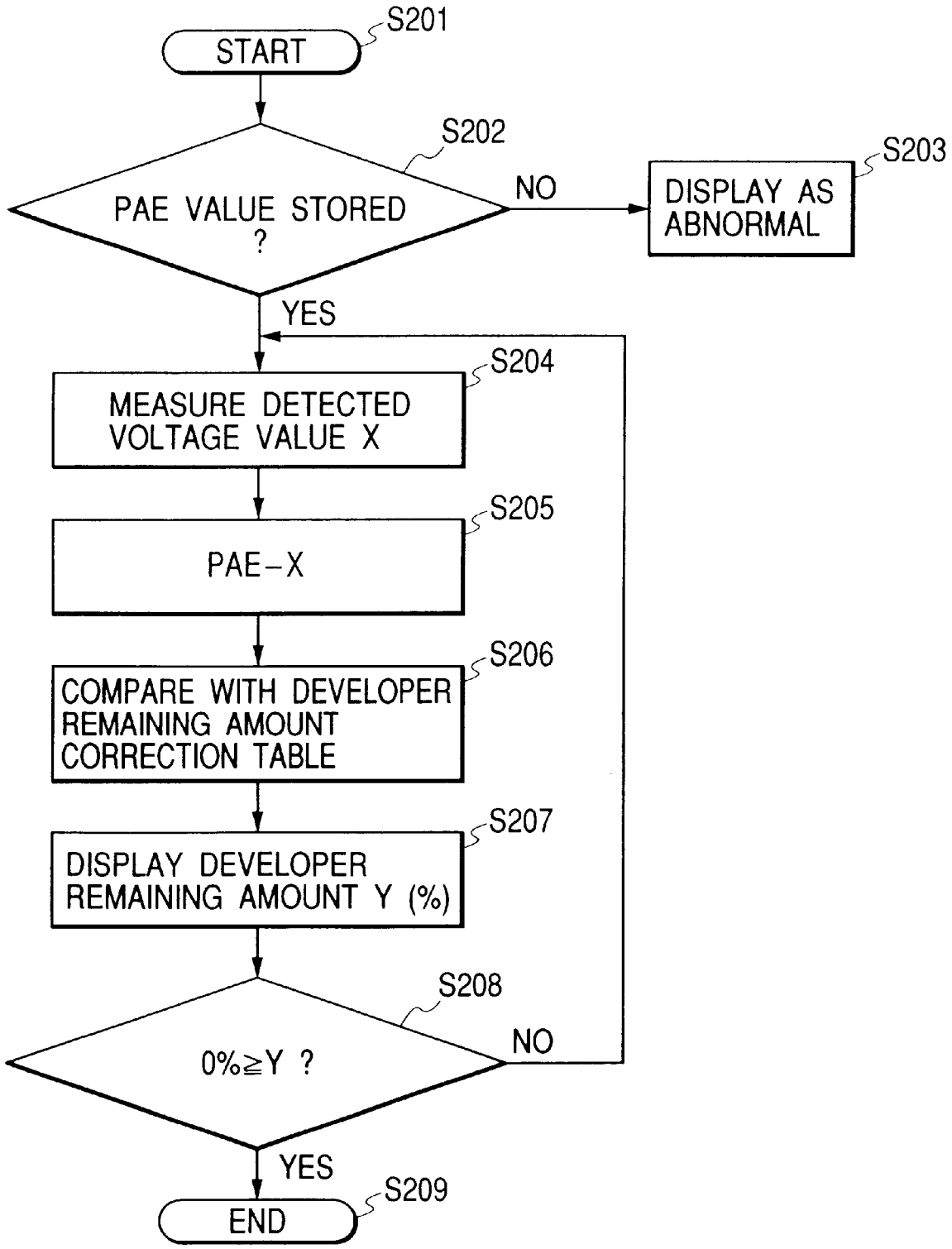
FIG. 23 is a flow chart for explaining the developer amount detecting operation using memory means of the cartridge according to the ninth embodiment.

Next, the detecting operation for detecting the developer remaining amount according to the illustrated embodiment will be explained with reference to a flow chart shown in FIG. 23. Incidentally, the used developer remaining amount correction table 26 is as shown in the Table 6.

Step S201: A power supply of the main body 100 of the image forming apparatus is turned ON.

Step S202: The main body side developer remaining amount detecting portion 23 judges whether the PAE value is stored in the memory 20. If it is judged as "NO", the sequence goes to a step S203, where information indicating an abnormality of the process cartridge B is displayed on the display means 40 of the main body 100 of the image forming apparatus. If it is judged as "YES", the sequence goes to a step S204.

Step S204: The detected voltage value X is measured by the main body side developer remaining amount detecting portion 23.

Step S205: The calculation portion 24 calculates the changed amount of the detected voltage value X from the PAE value on the basis of the relationship between the PAE value and the detected voltage value X.

Step S206: The control portion 25 compares the value calculated by the calculation portion 24 in the step S208 with the developer remaining amount correction table 26.

Step S207: The control portion 25 sends a signal indicating the fact that the developer remaining amount is Y% to the display portion 40 of the main body 100 of the image forming apparatus, and such information is displayed on the display portion 40.

Step S208: The control portion 25 judges whether the developer remaining amount Y (%) reaches 0%. If NO, the sequence goes to the step S204, where the above sequence is repeated; whereas, if YES, the sequence goes to a step S209.

Step S209: The sequence is ended.

Figure 24:
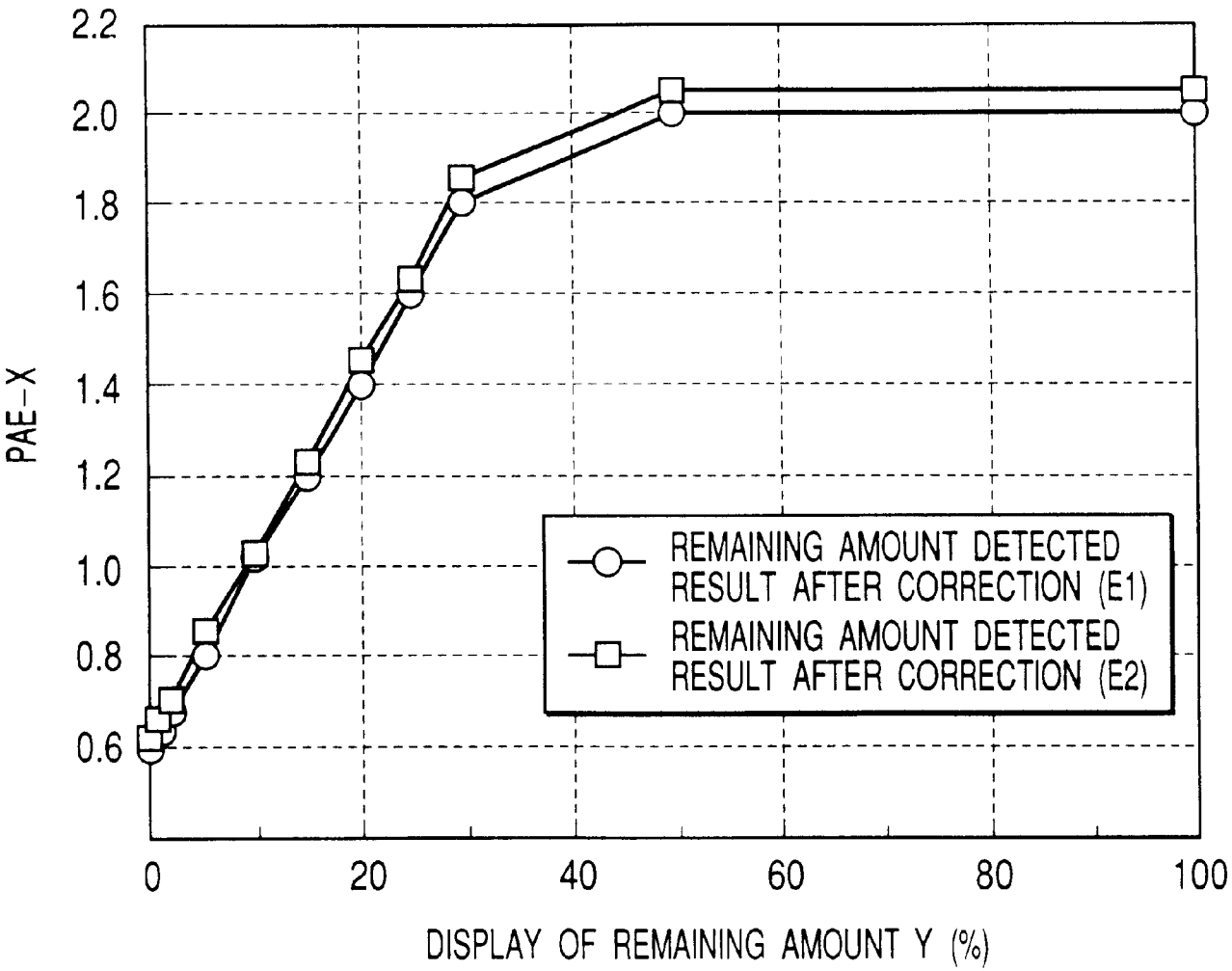
FIG. 24 is a graph for explaining the display of the developer remaining amount after the detected voltage value of the developer amount detecting device is corrected in accordance with the ninth embodiment.

As a result of the indication of the developer remaining amount depending upon the consumption of the developer being evaluated with respect to two process cartridges B (E1, E2) including respective developer amount detecting devices having different PAE values by effecting the control in accordance with the above-mentioned flow chart, as shown in FIG. 24, it was found that the successive developer remaining amount detection with eliminating the individual difference of the process cartridge B can be achieved. In FIG. 24, the ordinate indicates the changed amount of the detected voltage value X obtained by the developer amount detecting device from the PAE value, and the abscissa indicates the remaining amount display Y (%) of the developer in the developing device C.

As mentioned above, according to the present invention, even if the capacitance detected by the developer remaining amount detecting means 30 in the no developer condition is different from cartridge to cartridge, due to the positional relationship of the developer remaining amount detecting means 30, since the relationship between the developer remaining amount and the capacitance (detected voltage value in the illustrated embodiment) detected by the developer remaining amount detecting means can be corrected and be grasped correctly on the basis of the output of the developer remaining amount detecting means under the condition that the developer is not loaded in the developing device C, the remaining amount of the developer can be detected correctly. Further, by displaying the information regarding the detected developer remaining amount, the user can be informed of the correct exchanging time (purchasing time) of the process cartridge.

Further, by storing the information (the detected voltage value in the illustrated embodiment) corresponding to the capacitance detected by the developer remaining amount detecting means under the condition that the developer is not loaded in the memory of the cartridge, even in a case where the cartridge is dismounted from the main body of the image forming apparatus on the way of the usage of the cartridge and a new cartridge is mounted, when the dismounted cartridge is again used later, the relationship between the developer remaining amount and the output (capacitance, detected voltage value) of the developer remaining amount detecting means can be corrected and can be grasped correctly by reading the information stored in the memory by means of the main body of the image forming apparatus, thereby always detecting the remaining amount of the developer correctly.

Tenth Embodiment

Next, a tenth embodiment of the present invention will be explained. In the tenth embodiment, the construction of the image forming apparatus and the process cartridge are fundamentally similar to those of the ninth embodiment, but control of the developer remaining amount detection using the memory means 20 is different. Accordingly, elements having the same construction and function as those in the ninth embodiment are designated by the same reference numerals and a detailed explanation thereof will be omitted, and only a characteristic portion of this embodiment will be described.

In the ninth embodiment, as the information regarding the output of the developer remaining amount detecting means 30 under the condition that the developer is not loaded in the developing device C, the PAE value, i.e., the detected voltage value of the developer remaining amount detecting means 30 measured by the tool in the condition that the developer is not loaded in the developing device C at the manufacture of the process cartridge B, is stored in the memory 20 of the process cartridge B and is used.

To the contrary, in this embodiment, as the information regarding the output of the developer remaining amount detecting means 30 under the condition that the developer is not loaded in the developing device C, the following information is stored in the memory 20 of the process cartridge B. That is to say, in the illustrated embodiment, the detected voltage value of the developer remaining amount detecting means 30, measured by the tool under the condition that the developer is not loaded in the developing device C at the manufacture of the process cartridge B, is grouped into predetermined ranges, and information capable of discriminating the respective groups (referred to as "PAE value discriminating information" hereinafter) is stored in the memory 20.

When the process cartridge B is mounted to the main body 100 of the image forming apparatus, the PAE value discriminating information is read out from the memory 20 and is recognized. The main body control portion 22 recognizes the PAE value previously set to correspond to the PAE value discriminating information as the PAE value of the process cartridge B.

Explained more concretely, according to the illustrated embodiment, the following control is effected:

(1) Under the condition that the developer is not loaded in the developing device C at the manufacture of the process cartridge B, the detected voltage of the developer remaining amount detecting means 30 is measured by the tool, and the measured value is made to correspond to the PAE value discriminating information grouped into the predetermined ranges.

(2) The memory means 20 is provided on the process cartridge B, and the PAE value discrimination information inherent to the process cartridge B is stored in the memory means 20 so that, when the process cartridge B is mounted to the main body 100 of the image forming apparatus, the PAE value discriminating information can be recognized by the main body control portion 22.

(3) The PAE value discriminating information is converted into the PAE value by a PAE value discriminating table.

(4) The developer remaining amount is calculated by utilizing the developer remaining amount correction table in accordance with the changed amount of the detected voltage value from the PAE value, by using the converted PAE value.

(5) The result is displayed on the display means 40 at any time. By doing so, the individual differences in different cartridges can be compensated for and the successive detection of the remaining amount of the developer can be effected more correctly, and, further, efficiency in the factory working process can be enhanced.

Next, the control arrangement of the memory 20 in the illustrated embodiment will be explained.

Figure 25:
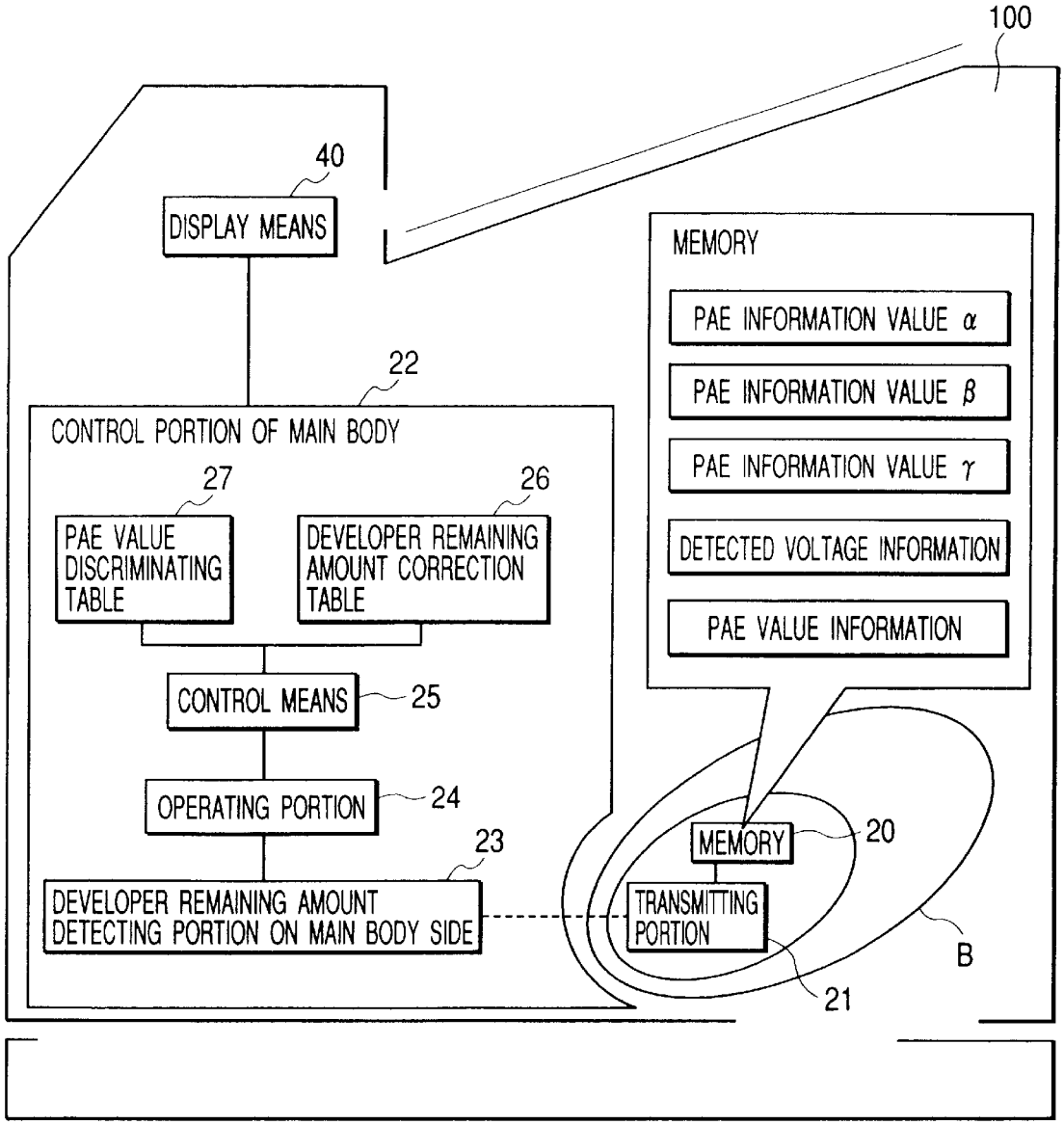
FIG. 25 is a schematic view showing the relationship between a cartridge according to a tenth embodiment of the present invention and a main body of an image forming apparatus, for explaining a control arrangement of a memory of the cartridge.

Similar to the ninth embodiment, in the illustrated embodiment, as shown in FIG. 25, the process cartridge B is provided with the memory 20 and the transmitting portion, and the main body control portion 22 of the main body 100 of the image forming apparatus is provided with the main body side developer remaining amount detecting portion 23, the calculation portion 24, the control means 25, the developer remaining amount correction table 26 and the PAE value discriminating table 27.

As mentioned above, the electric current from the developer remaining amount detecting means 30 is measured by the electric current measuring device 33 of the main body 100 of the image forming apparatus and is sent to the main body control portion 22 of the main body 100 of the image forming apparatus.

In the main body control portion 22, the output signal of the developer remaining amount detecting means 30 is converted into the voltage signal by the main body side developer remaining amount detecting portion 23. Further, the main body control portion 22 reads out the PAE value discriminating information from the memory 20 of the process cartridge B and recognizes it, and the control means 25 convert it into the PAE value by using the PAE value discriminating table 27. Further, as will be described later with reference to a flow chart, in the illustrated embodiment, the converted PAE value is stored in the memory 20 of the process cartridge B and is used for correcting the relationship between the output of the developer remaining amount detecting means 30 and the developer remaining amount.

The calculation portion 24 effects predetermined calculation (described later) on the basis of the information stored in the memory 20 of the process cartridge B and the signal from the main body side developer remaining amount detecting portion 23, and the control means 25 corrects the developer remaining amount detected value by comparing the data obtained in the calculation portion 24 by using the developer remaining amount correction table 26, thereby determining the developer remaining amount level.

Further, the main body control portion 22 seeks the developer remaining amount (%) on the basis of the detected remaining amount of the developer, and such information or the alarm "absence of developer" is displayed on the display means 40 of the main body 100 of the apparatus.

Although various pieces of information can be stored in the memory 20, in the illustrated embodiment, at least $\alpha$, $\beta$ and $\gamma$ (described later) as the PAE value discriminating information $\omega$ which will be fully described later, and the detected voltage value information and PAE value can be stored.

The data stored in the memory 20 can always be communicated with the calculation portion 24 in the main body control portion 22, and the data is verified by the control means 25 on the basis of this data.

Incidentally, the PAE value discriminating information $\omega$ may be set to any numerical value in accordance with a dispersion range of the detected voltage value of the developer remaining amount detecting means 30 under the condition that the developer is not loaded in the developing apparatus C, due to the tolerance of the measured value of the detected voltage obtained by the developer remaining amount detecting means 30.

For example, when the tolerance of the detected voltage value is great, many PAE value discriminating data are set; whereas, when the tolerance is small, a smaller number of PAE value discriminating data are set. In the illustrated embodiment, the discriminating information is divided into three stages in accordance with the detected voltage value of the developer remaining amount detecting means 30 measured by using the tool under the condition that the developer is not loaded in the developing apparatus C at the manufacture of the process cartridge B, and the PAE value discriminating data $\omega$ corresponding to these stages are regarded as $\alpha$, $\beta$, $\gamma$ ($\alpha<\beta<\gamma$), respectively.

In the illustrated embodiment, the widths of the PAE value discriminating data and the PAE value are selected to have the following relationship:

α=2.3 to 2.5 V

β=2.5 to 2.7 V

γ=2.7 to 2.9 V

Further, the main body control portion 22 is provided with the PAE value discriminating table 27 as shown in the following Table 7, and the control means 25 recognize that the PAE values corresponding to the PAE value discriminating information ω, i.e., α, β, γ, are 2.4 V, 2.6 V, 2.8 V, respectively and convert them by using such a table.

TABLE 7

| ω | PAE value |
|---|---|
| α | 2.4 |
| β | 2.6 |
| γ | 2.8 |

Figure 26:
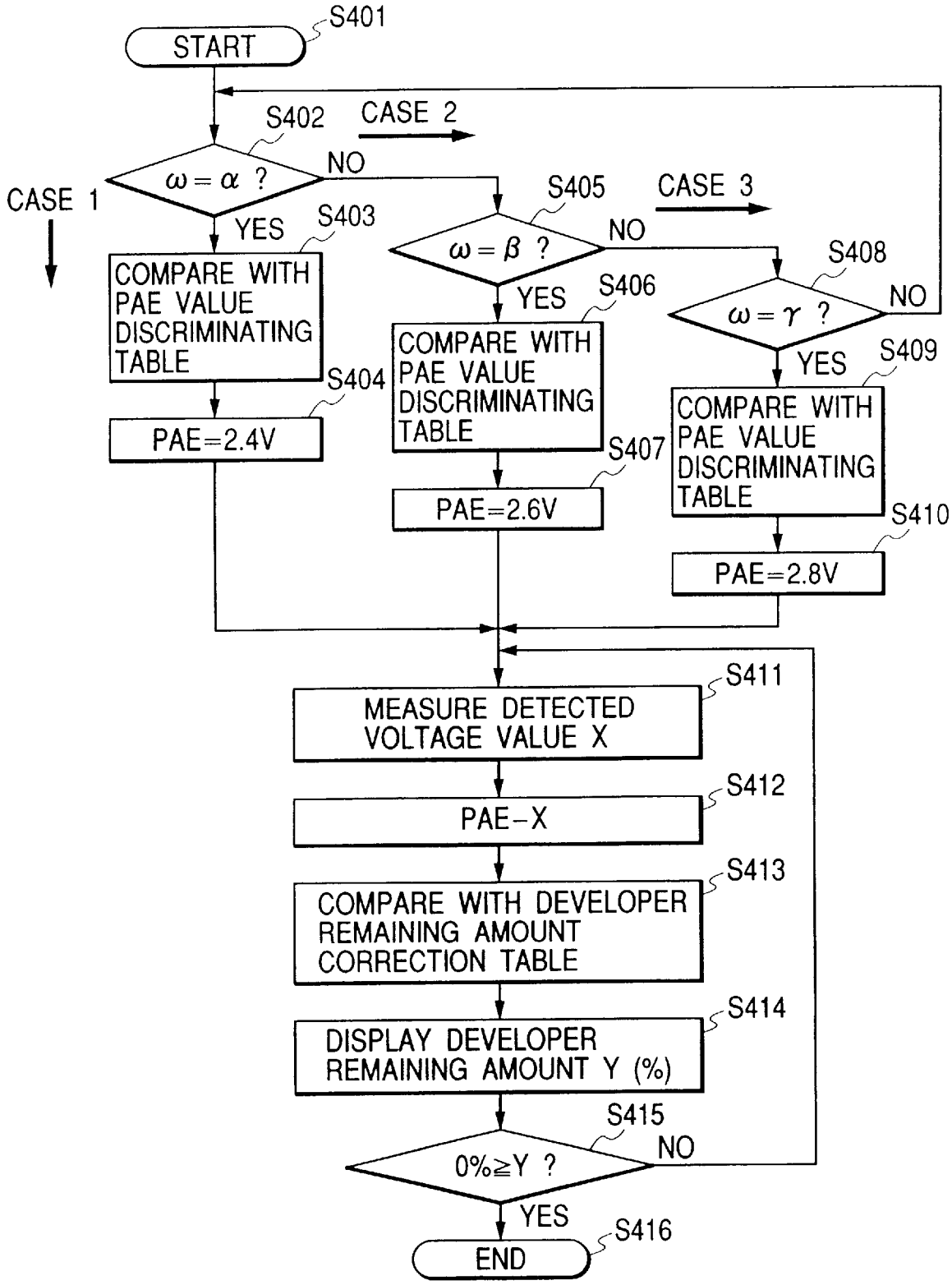
FIG. 26 is a flow chart for explaining the developer amount detecting operation using memory means of the cartridge according to the tenth embodiment.

Next, the detecting operation for detecting the developer remaining amount according to the illustrated embodiment will be explained with reference to a flow chart shown in FIG. 26. Incidentally, the developer remaining amount correction table 26 and the PAE value discriminating table 27 used are as shown in the Tables 6 and 7. Further, the PAE value discriminating information ω is stored in the memory 20 at the manufacture of the process cartridge B.

Step S401: a power supply of the main body 100 of the image forming apparatus is turned ON.

Step S402: The main body control portion 22 reads in the information stored in the memory 20, and the control means 25 judge whether the PAE value discriminating information ω stored in the memory 20 is α or not.

Case 1: If it is judged as "YES" in the step S402

Step S403: The control means 25 convert the PAE value discriminating information ω into the PAE value by using the PAE value discriminating table 27.

Step S404: The control means 25 ascertain that the PAE value is 2.4 V, and this PAE value is stored in the memory 20.

Step S411: The main-body-side-developer-remaining-amount detecting portion 23 measures the detected voltage X.

Step S412: The calculation portion 24 calculates the changed amount of the detected voltage value X from the PAE value, on the basis of the relationship between the PAE value and the detected voltage X.

Step S413: The control means 25 compare the value calculated by the calculation portion 24 in the step S412 with the developer remaining amount correction table 26.

Step S414: The control means 25 send the signal indicating the fact that the developer remaining amount is Y% to the display means 40 of the main body 100 of the image forming apparatus, and such information is displayed on the display means 40.

Step S415: The control means 25 judge whether the developer remaining amount (%) reaches 0%. If NO, the sequence goes to the step S411, where the above sequence is repeated. On the other hand, if YES, the sequence goes to a step S416.

Step S416: The sequence is ended.

Case 2: If it is judged as "NO" in the step S402

Step S405: The control means 25 judge whether the PAE value discriminating information ω is β or not. If YES, the sequence goes to a step S406. On the other hand, if NO, the sequence goes to a step S408 (refer to Case 3).

Step S406: The control means 25 convert the PAE value discriminating information ω into the PAE value by using the PAE value discriminating table 27.

Step S407: The control means 25 ascertain that the PAE value is 2.6 V, and this PAE value is stored in the memory 20.

Step S411: The main body side developer remaining amount detecting portion 23 measures the detected voltage X.

Step S412: The calculation portion 24 calculates the changed amount of the detected voltage value X from the PAE value, on the basis of the relationship between the PAE value and the detected voltage X.

Step S413: The control means 25 compare the value calculated by the calculation portion 24 in the step S412 with the developer remaining amount correction table 26.

Step S414: The control means 25 send the signal indicating the fact that the developer remaining amount is Y% to the display means 40 of the main body 100 of the image forming apparatus, and such information is displayed on the display means 40.

Step S415: The control means 25 judge whether the developer remaining amount (%) reaches 0%. If NO, the sequence goes to the step S411, where the above sequence is repeated. On the other hand, if YES, the sequence goes to a step S416.

Step S416: The sequence is ended.

Case 3: If it is judged as "NO" in the step S405

Step S408: The control means 25 judge whether the PAE value discriminating information ω is γ0 or not. If NO, the sequence is returned to the step S402; whereas, if YES, the sequence goes to a step S409.

Step S409: The control means 25 convert the PAE value discriminating information ω into the PAE value by using the PAE value discriminating table 27.

Step S410: The control means 25 ascertain that the PAE value is 2.8 V, and this PAE value is stored in the memory 20.

Step S411: The main body side developer remaining amount detecting portion 23 measures the detected voltage X.

Step S412: The calculation portion 24 calculates the changed amount of the detected voltage value X from the PAE value, on the basis of the relationship between the PAE value and the detected voltage X.

Step S413: The control means 25 compare the value calculated by the calculation portion 24 in the step S412 with the developer remaining amount correction table 26.

Step S414: The control means 25 send the signal indicating the fact that the developer remaining amount is Y% to the display means 40 of the main body 100 of the image forming apparatus, and such information is displayed on the display means 40.

Step S415: The control means 25 judge whether the developer remaining amount (%) reaches 0%. If NO, the sequence goes to the step S411, where the above sequence is repeated. On the other hand, if YES, the sequence goes to a step S416.

Step S416: The sequence is ended.

Figure 27:
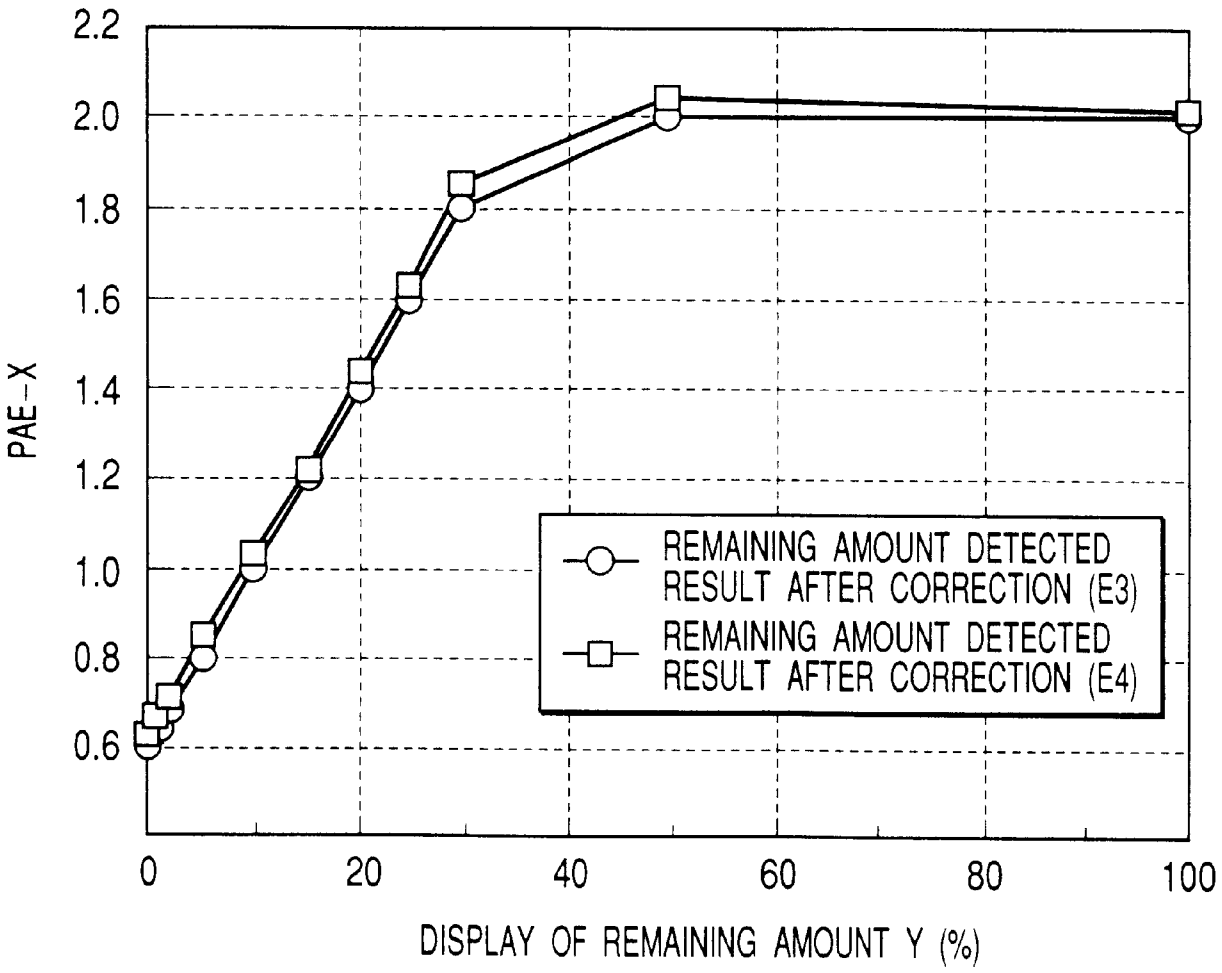
FIG. 27 is a graph for explaining the display of the developer remaining amount after the detected voltage value of the developer amount detecting device is corrected in accordance with the tenth embodiment.

As a result of the indication of the developer remaining amount depending upon the consumption of the developer, being evaluated with respect to two process cartridges B (E3, E4) including respective developer amount detecting devices having different PAE values by effecting the control in accordance with the above-mentioned flow chart, as shown in FIG. 27, it was found that successive developer remaining amount detection operations, which eliminate the individual difference of the process cartridge B, can be achieved. In FIG. 27, the ordinate indicates the changed amount of the detected voltage value X obtained by the developer amount detecting device from the PAE value, and the abscissa indicates the remaining amount display Y (%) of the developer in the developing device C.

Incidentally, in the illustrated embodiment, since the output voltage value of the developer remaining amount detecting means 30, measured by the tool under the condition that the developer is not loaded in the developing device C at the manufacture of the process cartridge B, is grouped into the predetermined ranges and the PAE value discriminating data ω capable of discriminating the respective groups are stored in the memory 20, the efficiency of the factory working process can be enhanced. Further, as can be understood from the flow chart shown in FIG. 26, by storing the PAE values converted by using the PAE value discriminating table 27 in the steps S404, S407 and S410, the PAE value once converted from the PAE value discriminating data ω can be read out from the memory 20 and be used, thereby simplifying the signal processing in the image forming apparatus.

As mentioned above, according to the illustrated embodiment, also with the arrangement of the illustrated embodiment, the relationship between the developer remaining amount and the detected capacitance (detected voltage value) can be corrected on the basis of the capacitance value (detected voltage value) detected under the condition that the developer is not loaded in the developing device C, thereby detecting the remaining amount of the developer correctly. Further, with the arrangement of the illustrated embodiment, the efficiency of the working process at the cartridge manufacturing factory can be enhanced.

Further, in the illustrated embodiment, by storing the PAE value discriminating data and the PAE values converted from the PAE value discriminating data in the memory of the cartridge as the information regarding the PAE value, in a case where the cartridge is dismounted from the main body of the image forming apparatus to exchange to a new one due to the usage of the cartridge, when the dismounted cartridge is again used later, the remaining amount of the developer can always be detected correctly by utilizing the information stored in the memory.

Eleventh Embodiment

Figure 28:
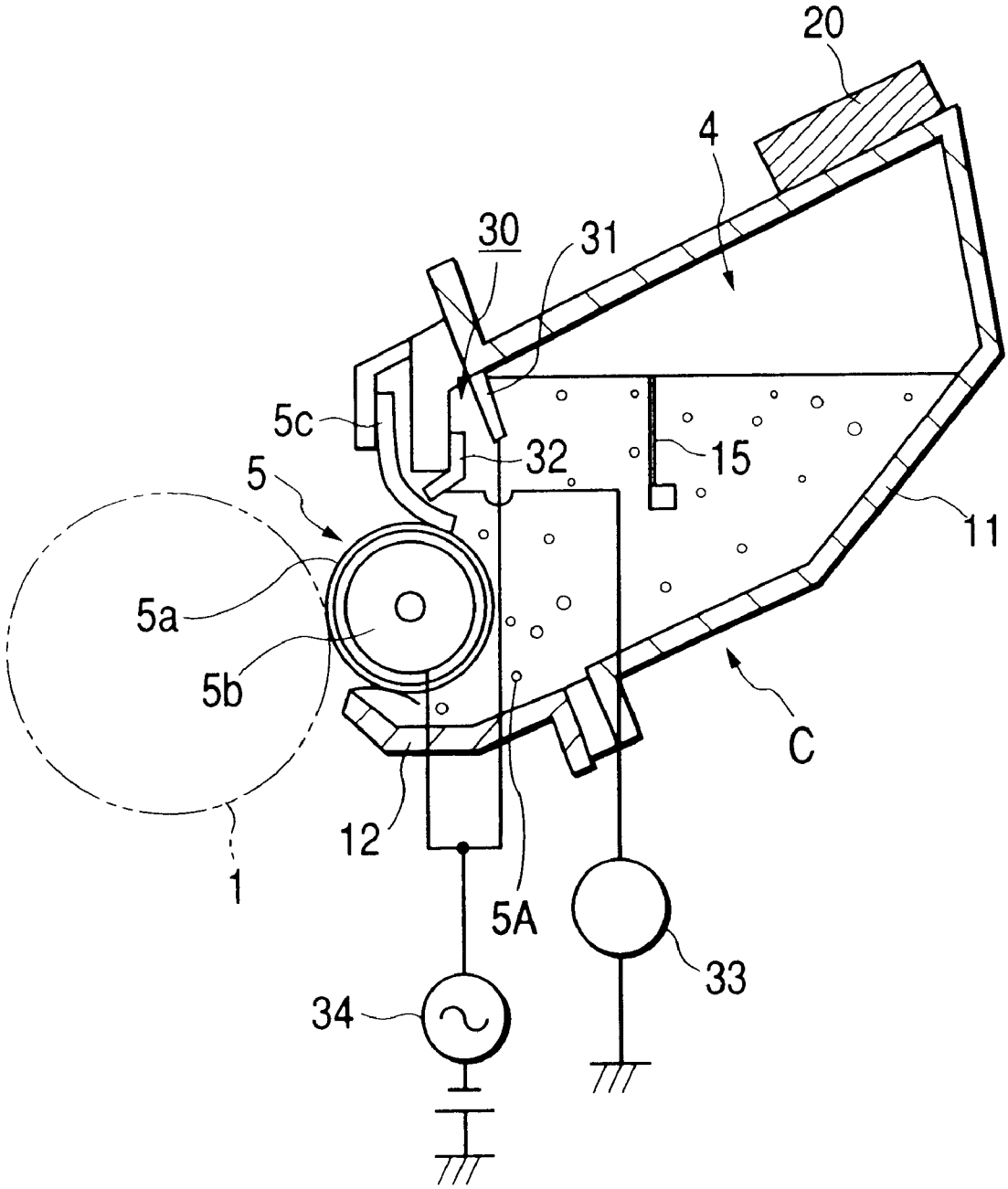
FIG. 28 is a sectional view of a developing device as a cartridge according to an eleventh embodiment of the present invention.

FIG. 28 shows a developing device C as a cartridge according to an eleventh embodiment of the present invention.

The developing device C according to this embodiment is constituted as a cartridge by integrally joining a developing room 5A holding a developing roller 5*a* and a developing blade 5*c* to a developer containing container 4 containing developer to be supplied to the developing means 5 via a plastic developer frame 11 and the developing frame 12. Namely, in the developing device C according to this embodiment, the developing device constituting parts of the process cartridge B explained in connection with the ninth and tenth embodiments are integrated as a unit; that is to say, it is considered that parts other than the photosensitive drum 1, charging means 2 and cleaning means 7 of the process cartridge B are integrated as a unit. Accordingly, all of the developing device constituting parts and the construction of the developer amount detecting device explained in connection with the ninth and tenth embodiments can similarly be applied to the developing device C according to the eleventh embodiment.

However, this embodiment differs from the ninth and tenth embodiments in that the memory 20 is provided on the developer containing container 4. Also, with the arrangement of this embodiment, the same technical effect as those in the ninth and tenth embodiments can be achieved.

In the above explanation, plural embodiments of the present invention were described.

Incidentally, of course, since the relationship between the developer remaining amount and the detected voltage value is changed greatly in accordance with the construction of the cartridge, particularly, the construction and arrangement of the developer remaining amount detecting means, the developer remaining amount correction table is not limited to the one shown in the Table 6 but can appropriately be determined in accordance with properties of the image forming apparatus and process cartridge to which the present invention is applied. Further, in the above embodiments, as shown in the Table 6, the interval of division of the changed amount of the detected voltage value X from the PAE value in the developer remaining amount correction table is set to correspond to 5 grams (5%) of the developer amount when the remaining amount is great, and the interval is reduced when the developer remaining amount is decreased. However, the present invention is not limited to the interval in the table shown in the Table 6, but, the interval is set individually in accordance with the embodiments, and, naturally, the narrower the interval the finer the display of the developer remaining amount.

Further, in the above embodiments, while an example that the developer remaining amount correction table 26, or the developer remaining amount correction table 26 and the PAE value discriminating table 27 are stored in the main body control portion 22 was explained, alternatively these tables may be stored in the memory means 20 of the cartridge. In this case, since the tables depending upon the inherent property of the cartridge can be held in the cartridge itself and be used, the successive remaining amount detection can be effected more correctly in correspondence to various cartridges.

In the above embodiments, while an example of the calculation of the correct developer remaining amount by using the developer remaining amount correction table on the basis of the AE value and the detected voltage value was explained, the detected voltage value may be corrected and the developer remaining amount may be calculated by using a function of predetermined weighting utilizing the PAE value.

Twelfth Embodiment

First of all, an embodiment of an electrophotographic image forming apparatus to which a process cartridge constructed in accordance with the present invention can detachably be mounted will be explained with reference to FIGS. 29 and 30. In this embodiment, the electrophotographic image forming apparatus is embodied as a laser beam printer A of the electrophotographic type and serves to receive image information from a host computer and to form an image on a recording medium such as a recording paper, an OHP sheet, cloth and the like by an electrophotographic image forming process.

The laser beam printer A has a drum-shaped electrophotographic photosensitive member, i.e., a photosensitive drum 1. The photosensitive drum 1 is charged by a charging roller 2 as charging means. Then, by illuminating the drum with a laser beam corresponding to the image information from a laser scanner 3, a latent image corresponding to the image information is formed on the photosensitive drum 1. The latent image is developed by developing means 5 of a developing device C to visualize the latent image as a toner image.

Namely, the developing device C has, as a developer containing portion, a developing room 5A including a developing roller 5*a* as a developer bearing member, and a developer containing container 4 formed adjacent to the developing room 5A, and developer T in the developer containing container 4 is supplied to the developing roller 5*a* within the developing room 5A. Agitating means 8, rotated in a direction shown by the arrow in FIG. 29, are provided within the developer containing container 4 so that, by rotating the agitating means 8, the developer T is supplied to the developing roller 5*a* while being loosened. In the illustrated embodiment, insulative magnetic one-component toner is used as the developer T. Further, the developing roller 5*a* has a stationary magnet 5*b* therein, so that the developer is carried by rotating the developing roller 5*a*. Meanwhile, triboelectric charge is applied to the developer and a developer layer having a predetermined thickness is formed by a developing blade 5*c* as a developer layer thickness regulating member, which developer layer is supplied to a developing area on the photosensitive drum 1. The developer supplied to the developing area is transferred onto the latent image on the photosensitive drum 1 thereby forming the toner image. The developing roller 5*a* is connected to developing bias applying means 33 (FIG. 31) so that developing bias voltage obtained by superimposing DC voltage to AC voltage is normally applied to the developing roller.

On the other hand, in synchronism with the formation of the toner image, a recording medium P set in a sheet feeding cassette 200 is conveyed to a transfer position by a pick-up roller 12 and conveying means 13*a*. A transfer roller 14 as transfer means is disposed at the transfer position so that, by applying voltage to the transfer roller, the toner image on the photosensitive drum 1 is transferred onto the recording medium P.

The recording medium P to which the toner image was transferred is conveyed to fixing means 15 by conveying means 13*b*. The fixing means 15 include a fixing roller 15*b* having a heater 15*a* therein, and a drive roller 15*c*. While the recording medium P is being passed through the fixing means, the toner image is fixed to the recording medium P by heat and pressure.

Thereafter, the recording medium P is discharged onto a discharge tray 16 by conveying means 13*c*. The discharge tray 16 is provided on an upper surface of a main body 100 of the laser beam printer A.

After the toner image was transferred to the recording medium P by the transfer roller 14, the developer remaining on the photosensitive drum 1 is removed by cleaning means 7, for preparing for the next image forming process. In the cleaning means 7, the residual developer on the photosensitive drum is scraped off by an elastic cleaning blade 7*a* urged against the photosensitive drum 1, and the scraped developer is collected into a waste developer container 7*b*.

Figure 29:
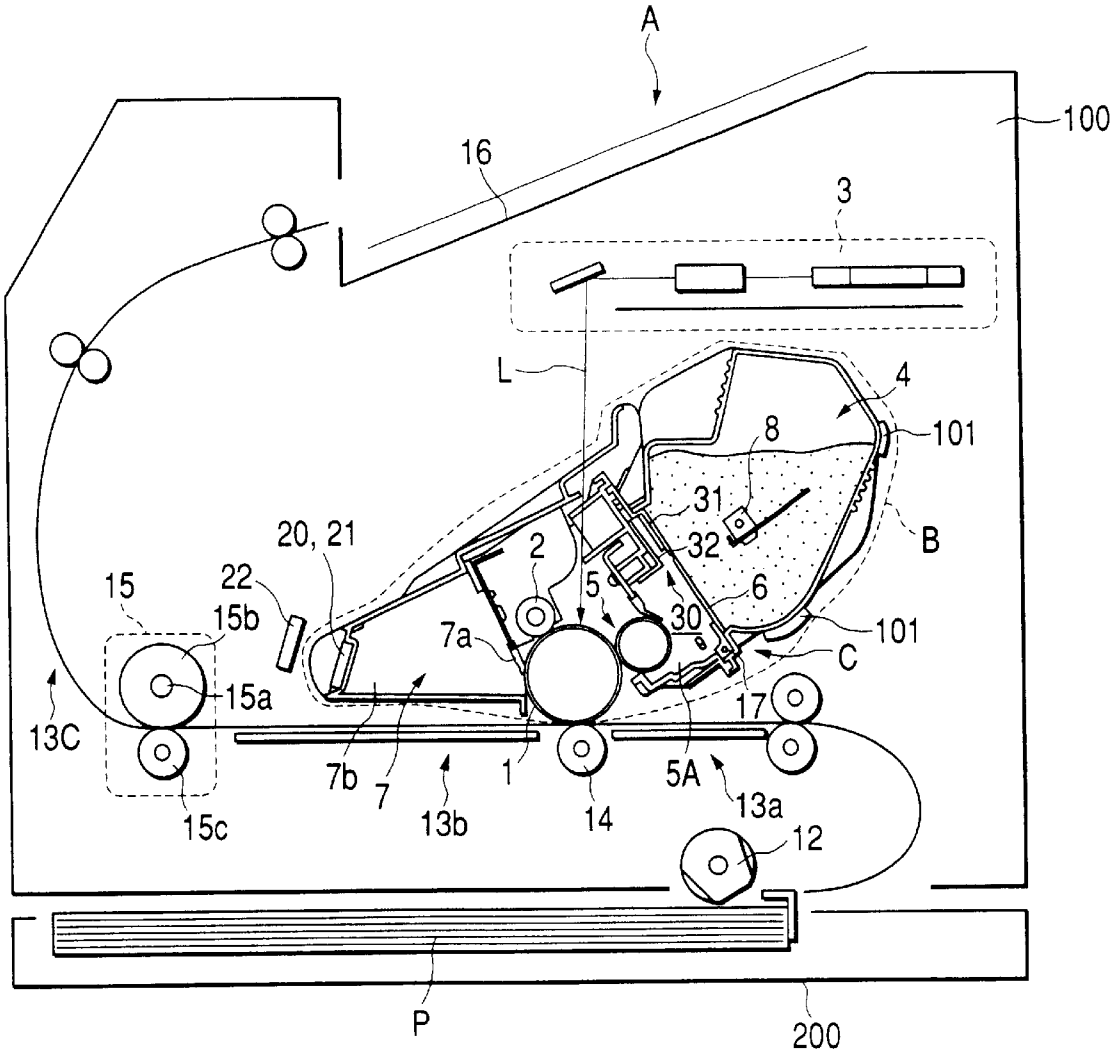
FIG. 29 is a sectional view of a process cartridge according to a twelfth embodiment of the present invention and an image forming apparatus.
Figure 30:
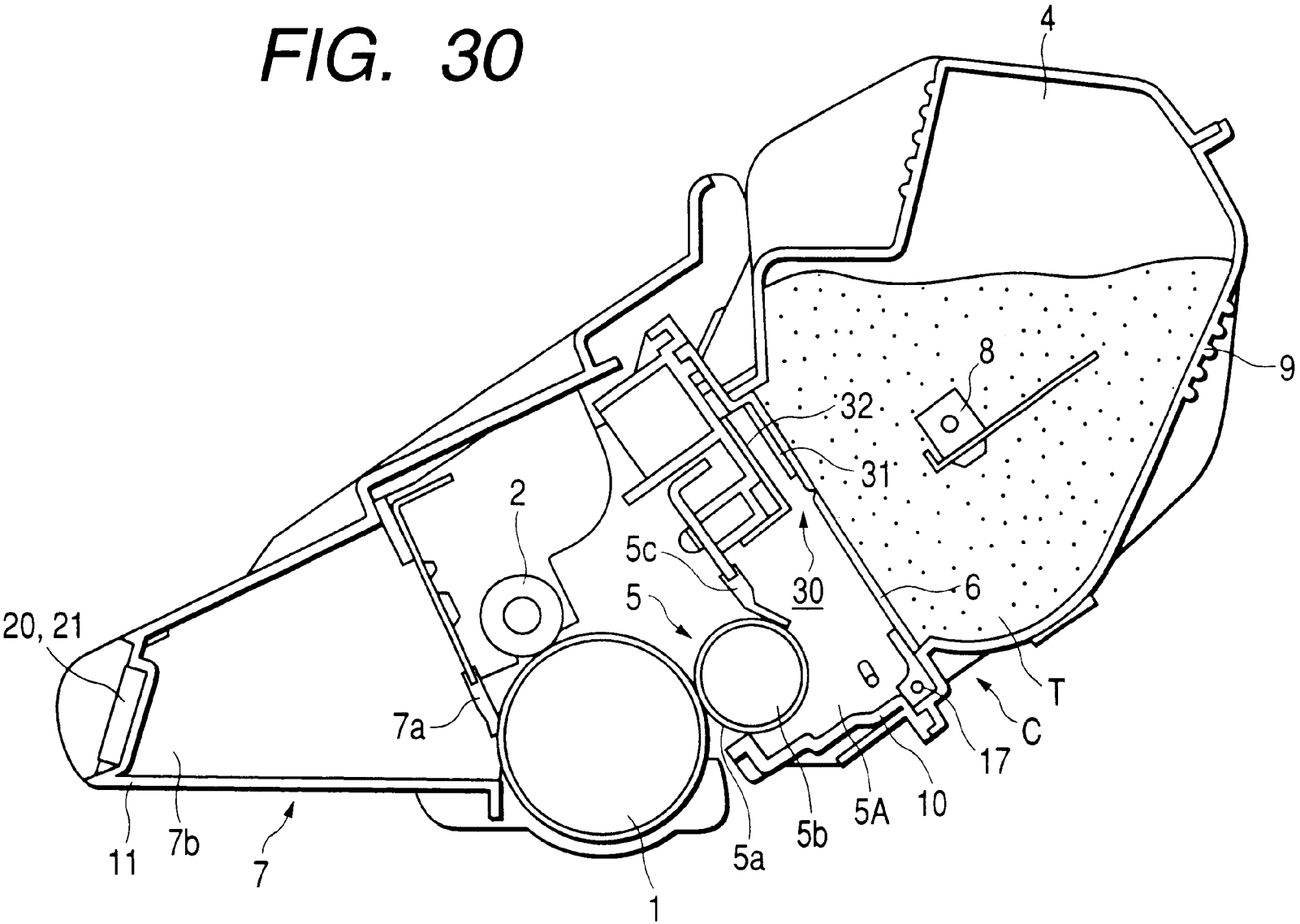
FIG. 30 is an enlarged sectional view of the process cartridge of FIG. 29.

On the other hand, in the illustrated embodiment, as shown in FIG. 30, in the process cartridge B, a developing unit (developing device) C is formed by integrally welding a developer frame 9 forming the developer containing container 4 containing the developer and having the agitating means 8 to a developing frame 12 forming the developing room 5A holding the developing means 5 such as the developing roller 5*a* and the developing blade 5*c*, and the cartridge is formed by integrally joining the developing unit C to a cleaning frame 11 to which the photosensitive drum 1, the cleaning means 7 such as the cleaning blade 7*a* and waste developer container 7*b* and the charging roller 2 are attached. The process cartridge B is detachably mounted to cartridge mounting means 101 (FIG. 29) of the main body 100 of the image forming apparatus by the user.

Further, a developer seal member 6 is provided between the developer containing container 4 and the developing room 5A. The developer seal member 6 is not unsealed until the process cartridge B is used and is automatically unsealed when the process cartridge B is mounted to the main body 100 of the image forming apparatus, as will be fully described later.

According to the present invention, the laser beam printer A has a developer amount detecting device having developer remaining amount detecting means 30 capable of detecting a remaining amount of the developer successively as the developer T in the developing device C is consumed.

In the illustrated embodiment, a plate antenna is used as the developer remaining amount detecting means 30. In the illustrated embodiment, as shown in FIG. 30, the plate antenna has an output metal plate 32 provided along the longitudinal entire area of the developing device C, and an input metal plate 31 having substantially the same longitudinal length as that of the output metal plate 32 and opposed to the output metal plate 32.

In this way, by providing the input metal plate 31 and output metal plate as the plate antenna within the developing device C and by measuring the capacitance between the input metal plate 31 and the output metal plate 32 and the capacitance between the developing roller 5*a* and the output metal plate 32 as the developer T in the developing device C is decreased, the developer amount in the developing device C can be known at any time.

Although the material of the input metal plate 31 and the output metal plate 32 as the plate antenna is not limited so long as it can fundamentally permit the flow electric current, in the illustrated embodiment, SUS having excellent anti-rust is used as the material of the metal plates 31, 32.

In the illustrated embodiment, the input metal plate 31 and the output metal plate as the plate antenna is provided in the developing frame 10 forming the developing room 5A.

Figure 31:
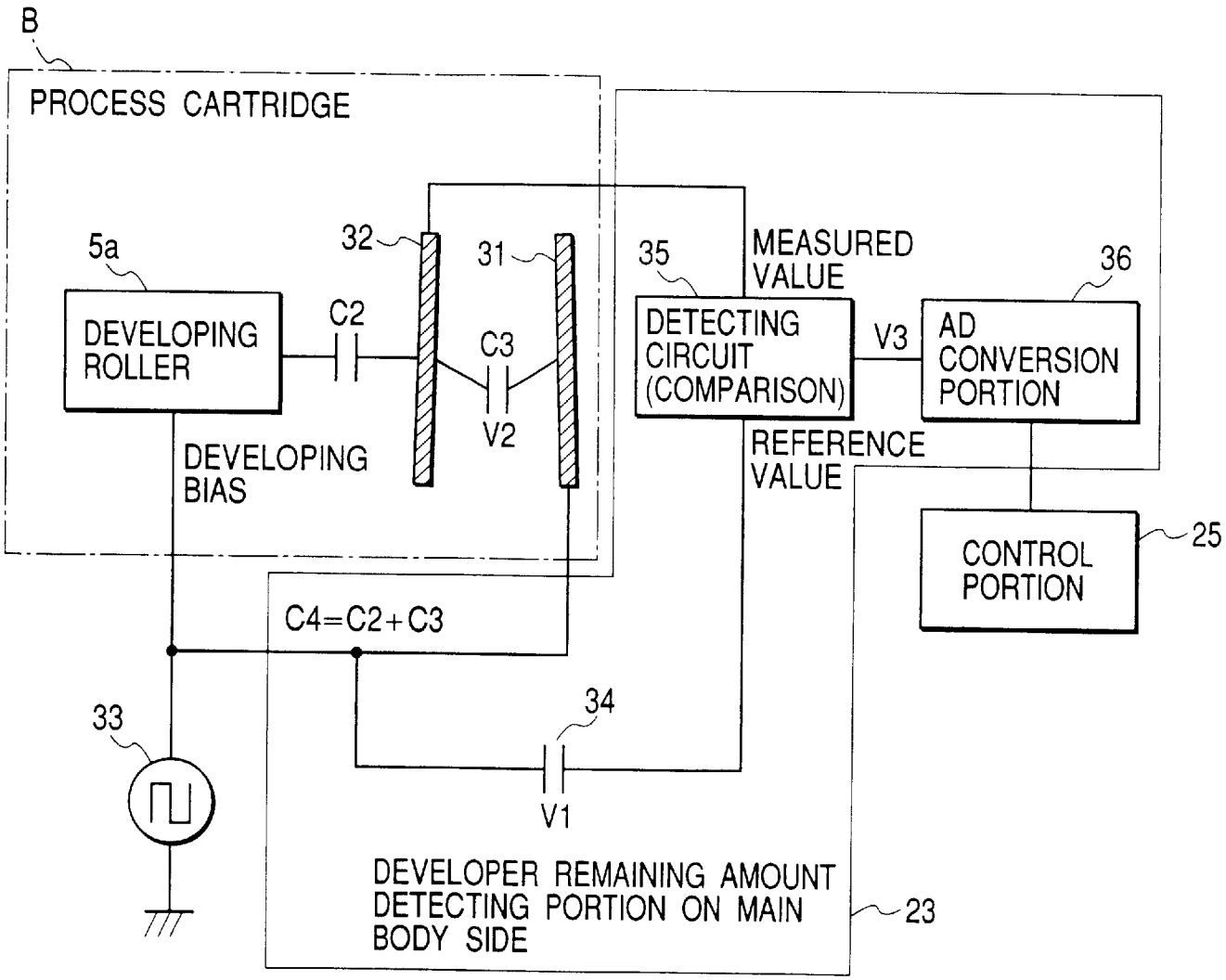
FIG. 31 is a view showing a circuit arrangement of a developer amount detecting device used in the twelfth embodiment of the present invention.

Explaining the circuit arrangement of the developer amount detecting device also with reference to FIG. 31, in the illustrated embodiment, when the process cartridge B is mounted on the main body 100 of the image forming apparatus, the developing roller 5*a* and the input metal plate 31 are electrically connected to a developing bias circuit 33 as developing bias applying means acting as voltage applying means provided on the main body 100 of the image forming apparatus. An AC bias of about 2 KHz as the normal developing bias and a DC bias of about −400 V are applied to the developing roller 5*a* and the input metal plate 31.

When a predetermined AC bias from the developing bias circuit 33 is outputted, the applied bias are applied to a reference capacitor 34, developing roller 5*a* and the input metal plate 31, respectively. As a result, voltage V1 is generated on both ends of the reference capacitor 34, and electric current corresponding to the capacitance C4 is generated between the input metal plate 31 and the output metal plate 32. The electric current value is converted into voltage V2 by calculation. The capacitance C4 is the sum of the capacitance C2 between the developing roller 5*a* and the output metal plate 32 and the capacitance C3 between the input metal plate 31 and the output metal plate 32.

A detecting circuit 35 serves to form voltage V3 on the basis of a voltage difference between the voltage V1 generated on both ends of the reference capacitor 34, the voltage V2 between the input metal plate 31 and the output metal plate 32, and the voltage V3 is outputted to an AD converter portion 36. The AD converter portion 36 serves to output a result obtained by digital-converting the analog voltage V3 to the main body control portion 22.

In the main body control portion 22, on the basis of the digital-converted voltage value, the developer remaining amount level is determined by using a calculation portion 24, the control means 25 and the developer remaining amount correction table 26 shown in FIG. 32, as will fully described later.

Further, the main body control portion 22 seeks the remaining percentage (%) of the developer on the basis of the detected developer remaining amount, and the sought information or the alarm "absence of developer" informing the user of the fact that the developer is decreased to the extent that image formation with a predetermined quality is impossible is displayed on the display means 40 of the main body 100 of the apparatus.

In the following explanation, a signal ultimately outputted through the output metal plate 32 in accordance with the capacitance between the developing roller 5*a* and the output metal plate 32 and the capacitance between the input metal plate 31 and the output metal plate 32 is referred to merely as the "output from the developer remaining amount detecting means" or the "detected value of the developer remaining amount detecting means".

Now, the developer-remaining-amount detecting principle of the developer amount detecting device according to the illustrated embodiment will be described further in detail.

In the illustrated embodiment, as mentioned above, the capacitance value detected by the developer remaining amount detecting means 30 is inputted to the main body-side-developer-remaining-amount detecting portion 23 of the main body control portion 22 and is converted into the voltage value therein (the voltage value detected in the main body control portion 22 of the main body 100 of the image forming apparatus on the basis of the output of the developer remaining amount detecting means 30 is referred to merely as the "detected voltage value V3" hereinafter).

Figure 33:
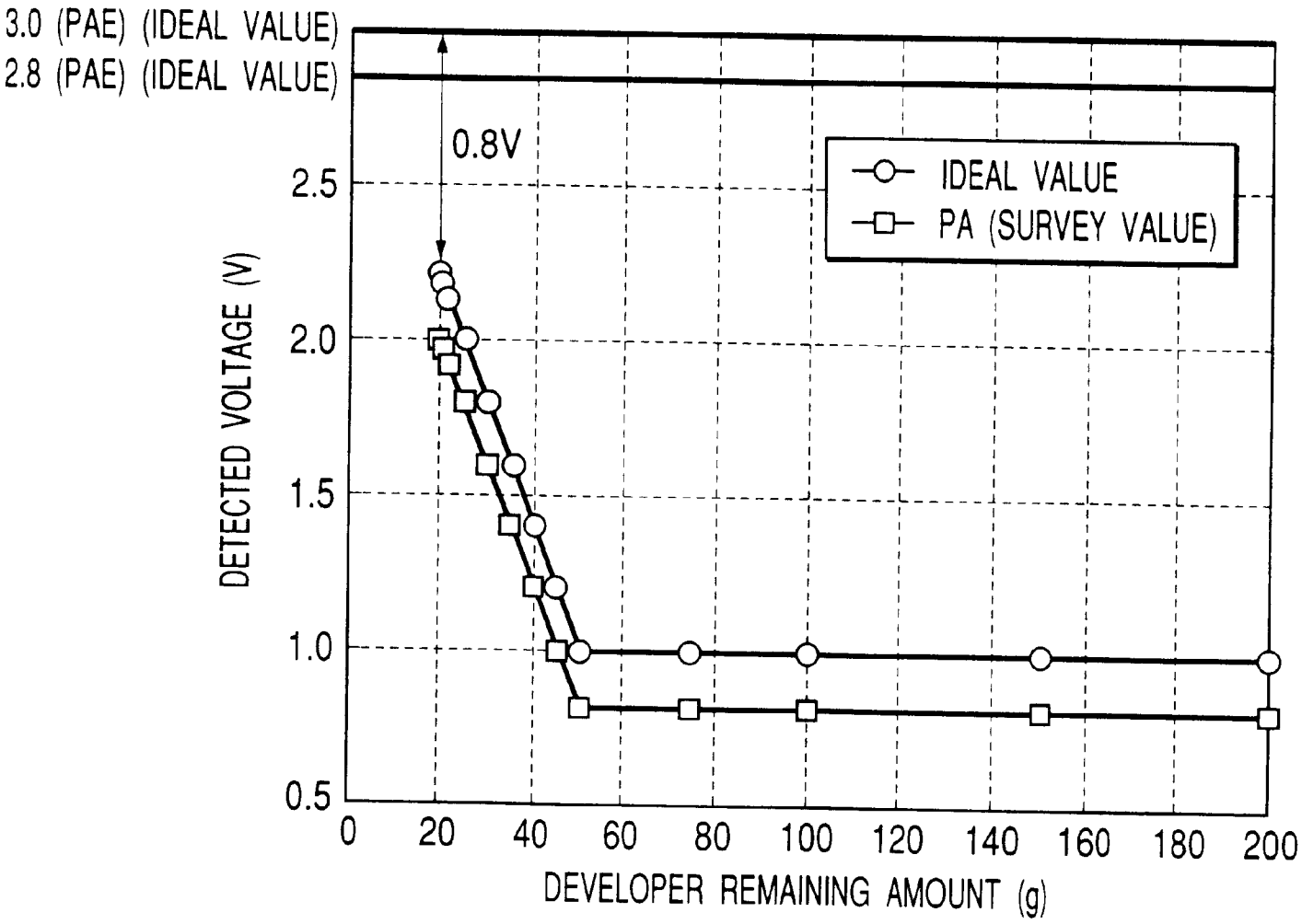
FIG. 33 is a graph showing the relationship between a detected voltage value of the developer amount detecting device constructed in accordance with the present invention and a developer remaining amount.

In the developer amount detecting device according to the illustrated embodiment, in accordance with the developer amount in the developing device C, for example, the voltage value as shown in FIG. 33 is outputted. In FIG. 33, the ordinate indicates a detected voltage value V3 corresponding to a value which is the sum of the capacitance value measured between the developing roller 5*a* and the output metal plate 32 as the developer remaining amount detecting means 30 and the capacitance value measured between the input metal plate 31 and the output metal plate 32, and the abscissa indicates the remaining amount of the developer in the developing device C. Further, FIG. 33 shows an ideal curve (-o-) of the detected voltage value detected by the developer amount detecting device, and a survey value PA (-□-) as an example that the detected voltage value is deviated from the ideal value due to individual or inherent differences of the cartridges as will be described later. Here, in the illustrated embodiment, from a relationship of the conversion circuit, as shown in the following relationship:

(capacitance, detected voltage)=(13 pF, 1.0 V), (18 pF, 0.8 V)

a decrease/increase relationship between the resultant capacitance (obtained by combining the capacitance between the developing roller 5*a* and the output metal plate 32 and the capacitance between the input metal plate 31 and the output metal plate 32) and the detected voltage has a reverse relationship, so that, when the capacitance detected by the developer-remaining-amount detecting means 30 is great, the detected voltage becomes small, and when the capacitance is small, the detected voltage becomes great.

Accordingly, under a condition that there is no developer between the developing roller 5*a* and the output metal plate 32 and between the input metal plate 31 and the output metal plate 32, the detected capacitance values show minimum values, and, in this case, the detected voltage values show maximum values (the maximum value of the detected voltage value of the developer-remaining-amount detecting means 30 is referred to as "PAE value (plate antenna empty value)" hereinafter).

In the illustrated embodiment, the PAE value is detected by using the developer-remaining-amount detecting means 30 before the developer-seal member 6 is unsealed under the condition that the process cartridge B is mounted to the main body 100 of the image forming apparatus. Namely, the plate antenna (input metal plate 31 and output metal plate 32) and the developing roller 5*a* as the developer-remaining-amount detecting means 30 are provided in the developing room 5A (first room) so that there is no developer between the developing roller 5*a* and the output metal plate 32 and between the input metal plate 31 and the output metal plate 32 until the developer-seal member 6 is unsealed. In the condition that there is no developer in the detecting areas of the developer-remaining-amount detecting means, the detected voltage value of the developer-remaining-amount detecting means 30 is the maximum value, i.e., PAE value. In the process cartridge B according to the illustrated embodiment, the PAE value is about 3.0 V.

Incidentally, in the illustrated embodiment, since the developing roller 5*a*, the output metal plate 32 located relatively near the developing roller 5*a*, and the input metal plate 31 located relatively near the output metal plate 32 are used as the developer-remaining-amount detecting means 30, in an arrangement relationship of the developer-remaining-amount detecting means 30, as shown in FIG. 33, when the developer within the developing device C is consumed so that half the developer or less than half the developer remains, an increase of the detected voltage value is started, and, thereafter, the reduction of the developer remaining amount can be detected successively until the developer is used up. With this arrangement, detection accuracy of the developer remaining amount at a specific location within the developing device C is enhanced, with the result that the developer remaining amount can be detected with high accuracy. However, the present invention is not limited to this example, but, as the developer-remaining-amount detecting means 30, an input side electrode and an output side electrode constituted by a plate antenna as is in the illustrated embodiment may be located at any positions within the developing device and, by measuring the capacitance between the electrodes, the remaining amount of the developer may be detected successively within a range from when much of the developer remains to when the developer is used up.

As mentioned above, in the developer-remaining-amount detecting means 30 of the plate-antenna type, the capacitance between the developer roller 5*a* and the output metal plate 32 as the electrode or the capacitance between the metal plates 31, 32 as the electrodes depends upon their respective positional relationship, with the result that there may be dispersion in the detected voltage value due to individual differences in process cartridges, due to dispersion in assembling tolerance of the plate antenna. Further, a dispersion in the detected voltage values occurs depending on the manufacturing lot of the developer to be contained, the usage environment, the tolerance of parts of the cartridge and the tolerance of electronic parts of the main body of the image forming apparatus.

Further, as the individual differences of the cartridges, for example, as shown in FIG. 33, the maximum value (PAE value) of the detected voltage value under the condition that there is no developer between the developing roller 5*a* and the output metal plate 32 and between the input metal plate 31 and the output plate 32 is differentiated between the ideal value (-o-) and the survey value PA (-□-) due to a deviation in positional relationship of the antenna plate.

That is to say, between the ideal value (-o-) and the survey value PA (-□-), for example, although the PAE value is 3.0 V in the ideal value, the PAE value becomes 2.8 V in the survey value PA.

As can be understood from FIG. 33, even when the dispersion in the detected voltage occurs in this way, in any cases, the curve configuration showing the relationship between the detected voltage and the and the developer remaining amount is not changed so long as the amount of the developer contained in the developing device C is identical, and, due to various factors as mentioned above, the detected voltage value is relatively deviated from the ideal curve (-o-), as the survey value PA (-□-) shown in FIG. 33.

The following Table 8 shows data regarding the developer remaining amounts and detected voltage of the ideal value (-o-) and the survey value PA (-□-) shown in FIG. 33.

TABLE 8

| deloveloper remaining amount (g) | Ideal value (V) | PA (V) (survey value) |
|---|---|---|
| 0 | — | — |
| 10 | — | — |
| 20 | 2.2 | 2.0 |
| 21 | 2.2 | 2.0 |
| 22 | 2.1 | 1.9 |
| 25 | 2.0 | 1.8 |
| 30 | 1.8 | 1.6 |
| 35 | 1.6 | 1.4 |
| 40 | 1.4 | 1.2 |
| 45 | 1.2 | 1.0 |
| 50 | 1.0 | 0.8 |
| 75 | 1.0 | 0.8 |
| 100 | 1.0 | 0.8 |
| 150 | 1.0 | 0.8 |
| 200 | 1.0 | 0.8 |

In this way, since there is a deviation in the detected voltage value due to the individual differences of process cartridges based on various factors, when the developer-remaining-amount level is detected by using a pre-set relationship between the detected value of the capacitance (detected voltage value) and the developer amount, the developer amount actually remaining in the developing device C may be deviated from the detected result.

Namely, if the developer remaining amount is determined only on the basis of the ideal curve representative of the relationship between the developer remaining amount and the detected voltage as shown in FIG. 33 and the Table 8, for example, when developer-remaining-amount detecting means in which the PAE value has an output property (2.8 V) smaller than the ideal value (3.0 V) as shown by the survey value (-□-) are used, if the developer amount is sought on the basis of the ideal curve (-o-), the developer amount will be estimated to be greater than the actual one.

As a result, for example, in a case where it is assumed that there is a danger of the occurrence of a so-called blank stripe (i.e., a condition in which a poor image is generated due to the fact that the entire image area cannot be visualized) at a time when the remaining amount of the developer becomes 20 grams, at a time when the detected voltage value becomes 2.2 V smaller than the PAE value (3.0 V) by 0.8 V in the ideal curve, the warning "absence of developer" can be displayed. In this case, in spite of the fact that the blank stripe image is actually generated when the detected voltage value is 2.0 V (2.8 V (PAE value)−0.8 V) in the survey value PA, if the developer remaining amount is determined only by the ideal curve, the fact that the detected voltage value is 2.0 V indicates the fact that the developer of 25 grams remains, with the result that the warning is not displayed until the detected voltage value becomes 2.2 V. Thus, in this case, the blank stripe image may be outputted before the user is informed of the warning.

On the other hand, in a case where the developer-remaining-amount detecting means in which the PAE value has an output property greater than the ideal curve (-o-) are used, contrary to the above, if the developer remaining amount is determined on the basis of the relationship between the developer remaining amount and the detected voltage value shown by the ideal curve, the developer amount will be estimated to be smaller than the actual one. Thus, if the alarming timing of "absence of developer" (there is the danger of the occurrence of a blank stripe image) is set on the basis of the ideal curve, at a time when the alarm is displayed, much developer remains in the developing device C, thereby discarding the developer in vain.

Figure 32:
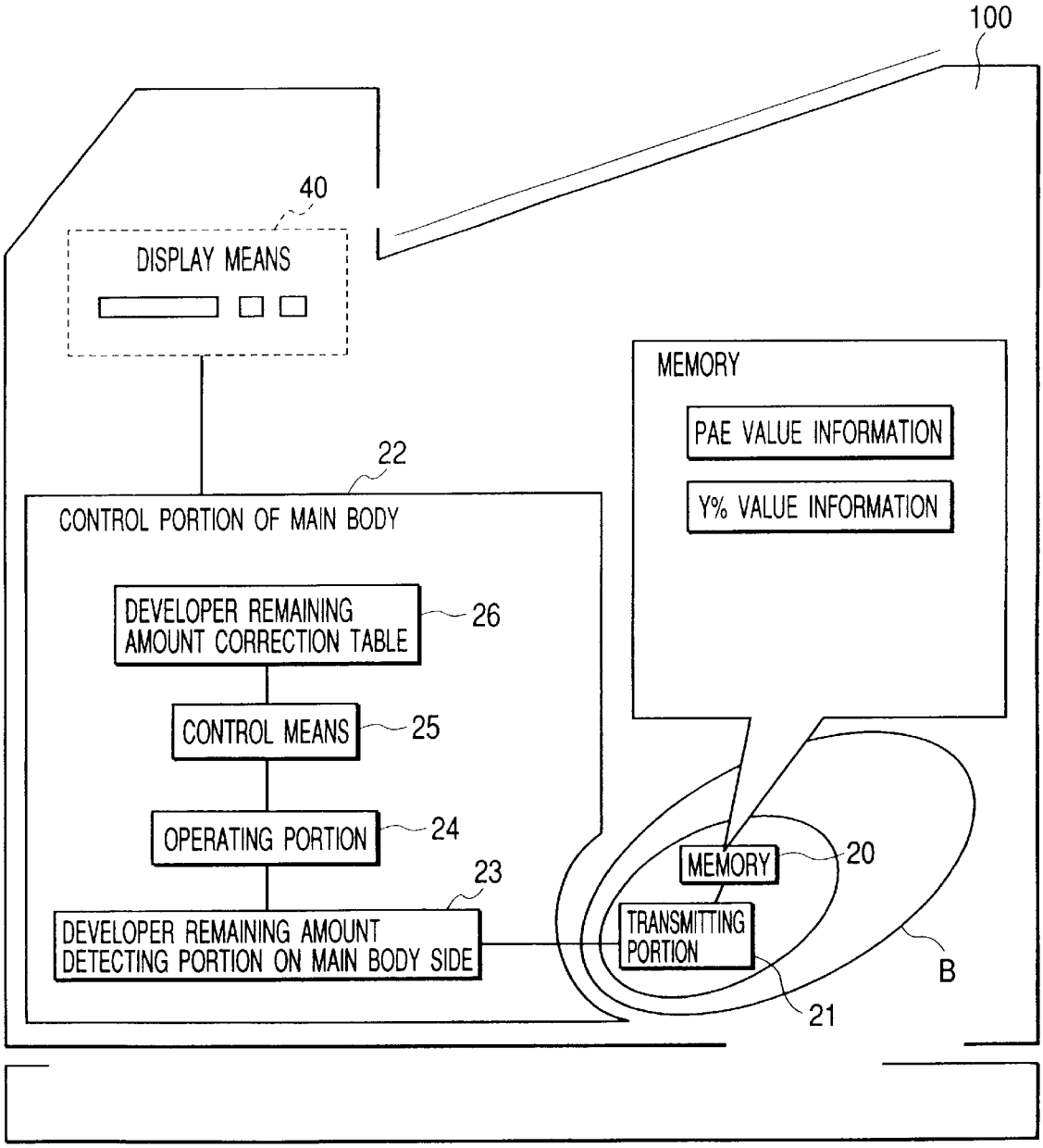
FIG. 32 is a schematic view showing the relationship between a process cartridge according to the twelfth embodiment and a main body of the image forming apparatus, for explaining a control arrangement of a memory of the cartridge.

To avoid this, according to the illustrated embodiment, as shown in FIGS. 29, 30 and 32, memory means 20 are provided on the process cartridge B, and memory means 20 is provided on the process cartridge B, and, by storing information corresponding to the output of the developer-remaining-amount detecting means 30 before the developer-seal member 6 is unsealed in the memory means 20, even if the output of the developer-remaining-amount detecting means 30 under the condition that there is no developer is different due to individual differences in process cartridges, such differences can be corrected, thereby achieving the correct detection of the developer remaining amount.

That is to say, more specifically, according to the illustrated embodiment, the following control is effected:

(1) The process cartridge B is provided with the memory means 20, and the detected voltage value, i.e., the PAE value of the developer remaining amount detecting means 30 detected by the main body 100 of the image forming apparatus before the developer-seal member 6 is unsealed is written in the memory means 20 provided on the process cartridge B.

(2) The developer remaining amount is calculated by utilizing the developer-remaining-amount-correction table in accordance with the changed amount of the detected voltage value from the PAE value, by using the PAE value stored in the memory means 20.

(3) The result is displayed on the display means 40 at any time.

In this way, the individual differences in the cartridges can be compensated for, thereby effecting more correct developer-remaining-amount detection successively.

First of all, the memory means 20 provided on the process cartridge B will be explained. As shown in FIGS. 29 and 30, according to the illustrated embodiment, the process cartridge B has a read/write memory 20 as the memory means 20 provided on an upper side surface of the waste-developer container 7*b*, and a cartridge-side transmitting portion 21 for controlling the reading/writing of information with respect to the memory 20. When the process cartridge B is mounted to the main body 100 of the image forming apparatus, the cartridge-side transmitting portion 21 is opposed to the main-body control portion 22 of the main body 100 of the image forming apparatus. Further, the main-body control portion 22 includes transmitting means of the main body 100 of the apparatus.

In the illustrated embodiment, although the memory 20 is provided on the upper side surface of the waste-developer container 7*b*, this is designed in consideration of the fact that, in the laser beam printer A according to the illustrated embodiment, since the process cartridge B is inserted into the main body 100 of the image forming apparatus with the waste-developer container 7*b* side as a leading end, the positioning of the communication means constituted by the cartridge-side transmitting portion 21 located adjacent to the memory 20 and the main-body control portion 22 of the main body 100 of the image forming apparatus can easily be effected.

As the memory means 20 used in the present invention, normal semiconductor electronic memories, such as a non-volatile memory or combination of a volatile memory and a back-up battery can be used without special limitation. Particularly, in the case of a memory of the non-contact type in which data communication between the memory 20 and a read/write IC is effected by an electromagnetic wave, since the cartridge-side transmitting portion 21 may not contact the main-body control portion 22, the danger of causing poor contact depending upon the mounting condition of the process cartridge B is eliminated, with the result that highly reliable control can be achieved. In the illustrated embodiment, a memory of the non-contact type is used as the memory means 20.

The main-body control portion 22 and the transmitting portion 21 constitute control means for effecting reading/writing of information with respect to the memory 20. The capacity of the memory 20 is sufficient to store the PAE value. Further, in addition to the PAE value, when other information is desired to be stored, a memory having the appropriate capacity can be selected. For example, a memory can be designed to have a capacity sufficient to store plural data, such as the cartridge usage amount and the cartridge property value. Further, information regarding the amount of usage of the cartridge and the detected voltage value obtained by the developer-remaining-amount detecting means 30 can be written and stored in the memory 20 at any time.

Next, the control arrangement of the memory 20 according to the illustrated embodiment will be explained.

As shown in FIG. 32, the process cartridge B is provided with the memory 20 and the transmitting portion 21, and the main body control portion 22 of the main body 100 of the image forming apparatus is provided with the main-body-side-developer-remaining-amount detecting portion 23, the calculation portion 24, the control means 25 and the developer-remaining-amount correction table 26.

As mentioned above, the electric current from the developer-remaining-amount detecting means 30 is measured by the electric-current measuring device 33 of the main body 100 of the image forming apparatus and is sent to the main-body-control portion 22 of the main body 100 of the image forming apparatus.

In the main-body-control portion 22, the output signal from the developer-remaining-amount detecting means 20 is converted into a voltage signal by the main-body-side-developer-remaining-amount detecting portion 23, and the calculation portion 24 effects a predetermined calculation process (described later) on the basis of the signals from the memory 20 of the process cartridge B and the main-body-side-developer-remaining-amount detecting portion 23, and, further, the control means 25 correct the developer-remaining-amount detected value properly by effecting verification of data obtained by the calculation portion 24 by using the developer-remaining-amount correction table 26, thereby determining the developer-remaining-amount level.

Further, in the main-body-control portion 22, the developer remaining amount (%) is sought on the basis of the detected developer remaining amount, and the sought information or the warning "absence of developer" is displayed on the display means 40 of the main body of the apparatus.

Although various information can be stored in the memory, in the illustrated embodiment, at least the detected voltage value (PAE value) of the developer-remaining-amount detecting means 30 before the developer-seal member 6 is unsealed, and, information regarding the detected developer remaining amount Y (%) are stored.

Further, the data stored in the memory 20 can always be communicated with respect to the calculation portion 24 of the main-body-control portion 22, so that the calculation is effected on the basis of the data and the data is verified by the control portion 25.

Next, a method for correcting the developer-remaining-amount detected value by using the memory 20 of the process cartridge B will be explained.

In the illustrated embodiment, after the process cartridge B was mounted to the main body 100 of the image forming apparatus and before the developer-seal member 6 is unsealed, the detected voltage value of the developer-remaining-amount detecting means 30 is measured, and the detected voltage value is written in the memory 20 as the PAE value.

Further, according to the illustrated embodiment, in the main-body-control portion 22, as a table for correcting the detected voltage value, a relationship between the change amount of the detected voltage value V3 from the PAE value and the developer remaining amount (g) in the developing device C is previously stored in the developer-remaining-amount-correction table 26. In the illustrated embodiment, as the change amount of the detected voltage value V3 from the PAE value, the difference (V) between the PAE value and the detected voltage value is corresponded to the developer remaining amount. The developer-remaining-amount correction table 26 used in the illustrated embodiment is shown in the following Table 9.

TABLE 9

| deloveloper remaining amount (g) | remaining amount display Y (%) | PAE - V3 |
|---|---|---|
| 0 | 0 (no toner) | — |
| 10 | 0 (no toner) | — |
| 20 | 0 (no toner) | from 0.8 |
| 21 | 1 | 0.8 to 0.84 |
| 22 | 2 | 0.84 to 0.88 |
| 25 | 5 | 0.88 to 1.0 |
| 30 | 10 | 1.0 to 1.2 |
| 35 | 15 | 1.2 to 1.4 |
| 40 | 20 | 1.4 to 1.6 |
| 45 | 25 | 1.6 to 1.8 |
| 50 | 30 | 1.8 to 2.0 |

As shown in the Table 9, in the illustrated embodiment, it is assumed that there is the danger of the occurrence the blank stripe image if the remaining amount in the developing device C becomes not more than 20 grams, and, it is set so that the warning "absence of developer" is displayed on the display means 40 of the main body 100 of the apparatus when the changed amount from the PAE value becomes 0.8 V or less. Further, in the illustrated embodiment, difference from the PAE value is divided with the appropriate interval between 0.8 and 2.0 V and is corresponded to the remaining amount of the developer. Further, in the illustrated embodiment, in the developer-remaining-amount table 26, the remaining amount (g) of the developer corresponds to the developer remaining amount (%) indicated by a percentage.

As a percentage indication of the developer remaining amount, the remaining percentage (%) of the developer with respect to the unused condition or the remaining percentage (%) of the usable developer with respect to the usable developer amount may be displayed. For example, when the developer amount in the unused condition is 200 grams and if the developer remaining amount becomes 20 grams or less, a blank stripe may occur, and therefore the amount of developer which can actually be used is 180 grams. The developer remaining amount (%) can be displayed on the basis of the remaining percentage of the developer with respect to this usable developer. The embodiment shown in the Table 9 shows an example that the remaining percentage of the usable developer with respect to the usable developer of 100 grams is displayed. Further, as is in the illustrated embodiment, due to the arrangement relationship of the developer-remaining-amount detecting means 30, when the increase of the detected voltage value (reduction of the capacitance) is started after the developer is consumed to some extent, regarding the display of the developer remaining amount (%) before the change in the detected voltage value is started, information for indicating a sufficient developer remaining amount, for example, "30% or more" or "100%" can be displayed.

In this way, in the calculation portion 24 of the main-body control portion 22, the changed amount of the detected voltage value from the PAE value is calculated on the basis of the detected voltage value inputted via the main-body-side-developer-remaining-amount detecting portion 23 and the PAE value stored in the memory 20 of the process cartridge B, and, in the control means 25, by comparing the changed amount calculated in the calculation portion 24 with the table (shown in the Table 9) stored in the developer-remaining-amount correction table 26, the remaining amount of the developer is determined and such information is displayed on the display means 40.

Next, a mechanism for storing the PAE value to the memory 20 according to the illustrated embodiment will be explained.

In the illustrated embodiment, as mentioned above, the voltage value detected by the developer-remaining-amount detecting means 30 before the developer-seal member 6 is unsealed within the main body 100 of the image forming apparatus is regarded as the PAE value.

As shown in FIG. 29, the developer-seal member 6 is provided between the developer containing container 4 and the developing room 5A of the process cartridge B. The seal member is not unsealed until the process cartridge B is used, and, in the illustrated embodiment, the seal member is automatically unsealed when the process cartridge B is mounted to the main body 100 of the image forming apparatus.

As the developer-seal member 6, a seal member that mechanically falls laterally by a cam or a seal member which can be taken up by rotation may be used. In the illustrated embodiment, a sealing member is used as the developer-seal member 6.

Figure 34:
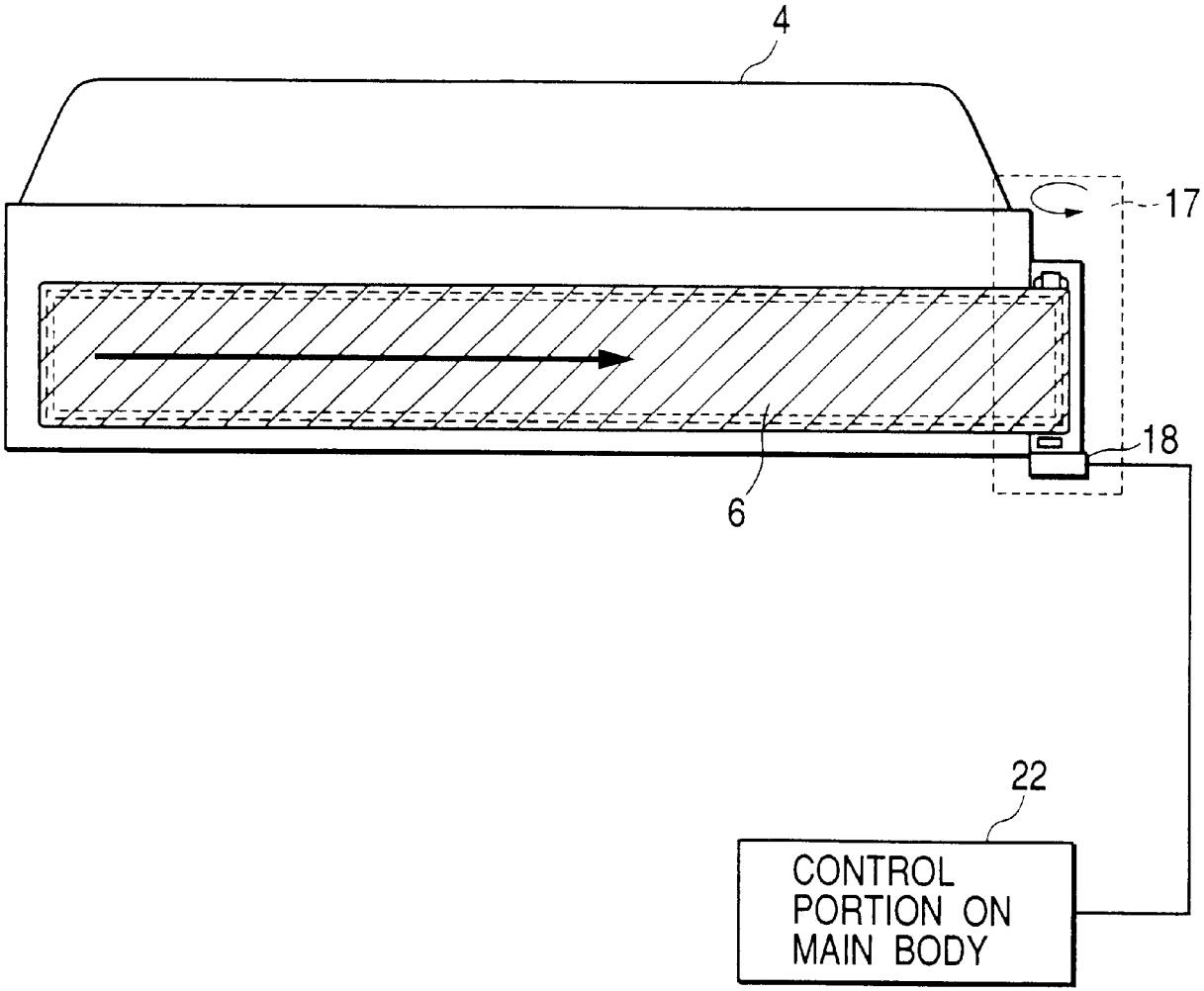
FIG. 34 is a longitudinal sectional view of a developer seal member.

FIG. 34 is a sectional view of the developer-seal member 6 and automatic unsealing means 17, looked at from the developing room side. In FIG. 34, the developing roller 5*a* and the developing blade 5*c* are not illustrated. In the illustrated embodiment, the automatic unsealing means 17 for the developer-seal member 6 is provided on the process cartridge B so that, a seal detecting portion 18 of the automatic unsealing means 17 receives an unseal signal from the main-body-control portion 22, the developer-seal member (sealing member) 6 is taken up or wound in a direction shown by the arrow in FIG. 34.

When the PAE information is stored in the memory 20, first of all, the main-body-control portion 22 judges whether the process cartridge B is mounted within the main body 100 of the image forming apparatus, and, thereafter, the main-body-control portion 22 judges whether the unseal signal for the developer-seal member 6 is inputted to the seal detecting portion 18. If it is judged that the seal member is not yet unsealed, the main-body-control portion 22 measures the detected voltage value V3 of the developer-remaining-amount detecting means 30, and the measured value is stored in the memory 20 as the PAE value.

Thereafter, the main-body-control portion 22 sends the unseal signal to the seal detecting portion 18, with the result that the developer-seal member 6 is automatically unsealed, thereby supplying the developer from the developer containing container 4 to the developing room 5A.

Figure 35:
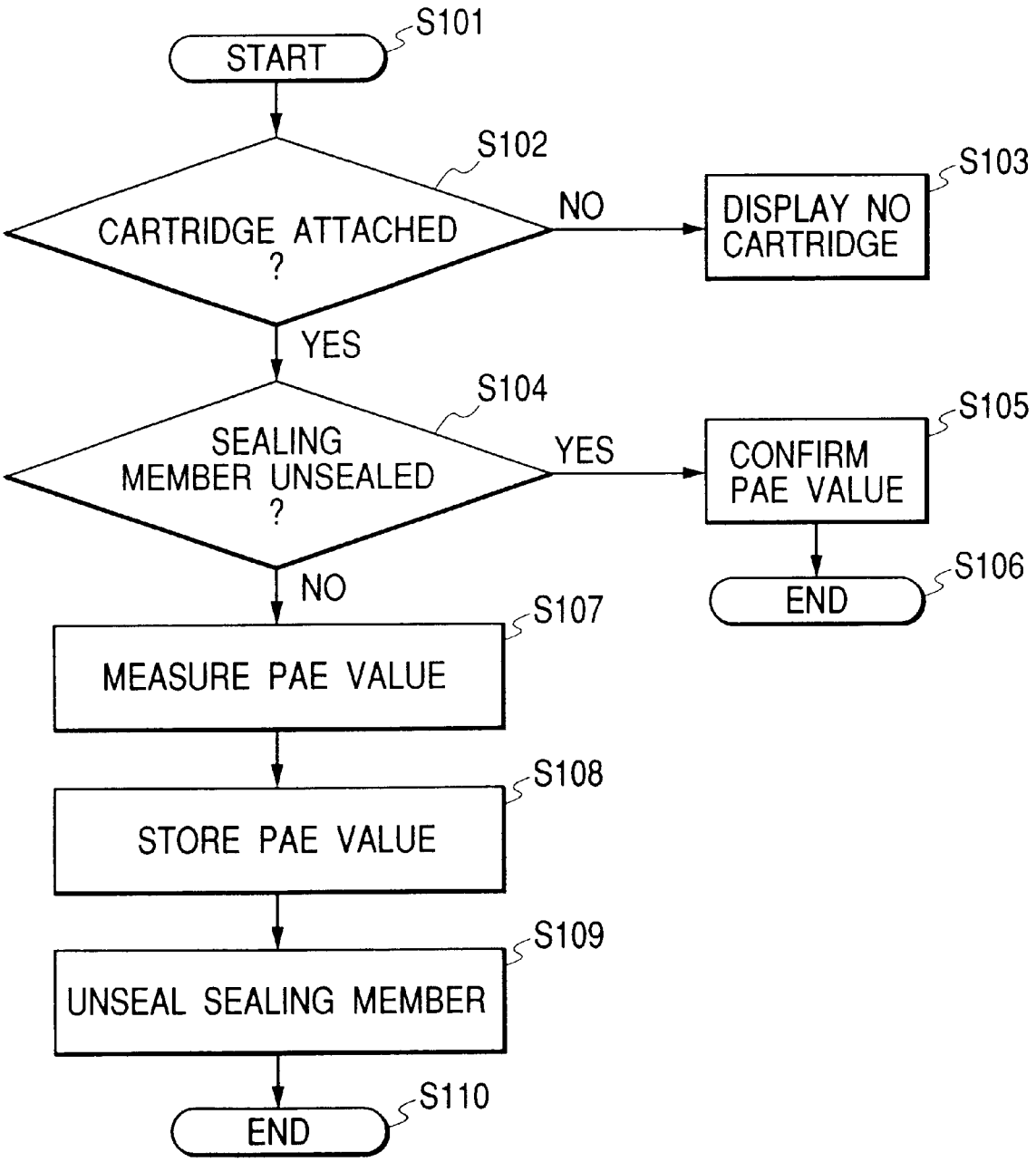
FIG. 35 is a flow chart showing a PAE value storing operation according to the twelfth embodiment.

Now, an embodiment of a storing operation for storing the PAE value in the memory and an automatic unsealing operation for the developer seal member 6 will be explained with reference to a flow chart shown in FIG. 35.

Step S101: A power supply of the main body 100 of the image forming apparatus is switched ON.

Step S102: The main body control portion 22 judges whether the process cartridge B is mounted within the main body 100 of the image forming apparatus. If it is judged as "NO", the sequence goes to a step S103, where "absence of developer" is displayed on the display means 40. If it is judged as "YES", the sequence goes to a step S104.

Step S104: The main-body-control portion 22 judges whether the process cartridge B is unsealed. If it is judged as "YES", the sequence goes to a step S105, where the PAE value is ascertained and the sequence is ended. If it is judged as "NO", the sequence goes to a Step S107.

Step S107: The detected voltage V3 is measured by the developer-remaining-amount detecting means 30.

Step S108: The detected voltage V3 measured in the step S107 is stored in the memory as the PAE value.

Step S109: The main body control portion 22 sends the unseal signal to the seal detecting portion 18, thereby unsealing the developer-seal member 6 automatically.

Step S110: The sequence is ended.

Figure 36:
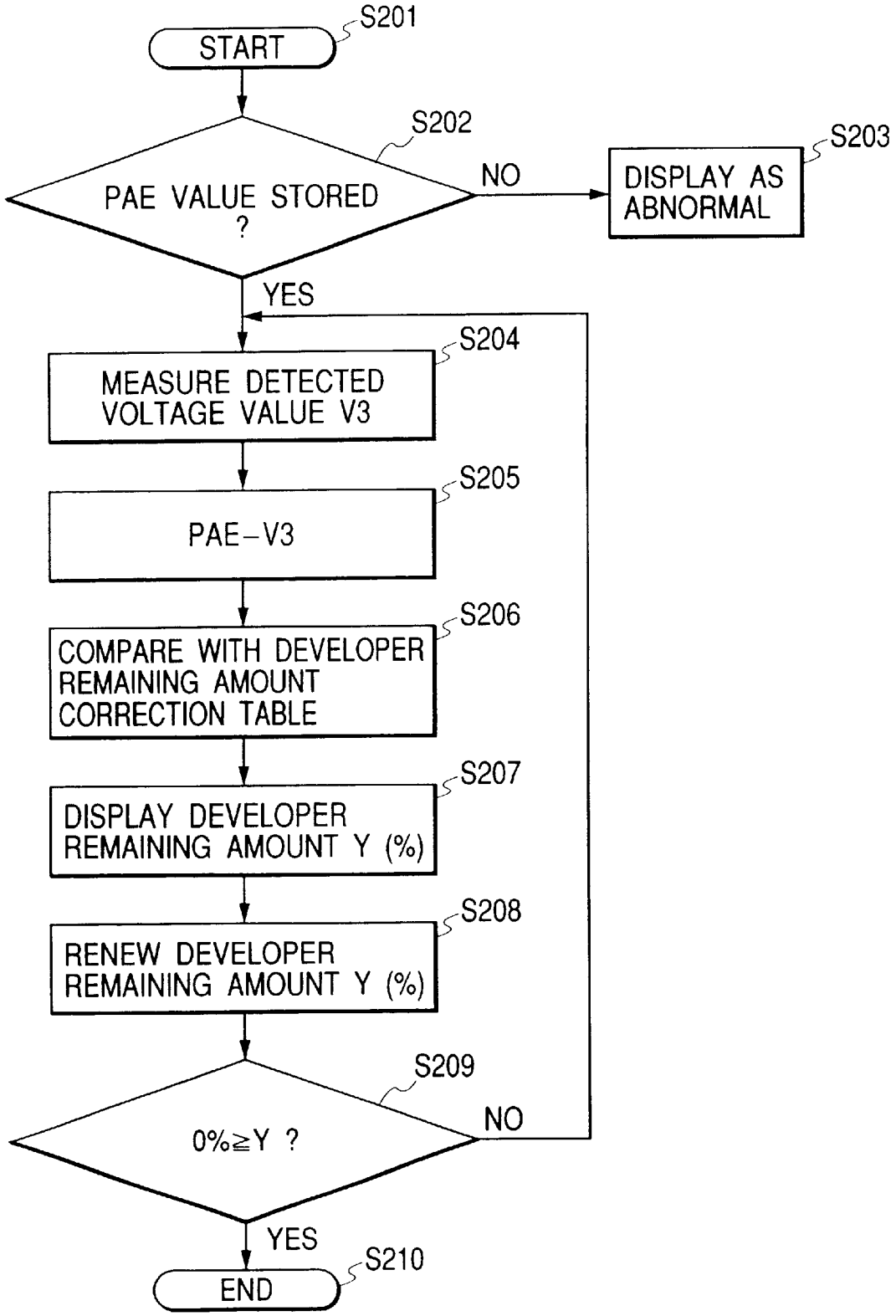
FIG. 36 is a flow chart for explaining a developer amount detecting operation using memory means of the cartridge according to the twelfth embodiment.

Next, an embodiment of a detecting operation for detecting the developer remaining amount will be explained with reference to a flow chart shown in FIG. 36. Incidentally, the used developer-remaining-amount correction table 26 is as shown in the Table 9.

Step S201: A power supply of the main body 100 of the image forming apparatus is turned ON.

Step S202: The main-body-side-developer-remaining-amount detecting portion 23 judges whether the PAE value is stored in the memory 20. If it is judged as "NO", the sequence goes to a step S203, where information for forming the abnormality of the process cartridge B is displayed on the display means 40 of the main body 100 of the image forming apparatus. If it is judged as "YES", the sequence goes to a step S204.

Step S204: The detected voltage value V3 is measured by the main-body-side-developer-remaining-amount detecting portion 23.

Step S205: The calculation portion 24 calculates the changed amount of the detected voltage value V3 from the PAE value on the basis of the relationship between the PAE value and the detected voltage value V3.

Step S206: The control portion 25 compares the value calculated by the calculation portion 24 in the step S208 with the developer remaining amount correction table 26.

Step S207: The control portion 25 sends the signal indicating the fact that the developer remaining amount is Y% to the display portion 40 of the main body 100 of the image forming apparatus, and such information is displayed on the display portion 40.

Step S208: The control portion 23 writes the detected developer-remaining-amount Y (%) information in the memory 20, thereby effecting renewal.

Step S209: The control portion 25 judges whether the developer-remaining-amount Y (%) reaches 0%. If NO, the sequence is returned to the step S204, where the above sequence is repeated; whereas, if YES, the sequence goes to a step S210.

Step S210: The sequence is ended.

Figure 37:
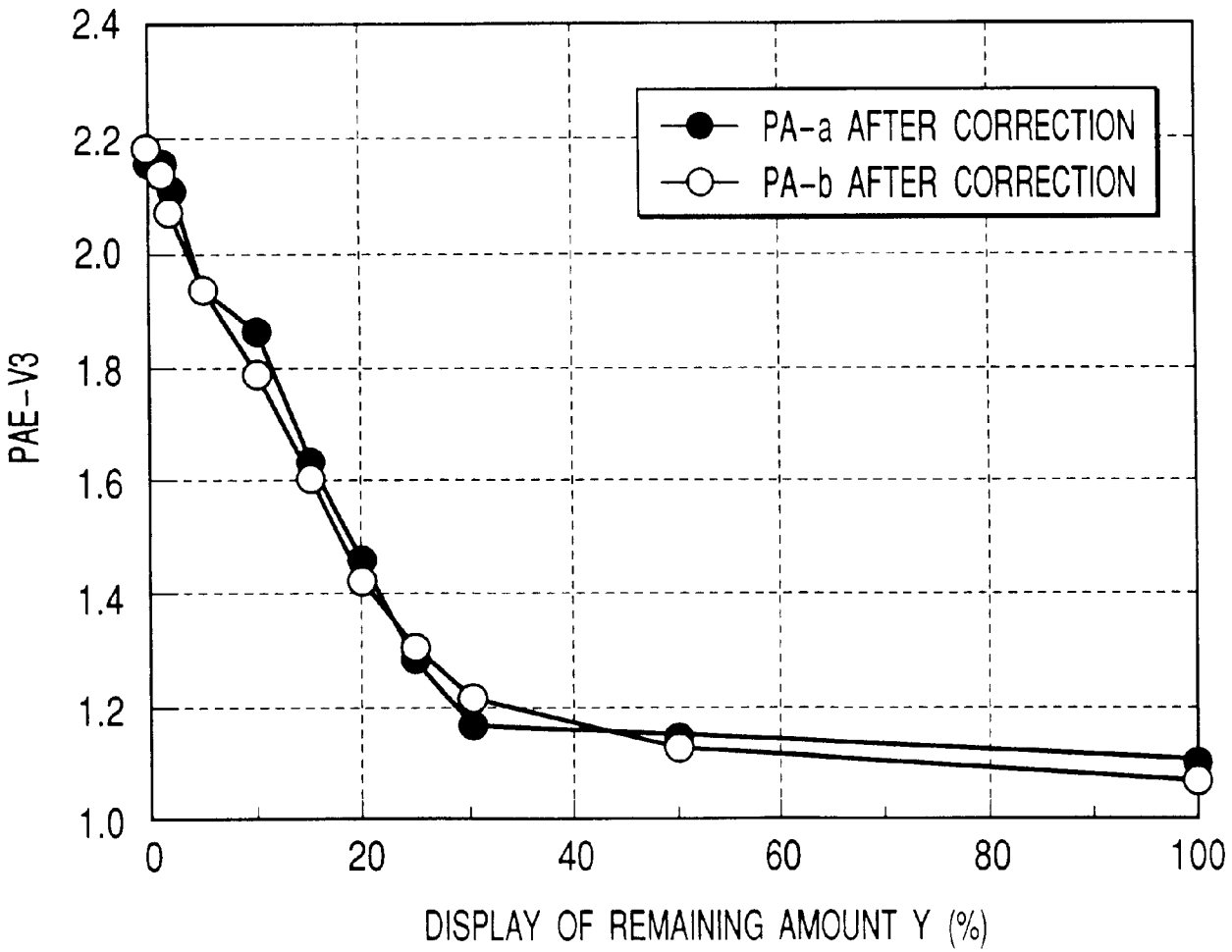
FIG. 37 is a graph for explaining the display of the developer remaining amount after the detected voltage value of the developer amount detecting device is corrected in accordance with the twelfth embodiment.

As a result that the indication of the developer remaining amount depending upon the consumption of the developer was evaluated with respect to two process cartridges B (PA-a, PA-b) including respective developer-amount detecting devices having different PAE values by effecting control in accordance with the above-mentioned flow chart, as shown in FIG. 37, it was found that the successive developer-remaining-amount detection eliminating the individual differences in process cartridges B can be achieved. In FIG. 37, the ordinate indicates the changed amount of the detected voltage value V3 obtained by the developer-amount detecting device from the PAE value, and the abscissa indicates the remaining amount display Y (%) of the developer in the developing device C.

As mentioned above, according to the present invention, even if the capacitance detected by the developer-remaining-amount detecting means 30 in the no developer condition is different from cartridge to cartridge due to the positional relationship of the developer-remaining-amount detecting means 30, by storing the output of the developer-remaining-amount detecting means 30 under the condition that the developer-seal member 6 is not unsealed, since the relationship between the developer remaining amount and the capacitance (the detected voltage value in the illustrated embodiment) detected by the developer-remaining-amount detecting means can be corrected and be grasped correctly on the basis of the output of the developer-remaining-amount detecting means under the condition that the developer is not loaded in the developing device C, the remaining amount of the developer can be detected correctly. Further, by displaying the information regarding the detected developer remaining amount, the user can be informed of the correct exchanging time (purchasing time) of the process cartridge.

Incidentally, in the illustrated embodiment, while an example that the correct developer remaining amount is calculated on the basis of the PAE value and the detected voltage value by using the developer-remaining-amount-correction table was explained, the detected voltage value may be corrected and the developer remaining amount may be calculated by using a function of predetermined weighting utilizing the PAE value.

Thirteenth Embodiment

Next, a thirteenth embodiment of the present invention will be explained. In the tenth embodiment, the construction of the image forming apparatus and process cartridge are fundamentally similar to those of the twelfth embodiment, but control of the developer-remaining-amount detection using the memory means 20 is different. Accordingly, elements having the same construction and function as those in the ninth embodiment are designated by the same reference numerals and a detailed explanation thereof will be omitted, and only characteristic portion of this embodiment will be described.

In the twelfth embodiment, the output voltage, i.e., PAE value of the developer-remaining-amount detecting means 30 before the developer-seal member 6 is unsealed under the condition that the process cartridge B is mounted to the main body 100 of the image forming apparatus is stored in the memory 20, and the relationship between the detected voltage of the developer-remaining-amount detecting means 30 and the developer remaining amount is corrected by using the PAE value.

To the contrary, in this embodiment, in addition to this, information regarding the output voltage value of the developer-remaining-amount detecting means 30 satisfying the condition that the developer is fully loaded in the developing device (referred to as "PAF value" (plate antenna full value) hereinafter) is also used.

Since the circuit arrangement of the developer-amount detecting device of the laser beam printer A according to this embodiment, the decrease/increase relationship between the detected voltage and the capacitance detected by the developer-remaining-amount detecting means 30, and the mechanism for detecting the developer remaining amount are the same as those in the twelfth embodiment, a detailed explanation thereof will be omitted.

As explained in connection with the twelfth embodiment referring to FIG. 33, when the developer-seal member 6 is unsealed, the capacitance detected by the developer-remaining-amount detecting means 30 has a minimum value, and, in this case, the detected voltage V3 is the maximum value, i.e., PAE value. In the developer-remaining-amount detecting means 30 according to the illustrated embodiment, the PAE value is selected to about 3.0 V.

Further, when the developer is fully loaded between the developing roller 5*a* and the output metal plate 32 and between the input metal plate 31 and the output metal plate 32, the capacitance detected by the developer-remaining-amount detecting means 30 is a maximum value, and, in this case, the detected voltage V3 is the minimum value, i.e., PAF value.

According to the illustrated embodiment, as will be fully described later, the PAF value is measured by the developer-remaining-amount detecting means 30 when the loading of the developer is completed after the process cartridge B was mounted within the main body 100 of the image forming apparatus and the developer-seal member 6 was unsealed, and the measured value is stored in the memory 20. During the running of the laser beam printer A, the detected voltage of the developer-remaining-amount detecting means is always compared with the PAF value stored in the memory 20. If the detected voltage value shows the minimum value (capacitance is the maximum value), the value is renewed. In the illustrated embodiment, the PAF value is about 1.0 V.

As explained in connection with the twelfth embodiment, in the developer-remaining-amount detecting means 30 of the plate antenna type, the capacitance between the developing roller 5*a* and the output metal plate 32 as the electrode or the capacitance between the metal plates 31 and 32 as the electrodes depends upon the respective positional relationship, and there arises a dispersion in the detected voltage value of the developer-remaining-amount detecting means due to the individual differences in cartridges, such as a deviation in the positional relationship of the plate antenna. Further, such dispersion is also caused by the usage environment, the tolerance of parts of the cartridge and/or the tolerance of electronic parts of the main body of the image forming apparatus. Further, the dispersion in the detected voltage value of the developer-remaining-amount detecting means 30 is also caused due to the manufacturing lot of the developer to be contained.

Thus, there arise dispersion in the output value (PAE value) of the developer-remaining-amount detecting means 30 when there is no toner between the developing roller 5*a* and the output metal plate 32 and between the input metal plate 31 and the output metal plate 32 and dispersion in the detected voltage value (PAF value) when the developer is fully loaded between them.

In this way, since the detected voltage deviates due to the individual differences of the process cartridges and the image forming apparatus for the above-mentioned reasons, if the developer-remaining-amount level is detected only by using the pre-set relationship between the detected voltage value and the developer remaining amount, the amount of the developer actually remaining in the developing device C becomes different from the detected result.

As a result, for example, as explained in connection with FIG. 33, in a process cartridge B in which the output voltage value of the developer-remaining-amount detecting means when the developer is fully loaded in the developing device is smaller than the ideal value, if the developer remaining amount is detected only on the basis of the ideal curve representing the pre-set relationship between the detected voltage value and the developer remaining amount, the developer remaining amount will be estimated to be greater than the actual amount, with the result that a fault image, such as a blank stripe, is outputted before the user is informed of the warning "absence of developer". To the contrary, in a process cartridge B in which the output voltage value of the developer-remaining-amount detecting means when the developer is fully loaded in the developing device is greater than the ideal value, the developer remaining amount is estimated to be smaller than the actual amount, with the result that the alarm "absence of developer" is emitted in spite of the fact that there is much developer in the developing device.

To avoid this, in the illustrated embodiment, a weighting function utilizing the PAE value and the PAF value and the developer remaining amount is previously set, and, by successively introducing coefficients Z as correction values of the weighting function previously set with the predetermined interval to correspond to the developer remaining amount to a calculation formula representing the relationship between the weighting function and the detected voltage value V3 of the developer-remaining-amount detecting means 30, the coefficient Z establishing the predetermined relationship between the weighting function and the detected voltage value V3 is determined. Thereafter, the developer remaining amount is determined on the basis of a pre-set developer-remaining-amount correction table 28 in which the coefficients Z correspond to respective developer remaining amounts. By effecting such control, even when the PAE value and the PAF value are different from cartridge to cartridge due to the individual differences in the cartridges, the relationship between the detected voltage of the developer-remaining-amount detecting means 30 and the developer remaining amount can be corrected.

Explaining in more detail, according to the present invention, the following control is effected:

(1) The memory means 20 is provided on the process cartridge B, and the detected voltage value, i.e., the PAE value of the developer-remaining-amount detecting means 30 is written in the memory 20 of the process cartridge B within the main body 100 of the image forming apparatus before the developer-seal member 6 is unsealed.

(2) The minimum value, i.e., the PAF value of the developer-remaining-amount detecting means 30 (the maximum value of the capacitance value) is written in the memory 20 of the process cartridge B. The detected voltage value successively detected is compared with the previously written PAF value by the comparing means. If the detected value is smaller than the previous value, the PAF value in the memory means 20 is rewritten; whereas, if otherwise, the value is not rewritten. Such an operation is repeated for each detected value.

(3) The weighting function utilizing the relationship between the PAE value and the PAF value and the developer remaining amount is previously stored in the main-body-control portion 22 of the main body 100 of the image forming apparatus or in the memory means 20 of the process cartridge B.

(4) By successively introducing the coefficients Z as the correction values of the weighting function previously set with the predetermined interval to the predetermined relationship between the weighting function and the detected voltage value, the correction value (coefficient Z) is determined.

(5) The developer remaining amount is calculated by using the developer-remaining-amount correction table in which the coefficients correspond to respective developer remaining amounts.

(6) The result is displayed on the display means 40. By doing so, the individual differences in the cartridges is compensated for, and the remaining amount of the developer can successively be detected more correctly.

Next, the control arrangement of the memory 20 according to the illustrated embodiment will be explained.

Figure 38:
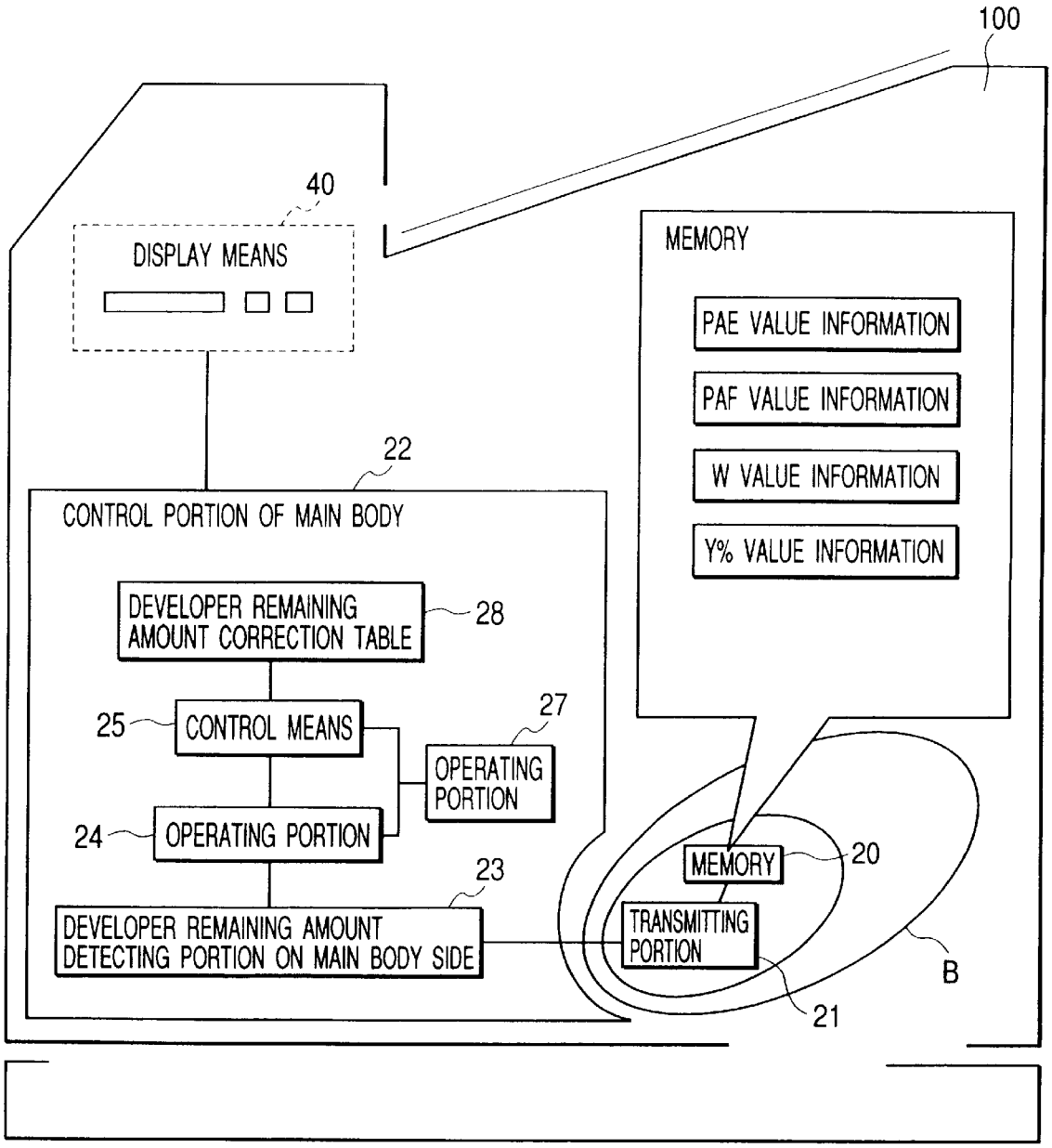
FIG. 38 is a schematic view showing the relationship between a process cartridge according to a thirteenth embodiment of the present invention and a main body of an image forming apparatus, for explaining a control arrangement of a memory of the cartridge.

In the illustrated embodiment, as shown in FIG. 38, similar to the twelfth embodiment, the process cartridge B is provided with the memory 20 and the transmitting portion 21, and the main body control portion 22 of the main body 100 of the image forming apparatus is provided with the main-body-side-developer-remaining-amount detecting portion 23, the calculation portion 24, the control means 25, the calculation formula 27 and the developer-remaining-amount-correction table 28.

As mentioned above, the output of the developer remaining amount detecting means 30 is sent to the main body control portion 22 of the main body 100 of the image forming apparatus. In the main body control portion 22, the output signal from the developer remaining amount detecting means 30 is converted into a voltage signal by the main-body-side-developer-remaining-amount detecting portion 23, and the calculation portion 24 effects a predetermined calculation process (described later) on the basis of the signals from the memory 20 of the process cartridge B and the main-body-side-developer-remaining-amount detecting portion 23 and the calculation formula 27, and, further, the control means 25 correct the developer-remaining-amount detected value properly by effecting verification of the data obtained by the calculation portion 24 by using the developer-remaining-amount-correction table 28, thereby determining the developer-remaining-amount level.

Further, in the main body control portion 22, the developer remaining amount (%) is sought on the basis of the detected developer remaining amount, and the sought information or the alarm "absence of developer" is displayed on the display means 40 of the main body 100 of the apparatus.

Although various pieces of information can be stored in the memory, in the illustrated embodiment, at least the output-voltage-value information (PAE value) of the developer remaining amount detecting means measured by the image forming apparatus before the developer-seal member 6 is unsealed, the minimum value information (PAF value) of the output voltage value of the developer remaining amount detecting means 30, and the W value information (described later fully) and information regarding the developer remaining amount Y (%) are stored.

The data stored in the memory 20 can always be communicated with respect to the calculation portion 24 of the main body control portion 22, so that the calculation is effected on the basis of the information and the data is verified by the control portion 25.

Next, a control method for controlling the detecting operation for detecting the developer remaining amount by using the memory 20 of the process cartridge B will be explained.

First of all, in the control method according to the illustrated embodiment, the following formula is set as a usage range of the developer:

$$(PAW\ \text{value}-PAF\ \text{value})=(PAE\ \text{value}-W-PAF\ \text{value}). \quad (1)$$

Namely, in consideration of the danger of the occurrence of the blank stripe image, the usage range of the developer is set between the detected voltage value, i.e., the blank stripe voltage (PAW value) corresponding to the developer amount at the time when the alarm "absence of developer" is emitted and the detected voltage value (PAF value) of the developer remaining amount detecting means in the condition that the developer is fully loaded.

Here, the PAW value (blank stripe voltage) has the following relationship:

$$PAW\ \text{value}=[(PAE\ \text{value})-(\text{experimental value } W \text{ based on accumulation of experimental data})]. \quad (2)$$

The blank stripe voltage (PAW value) is represented by the detected voltage value smaller than the PAE value at the time when the blank stripe image is generated. Namely, the value W (V) is different from the PAE value (detected voltage value), for example, at the time when the developer remaining amount is decreased to 20 grams (at which the alarm for the blank stripe image is effected in the twelfth embodiment) and is an experimental value based on the accumulation of the experimental data. In the developer-remaining-amount detecting means 30 according to the illustrated embodiment, the value W is 0.8 V (FIG. 33), and the usage range of the developer is represented by the following equation:

$$(PAW\ \text{value}-PAF\ \text{value})=(PAE\ \text{value}-W-PAF\ \text{value})=3.0-0.8-1.0=1.2\ (\text{V})$$

Next, the weighting function is:

$$F(PAF,PAE,W)=|PAF\ \text{value}+(PAW\ \text{value}-PAF\ \text{value})\times Z| \quad (3)$$

In the weighting function shown in the above equation (3), the coefficient Z is a correction value of the weighting function and is a value previously set to divide the usage range of the developer with an appropriate interval. And, the coefficients Z are previously made to correspond to the developer amounts to obtain the developer-remaining-amount-correction table 28 and are stored in the main body control portion 22. The developer-remaining-amount-correction table 28 used in the illustrated embodiment is shown in the following Table 10.

Incidentally, as shown in the Table 10, in the illustrated embodiment, it is designed so that, in consideration of the fact that there is a danger of generating a blank stripe image if the developer remaining amount in the developing device becomes not more than 20 grams, when the Z value of the developer amount detecting device decreases below 0.99, the alarm "absence of developer" is displayed on the display means 40 of the main body of the apparatus. Further, the weighting coefficient Z is divided with predetermined interval from 0.1 to 0.99 to correspond to the developer remaining amounts. Further, the developer remaining amount (g) corresponds to the developer remaining amount (%) for indicating the percentage of the developer remaining amount. The embodiment shown in the Table 10 shows an example how percentage of the usable developer remains with respect to the usable developer of 100 grams.

TABLE 10

| deloveloper remaining amount (g) | remaining amount display Y (%) | Y |
|---|---|---|
| 0 | 0 (no toner) | — |
| 10 | 0 (no toner) | — |
| 20 | 0 (no toner) | 0.99 |
| 21 | 1 | 0.95 |
| 22 | 2 | 0.89 |
| 25 | 5 | 0.78 |
| 30 | 10 | 0.65 |
| 35 | 15 | 0.50 |
| 40 | 20 | 0.35 |
| 45 | 25 | 0.25 |
| 50 | 30 | 0.18 |
| from 100 | 100 | 0.10 |

The calculation formula 27 indicating the relationship between the weighting function F(PAF,PAE,W) shown in the above equation (3) and the detected voltage value V3 and represented by the following relation (4) is stored in the main body control portion 22:

$$|PAF+(PAW-PAF)\times Z|\leqq|V3|. \quad (4)$$

And, the developer remaining amount is determined by successively introducing the coefficients Z into the relation (4). That is to say, when the developer remaining amount is detected, for example, first of all, the weighting coefficient Z (=0.1) corresponding to an area where the developer amount is greatest in the developer-remaining-amount-correction table 28 shown in the Table 10 is introduced into the relation (4). If the relation is not established, it is judge that the developer remaining amount is greater than 100 grams, and for example, the fact that the developer remaining amount is 100%, is displayed on the display means 40. Further, when Z=0.10, is introduced, if the relationship (4) is established, it is judged that the developer is deceased below 100 (g), and the weighting coefficient (Z=0.18) corresponding to the smaller developer-remaining-amount area following to the previous area (Z=0.10) in the developer-remaining-amount-correction table shown in the Table 10 is introduced into the relationship (4). If this relationship is not established, it is judged that the developer remaining amount is 50 grams, and, for example, the fact that the developer remaining amount is 30%, is displayed on the display means 40.

Namely, in the illustrated embodiment, the weighting coefficients Z corresponding to the developer remaining amounts in the developer-remaining-amount-correction table 28 shown in the Table 10 are introduced, successively from the smallest coefficient, into the relationship (4). And, if the relationship (4) is established, the calculation is repeated by introducing a succeeding greater Z value into the relationship (4) until the relationship (4) is not established, thereby determining the Z value by which the relationship (4) cannot be established thereby to recognize the developer remaining amount.

Figure 39:
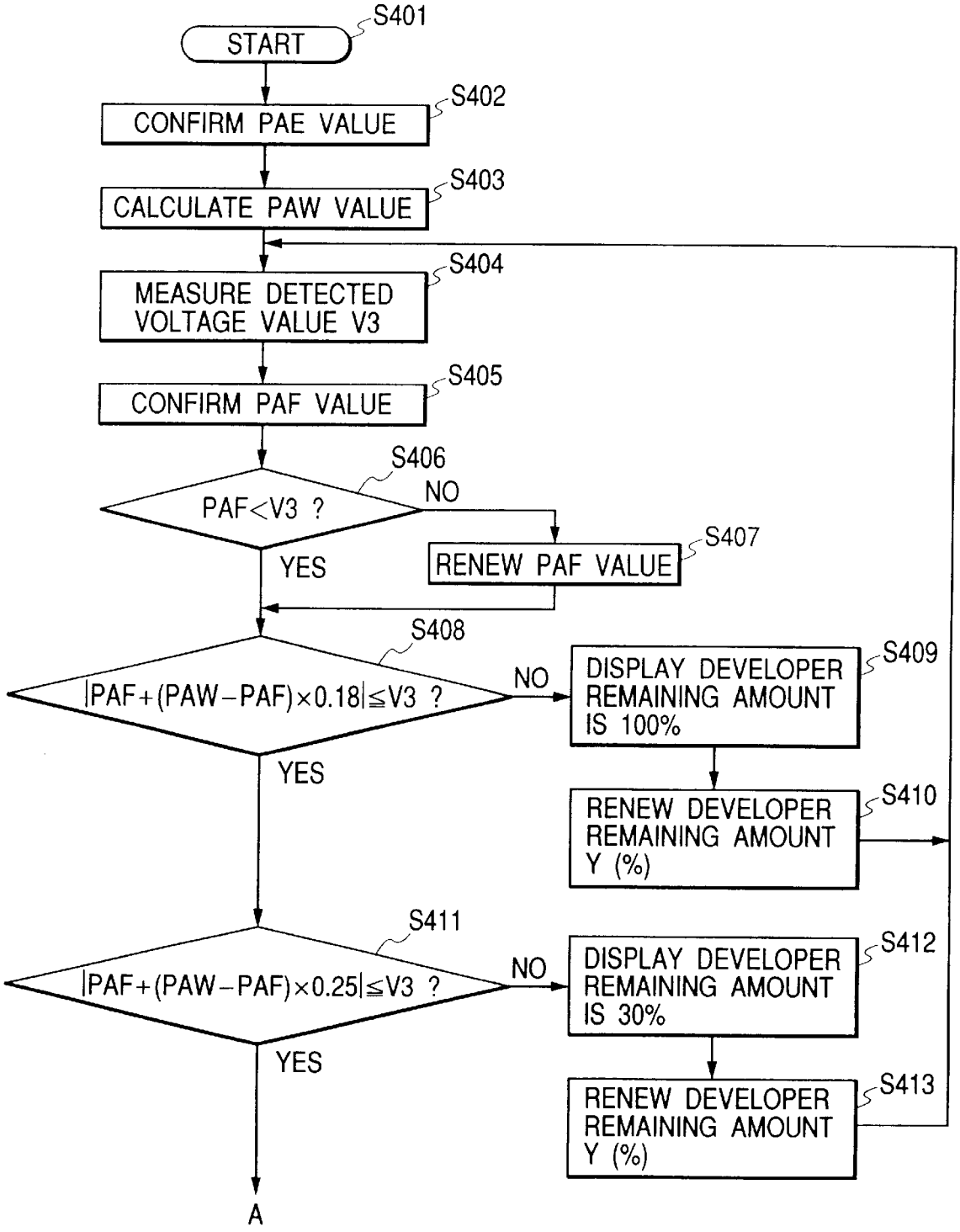
FIGS. 39 to 41 are a flow chart for explaining a developer amount detecting operation using memory means of the cartridge according to the thirteenth embodiment.
Figure 40:
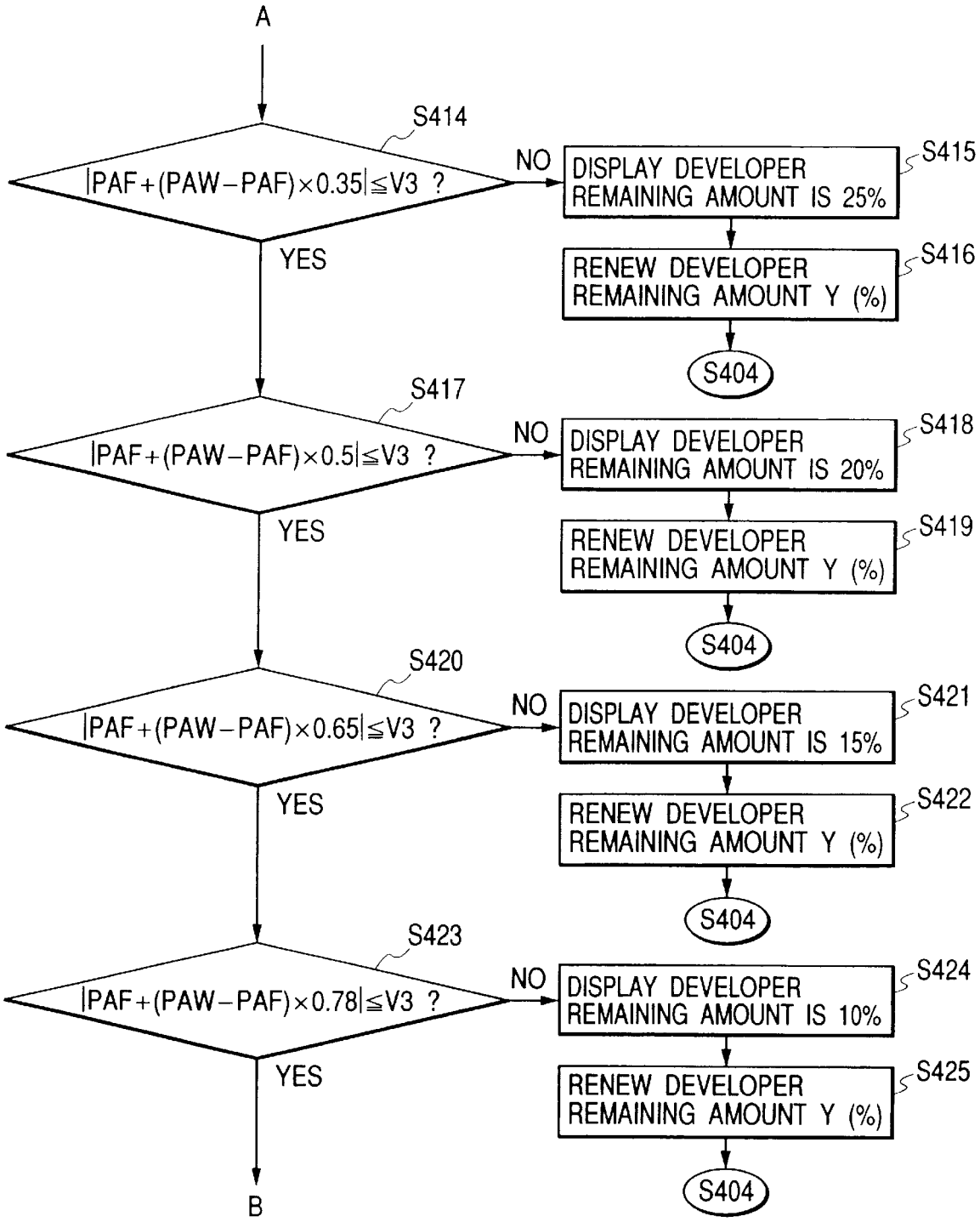
Figure 41:
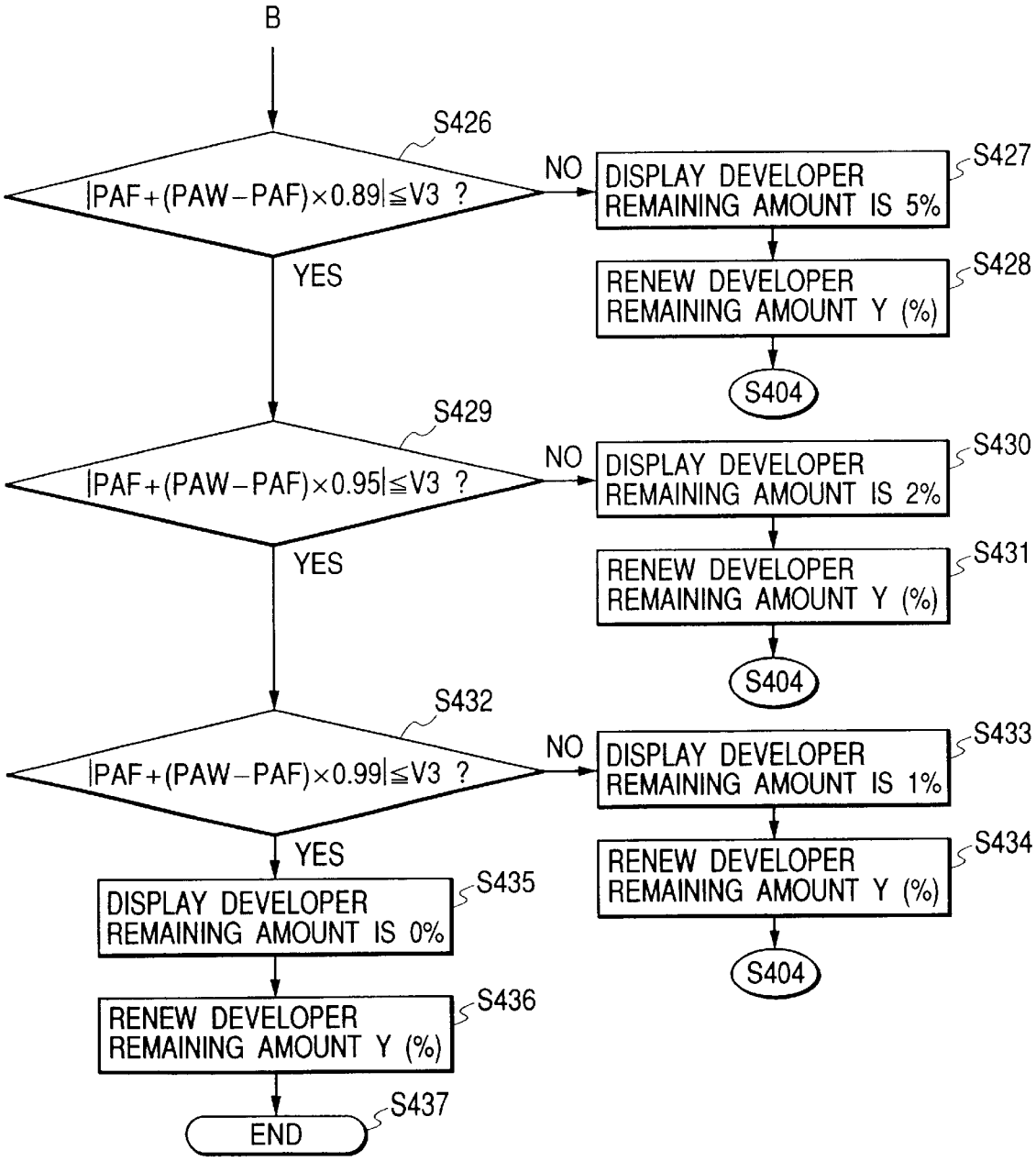

Next, an embodiment of a detecting operation for detecting the developer remaining amount according to the illustrated embodiment will be explained with reference to a flow chart shown in FIGS. 39 to 41. Incidentally, the developer-remaining-amount-correction table 28 used is as shown in the Table 10. The PAE value is stored in the memory 20 of the process cartridge M in accordance with the flow chart shown in FIG. 36 as explained in connection with the twelfth embodiment. Further, the experimental value (0.8 V in the illustrated embodiment) seeking the PAW value and based on the accumulation of experimental data is stored in the memory 20 at the manufacture of the process cartridge B.

Step S401: A power supply of the main body 100 of the image forming apparatus is switched ON.

Step S402: The control means 25 ascertain the PAE value in the memory 20.

Step S403: The calculation portion 24 calculates the PAW value on the basis of the W value and PAE value stored in the memory 20.

Step S404: The main-body-side-developer-remaining-amount detecting portion 23 measures the detected voltage value V3.

Step S405: The control means 25 ascertain the PAF value in the memory 20.

Step S406: The control means 25 compare the PAF value stored in the memory 20 with the detected voltage value V3, thereby judging whether the detected voltage value V3 exceeds the PAF value or not. If NO, the sequence goes to a step S407, where the PAF value in the memory 20 is renewed, and then, the sequence goes to a step S408. If YES, the sequence goes to the step S408.

Step S408: The calculation portion 24 obtains the calculation value by introducing Z=0 in the developer-remaining-amount-correction table 28 into F(PAF,PAE,W), and the control means 25 judge whether the value V3 exceeds F(PAF,PAE,W) or not. If YES, the sequence goes to a step S411. If NO, the sequence goes to a step S409, where the control means 25 send the signal indicating the fact that the developer remaining amount is 100% to the display means 40 of the main body 100 of the image forming apparatus and such information is displayed on the display means 40, and then, the sequence goes to a step S410, where the developer remaining amount Y (%) information in the memory 20 is renewed. Thereafter, the sequence is returned to the step S404.

Step S411: The calculation portion 24 obtains the calculation value by introducing Z=0.25 in the developer-remaining-amount-correction table 28 into F(PAF,PAE,W) and the control means 25 judge whether the value V3 exceeds F(PAF,PAE,W) or not. If YES, the sequence goes to a step S414. If NO, the sequence goes to a step S412, where the control means 25 send the signal indicating the fact that the developer remaining amount is 30% to the display means 40 of the main body 100 of the image forming apparatus and such information is displayed on the display means 40, and then, the sequence goes to a step S413, where the developer remaining amount Y (%) information in the memory 20 is renewed. Thereafter, the sequence is returned to the step S404.

Step S414: The calculation portion 24 obtains the calculation value by introducing Z=0.35 in the developer-remaining-amount-correction table 28 into F(PAF,PAE,W), and the control means 25 judge whether the value V3 exceeds F(PAF,PAE,W) or not. If YES, the sequence goes to a step S417. If NO, the sequence goes to a step S415, where the control means 25 send the signal indicating the fact that the developer remaining amount is 25% to the display means 40 of the main body 100 of the image forming apparatus and such information is displayed on the display means 40, and then, the sequence goes to a step S416, where the developer remaining amount Y (%) information in the memory 20 is renewed. Thereafter, the sequence is returned to the step S404.

Steps S417 to 430: Similarly, in steps S417, S420, S423, S426 and S429, if it is judged as "YES", the Z value is gradually increased in accordance with the developer-remaining-amount-correction table 28 and is introduced into F(PAF,PAE,W). This sequence is repeated until the Z value becomes 0.95. Further, in the above steps, if it is judged as "NO", the developer remaining amounts (%) corresponding to the Z values in the developer-remaining-amount-correction table 28 are displayed, and the developer remaining amounts Y (%) are renewed, and the sequence is returned to the step S404.

Step S432: The calculation portion 24 obtains the calculation value by introducing Z=0.99 in the developer-remaining-amount-correction table 28 into F(PAF,PAE,W), and the control means 25 judge whether the value V3 exceeds F(PAF,PAE,W) or not. If NO, the sequence goes to a step S433, where the control means 25 send the signal indicating the fact that the developer remaining amount is 1% to the display means 40 of the main body 100 of the image forming apparatus and such information is displayed on the display means 40, and then, the sequence goes to a step S434, where the developer remaining amount Y (%) information in the memory 20 is renewed. Thereafter, the sequence is returned to the step S404. On the other hand, if YES, the sequence goes to a step S435.

Step S435: The control means 25 send the signal indicating the fact that the developer remaining amount is 0% to the display means 40 of the main body 100 of the image forming apparatus and such information is displayed on the display means 40.

Step S436: The control means 25 renew the developer remaining amount Y (%) in the memory 20.

Step S437: The sequence is ended.

Figure 42:
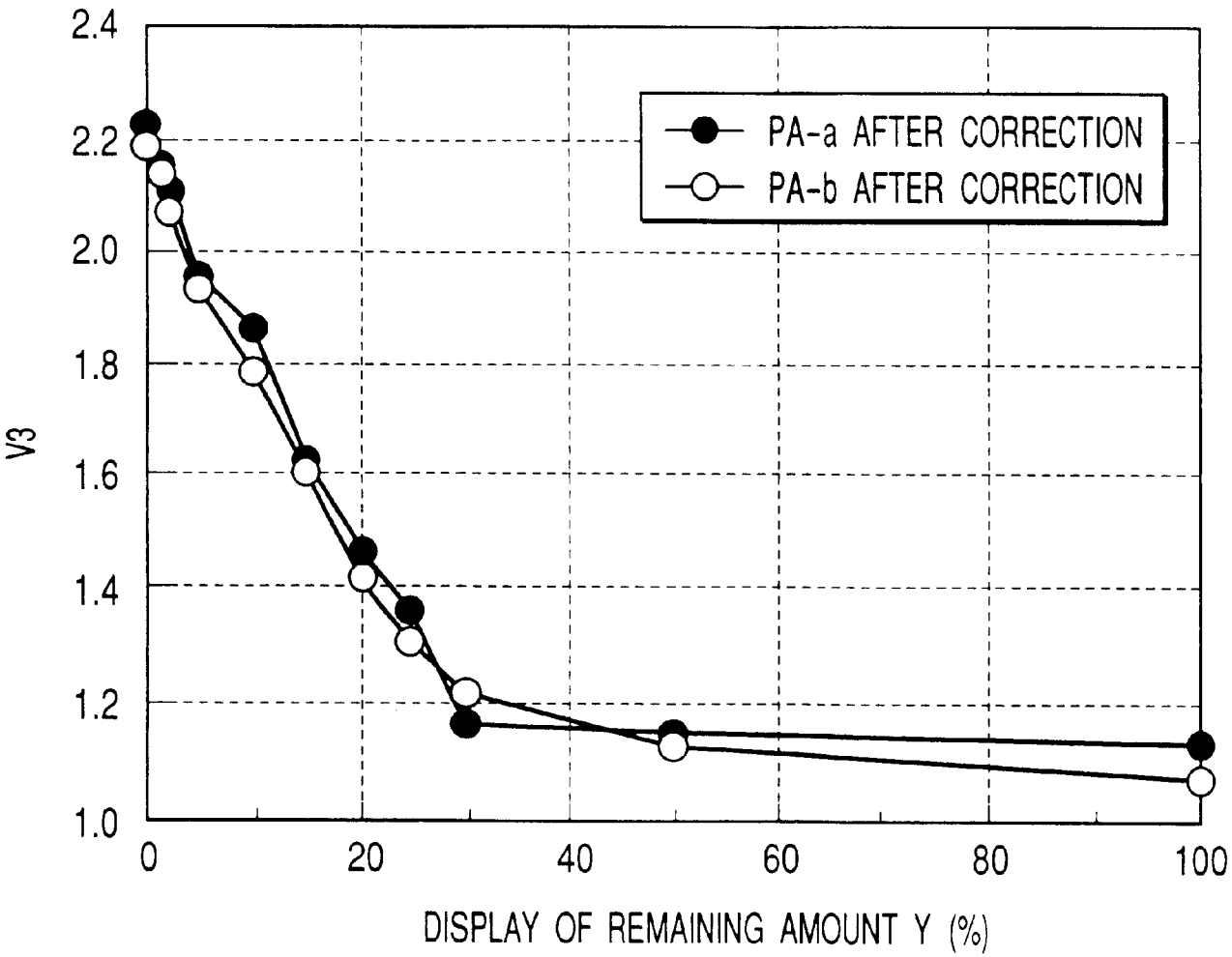
FIG. 42 is a graph for explaining the display of a developer remaining amount after a detected voltage value of a developer amount detecting device is corrected in accordance with the thirteenth embodiment.

As a result that the indication of the developer remaining amount depending upon the consumption of the developer was evaluated with respect to two process cartridges B (PA-a, PA-b) including respective developer amount detecting devices having different PAE and PAF values by effecting the control in accordance with the above-mentioned flow chart, as shown in FIG. 42, it was found that successive developer-remaining-amount detection in which individual differences of the process cartridges are eliminated B can be achieved. In FIG. 42, the ordinate indicates the detected voltage value V3 obtained by the developer amount detecting device, and the abscissa indicates the remaining amount display Y (%) of the developer in the developing device C.

As mentioned above, according to the present invention, even if the capacitance detected by the developer-remaining-amount detecting means 30 in the no developer condition and the capacitance detected by the developer-remaining-amount detecting means 30 in the developer full condition are different from cartridge to cartridge due to the positional relationship of the developer-remaining-amount detecting means 30, since the relationship between the developer remaining amount and the capacitances (detected voltage values) can be corrected, the remaining amount of the developer can be detected correctly.

Further, by storing the PAE and PAF values in the memory of the cartridge, even in a case where the cartridge is dismounted from the main body of the image forming apparatus and is exchanged to a new one on the way of the usage of the cartridge, when the dismounted cartridge is again mounted and used, by utilizing the information stored in the memory, the remaining amount of the developer can be detected always correctly.

Fourteenth Embodiment

A fourteenth embodiment of the present invention is characterized in that the developing device alone can be mounted to and dismounted from the printer (for example, FIG. 20).

The developing device according to this embodiment is constituted as a cartridge by integrally joining a developer room 5A holding developing means 5 such as a developing roller 5*a* and a developing blade 5*c* to a developer containing container 4 containing developer to be supplied to the developing means 5 via the plastic developer frame 11 and the developing frame 12. Namely, in the developing device C according to this embodiment, the developing device constituting parts of the process cartridge B explained in connection with the twelfth and thirteenth embodiments are integrated as a unit; that is to say, it is considered that parts other than the photosensitive drum 1, the charging means 2 and the cleaning means 7 of the process cartridge B are integrated as a unit. Accordingly, all of the developing device constituting parts and the construction of the developer amount detecting device explained in connection with the twelfth and thirteenth embodiments can similarly be applied to the developing device C according to the fourteenth embodiment.

However, this embodiment differs from the twelfth and thirteenth embodiments in that the memory 20 is provided on the developer containing container 4.

Also with the arrangement of this embodiment, the same technical effect as those in the twelfth and thirteenth embodiments can be achieved.

Fifteenth Embodiment

Next, a fifteenth embodiment of the present invention will be explained. Incidentally, since mechanical arrangements of a printer body and a cartridge and a developer-remaining detecting device are substantially the same as that of the above embodiment, an explanation thereof will be omitted.

Figure 43:
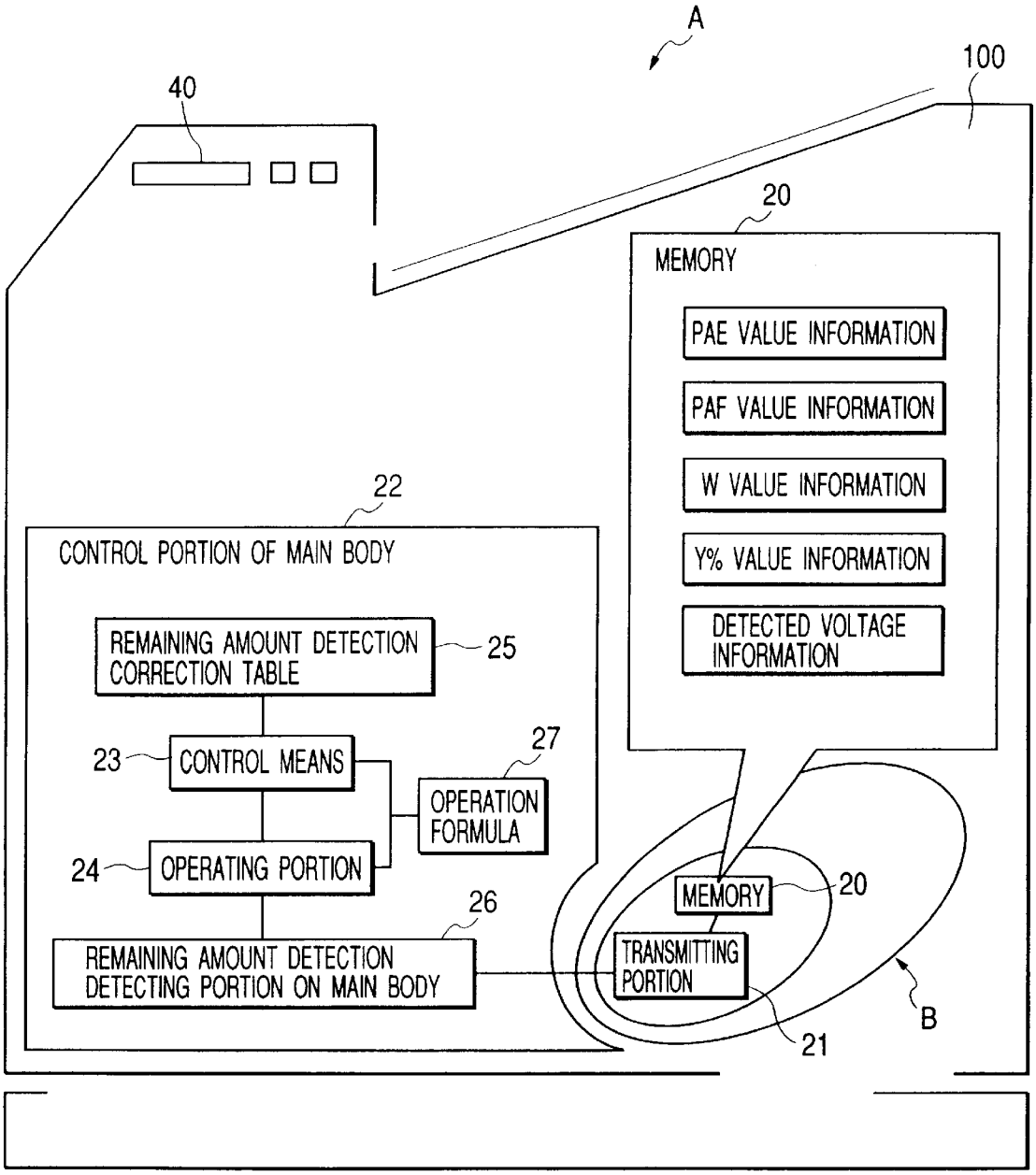
FIG. 43 is a schematic view showing the relationship between a memory of a process cartridge according to a fifteenth embodiment of the present invention and a control portion of a main body of an image forming apparatus.

FIG. 43 shows a constitution of the memory 20 in the present embodiment.

As shown in FIG. 43, the process cartridge B is provided with the memory 20 and the transmitting portion 21, and the main body control portion 22 of the main body 100 of the image forming apparatus is provided with the control portion 23, the calculation portion 24, the developer-remaining-amount-detection correction table 25, the developer-remaining-amount detecting portion 25, the calculation formula 27 and the developer remaining amount Y% correction table (not shown).

Although various data can be stored in the memory 20, in the illustrated embodiment, value information (referred to as "PAE" (plate antenna empty) hereinafter) under the condition that the developer is not loaded in the developer containing container 4, the minimum value information (referred to as "PAF" (plate antenna full) hereinafter) of the detected voltage value, the blank stripe W value information, the developer remaining amount Y% information and the detected voltage value information are stored.

Further, these memory data are always communicated with the calculation portion 24 of the main body control portion 22, and calculation is effected on the basis of these data, and the data is verified by the control portion 23. The detected voltage value detected by the remaining amount detecting portion 26 is stored in the memory 20 at any time.

The circuit arrangement for detecting the developer amount in the process cartridge is shown in the aforementioned FIG. 10. Regarding the developer amount, when predetermined AC bias is outputted from a developing bias circuit 34 as developing bias applying means, the applied bias are applied to a reference capacitor Cl, the developing roller 5*a* and the electrode 31, respectively. As a result, voltage V1 is generated on both ends of the reference capacitor C1, and electric current corresponding to capacitance C4 (C2+C3) is generated between the electrodes 31 and 32. Such electric current is converted into voltage V2 by calculation.

The detecting circuit of the electric current measuring device 33 forms voltage V3 on the basis of the voltage difference between the voltage V1 generated on both ends of the reference capacitor C1 and the voltage V2 between the electrodes, and the voltage V3 is outputted to the AD converter portion 35. The AD converter portion 35 serves to output a result obtained by digital-converting the analogue voltage V3 to the control portion 33. The control portion 33 recognizes the developer amount in the process cartridge on the basis of the voltage converted as the digital value.

Figure 44:
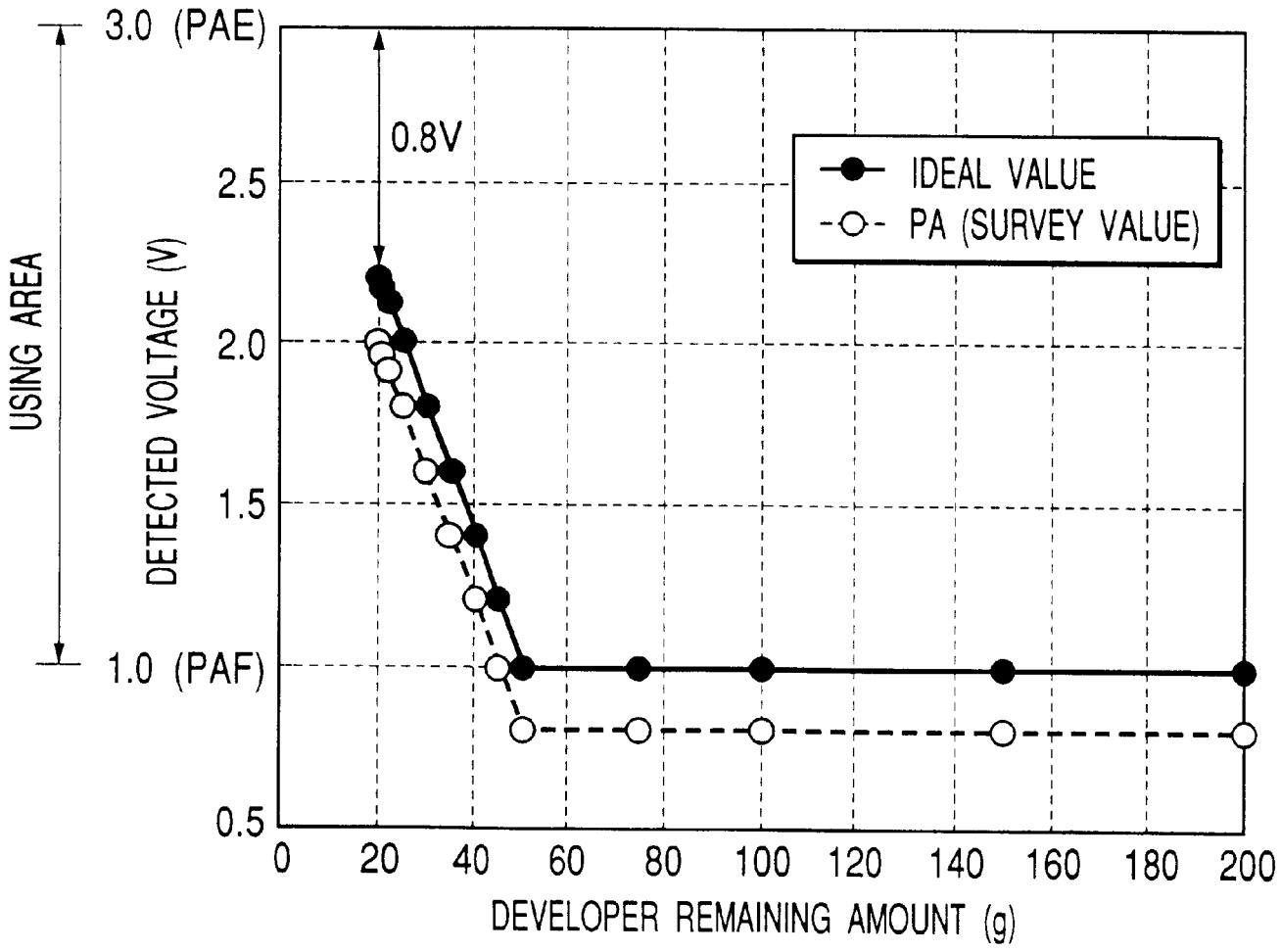
FIG. 44 is a graph showing the relationship between a detected voltage value of a developer amount detecting device constructed in accordance with the present invention and a developer remaining amount.

As mentioned above, in the illustrated embodiment, the capacitance value detected by the developer remaining amount detecting means 30 is converted into the voltage by the main body 100 of the image forming apparatus and is outputted in the form of the voltage value shown in FIG. 44. Under the condition that there is no developer within the developer containing container 4, the detected voltage value shows the maximum value, i.e., PAE value (capacitance is minimum). The PAE value is written in the memory 20 by a tool and the like at the manufacture of the process cartridge. Further, when the developer amount is a maximum, the detected voltage value shows the minimum value, i.e., PAF value (capacitance is maximum). The PAF value is written in the memory 20 under the condition that the loading of the developer is completed. Whenever the detected voltage value is a minimum (the capacitance is a maximum), the voltage value is renewed accordingly. Incidentally, the ideal PAE and PAF values in the illustrated embodiment are 3.0 V and 1.0 V respectively, as shown in the following Table 11.

Further, the relationship between the capacitance and the voltage varies with the circuit of the image forming apparatus, and the relationship between the capacitance and the voltage may be the same decrease function or increase function.

TABLE 11

| developer remaining amount (g) | Ideal value (V) | PA (V) (survey value) |
|---|---|---|
| 0 | (3.0) | |
| 10 | | |
| 20 | 2.2 | 2.0 |
| 21 | 2.2 | 2.0 |
| 22 | 2.1 | 1.9 |
| 25 | 2.0 | 1.8 |
| 30 | 1.8 | 1.6 |
| 35 | 1.6 | 1.4 |
| 40 | 1.4 | 1.2 |
| 45 | 1.2 | 1.0 |
| 50 | 1.0 | 0.8 |
| 75 | 1.0 | 0.8 |
| 100 | 1.0 | 0.8 |
| 150 | 1.0 | 0.8 |
| 200 | 1.0 | 0.8 |

Now, a conventional method for correcting the developer remaining amount and the capacitance value will be described.

In FIG. 44, the abscissa indicates the developer remaining amount in the developing device, and the ordinate indicates the detected voltage value, which is the sum of the capacitance C2 measured between the plate antennas 31 and 32 and the capacitance C3 measured between the developing roller 5*a* and the plate antenna 32. In FIG. 44, an ideal curve (-•-) shown by the solid line, and a relationship (-○-) shown by the broken line between the developer remaining amount sought from the PAE value and the detected voltage value are also illustrated. In any cases, the shapes of the curves are not changed so long as the developer amounts contained in the developing device are identical, and, as mentioned above, since the detected voltage values obtained in the no developer condition are different due to the deviation in the positional relationship between the antenna plates 31, 32, and the curves representing the relationship between the detected voltage value and the developer remaining amount sought on the basis of the ideal curve and the PA survey value are deviated from each other.

Figure 45:
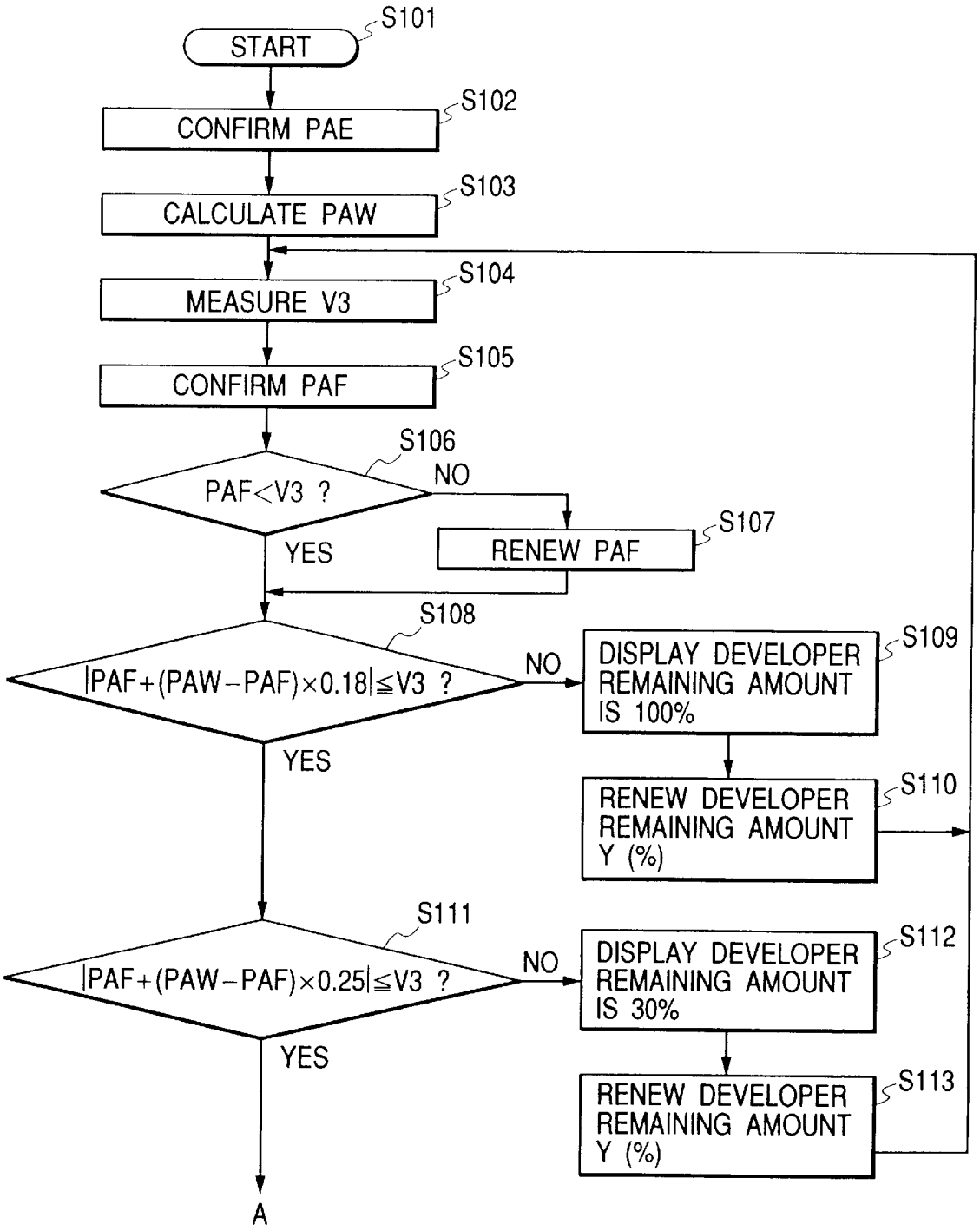
FIGS. 45 and 46 are a flow chart for explaining a developer amount detecting operation using memory means of the cartridge according to the fifteenth embodiment.

In order to emit the alarm before a condition (referred to as "blank stripe" hereinafter) that a poor image can be generated because the entire image area cannot be visualized due to a lack of developer as shown in FIGS. 44 and 45, in the illustrated embodiment, the alarm may be emitted when the detected voltage value becomes smaller than the PAE value by 0.8 V (developer remaining amount of about 20 grams).

However, if the developer remaining amount is judged only by the ideal curve, before the alarm "absence of developer" (blank stripe) should ultimately be emitted, the blank stripe may be generated. Namely, under the assumption that the blank stripe image would be generated when the developer remaining amount reaches 20 grams, if the detected voltage value corresponding to the occurrence of the blank stripe is sought on the basis of the ideal curve, it becomes 2.2 V. However, as is in the survey value, if the PAF value is 0.8 V, since the blank stripe may occur at 2.0 V, the blank stripe image may be outputted before the alarm "absence of developer" is emitted.

Furthermore, although almost not generated normally, if the developer does not reach the detecting area of the developer remaining amount detecting means because the developer condition is too bad to obtain a good image (however, a line image may be obtained), the PAF value of the detected voltage value will be detected to be greater than the normal or good developer condition (the capacitance is detected to be smaller). Further, when the relationship between the developer remaining amount and the detected voltage value is obtained by adding a certain value to such PAF value, the blank stripe image is generated before the alarm "absence of developer" is emitted. In order to prevent the occurrence of the blank stripe image also in consideration of such an irregular case, it is required that the correction be effected on the basis of not only the PAF value but also the PAE value to thereby avoid outputting of the blank stripe image.

Such dispersion in successive remaining amount detection inherent to the process cartridge is caused due to dispersion in the assembling tolerance of the remaining amount detecting antenna and the tolerance of parts of the cartridge and electronic parts of the main body of the apparatus. Thus, in the illustrated embodiment, the following control is effected:

(1) The memory means (memory) 20 is provided on the process cartridge, and the value (i.e., PAE value) measured by the tool under the condition that the developer is not loaded at the manufacture of the process cartridge is written in the memory of the process cartridge.

(2) The minimum value of the detected voltage value (maximum value of capacitance), i.e., the PAF value is obtained from the developer remaining amount detecting means and is written in the memory of the process cartridge. The detected voltage value successively detected is compared with the previously written value by the comparing means. If the detected value is smaller than the previous value, the PAF value in the memory means 20 is rewritten; whereas, if otherwise, the value is not rewritten. Such an operation is repeated for each detected value.

(3) The weighting function utilizing the relationship between the PAE value and the PAF value and the developer remaining amount is previously stored in the main body control portion or in the memory.

(4) By introducing the correction value of the weighting function to the relationship between the weighting function and the detected voltage value, the correction value is determined.

(5) The developer remaining amount is calculated by using the correction table.

(6) The result is displayed on the display means.

By the above control, even if the detected voltage value (capacitance value) is different due to the individual differences of the cartridges or even if the developer is hard to be entered into the detecting area of the developer remaining amount detecting means due to the abnormal developer condition, the alarm can surely be emitted before the blank stripe image is outputted, and the developer remaining amount can be detected successively.

Further explaining, in the above-mentioned control, the following formula is set as a usage range of the developer:

$$(PAE\ \text{value} - PAF\ \text{value}). \quad (1)$$

Further, in spite of the fact that the developer is remaining in the process cartridge, because of the smaller developer amount, a poor image such as the blank stripe image may be generated. The voltage value in this case is referred to as a blank stripe voltage, and, the usage range may be set on the basis of the relationship between the blank stripe voltage and the PAF value. The blank stripe voltage (PAW value) is represented as follows:

$$PAW\text{ value}=[(PAE\text{ value})-(\text{experimental value } W \text{ based on accumulation of experimental data})]$$

This value can be used in place of the PAE value in the above-mentioned relationship (1).

In the illustrated embodiment, the usage range is defined as follows:

$$(PAW\text{ value}-PAF\text{ value})=(PAE\text{ value}-W\text{ value}-PAF\text{ value}). \quad (2)$$

Since PAW=3.0−0.8=2.2 V and PAF=1.0 V, the usage range becomes 1.2 V (=2.2−1.0).

The weighting function is defined as follows:

$$F(PAF,PAE,W)=|PAF\text{ value}+(PAW\text{ value}-PAF\text{ value})\times Z|. \quad (3)$$

Where Z is a correction value and is a value dividing the usage range with an appropriate interval and is previously stored in the main body control portion as the successive detection-correction table.

And, the developer remaining amount is sought from Z by which the following relationship (4) is established:

$$|PAF+(PAW-PAF)\times Z|\leqq|V3| \quad (4)$$

On the basis of the successive detection correction table shown in the following Table 12, in the above relationship (4), Z=0.1 is not satisfied, the fact that the developer remaining amount is 100% is displayed; whereas, if Z=0.1 is satisfied, then Z=0.18 is introduced into the relationship (4). In this case, if not satisfied, the developer remaining amount becomes 30%. Namely, if the relationship (4) is satisfied by the higher order Z, the relationship (4) is checked while increasing the Z value successively until the relationship (4) is not satisfied. And, the developer amount is determined by the Z value which does not firstly satisfy the relationship (4).

TABLE 12

| developer remaining amount (g) | remaining amount display Y (%) | Z |
|---|---|---|
| 0 | 0 | |
| 10 | 0 | |
| 20 | 0 | 0.99 |
| 21 | 1 | 0.95 |
| 22 | 2 | 0.89 |
| 25 | 5 | 0.78 |
| 30 | 10 | 0.65 |
| 35 | 15 | 0.50 |
| 40 | 20 | 0.35 |
| 45 | 25 | 0.25 |
| 50 | 30 | 0.18 |
| from 100 | 100 | 0.10 |

Figure 46:
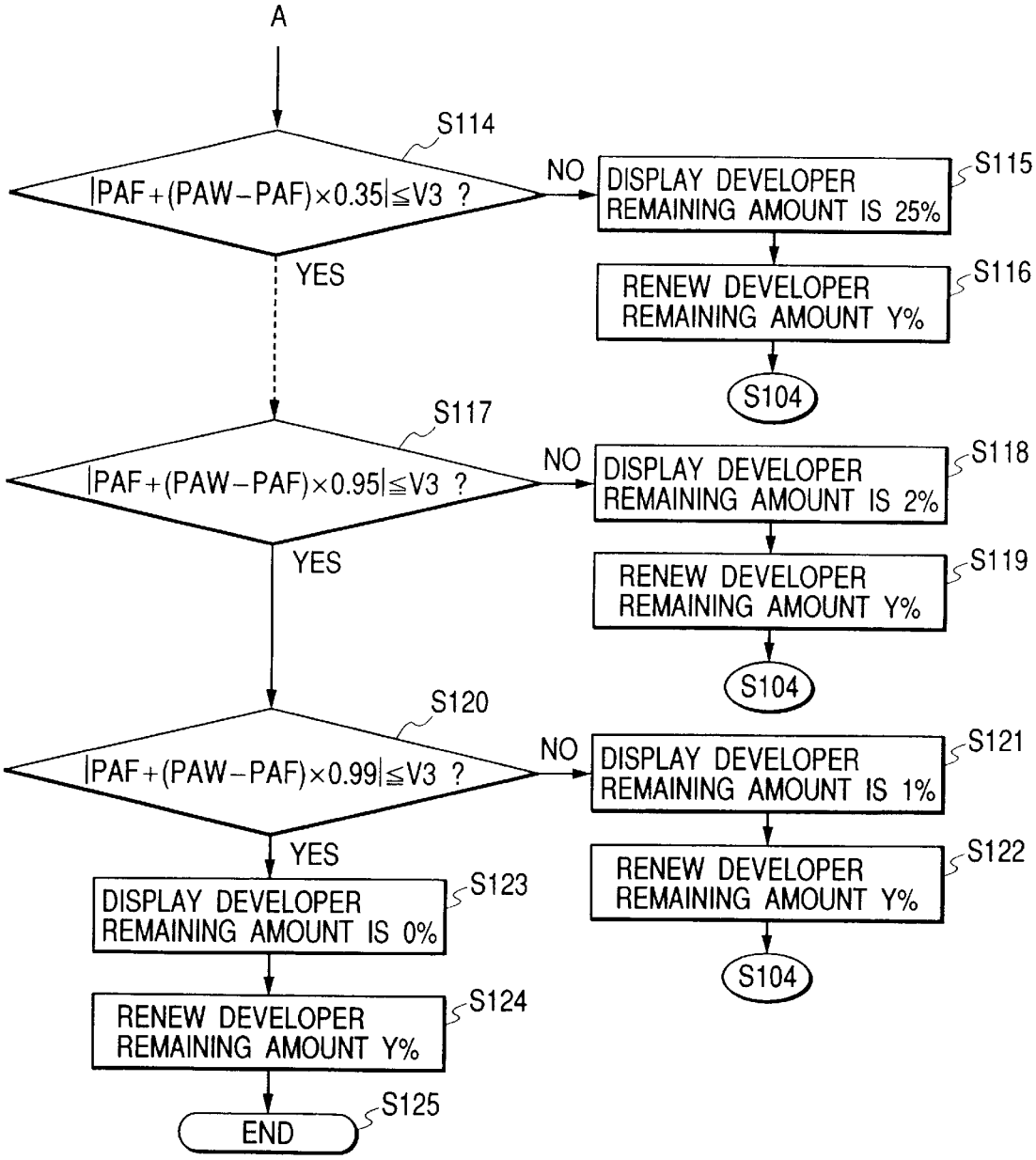

Next, an operation will be described for effecting the successive developer-remaining-amount detection according to the illustrated embodiment including steps S101 to S125 with reference to a flow chart shown in FIGS. 45 and 46.

05731 Step 5101 : A power supply is switched ON to start the operation of the main body 100 of the image forming apparatus (START).

Step S102: The control portion 23 ascertains the PAE value in the memory 20.

Step S103: The calculation portion 24 calculates the PAW.

Step S104: The remaining amount detecting portion 26 measures the detected voltage value V3.

Step S105: The control portion 23 ascertains the PAF value in the memory 20.

Step S106: The control portion 23 compares the PAF value stored in the memory 20 with the detected voltage value V3, thereby judging whether the detected voltage value V3 exceeds the PAF value or not. If NO, the sequence goes to a step S107, where the PAF value in the memory 20 is renewed, and then, the sequence goes to a step S108. If YES, the sequence goes to the step S108.

Step S108: The calculation portion 24 obtains the calculation value by introducing Z=0.18 in the remaining-amount-detection-correction table 25 into F(PAF,PAE,W), and the control portion 23 judges whether the developer-remaining-amount measured value V3 exceeds F(PAF,PAE, W) or not. If YES, the sequence goes to a step S111. If NO, the sequence goes to a step S109, where the control portion 23 sends the signal indicating the fact that the developer-remaining amount is 100% to the display means and such information is displayed on the display, and then, the sequence goes to a step S110, where the developer-remaining-amount information, i.e., Y (%) value information in the memory 20 is renewed. Thereafter, the sequence is returned to the step S104.

Step S111: The calculation portion 24 obtains the calculation value by introducing Z=0.25 in the remaining-amount-detection-correction table into F(PAF,PAE,W), and the control portion 23 judges whether the developer-remaining-amount measured value V3 exceeds F(PAF,PAE, W) or not. If YES, the sequence goes to a step S114. If NO, the sequence goes to a step S112, where the control portion 23 sends the signal indicating the fact that the developer remaining amount is 30% to the display means and such information is displayed on the display means, and then, the sequence goes to a step S113, where the Y (%) value information in the memory 20 is renewed. Thereafter, the sequence is returned to the step S104.

Step S114: The calculation portion 24 obtains the calculation value by introducing Z=0.35 in the remaining-amount-detection-correction table into F(PAF,PAE,W), and the control portion 23 judges whether the value V3 exceeds F(PAF,PAE,W) or not. If NO, the sequence goes to a step S115, where the control portion 23 sends the signal indicating the fact that the developer remaining amount is 25% to the display means and such information is displayed on the display means, and then, the sequence goes to a step S116, where the Y (%) value information in the memory 20 is renewed. Thereafter, the sequence is returned to the step S104.

If YES, in accordance with the remaining-amount-detection-correction table shown in the Table 12, Z=0.50 is introduced, and the sequence is repeated till Z=0.95.

Steps S117: The calculation portion 24 obtains the calculation value by introducing Z=0.95 in the remaining-amount-detection-correction table into F(PAF,PAE,W), and the control portion 23 judges whether the developer-remaining-amount measured value V3 exceeds F(PAF,PAE, W) or not. If NO, the sequence goes to a step S118, where the control portion 23 sends the signal indicating the fact that the developer remaining amount is 2% to the display means and such information is displayed on the display means, and then, the sequence goes to a step S119, where the Y (%) value information in the memory 20 is renewed. Thereafter, the sequence is returned to the step S104. If YES, the sequence goes to a step S120.

Step S120: The calculation portion 24 obtains the calculation value by introducing Z=0.99 in the remaining-amount-detection-correction table into F(PAF,PAE,W), and the control portion 23 judges whether the value V3 exceeds F(PAF,PAE,W) or not. If NO, the sequence goes to a step S121, where the control portion 23 sends the signal indicating the fact that the developer remaining amount is 1% to the display means and such information is displayed on the display means, and then, the sequence goes to a step S122, where the Y (%) value information in the memory 20 is renewed. Thereafter, the sequence is returned to the step S104. If YES, the sequence goes to a step S123.

Step S123: The control portion 23 sends the signal indicating the fact that the developer remaining amount is 0% to the display means and such information is displayed on the display means.

Step S124: The Y (%) value information in the memory 20 is renewed.

Step S125: The sequence is ended.

Figure 47:
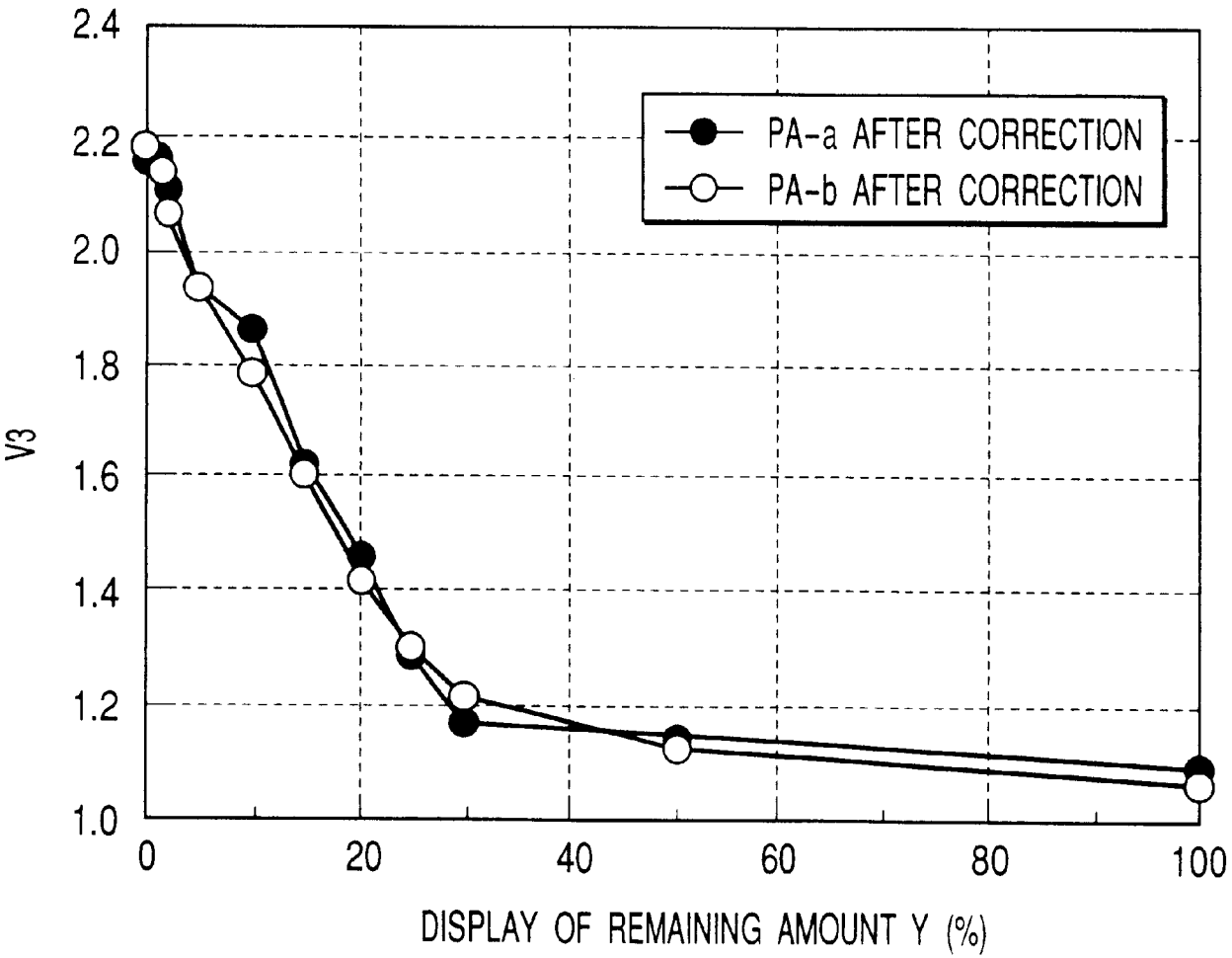
FIG. 47 is a graph showing the relationship between the display of the developer remaining amount and the detected voltage value after correction in accordance with fifteenth embodiment.

By effecting the control operation including the steps S101 to S125 in accordance with the above-mentioned flow chart, as shown in FIG. 47, the successive remaining-amount detection can be effected while compensating for the individual differences of the cartridges.

Naturally, since the relationship between the developer remaining amount and the detected voltage value greatly varies with the construction of the cartridge, particularly the construction and arrangement of the developer-remaining-amount detecting means, the above-mentioned constant value is not limited to the one described in the illustrated embodiment, but such value can be individually set in accordance with embodiments.

Further, while an example that the remaining-amount-detection-correction table 25 is stored in the main body control portion 22 was explained, such a table may be stored in the memory 20 of the process cartridge B. In this case, the table depending upon the inherent property of the cartridge can be used, thereby effecting successive remaining-amount detection more correctly. While an example that the developer remaining amount is calculated by using the table was explained, the value Z may be governed by a calculation to be varied with the cartridge individually.

Sixteenth Embodiment

Next, a sixteenth embodiment of the present invention will be explained. In the sixteenth embodiment, since the constructions of the image forming apparatus and the process cartridge are the same as those in the fifteenth embodiment, an explanation thereof will be omitted, and only characteristic portions of this embodiment will be described.

The fifteenth embodiment, explained that as the PAE value as the correction value for the successive developer-remaining-amount detection the measured value measured by the tool at the manufacture of the process cartridge is stored in the memory 20 while, in the sixteenth embodiment, as the PAE values, the value measured by the tool under the condition that the developer is not loaded in the developer containing container at the manufacture of the process cartridge are grouped into predetermined ranges, and PAE information values capable of discriminating such groups are stored in the memory 20. When the process cartridge B is mounted to the main body 100 of the image forming apparatus, the PAE information value is read out from the memory 20 and is recognized by the main body control portion 22. The main body control portion 22 recognizes a value corresponding to the PAE information value as the PAE value of the process cartridge.

As the memory 20 used in the present invention, as explained in connection with the fifteenth embodiment, normal semiconductor electronic memories may be used without special limitation. Particularly, in case of a memory of the non-contact type in which data communication between the memory 20 and a read/write IC is effected by an electromagnetic wave, since the transmitting portion 21 may not contact the main body control portion 22, the danger of the occurrence of poor contact, depending upon the mounting condition of the cartridge B, can be eliminated, thereby effecting reliable control.

The control portion 22 and the transmitting portion 21 constitute control means for effecting read/write of information with respect to the memory 20. The memory 20 has a capacity sufficient to store plural pieces of data such as the usage amount of the cartridge and the property of the cartridge, which will be described later. Further, the used amount of the cartridge is written in the memory 20 at any time.

Figure 48:
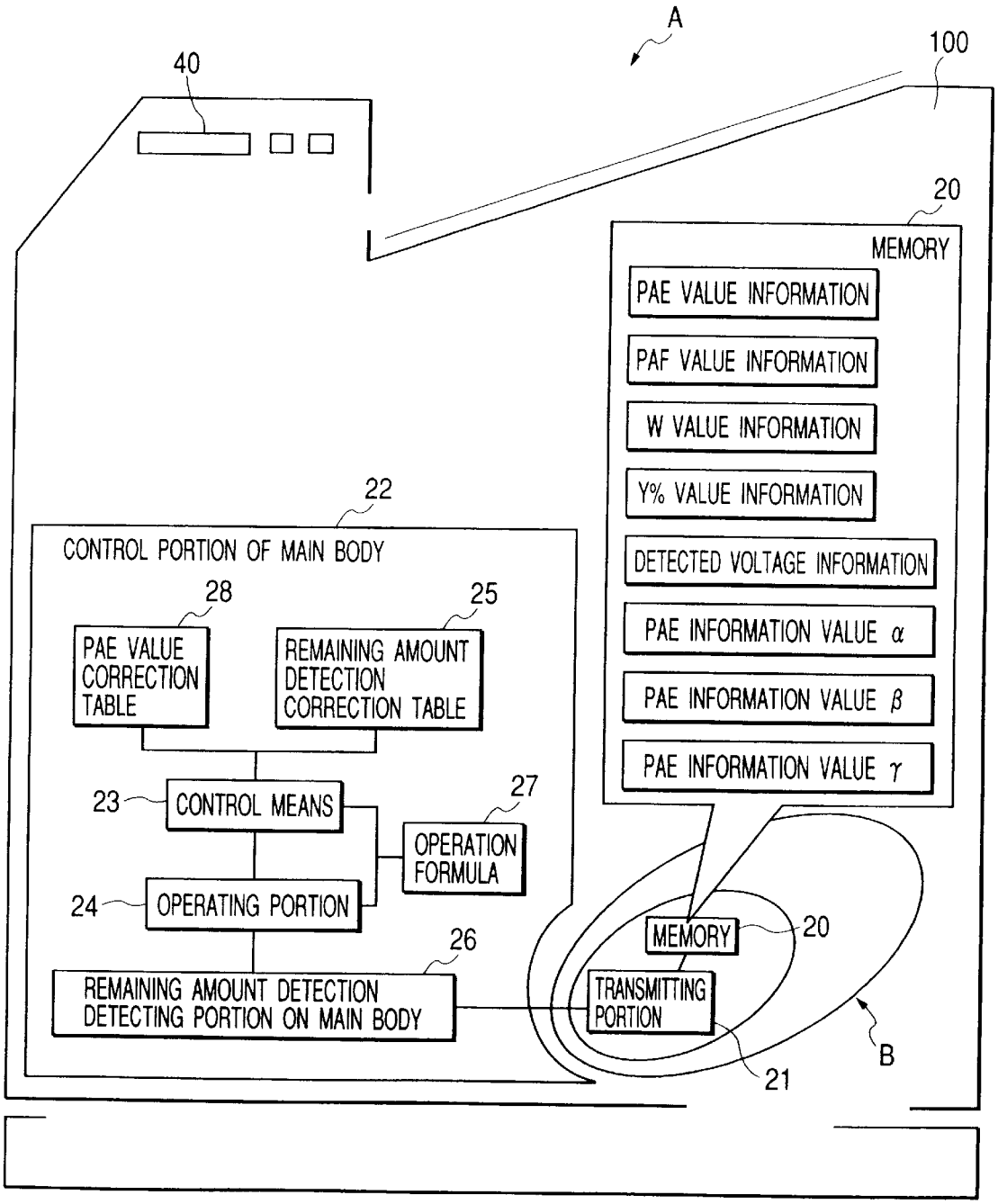
FIG. 48 is a schematic view showing the relationship between a memory of a process cartridge according to a sixteenth embodiment of the present invention and a control portion of a main body of an image forming apparatus.

In FIG. 48, a memory control arrangement according to the illustrated embodiment will be explained. The cartridge B is provided with the memory 20 and the transmitting portion 21. Further, the main body control portion 22 of the main body 100 of the image forming apparatus is provided with the control portion 23, the calculation portion 24, the developer remaining amount detection correction table 25, the developer remaining amount detecting portion 26, the calculation formula 27 and the PAE correction table 28.

Although various data are stored in the memory 20, in the illustrated embodiment, at least PAE information, PAF information, W information, Y% value information, detected voltage V3 information, PAE information value $\alpha$, PAE information value $\beta$ and PAE information value $\gamma$ are stored.

Further, these memory data can always be communicated with the calculation portion of the main body control portion 22, and the calculation is effected on the basis of such informations and the data is verified by the control portion 23.

Next, the successive developer remaining- amount detection will be explained.

In the illustrated embodiment, the capacitance value detected by the developer-remaining-amount detecting means is converted into the voltage value by the main body 100 of the image forming apparatus, and the control is effected on the basis of such voltage value. The voltage value is a detected voltage value, which is a sum of the capacitance value measured between the plate antennas 31 and 32 and the capacitance value measured between the plate antenna 32 and the developing roller 5*a*. When the developer amount is a maximum, the detected voltage value is the minimum value, i.e., the PAF value (the capacitance shows the maximum value). The PAF value is written in the memory 20 under the condition that the loading of the developer is completed and is renewed whenever the detected voltage value becomes a minimum (the capacitance shows the maximum value) during the running of the laser beam printer. Incidentally, the PAF value in the illustrated embodiment is about 1.0 V.

Further, the relationship between the capacitance and the voltage is varied with the circuit of the image forming apparatus, and the relationship between the capacitance and the voltage may be the same decrease function or increase function.

Further, the transition of the successive remaining amount detection is not changed so long as the developer amount contained in the developing device is identical, and, since the detected voltage value (capacitance value) in the no developer condition is varied with the positional relationship between the plate antennas, the curves representing the relationship between the developer remaining amount and the detected voltage value are deviated from each other.

For example, when a certain reference cartridge is provided in order to ensure that the user is warned of the blank stripe condition and the developer remaining amount is judged in accordance with a table of such a cartridge and the blank stripe alarm is effected on the basis of such judgement, in some cartridges, the blank stripe image may be outputted before the blank stripe alarm. Such dispersion in successive remaining-amount detection due to the individual differences in the process cartridges is caused by dispersion in the assembling tolerance of the remaining amount detecting antennas and/or the tolerance of parts of the cartridge and electronic parts of the main body of the apparatus.

Thus, in the illustrated embodiment, the following control is effected:

(1) The PAE information value of the process cartridge B is measured by the tool under the condition that the developer is not loaded at the manufacture of the process cartridge.

(2) The memory 20 is provided on the process cartridge B, and the PAE information value inherent to the process cartridge is stored in the memory 20, and, when the process cartridge B is mounted to the main body 100 of the image forming apparatus, the main body control portion 22 recognizes the PAE information value.

(3) The PAE information value is converted into the PAE value by the PAE value correction table 22.

(4) The minimum value, i.e., PAF value (maximum value of capacitance) of the detected voltage value is obtained from the developer remaining amount detecting means 30, and the PAF value is written in the memory 20 of the process cartridge B. The detected voltage value successively detected is compared with the previously written value by the comparing means. If the detected voltage value is smaller than the previous value, the PAF value in the memory is rewritten; whereas, if otherwise, the PAF value is not rewritten. Such operation is repeated for each detected voltage value.

(5) The weighting function utilizing the relationship between the PAE value and the PAF value and the developer remaining amount is sought, and the sought result is previously stored in the main body control portion 22 or in the memory 20. (6) The correction value is determined by introducing the correction value for the weighting function to the relationship between the weighting function and the detected voltage value.

(7) The developer remaining amount is calculated on the basis of the correction table.

By this control method, even if the detected voltage value (capacitance) is changed due to the individual differences in the cartridges or even if it is hard for the developer to enter into the detecting area of the developer remaining amount detecting means due to an abnormal developer condition, a method for successively detecting the developer remaining amount while surely emitting the alarm before the blank stripe image is outputted can be proposed, and efficiency of the factory working process can be enhanced.

Incidentally, the detected voltage value V3 detected by the successive remaining amount detecting portion 26 is stored in the memory 20. Further, the PAE information value may be set any time in accordance with a dispersion range due to the tolerance of the measured value. For example, when the tolerance is great, many PAE information values are set; whereas, when the tolerance is small, fewer PAE information values are set. In the illustrated embodiment, there are three PAE information values α, β, γ (α<β<γ) that are provided. These PAE information values are divided into three steps on the basis of the values measured by the tool under the condition that the developer is not loaded at the manufacture of the process cartridge.

Incidentally, a relationship between the PAE information values (ω) and voltage width is selected as follows:

$\alpha$=2.7 to 2.9 V $\beta$=2.9 to 3.1 V $\gamma$=3.1 to 3.3 V

In the control method, the usage range is set as follows:

$$(PAE \text{ value} - PAF \text{ value}). \quad (1)$$

Further, when the developer amount is small in spite of the fact that the developer is remaining in the process cartridge, a poor image, such as a blank stripe, may occur. The voltage value in this case is referred to as a blank stripe voltage, and, the usage range may be set on the basis of a relationship between the blank stripe voltage and the PAF value. The blank stripe voltage (PAW value) is represented as follows:

$$PAW \text{ value} = [(PAE \text{ value}) - (\text{experimental value } W \text{ based on accumulation of experimental data})]$$

This value can be used in place of PAE value in the above-mentioned relationship (1).

In the illustrated embodiment, the usage range is defined as follows:

$$(PAW \text{ value} - PAF \text{ value}) = (PAE \text{ value} - W \text{ value} - PAF \text{ value}). \quad (2)$$

When the PAE information value (ω) is β, as shown in the following Table 13, the PAE value becomes 3.0 V. Further, when the W value is 0.8 V, since PAW=3.0−0.8=2.2 V and PAF=1.0 V, the usage range becomes 1.2 V (=2.2−1.0).

TABLE 13

| ω | PAE value |
|---|---|
| α | 2.8 |
| β | 3.0 |
| γ | 3.2 |

The weighting function is defined as follows:

$$F(\text{PAF,PAE,W}) = |PAF \text{ value} + (PAW \text{ value} - PAF \text{ value}) \times Z|. \quad (3)$$

where Z is a correction value and is a value dividing the usage range with appropriate interval and is previously stored in the main body control portion as the successive detection correction table.

And, the developer remaining amount is sought from Z by which the following relationship (4) is established:

$$|PAF + (PAW - PAF) \times Z| \leqq |V3| \quad (4)$$

On the basis of the successive detection-correction table shown in the following Table 14, in the above relationship (4), if Z=0.1 is not satisfied, the fact that the developer remaining amount is 100% is displayed; whereas, if Z=0.1 is satisfied, Then Z=0.18 is introduced into the relationship (4). In this case, if it is not satisfied, the developer remaining amount becomes 30%. Namely, if the relationship (4) is satisfied by the higher order Z, the relationship (4) is checked while increasing Z value successively until the relationship (4) is not satisfied. And, the developer amount is determined by the Z value, which does not firstly satisfy the relationship (4).

TABLE 14

| developer remaining amount (g) | remaining amount display Y (%) | Z |
|---|---|---|
| 0 | 0 | |
| 10 | 0 | |
| 20 | 0 | 0.99 |
| 21 | 1 | 0.95 |
| 22 | 2 | 0.89 |
| 25 | 5 | 0.78 |
| 30 | 10 | 0.65 |
| 35 | 15 | 0.50 |
| 40 | 20 | 0.35 |
| 45 | 25 | 0.25 |
| 50 | 30 | 0.18 |
| from 100 | 100 | 0.10 |

Figure 49:
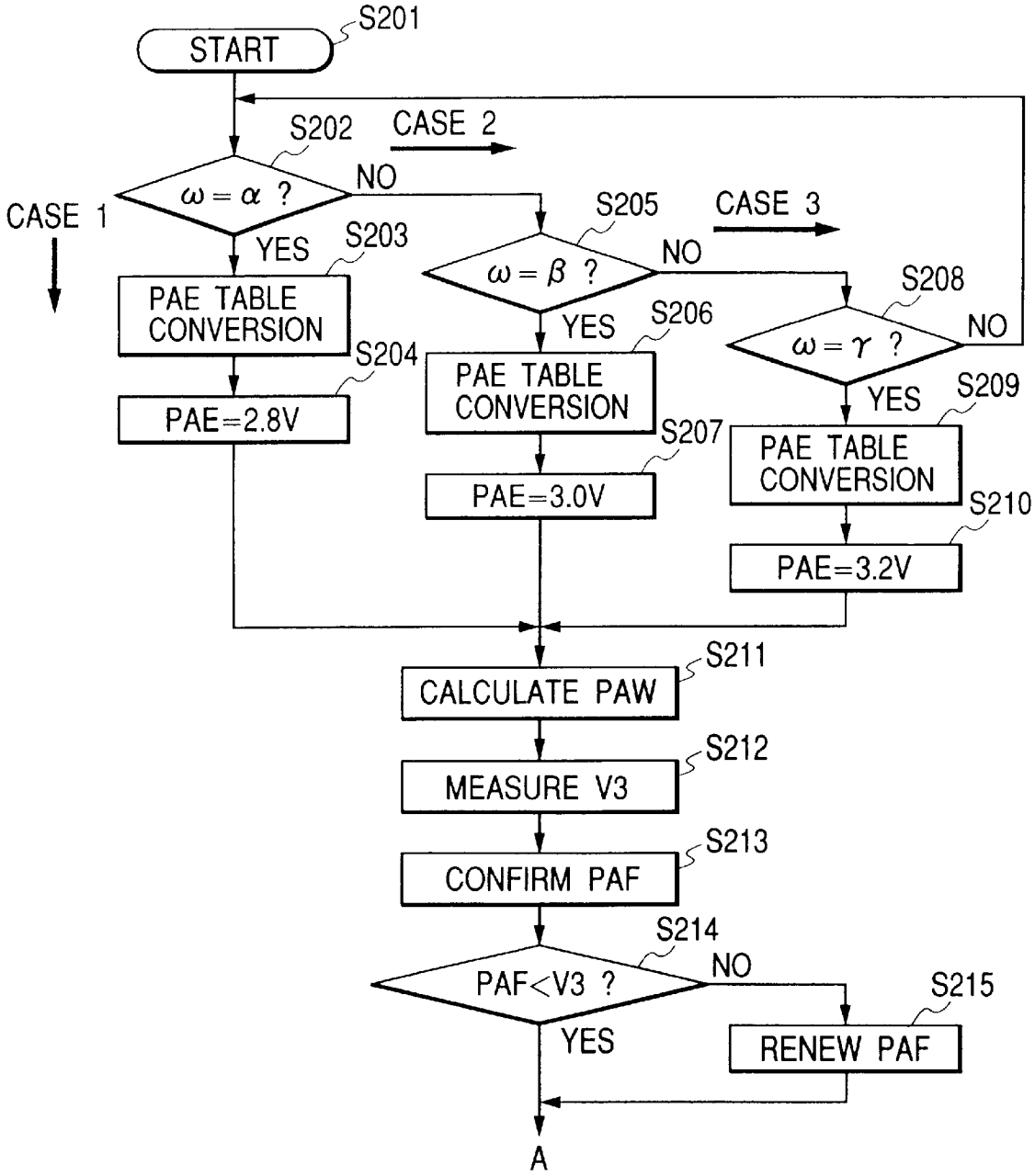
FIGS. 49 and 50 are a flow chart for explaining a developer amount detecting operation using memory means of the cartridge according to the sixteenth embodiment.
Figure 50:
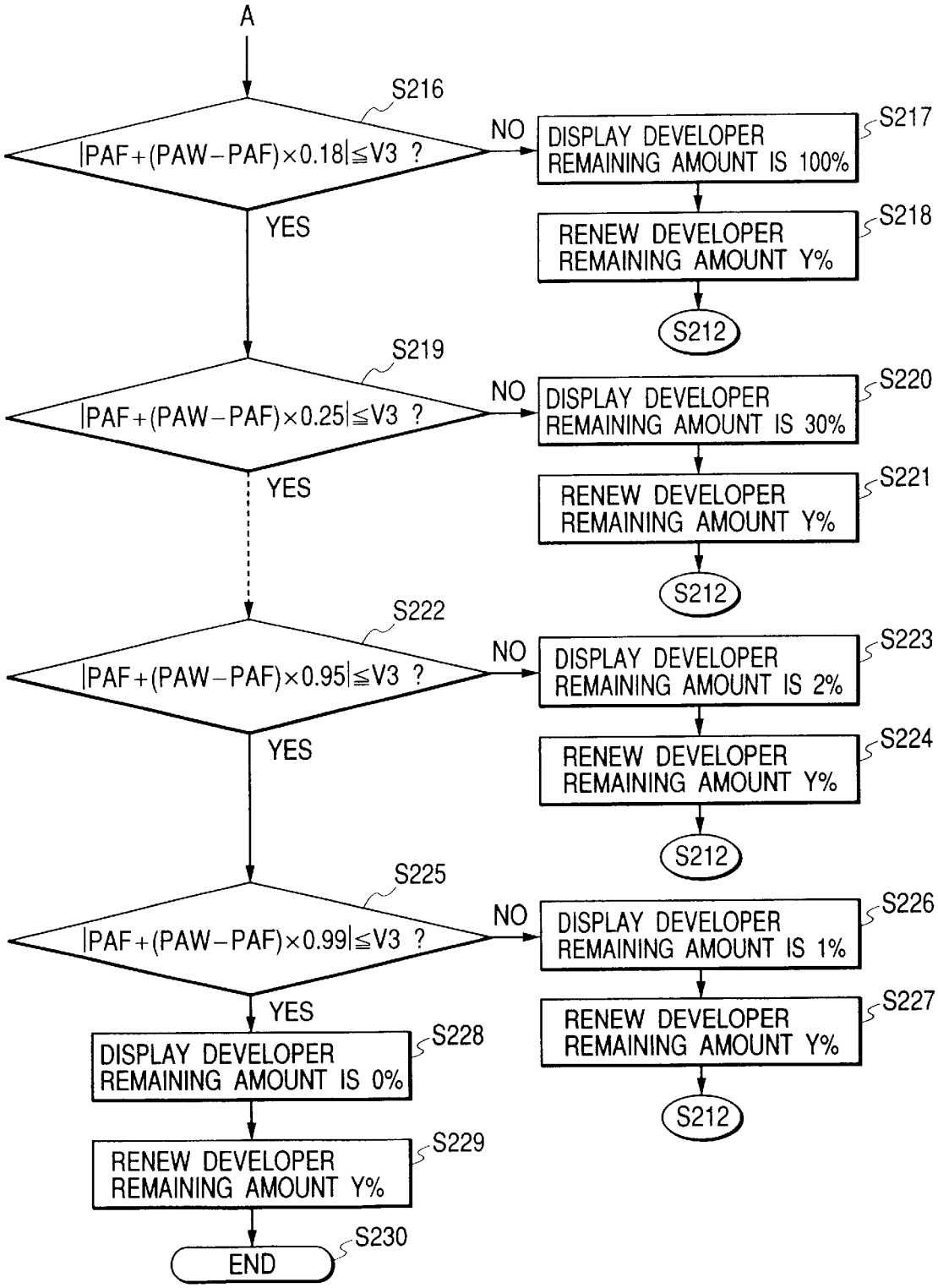

FIGS. 49 and 50 show a flow chart for the successive remaining amount detection sequence having steps S201 to S230. Incidentally, the PAE value is stored in the memory 20 at the manufacture of the process cartridge.

Step S201: A power supply of the main body 100 is switched ON to start the operation of the main body 100 of the image forming apparatus (START).

Step S202: The control portion 23 judges whether the PAE information value ω is α or not.

Case 1: If it is judged as "YES" in the step S202

Step S203: The control portion 23 converts the PAE information value ω into the PAE value by using the PAE value correction table 28.

Step S204: The control portion 23 ascertains that the PAE value is 2.8 V, and this PAE value information is stored in the memory 20. Thereafter, the sequence goes to a step S211.

Case 2: If is judged as "NO" in the step S202

Step S205: The control portion 23 judges whether the PAE information value ω is β or not. If NO, refer to a Case 3 which will be described later. On the other hand, if YES, the sequence goes to a step S206.

Step S206: The control portion 23 converts the PAE information value ω into the PAE value by using the PAE value correction table 28.

Step S207: The control portion 23 ascertains that the PAE value is 3.0 V, and this PAE value information is stored in the memory 20.

Case 3: If it is judged as "NO" in the step S305

Step S208: The control portion 23 judges whether the PAE information value ω is γ or not. If NO, the sequence is returned to the step S202; whereas, if YES, the sequence goes to a step S209.

Step S209: The control portion 23 converts the PAE information value ω into the PAE value by using the PAE value correction table 28.

Step S210: The control portions 23 ascertains that the PAE value is 3.2 V, and this PAE value information is stored in the memory 20. Thereafter, the sequence goes to a step S211.

Step S211: The calculation portion 24 calculates the PAW value.

Step S212: The developer remaining amount detecting portion 26 measures the detected voltage V3.

Step S213: The control portion 23 ascertains the PAF information in the memory 20.

Step S214: The control portion 23 compares the PAF value stored in the memory 20 with the detected voltage value V3, thereby judging whether the detected voltage value V3 exceeds the PAF value or not. If NO, the sequence goes to a step S215, where the PAF value in the memory 20 is renewed, and then, the sequence goes to a step S216. If YES, the sequence goes to the Step S216.

Step S216: The calculation portion 24 obtains the calculation value by introducing Z=0.18 in the remaining-amount-detection-correction table into F(PAF,PAE,W), and the control portion 23 judges whether the detected voltage value V3 exceeds F(PAF,PAE,W) or not. If YES, the sequence goes to a step S219. If NO, the sequence goes to a step S217, where the control portion 23 sends the signal indicating the fact that the developer remaining amount is 100% to the display means and such information is displayed on the display, and then, the sequence goes to a step S218, where the Y (%) value information in the memory 20 is renewed. Thereafter, the sequence is returned to the step S212.

Step S219: The calculation portion 24 obtains the calculation value by introducing Z=0.25 in the remaining amount detection correction table into F(PAF,PAE,W), and the control portion 23 judges whether the detected voltage value V3 exceeds F(PAF,PAE,W) or not. If NO, the sequence goes to a step S220, where the control portion 23 sends the signal indicating the fact that the developer remaining amount is 30% to the display means and such information is displayed on the display means, and then, the sequence goes to a step S221, where the Y (%) value information in the memory 20 is renewed. Thereafter, the sequence is returned to the step S212.

If YES, in accordance with the remaining-amount-detection-correction table shown in the Table 14, Z=0.35 is introduced, and the sequence is repeated until Z=0.95.

Step S222: The calculation portion 24 obtains the calculation value by introducing Z=0.95 in the remaining-amount-detection-correction table into F(PAF,PAE,W), and the control portion 23 judges whether the detected voltage value V3 exceeds F(PAF,PAE,W) or not. If NO, the sequence goes to a step S223, where the control portion 23 sends the signal indicating the fact that the developer remaining amount is 2% to the display means and such information is displayed on the display means, and then, the sequence goes to a step S224, where the Y (%) value information in the memory 20 is renewed. Thereafter, the sequence is returned to the step S212. If YES, the sequence goes to a step S225.

Step S225: The calculation portion 24 obtains the calculation value by introducing Z=0.99 in the remaining-amount-detection-correction table into F(PAF,PAE,W), and the control portion 23 judges whether the value V3 exceeds F(PAF,PAE,W) or not. If NO, the sequence goes to a step S226, where the control portion 23 sends the signal indicating the fact that the developer remaining amount is 1% to the display means and such information is displayed on the display means, and then, the sequence goes to a step S227, where the Y (%) value information in the memory 20 is renewed. Thereafter, the sequence is returned to the step S212. If YES, the sequence goes to a step S228.

Step S228: The control portion 23 sends the signal indicating the fact that the developer remaining amount is 0% to the display means and such information is displayed on the display means.

Step S229: The Y (%) value information in the memory 20 is renewed.

Step S230: The sequence is ended.

Figure 51:
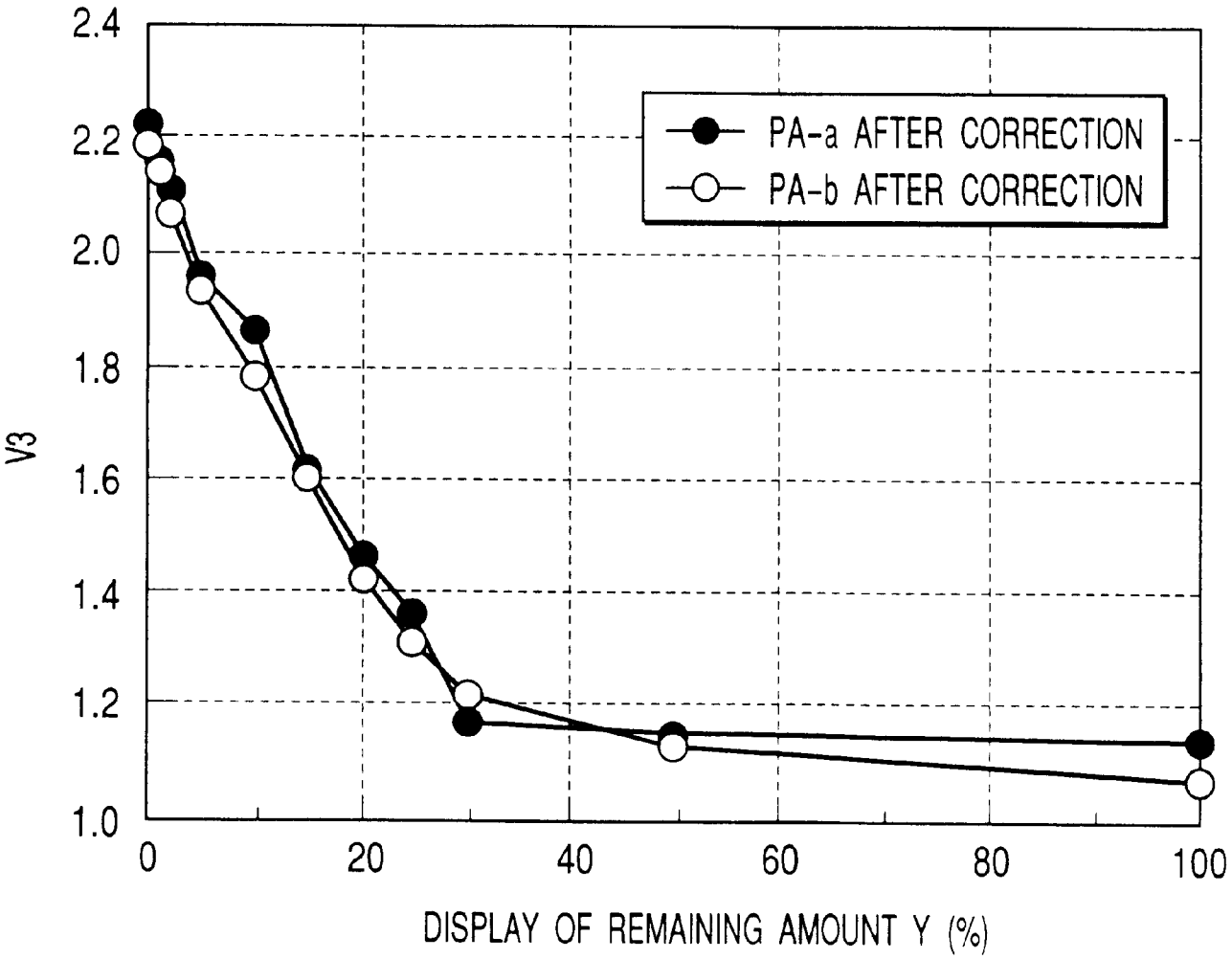
FIG. 51 is a graph showing the relationship between the display of a developer remaining amount and the detected voltage value after correcting in accordance with sixteenth embodiment.

By effecting the control operation in accordance with the above-mentioned flow chart including the steps S201 to S230, as shown in FIG. 51, the successive remaining-amount detection can be effected while compensating for the individual differences of the cartridges.

Naturally, since the relationship between the developer remaining amount and the detected voltage value is greatly varied with the construction of the cartridge, particularly the construction and arrangement of the developer-remaining-amount detecting means, the above-mentioned constant value is not limited to one described in the illustrated embodiment, but such value can be individually set in accordance with embodiments.

Further, while an example that the remaining amount detection correction table 25 is stored in the main body control portion 22 was explained, such a table may be stored in the memory 20 of the process cartridge B. In this case, the table depending upon the inherent property of the cartridge can be used, thereby effecting the successive remaining-amount detection more correctly. While an example that the developer remaining amount is calculated by using the table was explained, the value Z may be governed by calculation to be varied with the cartridge individually.

Seventeenth Embodiment

Figure 52:
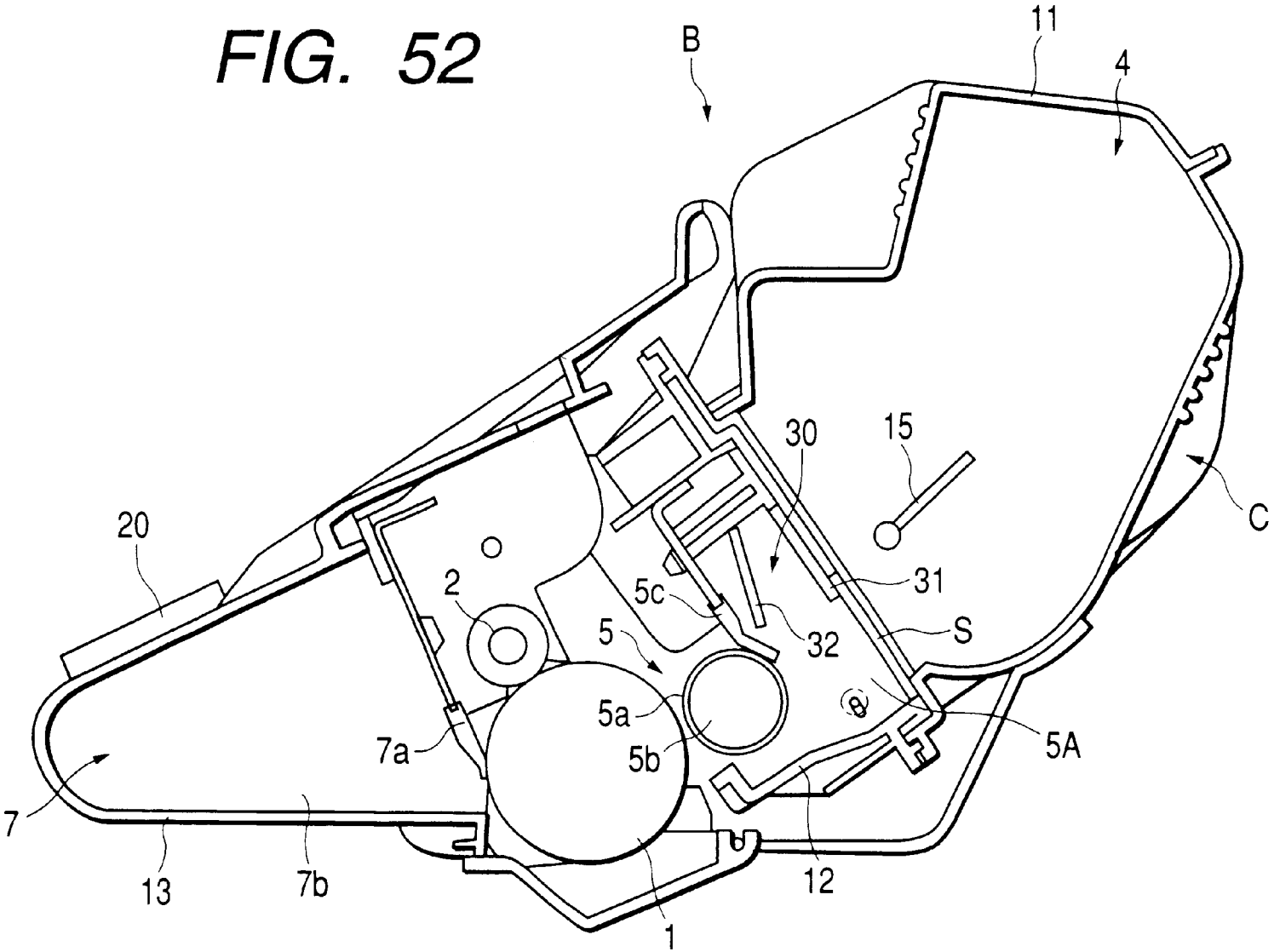
FIG. 52 is a sectional view of a process cartridge according to a seventeenth embodiment of the present invention.

FIG. 52 shows a process cartridge B according to a seventeenth embodiment of the present invention. The process cartridge B according to this embodiment is detachably mountable to the image forming apparatus explained in connection with the fifteenth embodiment and has the same construction as that of the process cartridge explained in connection with the fifteenth embodiment. Accordingly, elements having the same construction and function are designated by the same reference numeral, and a detailed explanation thereof will be omitted.

Namely, in the illustrated embodiment, in the process cartridge B, a developer frame 11 having a developer container 4 containing developer and a developing room (developer containing portion) 5A and a developer feeding member 15 and a developing frame 12 holding developing means such as a developing roller 5*a* and a developing blade 5*c* are welded together to form a developing unit, and the developing unit is integrally joined to a cleaning frame 13 to which a photosensitive drum 1, cleaning means such as a cleaning blade 7*a* and a charging roller are attached, thereby forming a cartridge.

The process cartridge B is detachably mounted to cartridge mounting means of the main body 100 of the image forming apparatus by the user.

The process cartridge B according to the illustrated embodiment also is provided with a developer-amount detecting device capable of successively detecting a remaining amount of the developer upon consumption of the developer in the developer container 4. The developer-amount detecting device according to the illustrated embodiment has the same construction as that explained in connection with the fifteenth embodiment and has a plate antenna (capacitance detecting electrodes) as developer-remaining-amount detecting means 30, which plate antenna is constituted by an output metal plate 32 opposed to the developing roller 5*a* and extending through the entire longitudinal area of the developing device C, and an input metal plate 31 having the same longitudinal length as the output metal plate 32 and opposed to the latter.

Also in this embodiment, the developing roller 5*a* and the input metal plate 31 are electrically connected to developing-bias applying means 34 as voltage applying means of the main body 100 of the image forming apparatus under a condition that the process cartridge B is mounted to the main body 100 of the image forming apparatus.

When AC bias of about 2 kHz and DC bias of about−400 V (normal developing bias) are applied to the developing roller 5*a* and the input metal plate 31, electric current flows between the developing roller 5*a* and the output metal plate 32 opposed thereto and between the input metal plate 31 and the output metal plate 32, and a resulting electric current value is measured by an electric current measuring device 33. From the electric current value measured by the electric current measuring device 33 in this way, the resultant capacitance of the capacitance between the developing roller 5*a* and the output metal plate 32 and the capacitance between the input metal plate 31 and the output metal plate 32 is measured.

In this way, by providing the input metal plate (antenna plate) 31 and output metal plate (antenna plate) 3 as the plate antenna within the developing device C and by measuring the capacitance between the antenna plates 31, 32 and the capacitance between the developing roller 5*a* and the antenna plate 32 as the developer T in the developing device C is decreased, the developer amount in the developer containing container 4 and developing room 5A constituting the developer containing portion can be known at any time.

However, the capacitance value C2 between the developing roller 5*a* and the antenna plate 32 and the capacitance value C3 between the antenna plates 31, 32 are influenced by an entering amount of the developer. As shown in FIG. 52, prior to use, in the process cartridge B, the developing room 5A is isolated from the developer in the developer containing container 4 by a seal S, and, immediately before the cartridge is used, the seal S is removed.

In the initiation of usage of the cartridge, immediately after the seal is unsealed, the developer does not adequately enter between the developing roller 5*a* and the antenna plate 32 and between the antenna plates 31, 32. Thus, in spite of the fact that the developer is fully loaded in the developer containing container 4, the capacitance value of the developer-remaining-amount detecting means 30 will indicate a smaller value (the output voltage value V3 shows a greater value). Namely, error detection is effected.

Figure 53:
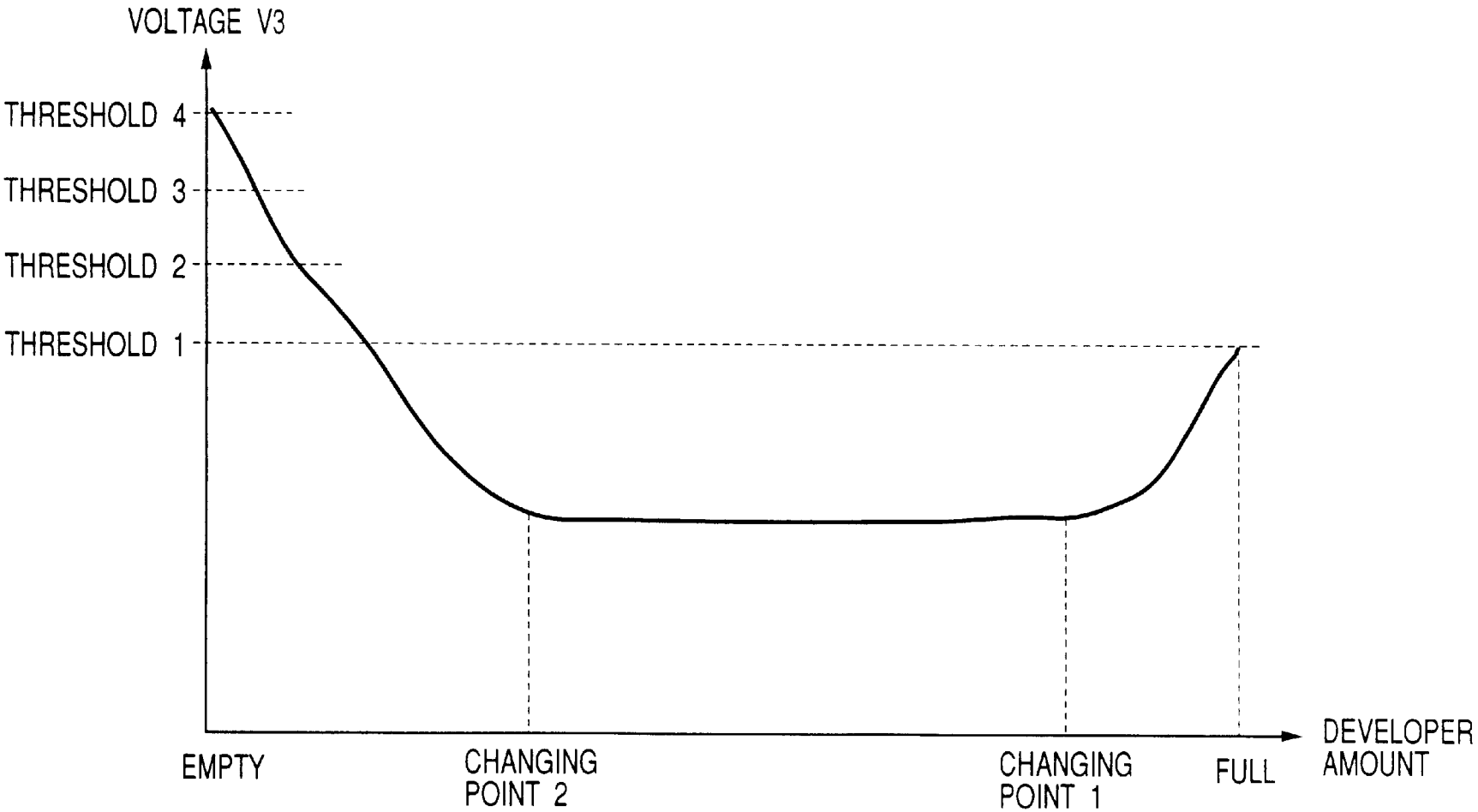
FIG. 53 is a graph showing a relationship between the detected voltage value of a conventional developer amount detecting device and a developer remaining amount.

FIG. 53 shows voltage V3 outputted from a detecting circuit 33. A developer room 5A of a new process cartridge B is empty under a condition that the developer is loaded in a developer containing container 4. When the process cartridge B starts to be used, the developer in the developer containing container 4 is pushed by an agitating member 15, so that the developer is gradually loaded in the developing room 5A. When the developer amount in the developing room 5A starts to be increased, the voltage V3 outputted from the detecting circuit 33 is gradually decreased up to a change point P1 where the developing room 5A is fully filled with the developer.

A change point 2 is a point where the developer in the developer containing container 4 is used up and the developer cannot be supplied to the developing room 5A by the agitating member 15. After the change point 2 is reached, since the developer amount in the developing room 5A is decreased, the voltage V3 outputted from the detecting circuit 33 is increased.

Since such voltage transition is effected, in the conventional developer-remaining-amount detection, the developer-remaining amount in the process cartridge B was detected, for example, in such a manner that, when a threshold value is less than V3, 100% is indicated, and, when V3 is threshold value 1 to 2, 15% is indicated.

However, in such a conventional developer-remaining-amount detection, the developer-remaining amount, i.e., the ratio from the developer full condition is judged on the basis of an absolute value of the capacitance between the electrodes within the developing device. Thus, in the new process cartridge, since the capacitance is increased from when the cartridge is newly used to when the developing room 5A is filled with the developer, in order to judge the developer-remaining amount correctly, the developer-remaining amount cannot be detected only from a value smaller than the capacitance before the developing room 5A is filled with the developer. Accordingly, there arose a problem that the developer-remaining-amount detection range is narrow.

Further, in the conventional developer-remaining-amount detection, there also arose a problem that developer-remaining-amount detection with a high resolving power and with a high accuracy cannot be achieved due to dispersion in the attaching positions of the electrodes installed within the developer containing container, the condition of the developer, and the dispersion in detecting circuit system.

According to the illustrated embodiment, (1) The capacitance between the electrodes obtained when the developing room 5A is filled with the developer (developer full condition) and the capacitance obtained when the developing room 5A is empty are stored in a non-volatile memory, and, while correcting such values in accordance with the circumference, the developer remaining amount in the process cartridge, i.e., a ratio between the present developer amount and the developer amount in the developer full condition is calculated by comparing the detected capacitance with the stored value.

(2) Inclination of reduction of the capacitance between the electrodes as the developer in the developing room 5A is decreased, a usage condition of the process cartridge until the reduction of the developer is started are stored in the memory, the developer remaining amount in the process cartridge, i.e., a ratio between the present developer amount in the process cartridge and the developer amount in the developer full condition is calculated, while correcting the stored values.

By detecting the developer remaining amount on the basis of such developer remaining detecting methods, the developer remaining amount can be detected with high accuracy and a high reliable image forming system can be provided.

Also in the illustrated embodiment, similar to the fifteenth embodiment, the circuit arrangement for detecting the developer amount in the process cartridge shown in FIG. 10 is used.

Namely, when a predetermined AC bias is outputted from the developing bias circuit 34 as developing bias applying means, the bias is applied to a reference capacitor C1, the developing roller 5*a* and the electrode 31, respectively. As a result, voltage V1 is generated on both ends of the reference capacitor C1, and electric current corresponding to capacitance C4 (C2+C3) flows between the electrodes 31, 32. The electric current is converted into voltage V2 by a calculation formula.

The detecting circuit of the electric current measuring device 33 forms a voltage V3 on the basis of the voltage difference between the voltage V1 generated on both ends of the reference capacitor C1 and the voltage V2 between the electrodes, and the generated voltage V3 is outputted to the AD converter portion 35. The AD converter portion 35 outputs a result obtained by digital-converting the analog voltage V3 to the control portion 23. The control portion 23 recognizes the developer amount in the process cartridge on the basis of the digital-converted voltage.

Figure 54:
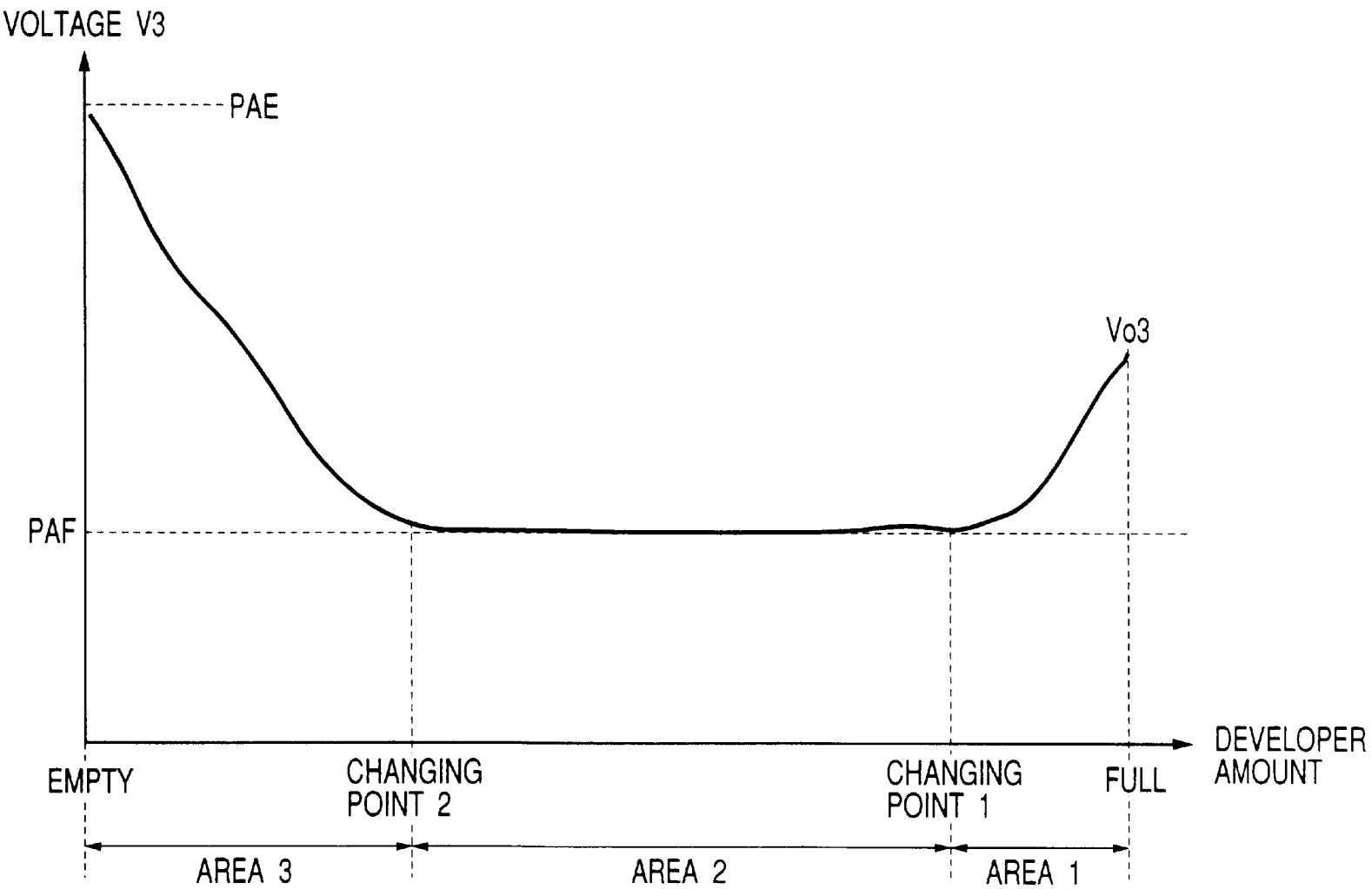
FIG. 54 is a graph showing the relationship between the detected voltage value of the developer amount detecting device according to the seventeenth embodiment and the developer remaining amount.

As mentioned above, in the illustrated embodiment, the voltage V3 outputted from the detecting circuit 33 indicates the transition of the voltage shown in FIG. 54 in accordance with the developer amount. A developer room 5A of a new process cartridge B is empty under a condition that the developer is loaded in a developer containing container 4. When the process cartridge B starts to be used, the developer in the developer containing container 4 is pushed out by the agitating member 15, so that the developer is gradually loaded in the developing room 5A. When the developer amount in the developing room 5A starts to be increased, the voltage V3 outputted from the detecting circuit 33 is gradually decreased from an initial value V03 up to a change point P1 where the developing room 5A is fully filled with the developer. This is a phenomenon within an area I shown in FIG. 54.

The reason why the initial value V03 does not become the PAE value is that the agitating member 15 is rotated to carry the developer to the developing room 5A before the detection of the developer remaining amount is started.

A change point 2 is a point where the developer in the developer containing container 4 is used up and the developer cannot be supplied to the developing room 5A by the agitating member 15. In an area 2 from the change point 1 to the change point 2, since the developing room 5A is always in the developer full condition, the voltage V3 becomes the minimum value (PAF value). After the change point 2 is reached (area 3), since the developer amount in the developing room 5A is decreased, the voltage V3 is increased up to the voltage corresponding to the PAE value when the developing room 5A is empty.

The minimum value of the detected voltage is the PAF value, and the voltage V3 when the developing room is empty is the PAE value.

The developer remaining amount in the illustrated embodiment is sought from a satisfying the following relationship (1):

$$PAF+(PAE-PAF)\times\alpha<V3. \quad (1)$$

Figure 55:
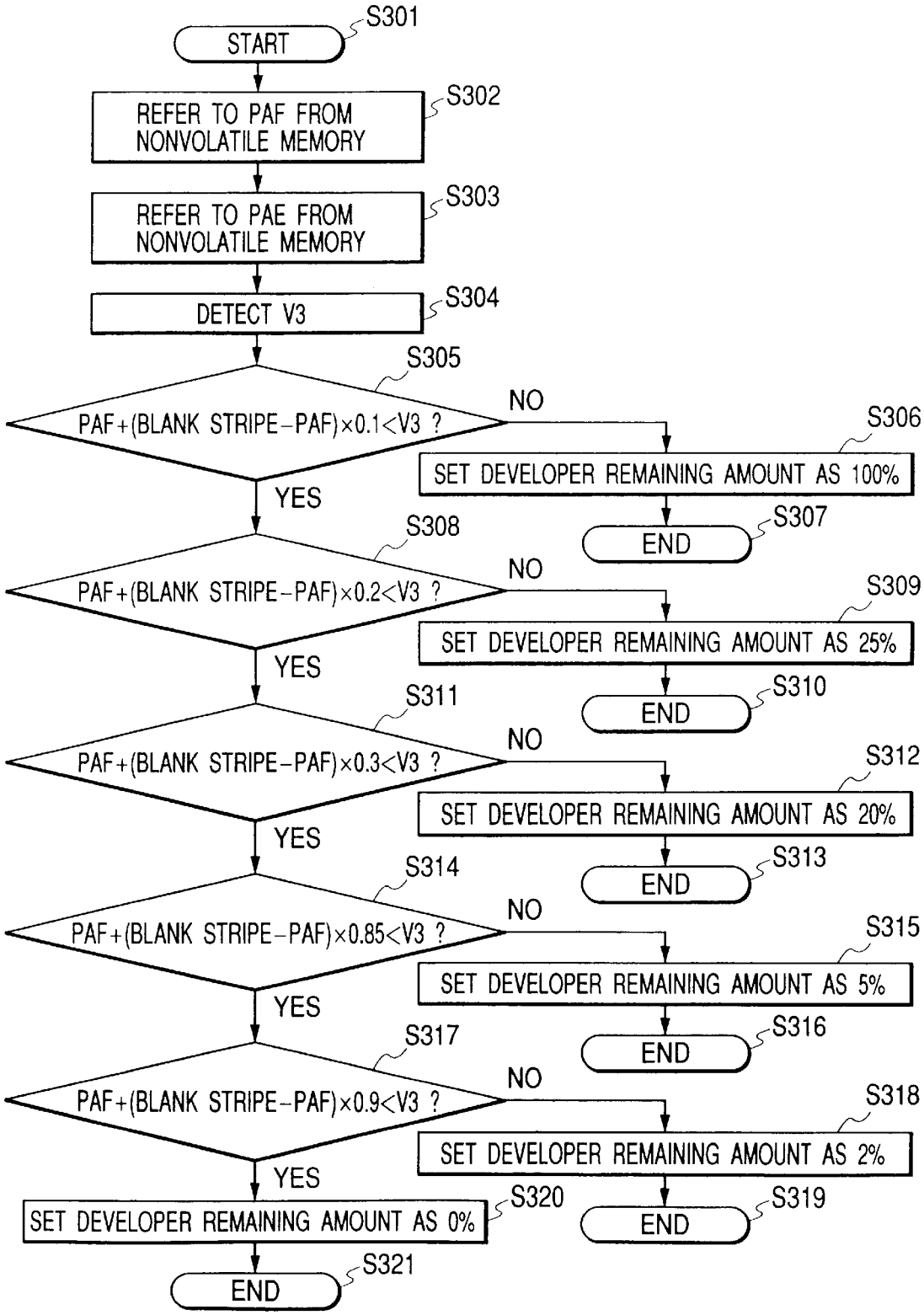
FIGS. 55 and 56 are a flow chart for explaining a developer amount detecting operation using memory means of the cartridge according to the seventeenth embodiment.

Namely, as can be understood from a control sequence having steps S301 to S321 shown in FIG. 55, the main body of the image forming apparatus is turned ON to start the image forming operation (START) (step S301). Then, the voltage V3 is measured by the remaining-amount-detecting portion 26 as the developer-remaining-amount-detection calculation means while referring to the PAF and PAE value stored in the memory means 20 (steps S302, S303, S304). On the basis of the measured value V3 measured by the remaining-amount-detecting portion 26, the above relationship (1) is calculated (step S305). For example, if $\alpha$=0.1 is not satisfied, the developer remaining amount is regarded as 100% (steps S306, S307). On the other hand, if $\alpha$=0.1 is satisfied, then $\alpha$=0.2 is introduced into the relationship (1) (step S308). If not satisfied, the developer remaining amount is regarded as 25% (steps S309, S310). If $\alpha$=0.2 is satisfied, the relationship (1) is calculated while successively increasing the $\alpha$ value until $\alpha$ is not satisfied, and the developer remaining amount is determined by $\alpha$ value which is not satisfied firstly (steps S311 to S321).

Informing the user of the developer remaining amount is effected through a host computer or a printer controller such as an operation panel. The developer remaining amount on the host computer may be displayed as a ratio with respect to the developer full condition, i.e., the remaining percentage (%) or may be displayed as a remaining printable sheet number.

Further, the resolving power may have an equidistant interval such as 100%, 90%, 80%, . . . , 30%, 20%, 10%, 0% or may be increased in a fewer developer area, such as 100%, 20%, 15%, 10% 8%, 6%, . . . .

In order to detect the developer remaining amount with high accuracy, the PAE and PAF values may be detected with high accuracy. The PAE and PAF values are stored in the non-volatile memory 20 as initial data in the factory and forwarded as it is. There is no dispersion in PAE after being determined in the factory. Thus, during the usage of the process cartridge B, by correcting the PAF value, the developer remaining amount can be detected with high accuracy.

Figure 56:
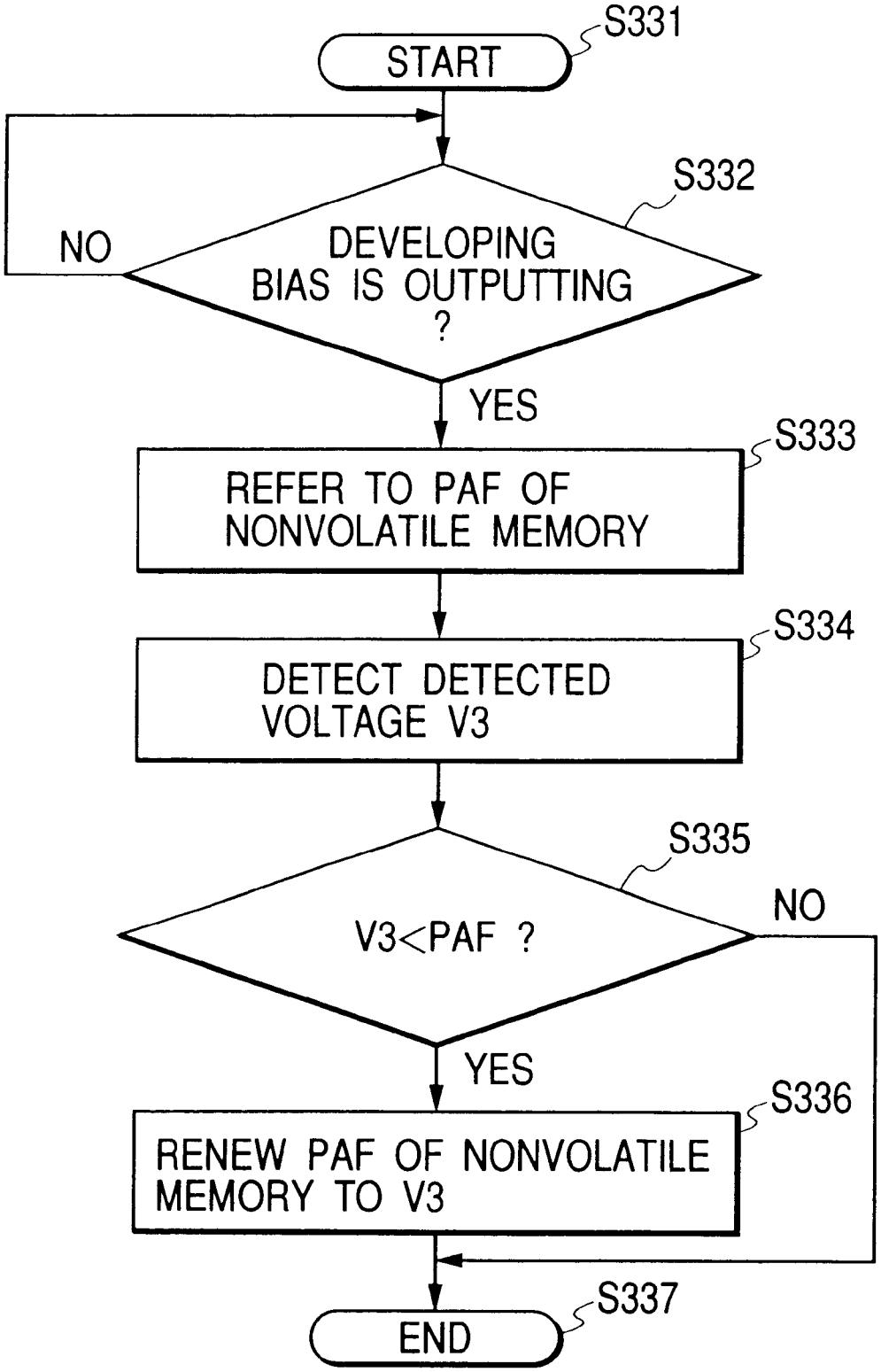

Such a control sequence is shown in FIG. 56. The main body of the image forming apparatus is turned ON to start the image forming operation (START) (step S331). Then, when the developing bias is being outputted, the PAF value is corrected (step S332). That is to say, when the predetermined AC bias is being outputted from the developing bias circuit 34, the detected voltage V3 is detected from the detecting circuit, and the detected voltage V3 is compared with the PAF value stored in the memory 20 (steps S333 to S335). If the relationship between the detected voltage V3 and the PAF value satisfies "V3 <PAF", the PAF value stored in the non-volatile memory 20 is written on the V3 value (step S336), and, thereafter, this value is used as the PAF value to calculate the reference value. If "V3<PAF" is not satisfied, the value is regarded as the reference value of PAF (steps S335, S337).

By correcting the PAF value in this way, the developer remaining amount can be detected with high accuracy.

Eighteenth Embodiment

Also in an eighteenth embodiment of the present invention, the image forming apparatus explained in connection with the fifteenth embodiment and the process cartridge B, explained in connection with the seventeenth embodiment, are used, and the detecting circuit arrangement shown in FIG. 10 is used for detecting the developer remaining amount.

Figure 57:
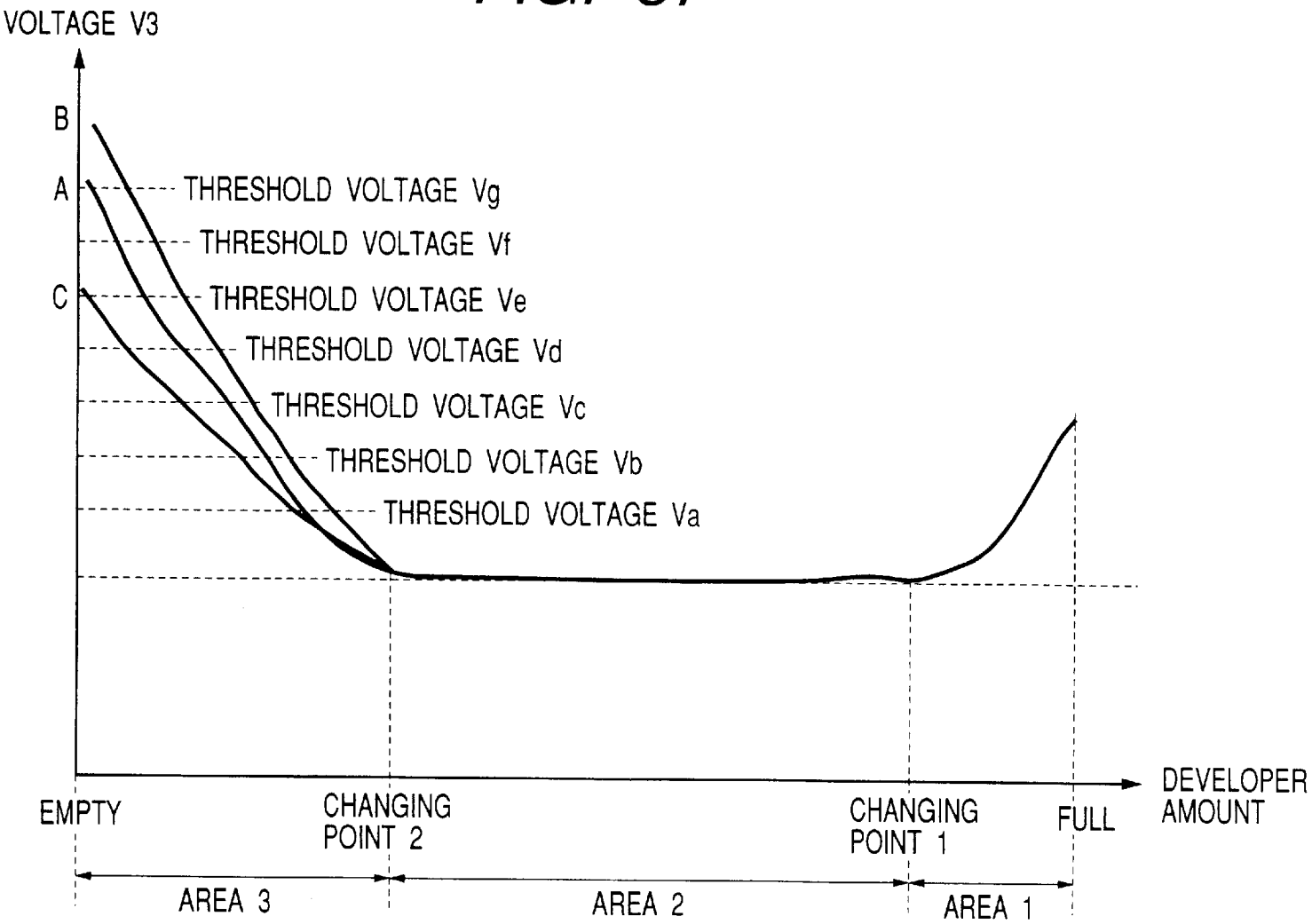
FIG. 57 is a graph showing a relationship between the detected voltage value of a developer amount detecting device according to an eighteenth embodiment of the present invention and a developer remaining amount.

FIG. 57 shows the transition of the voltage V3 outputted from the detecting circuit 33 according to this embodiment. In an area 1, the developer in the developer containing container 4 is carried into the developing room 5A by the developer feeding member, i.e., agitating member 15, with the result that the detected value V3 is decreased until the developing room 5A is filled with the developer. An area 2 is a zone where the voltage V3 is not changed until the developer in the developer containing container 4 becomes empty, and an area 3 is a zone where the detected voltage V3 is increased by reduction of the developer in the developing room 5A. The transition of increase of voltage in the area 3 is shifted between B and C in FIG. 57 due to dispersion in attaching positions of the pair of electrodes 31, 32, the condition of the developer and/or dispersion in detecting circuit system. Threshold voltages Va to Vg show the optimum threshold voltage when the trace of the voltage V3 in the area 3 is shifted as the A line.

In the illustrated embodiment, since the voltage transition of the voltage V3 in the area 3 makes threshold voltages Va to Vg variable in accordance with the trace, developer remaining amount detection with high accuracy can be achieved.

In the illustrated embodiment, in order to detect the transition of the voltage V3, the accumulated (total) number of the print sheet numbers or dot numbers is used. The print sheet number or dot number is stored in the non-volatile member 20 of the process cartridge B, and, whenever the printing is effected, the number is counted up and is written-on.

Figure 58:
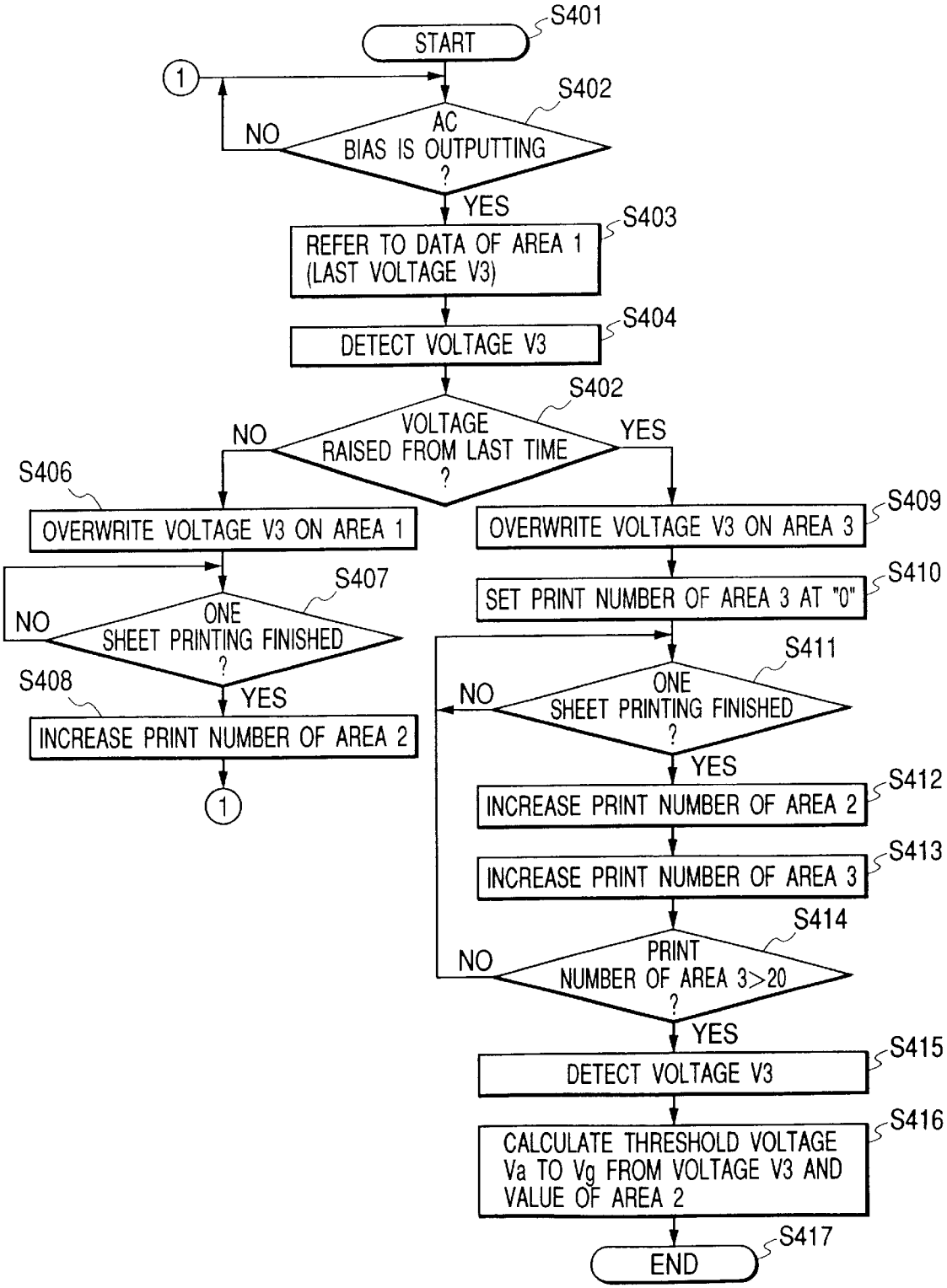
FIG. 58 is a flow chart for explaining a control sequence until threshold voltage is sought.

The control portion 22 of the main body 100 of the image forming apparatus seeks the difference (from the voltage when the change point 2 is detected) of the detected voltage V3 the predetermined number (for example, 20) of sheets are printed, i.e., the inclination of the trace of the voltage increase. The threshold voltages Va to Vg are set on the basis of the total print sheet number until the change point 2 is detected and the inclination sought. In this case, the print sheet number or dot number may be used. A control sequence chart of the control portion 22 until the threshold voltages are sought is shown in FIG. 58.

Now, the control operation including steps S401 to S417 will be explained with reference to FIG. 58.

Step S401: A power supply switch is turned ON to start the image forming operation (START).

Step S402: It is judged whether the developing bias is outputted.

Steps S403, S404, S405: When the developing bias is being outputted, the voltage V3 is detected by the developer remaining amount detecting means 26, and the detected voltage V3 is compared with the data (previous voltage V3) in the area I stored in the memory 20.

Step S406: If the voltage V3 is not increased more than the previous voltage, and the voltage V3 is written-on in the area 1, and then, the sequence goes to a step S407.

Step S407: It is judged whether one sheet print operation is finished; if one sheet print is finished, the sequence goes to a step S408, where increment of print sheet number data in the area 2 in the memory 20 is effected. Then, the sequence is returned to the step S402.

Steps S409, S410: If the measured voltage V3 is increased more than the previous voltage in the step S405, in a step S409, the data in the area 3 stored in the memory 20 is written-on, and, in a step S410, the print sheet number count in the area 3 is cleared to 0 (zero). Then, the sequence goes to a step S411.

Step S411: It is judged whether one sheet print operation is finished; if one sheet print is finished, the sequence goes to steps S412, S413, where increment of the print sheet number data in the area 2 and increment of the print sheet number data in an area 4 in the memory 20 are effected, respectively.

Step S414: It is judged whether the print sheet number in the area 3 exceeds 20 sheets; if not, the sequence is returned to the step S411. If the print sheet number in the area 4 exceeds 20 sheets, the sequence goes to steps S415.

Steps S415, S416: In a step S415, the voltage V3 is detected by the remaining amount detecting means 26, and, in a step S416, the threshold voltages Va to Vg are calculated on the basis of the detected voltage V3 and the value in the area 2.

Step S417: The sequence is ended.

By the above control sequence, the threshold voltages used in the developer remaining amount detection can be sought, and the developer remaining amount can be detected with high accuracy.

Nineteenth embodiment

In a nineteenth embodiment of the present invention, a developing device alone can be detachably mounted to a main body of an image forming apparatus (for example, FIG. 20).

A developing device C according to this embodiment includes a developer bearing member such as a developing roller 5*a* and a developing room 5A containing developer therein to be supplied to the developer bearing member and is constituted as a cartridge by integrally welding plastic developing frames 11, 12 together. Namely, in the developing device C according to the illustration, the developing device constituting parts of the process cartridge explained in connection with the fifteenth to eighteenth embodiments are constructed as a unit, and, thus, it is considered that the parts of the process cartridge B other than the photosensitive drum 1, charging means 2 and cleaning means 7 are integrated as a unit. Of course, by constructing the developing device constituting parts of the process cartridge B explained in connection with the fifteenth to eighteenth embodiments as a unit, a developing device C as a cartridge can be obtained.

Accordingly, all of the developing device constituting parts of the process cartridge B and the construction of the developer amount detecting device explained in connection with the fifteenth to eighteenth embodiments are similarly applied to the developing device C according to this embodiment. Therefore, the explanation of such construction and function may be the same as those in the fifteenth to eighteenth embodiments.

What is claimed is:

1. An image forming apparatus comprising:

a detachable unit detachably mountable to a main assembly of said image forming apparatus, said detachable unit having a developer container for containing developer;

developer amount detecting means for detecting an amount of the developer contained in said developer container; and determining means for determining the amount of the developer in accordance with a maximum value of detected amounts detected by said developer amount detecting means.

2. An image forming apparatus according to claim 1, wherein said determining means determines the amount of the developer in accordance with a difference between the maximum value and the detected amount.

3. An image forming apparatus according to claim 1, further comprising a memory, wherein said memory stores the maximum value.

4. An image forming apparatus according to claim 3, wherein said memory is mounted to said detachable unit.

5. An image forming apparatus according to claim 1, wherein said developer amount detecting means is mounted to said detachable unit.

6. An image forming apparatus according to claim 1, further comprising display means for displaying the amount of the developer determined by said determining means.

7. An image forming apparatus according to claim 1, wherein said image forming apparatus can communicate with electronic equipment having a display and the amount of the developer determined by said determining means is displayed on said display.

8. An image forming apparatus according to claim 1, wherein said determining means determines the amount of the developer in accordance with a detected amount detected by said developer amount detecting means when the developer is not filled in said container.

9. An image forming apparatus according to claim 8, wherein said determining means determines a correct current amount of the developer in accordance with a difference between an amount detected by said developer amount detecting means when the developer is not filled and an amount currently detected by said developer amount detecting means.

10. An image forming apparatus according to claim 8, further comprising a memory, wherein said memory stores the detected amount detected by said developer amount detecting means when the developer is not filled.

11. An image forming apparatus according to claim 10, wherein said memory is mounted to said detachable unit.

12. An image forming apparatus according to claim 10 or 11, wherein said developer amount detecting means is mounted to said detachable unit.

13. An image forming apparatus according to claim 8, further comprising display means for displaying the amount of the developer determined by said determining means.

14. An image forming apparatus according to claim 8, wherein said image forming apparatus can communicate with electronic equipment having it display and the amount of the developer determined by said determining means is displayed on said display.

15. An image forming apparatus according to claim 1, wherein the developer amount detecting means comprises:

signal output means for outputting a signal according to an amount of developer in the developer container; and means for obtaining an amount of the developer contained in the developer container from said signal output means by calculating a value according to the signal a plurality of times.

16. An image forming apparatus comprising:

a developer container for containing developer;

developer amount detecting means for detecting an amount of the developer contained in said developer container;

a memory; and recording means for recording a detected amount detected by said developer amount detecting means in said memory, said recording means renewing the detected amount stored in said memory when the detected amount detected by said detecting means is greater than the detected amount stored in said memory.

17. An image forming apparatus according to claim 16, further comprising determining means for determining the amount of the developer in accordance with the detected amount stored in said memory.

18. An image forming apparatus according to claim 17, wherein said determining means determines the amount of the developer in accordance with a difference between the detected amount stored in said memory and the detected amount detected by said developer amount detecting means.

19. An image forming apparatus according to claim 17, further comprising display means for displaying the amount of the developer determined by said determining means.

20. An image forming apparatus according to claim 17, wherein said image forming apparatus can communicate with electronic equipment having a display and the amount of the developer determined by said determining means is displayed on said display.

21. An image forming apparatus according to claim 16, wherein at least said developer container and said memory are constituted as a unit, and said unit is detachably mountable to a main assembly of said image forming apparatus.

22. An image forming apparatus according to claim 16, wherein the developer amount detecting means comprises:

signal output means for outputting a signal according to an amount of developer in the developer container; and means for obtaining an amount of the developer contained in the developer container from said signal output means by calculating a value according to the signal a plurality of times.

23. A unit detachably mountable on an image forming apparatus, comprising:

a memory; and a developer container for containing a developer;

wherein said memory stores a maximum value of detected amounts of developer contained in said developer container detected by developer amount detecting means for detecting an amount of the developer contained in said developer container.

24. A unit according to claim 23, wherein the maximum value is rewritable information.

25. A unit according to claim 23, wherein said memory further stores a correction table for correcting the detected amount detected by said developer amount detecting means in accordance with the maximum value.

26. A unit according to claim 23, further comprising said developer amount detecting means.

27. A unit according to claim 23, further comprising at least one of an image bearing member, charging means for charging said image bearing member, developing means for supplying the developer to said image bearing member and cleaning means for cleaning said image bearing member.

28. A unit according to claim 23, wherein said memory further stores a detected amount detected by the developer amount detecting means when the developer is not filled in said container.

29. A unit according to claim 28, wherein said memory stores a correction table for correcting the detected amount detected by said developer amount detecting means in accordance with the detected amount detected by said developer amount detecting means when the developer is not filled in said container.

30. A unit according to claim 28, wherein said memory stores a plurality of the detected amounts.

31. A unit according to claim 28, wherein said memory stores discriminating information corresponding to a plurality of the detected amounts.

32. A unit according to claim 28, further comprising said developer amount detecting means.

33. A unit according to claim 28, further comprising at least one of an image bearing member, charging means for charging said image bearing member, developing means for supplying the developer to said image bearing member and cleaning means for cleaning said image bearing member.

34. A unit detachably mountable on an image forming apparatus, comprising:

a memory; and a developer container for containing a developer; wherein said memory stores a plurality of detected amounts detected by developer amount detecting means for detecting an amount of the developer contained in said developer container.

35. A unit according to claim 34, wherein said memory further stores a correction table for correcting the detected amount detected by said developer amount detecting means in accordance with the plurality of detected amounts.

36. A unit according to claim 34, further comprising said developer amount detecting means.

37. A unit according to claim 34, further comprising at least one of an image bearing member, charging means for charging said image bearing member, developing means for supplying the developer to said image bearing member and cleaning means for cleaning said image bearing member.

38. An image forming apparatus comprising:

a developer container detachably mountable on a main assembly of said image forming apparatus, wherein said developer container has a first room and a second room;

developer amount detecting means arranged in said first room for detecting an amount of developer;

a seal member for sealing the developer within said second room; and determining means for determining the amount of the developer in accordance with a detected amount detected by said developer amount detecting means before said seal member is removed.

39. An image forming apparatus according to claim 38, wherein said container further mounts a memory thereon, and said memory stores the detected amount detected by said developer amount detecting means before said seal member is removed.

40. An image forming apparatus according to claim 38, wherein said determining means determines the amount of the developer in accordance with a difference between the detected amount detected by said developer amount detecting means before said seal member is removed and a detected amount detected by said developer amount detecting means after said seal member is removed.

41. An image forming apparatus according to claim 38, further comprising automatic unsealing means for removing said seal member.

42. A unit detachably mountable on an image forming apparatus, comprising:

a memory;

a developer container for containing a developer, said container having a first room and a second room;

developer amount detecting means arranged in said first room for detecting an amount of developer; and a seal member for sealing the developer within said second room;

wherein said memory stores a detected amount detected by said developer amount detecting means before said seal member is removed.

43. A unit according to claim 42, wherein said memory further stores a correction table for correcting the detected amount detected by said developer amount detecting means in accordance with the detected amount.

44. A unit according to claim 42, further comprising at least one of an image bearing member, charging means for charging said image bearing member, developing means for supplying the developer to said image bearing member and cleaning means for cleaning said image bearing member.

45. An image forming apparatus to which a cartridge is capable of being attached, said cartridge including detection signal output means for outputting a detection signal varying in accordance with an amount of toner contained in the cartridge and a memory, comprising:

attaching means for attaching said cartridge;

writing means for writing data in said memory of said attached cartridge; and identifying means for identifying the amount of toner contained in said cartridge based on the detection signal outputted from said detection signal output means;

wherein said writing means writes a first data according to the output of said detection signal output means under a condition where the toner contained in said cartridge is not substantially consumed, and the first data is not renewed in accordance with reduction of the toner, and wherein said identifying means identifies a current remaining amount of toner, based on the detection signal currently outputted from said detection signal output means and the first data stored in said memory.

46. An image forming apparatus according to claim 45, wherein said memory has an area for storing a second data according to an output of said detection signal output means under a condition where toner is not detected, and wherein said identifying means identifies a current remaining amount of toner, based on the detection signal currently outputted from said detection signal output means and the first and second data stored in said memory.

47. An image forming apparatus according to claim 46, wherein the second data is written during the manufacturing stage of said cartridge.

48. An image forming apparatus according to claim 46, wherein said cartridge includes a first room provided with said detection signal output means and a second room in which the toner is sealed by a seal member in unused state, wherein said cartridge is made to be in a usable condition by unsealing the seal member, and wherein said writing means writes data, according to the output of said detection signal output means under a condition where the toner is sealed by said seal member, in said memory as the second data.

49. An image forming apparatus according to claim 48, further comprising means for stripping said seal member after said writing means writes the data, according to the output of said detection signal output means under the condition where the toner is sealed by said seal member, in said memory as the second data.

50. An image forming apparatus according to claim 45, wherein said writing means takes in, operates on, and processes the detection signal outputted from said detection signal output means plural times under a condition where the toner that is contained in said cartridge is not substantially consumed to obtain the first data to be written in said memory.

51. An image forming apparatus according to claim 43, wherein after the first data is written in said memory, data according to the output of said detection signal output means under a condition where the toner that is contained in said cartridge is not substantially consumed is obtained, the obtained data and the first data stored in said memory are compared, and the first data in said memory is renewed with the data newly obtained in accordance with the comparison result.

52. An image forming apparatus according to claim 45, wherein said memory has an area for storing a table showing a relation between the detection signal output from said detection signal output means and a remaining amount of toner, and means for correcting the table based on the first data stored in said memory.

53. An image forming apparatus according to claim 45, wherein said identifying means includes operating means for taking in, operating on, and processing the detection signal outputted from said detection signal output means plural times.

54. An image forming apparatus according to claim 45, further comprising at least one of an image bearing member, charging means for charging said image bearing member, developing means for supplying the toner to said image bearing member and cleaning means for cleaning said image bearing member.

55. An amount of toner detecting method in an image forming apparatus to which a cartridge is capable of being attached, the cartridge including detection signal output means for outputting a detection signal variable in accordance with an amount of toner contained in the cartridge and a memory, comprising steps of:

a writing step of writing first data according to an output of the detection signal output means under a condition where the toner contained in the cartridge is not substantially consumed, and the first data is not renewed in accordance with reduction of the toner;

a taking-in step of taking in a detection signal outputted from the detection signal output means; and an identifying step of identifying the current remaining amount of toner, based on the detection signal taken-in in said taking-in step and the first data stored in the memory.

56. An amount of toner detecting method according to claim 55, wherein the memory has an area for storing second data according to an output of the detection signal output means under a condition where toner is not detected, and in said identifying step; a current remaining amount of toner is identified based on the detection signal currently output from the detection signal output means and the first and second data stored in the memory.

57. An amount of toner detecting method according to claim 56, wherein the second data is written during a manufacturing stage of the cartridge.

58. An amount of toner detecting method according to claim 56, wherein the cartridge includes a first room provided with the detection signal output means and a second room in which the toner is sealed by a seal member in an unused state, wherein the cartridge is made to be in a usable condition by unsealing the seal member, and wherein, in the writing step, data according to the output of the detection signal output means under a condition where the toner is sealed by the seal member is written in the memory as the second data.

59. An amount of toner detecting method according to claim 58, further comprising a step of stripping the seal member after said writing step writes the data, according to the output of the detection signal output means under the condition where the toner is sealed by the seal member, in the memory as the second data.

60. An amount of toner detecting method according to claim 55, wherein in said writing step, the detection signal outputted from the detection signal output means is taken in, operated on, and processed plural times under a condition where the toner that is contained in the cartridge is not substantially consumed to obtain the first data to be written in the memory.

61. An amount of toner detecting method according to claim 55, wherein in said writing step, after the first data is written in the memory, data, according to the output of the detection signal output means under a condition where the toner that is contained in the cartridge is not substantially consumed, is obtained, the obtained data and the first data stored in the memory are compared, and the first data in the memory is renewed with the data newly obtained in accordance with the comparison result.

62. An amount of toner detecting method according to claim 55, wherein the memory has an area for storing a table showing a relation between the detection signal output from the detection signal output means and a remaining amount of toner, and said identifying step includes a step of correcting the table based on the first data stored in the memory.

63. An amount of toner detecting method according to claim 55, wherein said identifying step includes an operating step of taking in, operating on, and processing the detection signal outputted from the detection signal output means plural times.

64. An amount of toner detecting method according to claim 55, wherein the cartridge includes at least one of an image bearing member, charging means for charging the image bearing member, developing means for supplying the toner to the image bearing member and cleaning means for cleaning the image bearing member.

65. A cartridge to which an image forming apparatus is attached, comprising:

detection signal output means for outputting a detection signal varying in accordance with an amount of toner contained in said cartridge; and a memory;

wherein said memory a has first area for storing data according to the output of said detection signal output means under a condition where the toner contained in said cartridge is not substantially consumed is written, and said first data is not renewed by data according to the output of said detection signal output means under a condition where the toner contained in said cartridge is consumed.

66. A cartridge according to claim 65, wherein said memory has a second area for storing second data according to an output of said detection signal output means under a condition where toner is not stored.

67. A cartridge according to claim 66, wherein the second data is written during a manufacturing stage of said cartridge.

68. A cartridge according to claim 66, wherein said cartridge includes a first room provided with said detection signal output means, a second room in which the toner is sealed by a seal member in an unused state, and writing means, wherein said cartridge is made to be in a usable condition by unsealing the seal member, and wherein said writing means writes data, according to the output of said detection signal output means under a condition where the toner is sealed by said seal member, in said memory as the second data.

69. A cartridge according to claim 65, wherein said memory has an area for storing a table showing a relation between the detection signal outputted from said detection signal output means and a capacity of the toner.

70. A cartridge according to claim 65, further comprising at least one of an image bearing member, charging means for charging said image bearing member, developing means for supplying the toner to said image bearing member and cleaning means for cleaning said image bearing member.

71. A memory unit to be mounted on a cartridge detachably attachable to an image forming apparatus and including a developer container and output means having output characteristics such that an output level thereof is substantially constant with respect to an amount of the developer in a first range and an output level thereof is varied according to an amount of the developer in a second range, said memory unit comprising:

a first area into which first data, corresponding to the substantially constant output level in the first range and transmitted from the image forming apparatus, is to be written; and a second area into which second data, calculated in accordance with an output from the output means and the first data stored in said first area by the image forming apparatus, corresponding to an amount of the developer when an amount of the developer is in the second range and transmitted from the image forming apparatus, is to be written.

72. A memory unit according to claim 71, further comprising a third area for storing third data used for the image forming apparatus to determine a shortage of developer in the developer container in accordance with the output from the output means.

73. A memory unit according to claim 71, wherein said first area is an area into which data corresponding to an average value of plural outputs from the output means is to be written as the first data.

74. A memory unit according to claim 73, wherein said first area is an area into which data corresponding to an average value of plural outputs obtained by excluding a maximum output and a minimum output among a predetermined number of outputs from the output means is to be written as the first data.

75. A memory unit according to claim 71, wherein said second area is an area into which data calculated by the image forming apparatus in accordance with an average value of plural outputs from the output means and the first data stored in said first area is to be written as the second data.

76. A memory unit according to claim 75, wherein said second area is an area into which data, calculated by the image forming apparatus in accordance with the first data stored in said first area and an average value of plural outputs obtained by excluding a maximum output and a minimum output among a predetermined number of outputs from the output means, is to be written as the second data.

77. A device to be mounted on a cartridge detachably attachable to an image forming apparatus and including a developer container and output means having output characteristics such that an output level thereof is substantially constant with respect to an amount of the developer in a first range and an output level thereof is varied according to an amount of the developer in a second range, said device comprising:

a memory unit having a first area into which first data corresponding to the substantially constant output level in the first range is to be written; and a transmitting unit for transmitting data between said memory unit and the image forming apparatus and for controlling a read out/write into operation with said memory unit, wherein, when the image forming apparatus transmits the first data, said transmitting unit receives the transmitted first data and controls the writing of the received first data into said first area of said memory unit.

78. A device according to claim 77, wherein said memory unit further comprises a second area into which second data, calculated in accordance with an output from the output means and the first data stored in said first area by the image forming apparatus and corresponding to an amount of the developer when an amount of the developer is in the second range, is to be written, and wherein, when the image forming apparatus transmits the second data, said transmitting unit receives the transmitted second data and controls the writing of the received second data into said second area of said memory unit.

79. A device according to claim 78, wherein said second area is an area into which data calculated by the image forming apparatus in accordance with the first data stored in said first area and an average value of plural outputs from the output means is to be written as the second data.

80. A device according to claim 79, wherein said second area is an area into which data, calculated by the image forming apparatus in accordance with the first data stored in said first area and an average value of plural outputs obtained by excluding a maximum output and a minimum output among a predetermined number of outputs from the output means, is to be written as the second data.

81. A device according to claim 78, wherein said transmitting unit transmits data between said memory unit and the image forming apparatus by using an electromagnetic wave.

82. A device according to claim 77, wherein said memory unit comprises an area for storing third data used for the image forming apparatus to determine a shortage of developer in the developer container in accordance with the output from the output means.

83. A device according to claim 77, wherein said first area is an area into which data corresponding to an average value of plural outputs from the output means is to be written as the first data.

84. A device according to claim 83, wherein said first area is an area into which data corresponding to an average value of plural outputs obtained by excluding a maximum output and a minimum output among a predetermined number of outputs from the output means is to be written as the first data.

85. A control method for a memory unit to be mounted on a cartridge detachably attachable to an image forming apparatus including a developer container and output means having output characteristics such that an output level thereof is substantially constant with respect to an amount of the developer in a first range and an output level thereof is varied according to an amount of the developer in a second range, said method comprising the steps of:

receiving first data transmitted from the image forming apparatus, the first data corresponding to the substantially constant output level in the first range;

controlling the writing of the first data into a first area of the memory unit;

controlling the reading out of the first data stored in the first area;

transmitting the read-out first data to the image forming apparatus;

receiving second data, calculated by the image forming apparatus in accordance with an output from the output means and the first data stored in the first area by the image forming apparatus, corresponding to an amount of the developer when the amount of the developer is in the second range and transmitted from the image forming apparatus; and controlling the writing of the second data into a second area of the memory unit.

86. A control method for a memory unit according to claim 85, wherein the memory unit further comprises a third area for storing third data used for the image forming apparatus to determine a shortage of developer in the developer container in accordance with the output from the output means, and wherein said method further comprises a step of controlling the reading out of the third data stored in the third area and a step of transmitting the read-out third data to the image forming apparatus.

87. A control method for a memory unit according to claim 85, wherein data corresponding to an average value of plural outputs is received as the first data in said first data receiving step.

88. A control method of a memory unit according to claim 87, wherein data, corresponding to an average value of plural outputs obtained by excluding a maximum output and a minimum output among a predetermined number of outputs from the output means, is received as the first data in said first data receiving step.

89. A control method for a memory unit according to claim 87, wherein data, calculated by the image forming apparatus in accordance with the first data stored in the first area and an average value of plural outputs obtained by excluding a maximum output and a minimum output among a predetermined number of outputs from the output means, is received as the second data in said second data receiving step.

90. A control method for a memory unit according to claim 85, wherein data, calculated by the image forming apparatus in accordance with the first data stored in the first area and an average value of plural outputs of the output means, is received as the second data in said second data receiving step.

* * * * *

UNITED STATES PATENT AND TRADEMARK OFFICE

CERTIFICATE OF CORRECTION

PATENT NO. : 6,591,070 B1
DATED : July 8, 2003
INVENTOR(S) : Takeo Shoji et al.

It is certified that error appears in the above-identified patent and that said Letters Patent is hereby corrected as shown below:

Column 4,
Line 1, “detach ably” should read -- detachably --.

Column 12,
Line 19, “tion” should read -- tion in --.

Column 16,
Line 50, “According,” should read -- Accordingly, --.

Column 40,
Line 57, “dislayed” should read -- displayed --.

Column 46,
Line 27, “γ0” should read -- γ --.

Column 51,
Line 4, “described” should read -- be described --.

Column 60,
Line 3, “tenth” should read -- thirteenth --.

Column 64,
Line 30, “Y” should read -- Z --.
Line 57, “judge” should read -- judged --.

Column 66,
Line 63, “cartridges are eliminated B” should read -- cartridges B are eliminated --.

Column 71,
Line 65, “05731 Step 5101:” should read -- Step S101: --.

Column 82,
Line 21, “area I” should read -- area 1 --.
Line 42, “from a” should read -- from α --.

Column 84,
Line 50, steps S415.” should read -- step S415. --.

UNITED STATES PATENT AND TRADEMARK OFFICE

CERTIFICATE OF CORRECTION

PATENT NO. : 6,591,070 B1
DATED : July 8, 2003
INVENTOR(S) : Takeo Shoji et al.

It is certified that error appears in the above-identified patent and that said Letters Patent is hereby corrected as shown below:

Column 86,
Line 15, “it” should read -- a --.

Column 87,
Line 47, “wherein” should read -- ¶ wherein --.

Column 89,
Line 31, “claim 43,” should read -- claim 45, --.

Column 90,
Line 10, “step;” should read -- step, --.

Column 91,
Line 5, “a has” should read -- has a --.

Signed and Sealed this

Second Day of December, 2003

JAMES E. ROGAN
*Director of the United States Patent and Trademark Office*